US011882901B2

(12) United States Patent
Dyer et al.

(10) Patent No.: US 11,882,901 B2
(45) **Date of Patent: *Jan. 30, 2024**

(54) DYNAMIC LACING SYSTEM

(71) Applicant: NIKE, Inc., Beaverton, OR (US)

(72) Inventors: Caleb W. Dyer, Beaverton, OR (US); Peter Lam, Portland, OR (US); Austin J. Orand, Portland, OR (US); Andrea M. Vinet, Portland, OR (US); Peter Williams, Portland, OR (US); Samantha Young, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 407 days.

This patent is subject to a terminal disclaimer.

(21) Appl. No.: 16/871,826

(22) Filed: May 11, 2020

(65) Prior Publication Data

US 2020/0268094 A1 Aug. 27, 2020

Related U.S. Application Data

(63) Continuation of application No. 15/655,769, filed on Jul. 20, 2017, now Pat. No. 11,026,472.

(Continued)

(51) Int. Cl.
*A43B 11/00* (2006.01)
*A43C 11/16* (2006.01)

(Continued)

(52) U.S. Cl.
CPC ..... *A43B 3/26* (2013.01); *A43B 11/00* (2013.01); *A43B 13/125* (2013.01);

(Continued)

(58) Field of Classification Search
CPC ..... A43C 1/00; A43C 11/165; A43C 11/20; A43B 11/00; Y10T 24/3996; Y10T 24/3984

(Continued)

(56) References Cited

U.S. PATENT DOCUMENTS 625,423 A 5/1899 Scriven
1,362,225 A 12/1920 Carlslund (Continued)

FOREIGN PATENT DOCUMENTS

AT 511349 B1 11/2012
CN 1047797 A 12/1990

(Continued)

OTHER PUBLICATIONS

"Operable" The Free Dictionary by Farlex. Web. https://www.thefreedictionary.com/operable.*

(Continued)

*Primary Examiner* — Jillian K Pierorazio
(74) *Attorney, Agent, or Firm* — Bookoff McAndrews, PLLC

(57) ABSTRACT

An article of footwear includes an upper defining an interior void and a first cable movable in a tightening direction to move the upper into a tightened state and movable in a loosening direction to move the upper into a loosened state. The article of footwear also includes a tightening grip operable to be moved away from the upper in a first direction to move the first cable in the tightening direction and a cable lock operable in a locked state to restrict movement of the first cable in the loosening direction and operable in an unlocked state to permit movement of the first cable in the loosening direction. A release grip is operable to be moved (Continued)

away from the upper in a second direction to move the cable lock from the locked state to the unlocked state, whereby the release grip is separate from the tightening grip.

20 Claims, 57 Drawing Sheets

Related U.S. Application Data

(60) Provisional application No. 62/413,125, filed on Oct. 26, 2016, provisional application No. 62/365,781, filed on Jul. 22, 2016, provisional application No. 62/365,764, filed on Jul. 22, 2016.

(51) Int. Cl.
*A43B 3/26* (2006.01)
*A43B 13/12* (2006.01)
*A43B 23/02* (2006.01)
*A43C 7/00* (2006.01)
*A43C 11/20* (2006.01)

(52) U.S. Cl.
CPC ..... *A43B 23/0245* (2013.01); *A43C 7/00* (2013.01); *A43C 11/165* (2013.01); *A43C 11/20* (2013.01); *Y10T 24/3713* (2015.01); *Y10T 24/3969* (2015.01); *Y10T 24/3996* (2015.01)

(58) Field of Classification Search
USPC ..... 30/50.1
See application file for complete search history.

(56) References Cited

U.S. PATENT DOCUMENTS 1,606,862 A 11/1926 Yaro
1,964,406 A 6/1934 Pellkofer
1,985,310 A * 12/1934 Brauer ..... A43D 3/022 12/107 R
2,072,785 A 3/1937 Herman
2,164,123 A * 6/1939 Rio ..... A43C 7/04 24/136 R
2,200,895 A * 5/1940 Rio ..... A43C 7/00 24/527
2,206,136 A 7/1940 Tchetchet
2,342,188 A 2/1944 Ghez et al.
2,370,302 A 2/1945 Ghez et al.
2,435,668 A 2/1948 Behringer
2,470,200 A 5/1949 Wallach
2,922,235 A 1/1960 Meltzer
2,922,236 A 1/1960 Meltzer
2,992,235 A 7/1961 Green et al.
3,123,182 A * 3/1964 Malone et al. ..... A47H 11/02 188/65.1
3,481,332 A 12/1969 Marcia
3,897,161 A * 7/1975 Reinwall, Jr. ..... F16G 11/103 24/134 P
4,026,045 A 5/1977 Druss
4,156,574 A * 5/1979 Boden ..... F16G 11/101 403/374.2
4,309,832 A 1/1982 Hunt
4,331,152 A 5/1982 Bartoli et al.
4,391,048 A 7/1983 Lutz
4,430,810 A 2/1984 Bente
4,562,651 A 1/1986 Frederick et al.
4,635,698 A * 1/1987 Anderson ..... E06B 9/326 24/115 R
4,648,159 A 3/1987 Dougherty
4,654,985 A 4/1987 Chalmers
4,665,590 A 5/1987 Udelhofen et al.
4,704,808 A * 11/1987 Bianchini ..... A43B 5/06 36/43
4,807,333 A * 2/1989 Boden ..... A63C 10/06 24/136 R
4,878,269 A * 11/1989 Anscher ..... F16G 11/101 24/136 R
4,922,631 A 5/1990 Anderie
4,936,028 A 6/1990 Posacki
4,937,953 A * 7/1990 Walkhoff ..... A43C 11/165 36/117.7
4,941,273 A 7/1990 Gross
5,175,949 A 1/1993 Seidel
5,205,055 A 4/1993 Harrell
5,243,776 A 9/1993 Zelinko
5,333,398 A 8/1994 Seo
5,425,185 A * 6/1995 Gansler ..... A43C 11/00 36/50.1
5,454,140 A 10/1995 Murai
5,511,325 A * 4/1996 Hieblinger ..... A43C 11/165 36/105
5,535,531 A 7/1996 Karabed et al.
5,560,126 A 10/1996 Meschan et al.
5,562,689 A * 10/1996 Green ..... A61B 17/062 24/136 L
5,729,912 A 3/1998 Gutkowski et al.
5,755,044 A 5/1998 Veylupek
5,791,021 A * 8/1998 James ..... A43C 11/1406 24/712.2
5,791,068 A * 8/1998 Bernier ..... A43C 11/00 40/636
5,813,146 A 9/1998 Gutkowski et al.
5,839,210 A * 11/1998 Bernier ..... A43B 3/0078 36/138
5,894,639 A * 4/1999 Boden ..... F16G 11/106 24/115 M
5,934,599 A 8/1999 Hammerslag
5,983,530 A 11/1999 Chou
6,029,870 A 2/2000 Giacona, III
6,032,387 A 3/2000 Johnson
6,036,066 A 3/2000 Giacona, III
6,052,921 A 4/2000 Oreck
6,055,746 A 5/2000 Lyden et al.
6,088,936 A 7/2000 Bahl
6,115,945 A 9/2000 Ellis, III
6,185,798 B1 * 2/2001 Ton ..... F16G 11/101 24/712.1
6,202,953 B1 3/2001 Hammerslag
6,247,249 B1 6/2001 Lindqvist
6,263,593 B1 7/2001 Pierce et al.
6,289,558 B1 9/2001 Hammerslag
6,339,867 B1 * 1/2002 Azam ..... F16G 11/106 24/712.1
6,351,897 B1 3/2002 Smith
6,378,230 B1 * 4/2002 Rotem ..... A43B 11/00 36/51
6,427,361 B1 8/2002 Chou
6,443,338 B1 9/2002 Giacona, III
6,457,214 B1 10/2002 Boden
6,467,194 B1 * 10/2002 Johnson ..... A43C 1/06 36/118.1
6,622,358 B1 9/2003 Christy
6,691,433 B2 2/2004 Liu
6,775,928 B2 * 8/2004 Grande ..... A43C 11/20 36/50.1
6,823,610 B1 11/2004 Ashley
6,896,128 B1 * 5/2005 Johnson ..... A43C 11/165 36/118.1
6,990,755 B2 1/2006 Hatfield et al.
7,096,559 B2 8/2006 Johnson
7,103,994 B2 9/2006 Johnson
7,143,529 B2 12/2006 Robinson, Jr. et al.
7,159,340 B2 * 1/2007 Borsoi ..... A43B 5/0405 36/50.1
7,171,767 B2 2/2007 Hatfield et al.
7,231,699 B2 * 6/2007 Borsoi ..... F16G 11/106 24/712.6
7,281,341 B2 10/2007 Reagan et al.
7,290,357 B2 11/2007 McDonald et al.
7,331,126 B2 2/2008 Johnson
7,347,012 B2 3/2008 Clark et al.

(56) References Cited

U.S. PATENT DOCUMENTS 7,392,605 B2 7/2008 Hatfield et al.
7,510,538 B2 3/2009 Wolter et al.
7,513,068 B2 4/2009 Fauver
7,516,914 B2 4/2009 Kovacevich et al.
7,526,881 B2 5/2009 Jones et al.
7,540,100 B2 6/2009 Pawlus et al.
7,591,050 B2 9/2009 Hammerslag
7,607,241 B2 10/2009 McDonald et al.
7,648,404 B1 1/2010 Martin
7,661,205 B2 2/2010 Johnson
7,676,957 B2 3/2010 Johnson
7,721,468 B1 5/2010 Johnson et al.
7,752,774 B2 7/2010 Ussher et al.
7,770,268 B2 8/2010 Breuer
7,818,899 B2 10/2010 Dinndorf et al.
7,841,106 B2 11/2010 Farys
7,856,740 B2 12/2010 De Bast et al.
8,087,188 B2 * 1/2012 Labbe ..... A43C 11/008 24/712
8,387,282 B2 3/2013 Baker et al.
8,418,381 B2 4/2013 Reagan et al.
8,468,657 B2 6/2013 Soderberg et al.
8,474,157 B2 7/2013 Motawi et al.
8,505,220 B2 8/2013 James et al.
8,641,220 B1 * 2/2014 Lin ..... F21L 4/08 36/137
8,747,340 B2 6/2014 Gerber et al.
8,774,443 B1 7/2014 Anderson et al.
8,776,400 B2 7/2014 James et al.
8,776,401 B2 7/2014 James et al.
8,782,926 B2 * 7/2014 Kishino ..... A43C 7/00 36/50.1
8,782,927 B2 * 7/2014 Dinndorf ..... A43C 1/06 36/117.6
8,904,672 B1 12/2014 Johnson
8,904,673 B2 12/2014 Johnson et al.
9,101,181 B2 8/2015 Soderberg et al.
9,125,450 B2 * 9/2015 Zhao ..... A43B 5/0405
9,155,353 B2 10/2015 James et al.
9,179,729 B2 11/2015 Cotterman et al.
9,179,751 B2 11/2015 Lei et al.
9,357,807 B2 6/2016 Berns et al.
9,629,418 B2 * 4/2017 Rushbrook ..... A43B 23/047
9,675,132 B2 6/2017 Marshall et al.
9,681,705 B2 6/2017 Trudel et al.
9,737,115 B2 8/2017 Soderberg et al.
10,130,138 B2 11/2018 Neiley
10,368,608 B2 8/2019 Dyer et al.
10,463,102 B2 11/2019 Dyer et al.
10,543,630 B2 1/2020 Hipwood et al.
10,633,218 B2 4/2020 Wang
2001/0025434 A1 * 10/2001 Fellouhe ..... A43C 7/02 36/50.1
2002/0095750 A1 7/2002 Hammerslag
2003/0034365 A1 * 2/2003 Azam ..... A43C 11/20 223/113
2003/0041478 A1 3/2003 Liu
2003/0226284 A1 * 12/2003 Grande ..... A43C 11/20 36/50.5
2004/0074589 A1 4/2004 Gessler et al.
2004/0250388 A1 * 12/2004 Martin ..... A43C 7/08 24/712.5
2005/0126043 A1 6/2005 Reagan et al.
2005/0198867 A1 9/2005 Labbe
2005/0210706 A1 * 9/2005 Johnson ..... A43C 11/16 36/50.1
2006/0000116 A1 * 1/2006 Brewer ..... A43C 5/00 36/11.5
2006/0117600 A1 6/2006 Greene
2006/0156584 A1 7/2006 Johnson
2006/0168784 A1 * 8/2006 Ahn ..... A43C 11/00 24/712.5
2006/0174460 A1 8/2006 Borsoi
2006/0179685 A1 * 8/2006 Borel ..... A43C 7/00 36/50.1
2006/0191164 A1 * 8/2006 Dinndorf ..... A43C 1/06 36/50.1
2006/0196083 A1 9/2006 Martin et al.
2007/0011912 A1 1/2007 Clark et al.
2007/0011914 A1 1/2007 Keen et al.
2007/0022575 A1 * 2/2007 Takahashi ..... F16G 11/101 24/136 R
2007/0186447 A1 8/2007 Ramos
2007/0193066 A1 8/2007 Baychar
2007/0240334 A1 * 10/2007 Johnson ..... A43C 11/16 36/50.1
2007/0250388 A1 10/2007 Walker et al.
2007/0256281 A1 * 11/2007 Breuer ..... A43C 7/08 24/136 R
2007/0266598 A1 11/2007 Pawlus et al.
2008/0086911 A1 * 4/2008 Labbe ..... A43C 11/008 36/50.1
2008/0168685 A1 * 7/2008 Kim ..... A43C 1/003 36/50.1
2008/0216351 A1 9/2008 Carroll et al.
2008/0235995 A1 10/2008 Reagan et al.
2008/0301919 A1 * 12/2008 Ussher ..... A43B 3/34 24/712.7
2009/0000150 A1 1/2009 Wong
2009/0100717 A1 * 4/2009 Cabanis ..... A43B 5/0411 36/50.1
2009/0188130 A1 7/2009 Calderone
2009/0199435 A1 * 8/2009 Robinson, Jr. ..... A43C 11/165 36/108
2009/0272007 A1 * 11/2009 Beers ..... A43C 11/14 36/50.1
2010/0139057 A1 6/2010 Soderberg et al.
2010/0175278 A1 7/2010 Seliger
2010/0319216 A1 * 12/2010 Grenzke ..... A43C 11/165 36/50.1
2011/0030244 A1 * 2/2011 Motawi ..... A43B 3/0031 36/117.1
2011/0041359 A1 2/2011 Dojan et al.
2011/0047816 A1 3/2011 Nurse
2011/0067211 A1 * 3/2011 Huber ..... A43C 7/08 24/712.1
2012/0005865 A1 * 1/2012 Boden ..... F16G 11/101 24/136 R
2012/0047769 A1 3/2012 Hill et al.
2012/0233888 A1 * 9/2012 Baker ..... A43B 5/025 36/133
2012/0240428 A1 9/2012 Knoll
2012/0291242 A1 * 11/2012 Donnadieu ..... A43C 11/20 24/712.7
2013/0104429 A1 5/2013 Torres
2013/0138028 A1 5/2013 Gerber et al.
2013/0276330 A1 * 10/2013 Dinndorf ..... A43C 1/06 36/91
2013/0318820 A1 * 12/2013 Kishino ..... A43C 1/00 36/50.1
2014/0196313 A1 7/2014 Hatfield et al.
2014/0196316 A1 7/2014 Follet
2014/0223779 A1 * 8/2014 Elder ..... A43B 23/0245 36/83
2014/0259783 A1 * 9/2014 Dinndorf ..... A43B 13/141 36/102
2015/0076272 A1 3/2015 Trudel et al.
2015/0250268 A1 9/2015 Alt et al.
2015/0289595 A1 10/2015 Rushbrook et al.
2015/0289596 A1 10/2015 Beers et al.
2015/0313318 A1 * 11/2015 Gibb ..... A43C 7/00 36/58.5
2015/0342304 A1 * 12/2015 Modena ..... A43B 5/0401 36/115
2016/0009524 A1 1/2016 Grenet et al.
2016/0120263 A1 5/2016 Cortez et al.
2016/0286898 A1 10/2016 Manz et al.
2017/0095033 A1 4/2017 Farina et al.
2017/0112237 A1 4/2017 Ringholz et al.
2017/0127763 A1 * 5/2017 Ben-Arie ..... A43C 1/00

(56) References Cited

U.S. PATENT DOCUMENTS

| | | | | |
|---|---|---|---|---|
| 2017/0265577 | A1 | 9/2017 | Schneider | |
| 2017/0318908 | A1 | 11/2017 | Wyatt et al. | |
| 2018/0020767 | A1 | 1/2018 | Dyer et al. | |
| 2018/0020779 | A1* | 1/2018 | Ben-Arie | A43C 7/08 24/68 SK |
| 2018/0110295 | A1* | 4/2018 | Dyer | A43B 23/0245 |
| 2018/0223567 | A1 | 8/2018 | Hollis | |
| 2019/0343233 | A1 | 11/2019 | Rankin | |
| 2019/0357634 | A1* | 11/2019 | Bartels | A43B 3/12 |
| 2019/0380444 | A1* | 12/2019 | Dyer | A43C 11/16 |
| 2020/0023211 | A1 | 1/2020 | Chang | |
| 2020/0128918 | A1 | 4/2020 | Chen | |
| 2020/0128919 | A1 | 4/2020 | Burt et al. | |
| 2020/0268106 | A1* | 8/2020 | Blanche | A43C 11/00 |

FOREIGN PATENT DOCUMENTS

| | | | |
|---|---|---|---|
| CN | 1103566 | A | 6/1995 |
| CN | 1143310 | A | 2/1997 |
| CN | 2438353 | | 7/2001 |
| CN | 2524541 | Y | 12/2002 |
| CN | 1575683 | A | 2/2005 |
| CN | 2684614 | | 3/2005 |
| CN | 1694630 | | 11/2005 |
| CN | 1817260 | | 8/2006 |
| CN | 1826065 | | 8/2006 |
| CN | 1905816 | A | 1/2007 |
| CN | 101146462 | A | 3/2008 |
| CN | 201142965 | | 11/2008 |
| CN | 101583294 | A | 11/2009 |
| CN | 101631480 | A | 1/2010 |
| CN | 101677653 | A | 3/2010 |
| CN | 101784210 | A | 7/2010 |
| CN | 101953542 | B | 3/2012 |
| CN | 102481031 | A | 5/2012 |
| CN | 102697241 | A | 10/2012 |
| CN | 102783764 | A | 11/2012 |
| CN | 103224169 | | 7/2013 |
| CN | 103561603 | A | 2/2014 |
| CN | 203676303 | U | 7/2014 |
| CN | 104394730 | A | 3/2015 |
| CN | 104470390 | A | 3/2015 |
| CN | 104470394 | | 3/2015 |
| CN | 104919101 | A | 9/2015 |
| CN | 105008119 | A | 10/2015 |
| CN | 105188452 | A | 12/2015 |
| CN | 105722419 | | 6/2016 |
| CN | 107072349 | A | 8/2017 |
| CN | 107404973 | A | 11/2017 |
| CN | 207707397 | | 8/2018 |
| DE | 55619 | C | 3/1891 |
| DE | 297864 | C | 5/1917 |
| DE | 102005036013 | A1 | 2/2007 |
| DE | 202010001717 | U1 | 6/2010 |
| EP | 0089930 | A1 | 9/1983 |
| EP | 0636812 | A1 | 2/1995 |
| EP | 1125728 | A1 | 8/2001 |
| EP | 2524610 | A1 | 11/2012 |
| EP | 3429398 | A2 | 1/2019 |
| EP | 3501317 | | 6/2019 |
| FR | 2792506 | A1 | 10/2000 |
| JP | 2000014410 | A | 1/2000 |
| JP | 2005118430 | A | 5/2005 |
| JP | 2006527001 | A | 11/2006 |
| JP | 3135943 | U | 10/2007 |
| JP | 3222495 | U | 8/2019 |
| KR | 20140132069 | A | 11/2014 |
| KR | 2016-0007592 | | 1/2016 |
| KR | 20230003448 | A | 1/2023 |
| WO | WO-9947013 | A1 | 9/1999 |
| WO | WO-2004082417 | A1 | 9/2004 |
| WO | 2007057926 | A1 | 5/2007 |
| WO | 2009071652 | | 6/2009 |
| WO | 2014036471 | | 3/2014 |
| WO | WO-2014059458 | A1 | 4/2014 |
| WO | WO-2014203416 | A1 | 12/2014 |
| WO | 2015039052 | | 3/2015 |
| WO | WO-2015042216 | A1 | 3/2015 |
| WO | 2016/015161 | | 2/2016 |
| WO | WO-2020051278 | A1 | 3/2020 |
| WO | WO-2020061170 | A1 | 3/2020 |
| WO | WO-2020097006 | A2 | 5/2020 |

OTHER PUBLICATIONS

"Rearward" The Free Dictionary by Farlex. Web. https://www.thefreedictionary.com/rearward.*

"Region" The Free Dictionary by Farlex. Web. https://www.thefreedictionary.com/region.*

European Patent Office (ISA), International Preliminary Report on Patentability for International Application No. PCT/US2017/043189, dated Jan. 31, 2019.

China National Intellectual Property Office, Office Action for CN Application No. 20170607317.5, dated Oct. 23, 2019.

United States Patent and Trademark Office, Office Action for U.S. Appl. No. 15/946,951, dated Sep. 6, 2018.

China National Intellectual Property Office, Office Action for CN Application No. 201810516003.9, dated Apr. 8, 2020.

European Patent Office, Communication pursuant to Article 94(3) EPC for EP Application No. 19156088.7, dated Feb. 18, 2020.

European Patent Office, Communication pursuant to Article 94(3) EPC for EP Application No. 19154641.5, dated Feb. 14, 2020.

European Patent Office, Communication pursuant to Article 94(3) EPC for EP Application No. 19155271.0, dated Mar. 27, 2020.

European Patent Office, Communication pursuant to Article 94(3) EPC for EP Application No. 19156091.1, dated Mar. 10 2020.

European Patent Office, Communication pursuant to Article 94(3) EPC for EP Application No. 19158429.1, dated Feb. 18, 2020.

European Patent Office, Communication pursuant to Article 94(3) EPC for EP Application No. 19157058.9, dated Feb. 18, 2020.

Korean Intellectual Property Office, Office Action for KR Application No. 10-2019-7004710, dated Mar. 10, 2020.

United States Patent and Trademark Office, Office Action for U.S. Appl. No. 15/655,769, dated Apr. 10, 2020.

China National Intellectual Property Administration, First Office Action for CN Application No. 201810516838.4, dated Apr. 20, 2020.

European Patent Office, International Search Report and Written Opinion dated Apr. 1, 2019 for application No. PCT/US2019/014703.

United States Patent Office and Trademark Office, Non-Final office action for U.S. Appl. No. 16/594,269 dated May 9, 2022.

China National Intellectual Property Office, Second Office Action for CN Application No. 201980070588.9, dated Jun. 10, 2022.

Intellectual Patent Office of Vietnam, First Office Action for application No. 1-2019-00421 dated May 23, 2022.

Japan Patent Office, First Office Action for application No. 2021-512662 dated Jun. 7, 2022.

China National Intellectual Property Office, First Office Action for Application No. 202110666231.6 dated Mar. 9, 2022.

China National Intellectual Property Office, Second Office Action for Application No. 202110666231.6 dated Jul. 20, 2022.

The State Intellectual Property Office (P.R.C.), First Office Action for CN App. No. 202110666222.7, dated Aug. 17, 2022.

European Patent Office, Communication pursuant to Article 94(3) EPC for EP Application No. 19156091.1, dated Aug. 13, 2020.

China National Intellectual Property Administration, First Office Action for CN App. No. 201810517008.3, dated Jun. 24, 2020.

China Patent Office, 4th Office Action for Application No. 201810517018.7 dated Nov. 3, 2021.

International Search Report and Written Opinion for Application No. PCT/US2011/026896, dated May 5, 2011.

International Searching Authority, International Search Report and Written Opinion for International Application No. PCT/US2017/043189, dated Oct. 17, 2017.

United States Patent and Trademark Office, Office Action for U.S. Appl. No. 15/951,256, dated Jul. 19, 2018.

(56) References Cited

OTHER PUBLICATIONS

United States Patent and Trademark Office, Office Action for U.S. Appl. No. 15/913,342, dated Nov. 19, 2018.
United States Patent and Trademark Office, Office Action for U.S. Appl. No. 15/951,406, dated Oct. 25, 2018.
International Searching Authority, International Preliminary Report on Patentability for International Application No. PCT/US2017/043189, dated Jan. 31, 2019.
United States Patent and Trademark Office, Office Action for U.S. Appl. No. 15/951,256, dated Jan. 28, 2019.
United States Patent and Trademark Office, Office Action for U.S. Appl. No. 15/951,406, dated Mar. 28, 2019.
United States Patent and Trademark Office, Notice of Allowance for U.S. Appl. No. 15/946,951, dated Mar. 22, 2019.
United States Patent and Trademark Office, Notice of Allowance for U.S. Appl. No. 15/913,342, dated Mar. 21, 2019.
European Patent Office, Extended EP Search Report for EP Application No. 19154641.5, dated May 16, 2019.
European Patent Office, Extended EP Search Report for EP Application No. 19155271.0, dated May 16, 2019.
European Patent Office, Extended EP Search Report for EP Application No. 19157061.3, dated May 16, 2019.
European Patent Office, Extended EP Search Report for EP Application No. 19156091.1, dated May 16, 2019.
European Patent Office, Extended EP Search Report for EP Application No. 19156088.7, dated May 16, 2019.
European Patent Office, Extended EP Search Report for EP Application No. 19158429.1, dated May 16, 2019.
European Patent Office, Extended EP Search Report for EP Application No. 19157058.9, dated May 16, 2019.
European Patent Office as ISA, International Search Report and Written Opinion for PCT Application No. PCT/US2019/049658, dated Nov. 18, 2019.
United States Patent and Trademark Office, Non-Final Office Action for U.S. Appl. No. 15/655,769, dated Oct. 17, 2019.
European Patent Office, Communication pursuant to Article 94(3) EPC for EP Application No. 17746322.1, dated Dec. 18, 2019.
European Patent Office (ISA), International Search Report and Written Opinion for PCT/US2020/053693, dated Dec. 16, 2020.
China National Intellectual Property Administration, First Office Action dated Jul. 20, 2021 for application No. 201980019924.7.
China National Intellectual Property Administration, Third Office Action dated Aug. 27, 2021 for application No. 201810517018.7.
European Patent Office, Communication Pursuant to Article 94(3) EPC dated Jul. 12, 2021 for application No. 19155271.0.
China Patent Office, Third Office Action for Application No. 201810521370.8 dated Jun. 3, 2021.
China National Intellectual Property Administration, Third Office Action dated Sep. 27, 2021 for application No. 201810521041.3.
China National Intellectual Property Administration, Rejection Decision dated Sep. 22, 2021 for application No. 201810517008.3.
China National Intellectual Property Administration, First Office Action dated Jul. 30, 2021 for application No. 201980047915.9.
European Patent Office, Communication pursuant to Article 94(3) EPC for EP Application No. 19154641.5, dated Jun. 25, 2020.
China National Intellectual Property Administration, The First Office Action and Search Report for CN Application No. 201810516986.6, dated Apr. 20, 2020.
China National Intellectual Property Administration, The First Office Action for CN Application No. 201810521041.3, dated May 28, 2020.
China National Intellectual Property Administration, The Second Office Action for CN Application No. 201710607317.5, dated May 21, 2020.
China National Intellectual Property Administration, The First Office Action and Search Report for CN Application No. 20181051370.8 , dated May 18, 2020.
European Search Report for Application No. 22197962.8, dated Dec. 6, 2022, 11 pages.
"Portion" The Free Dictionary by Farlex. Web. https://www.thefreedictionary.com/portion, 8 pages.
"Region" English Collins Dictionary. Web. https://www.collinsdictionary.com/us/dictionary/english/region, 11 pages.

* cited by examiner

DYNAMIC LACING SYSTEM

CROSS REFERENCE TO RELATED APPLICATIONS

This application is a continuation of U.S. Non-Provisional application Ser. No. 15/655,769, filed Jul. 20, 2017, which claims priority to U.S. Provisional Application Ser. No. 62/365,764, filed Jul. 22, 2016, and to U.S. Provisional Application Ser. No. 62/365,781, filed Jul. 22, 2016, and to U.S. Provisional Application Ser. No. 62/413,125, filed Oct. 26, 2016, which are hereby incorporated by reference in their entirety.

FIELD

The present disclosure relates generally to articles of footwear having a dynamic lacing system for moving footwear between a tightened state and a loosened state.

BACKGROUND

This section provides background information related to the present disclosure which is not necessarily prior art.

Articles of footwear conventionally include an upper and a sole structure. The upper may be formed from any suitable material(s) to receive, secure and support a foot on the sole structure. A bottom portion of the upper, proximate to a bottom surface of the foot, attaches to the sole structure. Sole structures generally include a layered arrangement extending between an outsole providing abrasion-resistance and traction with a ground surface and a midsole disposed between the outsole and the upper for providing cushioning for the foot.

The upper may cooperate with laces, straps, or other fasteners to adjust the fit of the upper around the foot. For instance, laces may be tightened to close the upper around the foot and tied once a desired fit of the upper around the foot is attained. Care is required to ensure that the upper is not too loose or too tight around the foot each time the laces are tied. Moreover, the laces may loosen or become untied during wear of the footwear. While fasteners such as hook and loop fasteners are easier and quicker to operate than traditional laces, these fasteners have a propensity to wear out over time and require more attention to attain a desired tension when securing the upper to the foot.

Known automated tightening systems typically include a tightening mechanism, such as rotatable knob, that can be manipulated to apply tension to one or more cables that interact with the upper for closing the upper around that foot. While these automated tightening systems can incrementally increase the magnitude of tension of the one or more cables to achieve the desired fit of the upper around the foot, they require a time-consuming task of manipulating the tightening mechanism to properly tension the cables for securing the upper around the foot, and when it is desired to remove the footwear from the foot, the wearer is required to simultaneously depress a release mechanism and pull the upper away from the foot to release the tension of the cables. Thus, known automated tightening systems lack suitable provisions for both quickly adjusting the tension of the cables to close the upper around the foot and quickly releasing the tension applied to the cables so that the upper can be quickly loosened for removing the footwear from the foot. Moreover, the tightening mechanism employed by these known automated tightening systems is required to be incorporated onto an exterior of the upper so that the tightening mechanism is accessible to the wearer for adjusting the fit of the upper around the foot, thereby detracting from the general appearance and aesthetics of the footwear.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
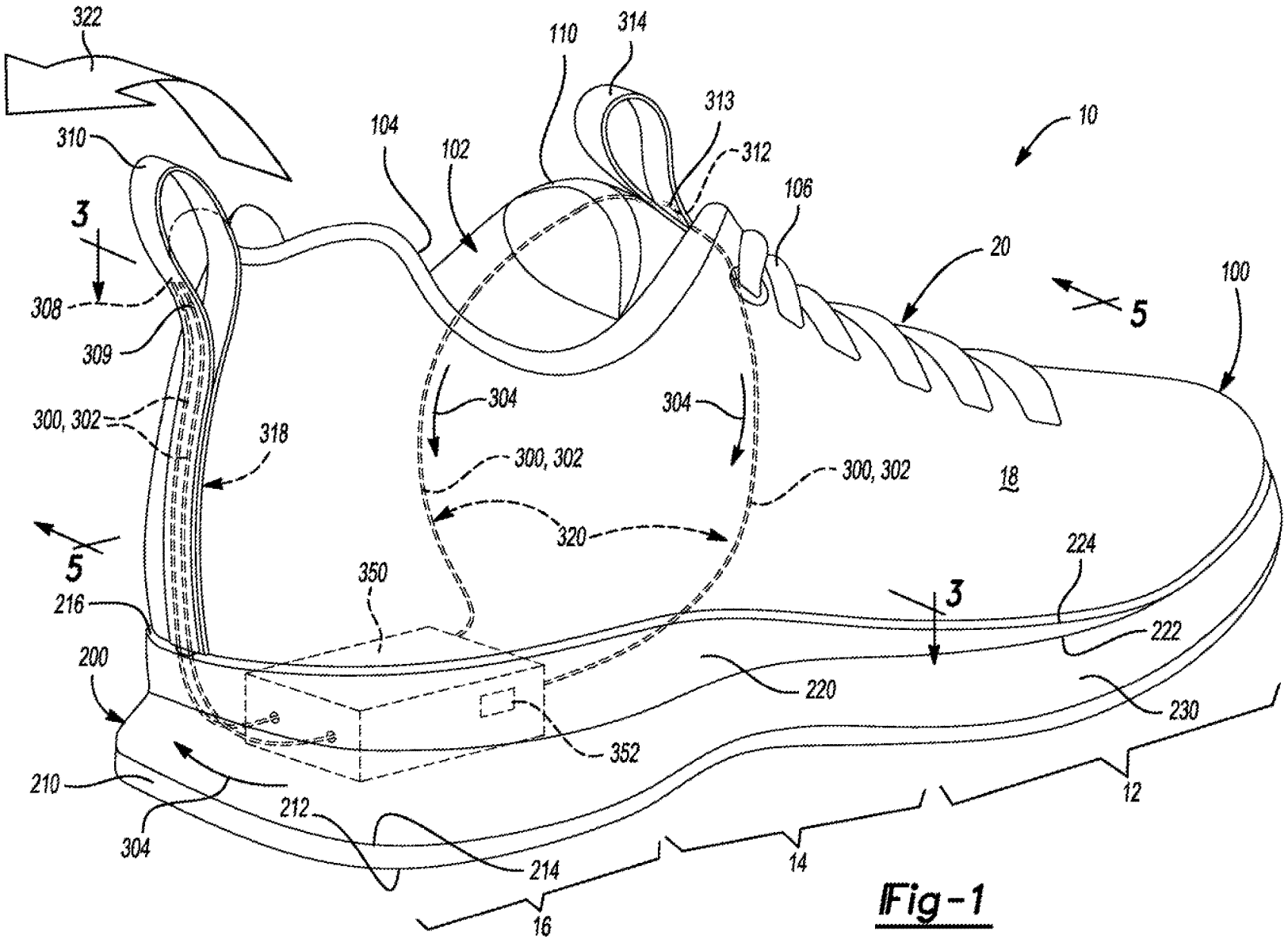
FIG. 1 is a top perspective view of an article of footwear having an upper in a tightened state in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

At least a portion of the upper of the article of footwear, and in some embodiments substantially the entirety of the upper, may be formed of a knitted component. The knitted component may additionally or alternatively form another element of the article of footwear such as the midsole, for example. The knitted component may have a first side forming an inner surface of the upper (e.g., facing the void of the article of footwear) and a second side forming an outer surface of the upper (e.g. facing generally away from the first side). An upper including the knitted component may substantially surround the void so as to substantially encompass the foot of a person when the article of footwear is in use. The first side and the second side of the knitted component may exhibit different characteristics (e.g., the first side may provide abrasion resistance and comfort while the second side may be relatively rigid and provide water resistance, among other advantageous characteristics mentioned below). The knitted component may be formed as an integral one-piece element during a knitting process, such as a weft knitting process (e.g., with a flat knitting machine or circular knitting machine), a warp knitting process, or any other suitable knitting process. That is, the knitting process may substantially form the knit structure of the knitted component without the need for significant post-knitting processes or steps. Alternatively, two or more portions of the knitted component may be formed separately as integral one-piece elements and then the respective elements attached. In some embodiments, the knitted component may be shaped after the knitting process to form and retain the desired shape of the upper (for example, by using a foot-shaped last). The shaping process may include attaching the knitted component to another object (e.g., a strobel) and/or attaching one portion of the knitted component to another portion of the knitted component at a seam by sewing, by using an adhesive, by bonding or by another suitable attachment process.

Forming the upper with the knitted component may provide the upper with advantageous characteristics including, but not limited to, a particular degree of elasticity (for example, as expressed in terms of Young's modulus), breathability, bendability, strength, moisture absorption, weight, and abrasion resistance. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, or an elastic material such as spandex) or construction (e.g., multifilament or monofilament), by selecting yarns of a particular size (e.g., denier), or a combination thereof. The knitted component may also provide desirable aesthetic characteristics by incorporating yarns having different colors, textures or other visual properties arranged in a particular pattern. The yarns themselves and/or the knit structure formed by one or more of the yarns of the knitted component may be varied at different locations such that the knitted component has two or more portions with different properties (e.g., a portion forming the throat area of the upper may be relatively elastic while another portion may be relatively inelastic). In some embodiments, the knitted component may incorporate one or more materials with properties that change in response to a stimulus (e.g., temperature, moisture, electrical current, magnetic field, or light). For example, the knitted component may include yarns formed of a thermoplastic polymer material (e.g., polyurethanes, polyamides, polyolefins, and nylons) that transitions from a solid state to a softened or liquid state when subjected to certain temperatures at or above its melting point and then transitions back to the solid state when cooled. The thermoplastic polymer material may provide the ability to heat and then cool a portion of the knitted component to thereby form an area of bonded or continuous material that exhibits certain advantageous properties including a relatively high degree of rigidity, strength, and water resistance, for example.

In some embodiments, the knitted component may include one or more yarns or strands that are at least partially inlaid or otherwise inserted within the knit structure of the knitted component during or after the knitting process, herein referred to as "tensile strands." The tensile strands may be substantially inelastic so as to have a substantially fixed length. The tensile strands may extend through a plurality of courses of the knitted component or through a passage formed within the knitted component and may limit the stretch of the knitted component in at least one direction. For example, the tensile strands may extend from an area underfoot, and/or approximately from a biteline of the upper to a throat area of the upper to limit the stretch of the upper in the lateral direction. The tensile strands may form one or more lace apertures for receiving a lace and/or may extend around at least a portion of a lace aperture formed in the knit structure of the knitted component.

One aspect of the disclosure provides an article of footwear including an upper defining an interior void and a first cable movable in a tightening direction to move the upper into a tightened state and movable in a loosening direction to move the upper into a loosened state. The article of footwear also includes a tightening grip operable to be moved away from the upper in a first direction to move the first cable in the tightening direction and a cable lock operable in a locked state to restrict movement of the first cable in the loosening direction and operable in an unlocked state to permit movement of the first cable in the loosening direction. The article of footwear further includes a release grip operable to be moved away from the upper in a second direction to move the cable lock from the locked state to the unlocked state, the release grip being separate from the tightening grip.

Implementations of the disclosure may include one or more of the following optional features. In some implementations, the cable lock is disposed remotely from the tightening grip and from the release grip. The article of footwear may further include a sole structure attached to the upper. In some examples, the tightening grip extends from the upper and the cable lock is disposed within the sole structure and the loosening grip extends from the upper. Optionally, the loosening grip may extend from the upper and the cable lock may be disposed within the sole structure.

In some configurations, the sole structure includes a midsole and an outsole. The midsole may include a cavity, the cable lock being disposed within the cavity. The cavity may oppose the outsole or the upper. The article of footwear may further include a strobel attached to the upper, the cavity opposing the strobel. In some examples, the cable lock is attached to the Strobel.

In some implementations, the tightening grip and the release grip are disposed on opposite sides of an ankle opening of the upper. The release grip may extend from a heel region of the upper. The article of footwear may further include a second cable having a first portion forming the tightening grip and a second portion received by the cable lock. In some examples, when the tightening grip is moved away from the upper an effective length of the second cable is increased. In other examples, when the tightening grip is moved away from the upper an effective length of the first cable is reduced. Additionally or alternatively, when the tightening grip is moved away from the upper a portion of the first cable is retracted within the cable lock. In some configurations of the article of footwear, the first direction is different than the second direction.

Another aspect of the disclosure provides an article of footwear including an upper defining an interior void and a first cable portion movable in a first tightening direction to move the upper into a tightened state and movable in a first loosening direction to move the upper into a loosened state. The article of footwear also includes a second cable portion movable in a second tightening direction to move first cable portion in the first tightening direction and movable in a second loosening direction when the first cable portion is moved in the first loosening direction. The article of footwear further includes a cable lock operable in a locked state to restrict movement of the first cable portion in the first loosening direction and the second cable portion in the second loosening direction and operable in an unlocked state to permit movement of the first cable portion in the first loosening direction and the second cable portion in the second loosening direction.

Implementations of the disclosure may include one or more of the following optional features. In some examples, the second cable portion forms a tightening grip formed as a loop and operable to be moved in a first direction away from the upper to move the second cable portion in the second tightening direction. The article of footwear may further include a release grip operable to be moved away from the upper in a second direction to move the cable lock from the locked state to the unlocked state. In this example, the release grip may be separate from the tightening grip and the first direction may be different than the second direction. Additionally or alternatively, wherein the cable lock may be disposed remotely from the tightening grip and from the release grip.

In some configurations, the article of footwear includes a sole structure attached to the upper. Here, the cable lock may be disposed within the sole structure. Optionally, the sole structure may include a midsole and an outsole. In some examples, the midsole includes a cavity, the cable lock being disposed within the cavity. The cavity may oppose the outsole or the upper. The article of footwear may further include a strobel attached to the upper, the cavity opposing the strobel. In some examples, the cable lock is attached to the strobel.

In some implementations, an effective length of the second cable portion is increased when the second cable portion is moved in the second tightening direction. Additionally or alternatively, an effective length of the first cable portion may be reduced when the first cable portion is moved in the first tightening direction. In other examples, a portion of the first cable portion is retracted within the cable lock when the first cable portion is moved in the first tightening direction. Similarly, a portion of the second cable portion may be retracted within the cable lock when the second cable portion is moved in the second loosening direction. In some examples, the first cable portion and the second cable portion are part of the same, unitary cable.

Another aspect of the disclosure provides a cable lock mechanism include a housing defining a cavity. The cable lock mechanism also includes a spool disposed within the cavity and a first annular groove operable to receive a first cable and a second annular groove operable to receive a second cable. The spool is rotatable in a first direction relative to the housing to payout a first portion of the first cable from the housing and spool a first portion of the second cable within the second annular groove. The spool is also rotatable in a second direction relative to the housing to payout a second portion of the second cable from the housing and spool a second portion of the first cable within the first annular groove. The cable lock mechanism further includes a first lock pawl operable between a locked state restricting rotation of the spool relative to the housing in the second direction and an unlocked state permitting rotation of the spool relative to the housing in the second direction.

Implementations of the disclosure may include one or more of the following optional features. In some examples, the first portion of the first cable and the second portion of the first cable are part of the same unitary cable. The first portion of the second cable and the second portion of the second cable may be part of the same unitary cable. In other examples, a length of the first portion of the first cable is equal to a length of the first portion of the second cable. Additionally or alternatively, a length of the second portion of the first cable is equal to a length of the second portion of the second cable.

In some configurations, the first lock pawl permits rotation of the spool relative to the housing in the first direction when in the locked state. Optionally, the first lock pawl may permit rotation of the spool relative to the housing in the first direction when in the unlocked state. In some examples, the first lock pawl includes a series of first teeth that engage the spool in the locked state. When the first lock pawl includes a series of first teeth that engage the spool in the locked state, the spool may include a series of second teeth that matingly receive the series of first teeth when the first lock pawl is in the locked state. In this example, the series of second teeth may be formed on an inner surface of the spool.

In some implementations, the first lock pawl is rotatably supported by the housing within the cavity. The first lock pawl may be biased into the locked state. Additionally or alternatively, the first lock pawl is biased into the locked state by a biasing member. In this example, the biasing member may be a spring.

The cable lock mechanism may further include a second lock pawl rotatably supported within the housing between a first position spaced apart from the spool and a second position in contact with a control surface of the spool. Here, the second lock pawl may be rotatably supported by the housing. Optionally, the second lock pawl is rotatably supported by the first lock pawl. Additionally or alternatively, the second lock pawl is biased into the second position. In other examples, the second lock pawl is biased into the second position by a biasing member. In this example, the biasing member may be a spring. When the cable lock mechanism includes a second lock pawl rotatably supported within the housing between a first position spaced apart from the spool and a second position in contact with a control surface of the spool, the control surface may be formed on an inner surface of the spool. The housing may include at least one flange extending therefrom. In this example, the at least one flange includes at least one aperture formed therethrough.

In some implementations, the cable lock mechanism is incorporated into an article of footwear. The cable lock mechanism may be disposed within a midsole of the article of footwear. The cable lock mechanism may also be attached to an upper of the article of footwear.

Another aspect of the disclosure provides a cable lock mechanism include a housing defining a cavity. The cable lock mechanism also includes a spool disposed within the cavity. The spool receives a first cable and a second cable. The cable lock mechanism further includes a first lock pawl operable between an unlocked state and a locked state. In the unlocked state the first lock pawl is spaced apart from the spool to permit rotation of the spool relative to the housing in a first direction and in a second direction opposite the first direction. In the locked state the first lock pawl engages an inner surface of the spool to restrict rotation of the spool relative to the housing in the second direction.

Implementations of the disclosure may include one or more of the following optional features. In some configurations, the spool includes a first annular groove receiving the first cable and a second annular groove receiving the second cable. In this configuration, the spool may be operable to payout a first portion of the first cable from the housing and spool a first portion of the second cable within the second annular groove when rotated in the first direction.

In some examples, the spool is operable to payout a second portion of the second cable from the housing and spool a second portion of the first cable within the first annular groove when rotated in the second direction. Here, the first portion of the first cable and the second portion of the first cable may be the same. The first portion of the second cable and the second portion of the second cable may also be part of the same unitary cable. Additionally or alternatively, a length of the first portion of the first cable is equal to a length of the first portion of the second cable. Further, a length of the second portion of the first cable is equal to a length of the second portion of the second cable.

In some implementations, the first lock pawl permits rotation of the spool relative to the housing in the first direction when in the locked state. The first lock pawl may ratchet along teeth of the inner surface when the first lock pawl is in the locked state and the spool is rotated in in the first direction. The first lock pawl may include a series of first teeth that engage the spool in the locked state. Here, the spool may include a series of second teeth that matingly receive the series of first teeth when the first lock pawl is in the locked state, the series of second teeth being formed on the inner surface of the spool. In some examples, the first lock pawl is rotatably supported by the housing within the cavity. The first lock pawl may be biased into the locked state. The first lock pawl may be biased into the locked state by a biasing member. Here, the biasing member may be a spring.

The cable lock mechanism may further include a second lock pawl rotatably supported within the housing between a first position spaced apart from the spool and a second position in contact with a control surface of the spool. In this example, the second lock pawl may be rotatably supported by the housing. Optionally, the second lock pawl may be rotatably supported by the first lock pawl. The second lock pawl may be biased into the second position. The second lock pawl may be biased into the second position by a biasing member. The biasing member may be a spring. The control surface may be formed on the inner surface of the spool.

In some configurations, the housing includes at least one flange extending therefrom. In this example, the at least one flange includes at least one aperture formed therethrough. The cable lock mechanism may be incorporated into an article of footwear. Here, the cable lock mechanism is disposed within a midsole of the article of footwear. The cable lock mechanism may also be attached to an upper of the article of footwear.

Another aspect of the disclosure provides a cable lock for a cable. The cable lock include a housing including a first engagement surface and a second engagement surface. The first engagement surface and the second engagement surface converge toward one another. The cable lock further includes a lock member slidably disposed within the housing and movable between a locked state and an unlocked state and including a first lock surface and a second lock surface that converge toward one another. The first lock surface operable to pinch a first portion of the cable between the first engagement surface and the first lock surface in the locked state. The second lock surface operable to pinch a second portion of the cable between the second engagement surface and the second lock surface in the locked state to restrict movement of the cable in a first direction relative to the housing. The cable lock also includes a biasing member operable to apply a biasing force and to bias the lock member in the locked state.

Implementations of the disclosure may include one or more of the following optional features. In some examples, the biasing member is a spring. Here, the spring may be a coil spring.

The cable lock may further include a release cord attached to the lock member. The release cord may be operable to move the lock member from the locked state to the unlocked state when a force of a predetermined magnitude is applied to the release cord. In this example, the release cord may be attached to the lock member at an opposite end of the lock member than the biasing member.

In some implementations, the lock member may include a retainer operable to selectively engage the housing and to maintain the lock member in the unlocked state. In this implementation, the retainer may be disposed at an opposite end of the lock member than the biasing member. The retainer may be formed on a tab portion of the lock member. The tab portion may be movable relative to the lock member between a rest state and a flexed state. The tab portion may be biased into the rest state. The tab portion may be operable to move from the rest state to the flexed state to disengage the retainer from the housing. Here, the cable lock may further include a release cord attached to the tab portion, the release cord operable to move the tab portion from the rest state to the flexed state. The release cord may be operable to move the lock member from the locked state to the unlocked state when a force of a predetermined magnitude is applied to the release cord.

In some examples, the lock member includes a first recess and a second recess operable to selectively receive a first retainer and a second retainer of the housing to maintain the lock member in the unlocked state. Here, the first retainer and the second retainer may be movable between an extended state and a retracted state. The first retainer and the second retainer may also be biased in to the extended state by a first biasing member and a second biasing member. The first biasing member and the second biasing member may be springs. The first biasing member and the second biasing member may be coil springs.

In some configurations, the first retainer and the second retainer are integrally formed with the housing. Optionally, the first retainer and the second retainer may act as living hinges movable between the extended state and the retracted state. Additionally or alternatively, the first retainer and the second retainer may be in the retracted state when received within the first recess and the second recess, respectively.

In some implementations, at least one of the first lock surface and the second lock surface include projections operable to grip the cable when the lock member is in the locked state. The cable may also be movable in a second direction opposite the first direction when the lock member is in the locked state or the unlocked state.

The cable lock may be incorporated in an article of footwear. The article of footwear may include a sole structure and an upper. The cable lock may be disposed at least partially within a cavity formed in the sole structure. Optionally, the cable lock may be attached to the upper.

Another aspect of the disclosure provides an article of footwear. The article of footwear includes an upper, a tensioning grip extending from the upper and configured as a loop, and a tensioning cable coupled with the tensioning grip and operable to move the upper into one of a tightened state and a loosened state. The tensioning cable is movable in a tightening direction to move the upper into the tightened state and movable in a loosening direction to move the upper into the loosened state. The article of footwear further includes a first conduit including an inner diameter that is greater than an outer diameter of the tensioning cable and receiving a portion of the tensioning cable therein. The first conduit is operable to accommodate bunching by the tensioning cable when the tensioning cable is moved in one of the tightening direction and the loosening direction.

Implementations of the disclosure may include one or more of the following optional features. In some configurations, the article of footwear further includes a second conduit including an inner diameter that is greater than an outer diameter of the tensioning cable and receiving a portion of the tensioning cable therein. The second conduit operable to accommodate bunching by the tensioning cable when the tensioning cable is moved in the other of the tightening direction and the loosening direction.

In some examples, the article of footwear further includes a cable lock operable between a locked state and an unlocked state. The locked state may restrict movement of the tensioning cable in the loosening direction in both the loosening direction and the tightening direction. The unlocked state may permit movement of the tensioning cable in both the loosening direction and the tightening direction. In some examples, the cable lock permits movement of the tensioning cable in the tightening direction when the cable lock is the locked state. In other examples, the cable lock may restrict movement of the tensioning cable in the tightening direction when the cable lock is in the locked state. In some configurations, the cable lock is biased into the locked state. Optionally, the cable lock may also include a release operable to transition the cable lock from the locked state to the unlocked state.

The article of footwear may further include an outsole attached to the upper and including a ground-engaging surface. The article of footwear may also include an inner surface disposed on an opposite side of the outsole than the ground-engaging surface. The inner surface defining a receiving area that receives the cable lock therein.

In some examples, the article of footwear includes the outsole attached to the upper and including a ground-engaging surface. The inner surface may be disposed on an opposite side of the outsole than the ground-engaging surface. In this example, the article of footwear may include a midsole having a footbed and a bottom surface disposed on an opposite side of the midsole than the footbed and opposing the inner surface of the outsole to define a cavity therebetween. The cable lock may be disposed within the cavity between the inner surface of the outsole and the bottom surface of the midsole.

In some implementations, the tensioning cable includes a continuous loop defining a first length between the cable lock and a tightening grip and a second length between the cable lock and a loosening grip. The movement of the tensioning cable in the tightening direction may cause the first length to increase and the second length to decrease. Movement of the tensioning cable in the loosening direction may cause the first length to decrease and the second length to increase.

In some examples, the cable lock includes a housing and a lock member slidably disposed within the housing. The lock member may be movable between a locked position restricting movement of the tensioning cable relative to the housing and an unlocked position permitting movement of the tensioning cable relative to the housing. Here, the lock member may include a first lock surface opposing a first engagement surface of the housing and a second lock surface opposing a second engagement surface of the housing. The lock member may be operable to pinch the tensioning cable between the first lock surface and the first engagement surface in the locked position. The lock member may also be operable to pinch the tensioning cable between the second lock surface and the second engagement surface in the locked position. The first lock surface and the second lock surface may be convergent. In some examples, the first lock surface is substantially parallel to the first engagement surface and the second lock surface is substantially parallel to the second engagement surface. Optionally, the cable lock may include a release operable to move the lock member from the locked position to the unlocked position. Here, the release may be attached to the lock member to permit a force applied to the release to move the lock member in a direction away from the first engagement surface and the second engagement surface relative to the housing. The housing may include a retainer operable to engage the lock member when the lock member is moved a predetermined distance away from the first engagement surface and the second engagement surface. The retainer may be operable to maintain the lock member in the unlocked position. In some examples, the cable lock is biased into the locked position by a biasing member.

In some configurations, the cable lock may include a housing and a spool supported by the housing and rotatable relative to the housing in a first direction when the tensioning cable moves in the tightening direction and in an opposite second direction when the tensioning cable moves in the loosening direction. The spool may include a first annular groove configured to collect a first portion of the tensioning cable and a second annular groove configured to collect a second portion of the tensioning cable. In this configuration, the cable lock may include a plurality of teeth supported for common rotation with the spool and positioned circumferentially around an axis of the spool. A first pawl supported by the housing and including a first biasing member may be operable to bias the first pawl into engagement with the plurality of teeth to selectively restrict the spool from rotating in the second direction. The plurality of teeth may be sloped to permit the spool to rotate in the first direction when the first pawl is engaged with the plurality of teeth. Additionally or alternatively, the cable lock may further include a release configured to selectively disengage the first pawl from the plurality of teeth to allow the spool to rotate in the second direction when a predetermined force is applied to the release that overcomes a biasing force of the first biasing member. The cable lock may also include a second pawl having a second biasing member configured to bias the second pawl into engagement with a control surface associated with the spool when the first pawl is disengaged from the plurality of teeth to permit the spool to rotate in the second direction. The second pawl may be rotatably supported by the first pawl. In some examples, the first portion of the tightening cable and the second portion of the tightening cable approach the spool from opposite directions.

In some implementations, the cable lock is supported by an outsole attached to the upper. In other implementations, the cable lock may be disposed between an outsole and a midsole of the footwear.

Another aspect of the disclosure provides an article of footwear including an upper and a tensioning cable movable in a tightening direction to move the upper into a tightened state and movable in a loosening direction to move the upper into a loosened state. The article of footwear further includes a first conduit operable to receive a length of the tensioning cable therein when the tensioning cable is moved in one of the tightening direction and the loosening direction to accommodate bunching by the tensioning cable. The length of the tensioning cable may be received within the first conduit when the tensioning cable is moved in the one of the tightening direction and the loosening direction being greater than a length of the first conduit.

Implementations of the disclosure may include one or more of the following optional features. In some examples, the article of footwear includes a second conduit operable to receive a length of the tensioning cable therein when the tensioning cable is moved in the other of the tightening direction and the loosening direction to accommodate bunching by the tensioning cable. The length of the tensioning cable may be received within the second conduit when the tensioning cable is moved in the other of the tightening direction and the loosening direction is greater than a length of the second conduit.

In some configurations, the article of footwear includes a cable lock operable between a locked state restricting movement of the tensioning cable in the loosening direction and an unlocked state permitting movement of the tensioning cable in both the loosening direction and the tightening direction. The cable lock may permit movement of the tensioning cable in the tightening direction when the cable lock is the locked state. The cable lock may also restrict movement of the tensioning cable in the tightening direction when the cable lock is in the locked state. In these configurations, the cable lock may be biased into the locked state. The cable lock may also include a release operable to transition the cable lock from the locked state to the unlocked state.

In some implementations, the article of footwear further includes an outsole attached to the upper and including a ground-engaging surface and an inner surface disposed on an opposite side of the outsole than the ground-engaging surface, the inner surface defining a receiving area that receives the cable lock therein. In other implementations, the article of footwear may include an outsole attached to the upper and including a ground-engaging surface and an inner surface disposed on an opposite side of the outsole than the ground-engaging surface and a midsole having a footbed and a bottom surface disposed on an opposite side of the midsole than the footbed and opposing the inner surface of the outsole to define a cavity therebetween, the cable lock being disposed within the cavity between the inner surface of the outsole and the bottom surface of the midsole. The tensioning cable may include a continuous loop defining a first length between the cable lock and a tightening grip and a second length between the cable lock and a loosening grip. Movement of the tensioning cable in the tightening direction may cause the first length to increase and the second length to decrease. Movement of the tensioning cable in the loosening direction may cause the first length to decrease and the second length to increase.

In some examples, the cable lock includes a housing and a lock member slidably disposed within the housing. Here, the lock member may be movable between a locked position restricting movement of the tensioning cable relative to the housing and an unlocked position permitting movement of the tensioning cable relative to the housing. The lock member may include a first lock surface opposing a first engagement surface of the housing and a second lock surface opposing a second engagement surface of the housing. Here, the lock member may be operable to pinch the tensioning cable between the first lock surface and the first engagement surface in the locked position and may be operable to pinch the tensioning cable between the second lock surface and the second engagement surface in the locked position. The first lock surface and the second lock surface may be convergent. The first lock surface may be substantially parallel to the first engagement surface and the second lock surface may be substantially parallel to the second engagement surface.

In some examples, the cable lock includes a release operable to move the lock member from the locked position to the unlocked position. In this example, the release may be attached to the lock member to permit a force applied to the release to move the lock member in a direction away from the first engagement surface and the second engagement surface relative to the housing. The housing may include a retainer operable to engage the lock member when the lock member is moved a predetermined distance away from the first engagement surface and the second engagement surface. The retainer may also be operable to maintain the lock member in the unlocked position. The cable lock may be biased into the locked position by a biasing member.

In some implementations, the cable lock includes a housing and a spool supported by the housing and rotatable relative to the housing in a first direction when the tensioning cable moves in the tightening direction and in an opposite second direction when the tensioning cable moves in the loosening direction. The spool may include a first annular groove configured to collect a first portion of the tensioning cable and a second annular groove configured to collect a second portion of the tensioning cable. The cable lock may include a plurality of teeth positioned circumferentially around an axis of the spool and a first pawl supported by the housing and including a first biasing member configured to bias the first pawl into engagement with the plurality of teeth to selectively restrict the spool from rotating in the second direction. The plurality of teeth may be sloped to permit the spool to rotate in the first direction when the first pawl is engaged with the plurality of teeth.

In some examples, the cable lock further includes a release configured to selectively disengage the first pawl from the plurality of teeth to allow the spool to rotate in the second direction when a predetermined force is applied to the release that overcomes a biasing force of the first biasing member. The cable lock may also include a second pawl having a second biasing member configured to bias the second pawl into engagement with a control surface associated with the spool when the first pawl is disengaged from the plurality of teeth to permit the spool to rotate in the second direction. Here, the second pawl may be rotatably supported by the first pawl.

In some implementations, the first portion of the tightening cable and the second portion of the tightening cable approach the spool from opposite directions. The cable lock may also be supported by an outsole attached to the upper. In other examples, the cable lock may also be disposed between an outsole and a midsole of the footwear.

Another aspect of the disclosure provides an article of footwear including an upper having a heel portion, an instep portion, and a forefoot portion, a tightening grip disposed at one of the instep portion and the heel portion of the upper, and a loosening grip disposed at the other of the instep portion and the heel portion of the upper. The article of footwear also includes a tensioning cable operably connected to the tightening grip and the loosening grip. The tensioning cable is movable in a tightening direction when the tightening grip is pulled away from the upper to move the upper into a tightened state. The tensioning cable is also movable in a loosening direction when the loosening grip is pulled away from the upper to move the upper into a loosened state.

Implementations of the disclosure may include one or more of the following optional features. In some implementations, the article of footwear includes a cable lock operable between a locked state restricting movement of the tensioning cable in the loosening direction and an unlocked state permitting movement of the tensioning cable in both the loosening direction and the tightening direction. In this implementation, the cable lock may permit movement of the tensioning cable in the tightening direction when the cable lock is the locked state. The cable lock may also restrict movement of the tensioning cable in the tightening direction when the cable lock is in the locked state. The cable lock may be biased into the locked state. The cable lock may further includes a release operable to transition the cable lock from the locked state to the unlocked state.

In some examples, the article of footwear further includes an outsole attached to the upper and including a ground-engaging surface and an inner surface disposed on an opposite side of the outsole than the ground-engaging surface, the inner surface defining a receiving area that receives the cable lock therein. In other examples, the article of footwear may include an outsole attached to the upper and including a ground-engaging surface and an inner surface disposed on an opposite side of the outsole than the ground-engaging surface and a midsole having a footbed and a bottom surface disposed on an opposite side of the midsole than the footbed and opposing the inner surface of the outsole to define a cavity therebetween, the cable lock being disposed within the cavity between the inner surface of the outsole and the bottom surface of the midsole.

In some configurations, the tensioning cable includes a continuous loop defining a first length between the cable lock and the tightening grip and a second length between the cable lock and the loosening grip. Movement of the tensioning cable in the tightening direction may cause the first length to increase and the second length to decrease, and movement of the tensioning cable in the loosening direction may cause the first length to decrease and the second length to increase.

The article of footwear may further include a first conduit configured to surround a portion of the tensioning cable along the first length when the tensioning cable moves relative to the conduit. The first conduit defining an inner diameter that may be greater than an outer diameter of the tensioning cable to accommodate bunching by the tensioning cable when the first length increases during movement of the tensioning cable in the tightening direction. The article of footwear may also include a second conduit configured to surround a portion of the tensioning cable along the second length when the tensioning cable moves relative to the conduit. The second conduit defining an inner diameter that may be greater than an outer diameter of the tensioning cable to accommodate bunching by the tensioning cable when the second length increases during movement of the tensioning cable in the loosening direction.

In some examples, the cable lock includes a housing and a lock member slidably disposed within the housing. The lock member may be movable between a locked position restricting movement of the tensioning cable relative to the housing and an unlocked position permitting movement of the tensioning cable relative to the housing. The lock member may include a first lock surface opposing a first engagement surface of the housing and a second lock surface opposing a second engagement surface of the housing. The lock member may be operable to pinch the tensioning cable between the first lock surface and the first engagement surface in the locked position and may be operable to pinch the tensioning cable between the second lock surface and the second engagement surface in the locked position. Here, the first lock surface and the second lock surface may be convergent. The first lock surface may be substantially parallel to the first engagement surface and the second lock surface may be substantially parallel to the second engagement surface.

The cable lock may further include a release operable to move the lock member from the locked position to the unlocked position. The release may be attached to the lock member to permit a force applied to the release to move the lock member in a direction away from the first engagement surface and the second engagement surface relative to the housing. Here, the housing may include a retainer operable to engage the lock member when the lock member is moved a predetermined distance away from the first engagement surface and the second engagement surface, the retainer operable to maintain the lock member in the unlocked position. The lock member may be biased into the locked position.

In some examples, the cable lock includes a housing and a spool supported by the housing and rotatable relative to the housing in a first direction when the tensioning cable moves in the tightening direction and in an opposite second direction when the tensioning cable moves in the loosening direction. The spool may include a first annular groove configured to collect a first portion of the tensioning cable and a second annular groove configured to collect a second portion of the tensioning cable. In this example, the cable lock may include a plurality of teeth positioned circumferentially around an axis of the spool and a first pawl supported by the housing and including a first biasing member configured to bias the first pawl into engagement with the plurality of teeth to selectively restrict the spool from rotating in the second direction. The plurality of teeth may be sloped to permit the spool to rotate in the first direction when the first pawl is engaged with the plurality of teeth. The cable lock may further include a release configured to selectively disengage the first pawl from the plurality of teeth to allow the spool to rotate in the second direction when a predetermined force is applied to the release that overcomes a biasing force of the first biasing member. Optionally, the cable lock may also include a second pawl having a second biasing member configured to bias the second pawl into engagement with a control surface associated with the spool when the first pawl is disengaged from the plurality of teeth to permit the spool to rotate in the second direction. The second pawl may be rotatably supported by the first pawl.

In some configurations, the first portion of the tightening cable and the second portion of the tightening cable approach the spool from opposite directions. The cable lock may be supported by an outsole attached to the upper. The cable lock may be disposed between an outsole and a midsole of the footwear.

In some examples, the article of footwear includes a first conduit operable to receive a length of the tensioning cable therein when the tensioning cable is moved in one of the tightening direction and the loosening direction to accommodate bunching by the tensioning cable. The length of the tensioning cable may be received within the first conduit when the tensioning cable is moved in the one of the tightening direction and the loosening direction being greater than a length of the first conduit. Here, the article of footwear further includes a second conduit operable to receive a length of the tensioning cable therein when the tensioning cable is moved in the other of the tightening direction and the loosening direction to accommodate bunching by the tensioning cable. The length of the tensioning cable may be received within the second conduit when the tensioning cable is moved in the other of the tightening direction and the loosening direction being greater than a length of the second conduit.

Yet another aspect of the disclosure provides an article of footwear including an upper and a sole structure attached to the upper. The article of footwear also includes a first cable extending between the upper and the sole structure and movable in a tightening direction to move the upper into a tightened state and movable in a loosening direction to move the upper into a loosened state. The article of footwear further includes a cable lock disposed within the sole structure and operable in a locked state to restrict movement of the first cable in the loosening direction and operable in an unlocked state to permit movement of the first cable in the loosening direction.

Implementations of the disclosure may include one or more of the following optional features. In some examples, the sole structure includes an outsole having a ground-contacting surface and a midsole disposed between the outsole and the upper. Here, the cable lock may be received within a cavity of the midsole. The cable lock may oppose the outsole or the cable lock may be in contact with the outsole. In this example, the article of footwear may include a strobel disposed between the upper and the midsole. Here, the cable lock may be received within a cavity of the midsole. Additionally or alternatively, the cable lock may oppose the strobel, may be in contact with the strobel, or may be attached to the strobel. In some configurations, the cable lock is attached to the midsole. Here, the article of footwear may include a strobel attached to the upper. The strobel may be disposed between the midsole and the outsole. The strobel may also be disposed between the cable lock and the outsole. Optionally, the cable lock may be disposed within one of a heel region of the sole structure, a midfoot region of the sole structure, and a forefoot region of the sole structure, the midfoot region disposed between the heel region and the forefoot region.

Another aspect of the disclosure provides an article of footwear including an upper and a sole structure including a midsole. The article of footwear also includes a first cable attached to the upper. The first cable is movable relative to the upper in a tightening direction to move the upper into a tightened state and movable relative to the upper in a loosening direction to move the upper into a loosened state. The article of footwear further includes a cable lock disposed within the midsole and operable in a locked state to restrict movement of the first cable in the loosening direction and operable in an unlocked state to permit movement of the first cable in the loosening direction.

Implementations of the disclosure may include one or more of the following optional features. In some configurations, the sole structure includes an outsole having a ground-contacting surface, the midsole disposed between the outsole and the upper. The cable lock may be received within a cavity of the midsole. In this configuration, the cable lock may oppose the outsole or may be in contact with the outsole.

In some examples, the article of footwear includes a strobel disposed between the upper and the midsole. In this example, the cable lock may be received within a cavity of the midsole. The cable lock may opposes the strobel, may be in contact with the strobel, or may be attached to the strobel.

In some implementations, the cable lock is attached to the midsole. Here, the article of footwear may also include a strobel attached to the upper. The strobel may be disposed between the midsole and an outsole of the sole structure. Additionally or alternatively, the strobel may be disposed between the cable lock and an outsole of the sole structure. Optionally, the strobel may be disposed between the cable lock and an outsole of the sole structure. The cable lock may be disposed within one of a heel region of the sole structure, a midfoot region of the sole structure, and a forefoot region of the sole structure, the midfoot region disposed between the heel region and the forefoot region.

Yet another aspect of the disclosure provides an article of footwear that includes an upper and a sole structure including an outsole having ground-contacting surface. The article of footwear also includes a first cable attached to the upper. The first cable is movable relative to the upper in a tightening direction to move the upper into a tightened state and movable relative to the upper in a loosening direction to move the upper into a loosened state. The article of footwear further includes a cable lock disposed within the sole structure and opposing the outsole. The cable lock is operable in a locked state to restrict movement of the first cable in the loosening direction and is operable in an unlocked state to permit movement of the first cable in the loosening direction.

Implementations of the disclosure may include one or more of the following optional features. In some examples, the sole structure includes a midsole disposed between the outsole and the upper. Here, the cable lock may be received within a cavity of the midsole. The cable lock may be in contact with the outsole. Optionally, the cable lock may be attached to the outsole. In some implementations, the article of footwear also includes a strobel disposed between the upper and the outsole. The cable lock may be received within a cavity of the midsole. In this implementation, the midsole may be disposed between the cable lock and the strobel. The cable lock may be disposed within one of a heel region of the sole structure, a midfoot region of the sole structure, and a forefoot region of the sole structure, the midfoot region disposed between the heel region and the forefoot region.

Another aspect of the disclosure provides an article of footwear including an upper, a sole structure, and a strobel attached to the upper and disposed between the upper and the sole structure. The article of footwear also includes a first cable attached to the upper. The first cable is movable relative to the upper in a tightening direction to move the upper into a tightened state and movable relative to the upper in a loosening direction to move the upper into a loosened state. The article of footwear further includes a cable lock disposed within the sole structure and opposing the strobel. The cable lock operable in a locked state to restrict movement of the first cable in the loosening direction and operable in an unlocked state to permit movement of the first cable in the loosening direction.

Implementations of the disclosure may include one or more of the following optional features. In some implementations, the sole structure includes an outsole having a ground-contacting surface and a midsole disposed between the outsole and the upper. Here, the cable lock may be received within a cavity of the midsole. Optionally, the cable lock may be in contact with the strobel, attached to the strobel, or attached to the midsole. When the cable lock is attached to the midsole, the cable lock may be attached to the strobel. Here, the cable lock may be attached to the strobel by at least one of an adhesive and a fastener. In some examples, the strobel is disposed between the midsole and the outsole. In other examples, the strobel may be disposed between the midsole and the outsole. Optionally, the strobel may also be disposed between the cable lock and the outsole. The cable lock may be disposed within one of a heel region of the sole structure, a midfoot region of the sole structure, and a forefoot region of the sole structure, the midfoot region disposed between the heel region and the forefoot region.

Yet another aspect of the disclosure provides an article of footwear including an upper and a sole structure including a midsole. The article of footwear also includes a first cable attached to the upper. The first cable is movable relative to the upper in a tightening direction to move the upper into a tightened state and movable relative to the upper in a loosening direction to move the upper into a loosened state. The article of footwear further includes a cable lock attached to the midsole and operable in a locked state to restrict movement of the first cable in the loosening direction and operable in an unlocked state to permit movement of the first cable in the loosening direction.

Another aspect of the disclosure provides an article of footwear including an upper and a first cable movable in a tightening direction away from the upper to move the upper into a tightened state and movable in a loosening direction to move the upper into a loosened state. The article of footwear also includes a cable lock disposed on the upper and operable in a locked state to restrict movement of the first cable in the loosening direction and operable in an unlocked state to permit movement of the first cable in the loosening direction.

Implementations of the disclosure may include one or more of the following optional features. In some examples, the cable lock is disposed on a heel of the article of footwear. Here, the cable lock may include a release cord operable to move the cable lock from the locked state to the unlocked state. The article of footwear may further include a sole structure attached to the upper and including a ground-contacting surface. In this example, the release cord may extend from the cable lock in a direction away from the ground-contacting surface. The cable lock may be elongate. Also, a longitudinal axis of the cable lock may be substantially perpendicular to the ground-contacting surface.

In some configurations, the cable lock includes a release cord operable to move the cable lock from the locked state to the unlocked state. The article of footwear may further include a sole structure attached to the upper and a ground-contacting surface. Here, the release cord may extend from the cable lock in a direction away from the ground-contacting surface. The cable lock may be elongate. A longitudinal axis of the cable lock may be substantially perpendicular to the ground-contacting surface.

In some implementations, the cable lock includes a housing having a first engagement surface and a second engagement surface. The first engagement surface and the second engagement surface may converge toward one another. The cable lock may also include a lock member slidably disposed within the housing and movable between a locked state and an unlocked state and including a first lock surface and a second lock surface that converge toward one another. The first lock surface may be operable to pinch a first portion of the first cable between the first engagement surface and the first lock surface in the locked state to restrict movement of the first cable in a first direction relative to the housing. The second lock surface may be operable to pinch a second portion of the first cable between the second engagement surface and the second lock surface in the locked state to restrict movement of the first cable in a first direction relative to the housing. The cable lock may further include a biasing member operable to apply a biasing force and to bias the lock member in the locked state. Here, the biasing member may be a spring. The spring may be a coil spring.

In some examples, the article of footwear includes a release cord attached to the lock member and operable to move the lock member from the locked state to the unlocked state when a tensile force exceeding the biasing force of the biasing member is applied to the release cord in an unlocking direction Here, the release cord may be attached to the lock member at an opposite end of the lock member than the biasing member. The lock member may include a retainer operable to selectively engage the housing and to maintain the lock member in the unlocked state. The retainer may be disposed at an opposite end of the lock member than the biasing member. The retainer may be formed on a tab portion of the lock member. The tab portion may be movable relative to the lock member between a rest state and a flexed state. Optionally, the tab portion may be biased into the rest state. The tab portion may also be operable to move from the rest state to the flexed state to disengage the retainer from the housing. The article of footwear may include a release cord attached to the tab portion, the release cord operable to move the tab portion from the rest state to the flexed state. Here, the release cord may be operable to move the lock member from the locked state to the unlocked state when a force of a predetermined magnitude is applied to the release cord.

In some configurations, the lock member includes a first recess and a second recess operable to selectively receive a first retainer and a second retainer of the housing to maintain the lock member in the unlocked state. The first retainer and the second retainer may be movable between an extended state and a retracted state. Additionally or alternatively, the first retainer and the second retainer may be biased in to the extended state by a first biasing member and a second biasing member. Here, the first biasing member and the second biasing member may be springs. The first biasing member and the second biasing member may be coil springs.

In some examples, the first retainer and the second retainer are integrally formed with the housing. The first retainer and the second retainer may act as living hinges movable between the extended state and the retracted state. The first retainer and the second retainer are in the retracted state when received within the first recess and the second recess, respectively.

In some implementations, at least one of the first lock surface and the second lock surface include projections operable to grip the first cable when the lock member is in the locked state. Optionally, the first cable may be movable in a second direction opposite the first direction when the lock member is in the locked state or the unlocked state. Additionally or alternatively, the first cable may be movable in a second direction opposite the first direction when the lock member is in the unlocked state.

Another aspect of the disclosure provides an article of footwear including an upper having a first series of cable guides and a second series of cable guides. The article of footwear also includes a first cable including a first portion received by and extending between adjacent ones of the first cable guides and a second portion received by an extending between adjacent ones of the second cable guides. The first portion is movable in a first tightening direction and the second portion is movable in a second tightening direction to move the upper into a tightened state. The first portion is also movable in a first loosening direction and the second portion is also movable in a second loosening direction to move the upper into a loosened state. The article of footwear further includes a cable lock operable in a locked state to restrict movement of the first portion in the first loosening direction and to restrict movement of the second portion in the second loosening direction. The cable lock is operable in an unlocked state to permit movement of the first portion in the first loosening direction and to permit movement of the second cable in the second loosening direction. The article of footwear also includes a release cable operable to move the cable lock from the locked state to the unlocked state. The release cable includes a release grip located remotely from the cable lock.

Implementations of the disclosure may include one or more of the following optional features. In some implementations, the article of footwear further includes a second cable including a first portion received by the cable lock and a second portion forming a tightening grip located remotely from the cable lock. In this implementation, the second cable may be operable to place the first cable under tension to move the first portion in the first tightening direction and to move the second portion in the second tightening direction when a force of a predetermined magnitude is applied to the tightening grip. The tightening grip may be disposed proximate to an ankle opening of the upper. The tightening grip may be spaced apart from the release cable. Optionally, the tightening grip may be located proximate to the release cable. Additionally or alternatively, the tightening grip may be located closer to a forefoot region of the upper than the release cable or the tightening grip may be located closer to a heel region of the upper than the release cable.

The cable lock may be disposed on surface of the upper. The cable lock may also be disposed on a heel region of the upper. In some examples, the article of footwear includes a sole structure including a midsole and an outsole, here, the cable lock may be disposed within the midsole. The cable lock may also be received within a cavity of the midsole. Optionally, the cable lock may oppose the outsole or may be in contact with the outsole.

In some implementations, the article of footwear further includes a strobel disposed between the upper and the midsole. Here, the cable lock may be received within a cavity of the midsole. Optionally, the cable lock may opposes the strobel, may be in contact with the strobel, or may be attached to the strobel. Additionally or alternatively, the cable lock may be attached to the midsole. In some examples, the article of footwear further includes a strobel attached to the upper. In this example, the strobel may be disposed between the midsole and the outsole. Optionally, the strobel may be disposed between the cable lock and the outsole.

Another aspect of the disclosure provides an article of footwear including an upper having a first series of cable guides and a second series of cable guides. The article of footwear also includes a first cable including a first portion received by and extending between adjacent ones of the first cable guides and a second portion received by an extending between adjacent ones of the second cable guides. The first portion is movable in a first tightening direction and the second portion is movable in a second tightening direction to move the upper into a tightened state. The first portion is also movable in a first loosening direction and the second portion is also movable in a second loosening direction to move the upper into a loosened state. The article of footwear further includes a cable lock operable in a locked state to restrict movement of the first portion in the first loosening direction and to restrict movement of the second portion in the second loosening direction. The cable lock is also operable in an unlocked state to permit movement of the first portion in the first loosening direction and to permit movement of the second cable in the second loosening direction. Additionally, the article of footwear further includes a second cable including a first portion received by the cable lock and a second portion forming a tightening grip located remotely from the cable lock. The second cable is operable to place the first cable under tension to move the first portion in the first tightening direction and to move the second portion in the second tightening direction when a force of a predetermined magnitude is applied to the tightening grip.

Implementations of the disclosure may include one or more of the following optional features. In some examples, the article of footwear further includes a release cable operable to move the cable lock from the locked state to the unlocked state. Here, the release cable may include a release grip located remotely from the cable lock. The tightening grip and the release grip may be disposed proximate to one another. Optionally, the tightening grip and the release grip may be spaced apart from one another. Additionally or alternatively, the tightening grip may be located closer to a forefoot region of the upper than the release cable or may be located closer to a heel region of the upper than the release cable. In other examples, the tightening grip may be disposed proximate to an ankle opening of the upper.

In some configurations, the cable lock is disposed on surface of the upper. In others, the cable lock may be disposed on a heel region of the upper. The article of footwear may also include a sole structure including a midsole and an outsole, the cable lock being disposed within the midsole. The cable lock may be received within a cavity of the midsole. Optionally, the cable lock may oppose the outsole or may be in contact with the outsole. Additionally, the article of footwear may include a strobel disposed between the upper and the midsole. Here, the cable lock may be received within a cavity of the midsole. In some examples, the cable lock opposes the strobel. The cable lock may also be in contact with the strobel, attached to the strobel, or attached to the midsole. The article of footwear may further include a strobel attached to the upper. Optionally, the strobel may be disposed between the midsole and the outsole or the strobel may be disposed between the cable lock and the outsole.

Another aspect of the disclosure provides an article of footwear including an upper defining an interior void and a first cable. The first cable is movable in a tightening direction to move the upper into a tightened state and movable in a loosening direction to move the upper into a loosened state. The article of footwear also includes a cable lock operable in a locked state to restrict movement of the first cable in the loosening direction and operable in an unlocked state to permit movement of the first cable in the loosening direction. The article of footwear further includes a sole structure attached to the upper and including a cavity receiving the cable lock therein and at least one channel extending from the cavity to an exterior of the sole structure, the first cable extending from the cable lock within the cavity to the exterior of the sole structure via the at least one channel.

Implementations of the disclosure may include one or more of the following optional features. In some examples, the article of footwear further includes a tightening grip operable to be moved away from the upper in a first direction to move the first cable in the tightening direction. The article of footwear may also include a release grip operable to be moved away from the upper in a second direction to move the cable lock from the locked state to the unlocked state, the release grip being separate from the tightening grip. The cable lock may be disposed remotely from the tightening grip and from the release grip. Optionally, the release grip may extend from the upper.

In some implementations, the sole structure includes a midsole and an outsole. Here, the midsole may include the cavity. The cavity may oppose the outsole or the upper. Additionally or alternatively, when the sole structure includes a midsole and an outsole, the article of footwear may include a strobel attached to the upper, the cavity opposing the strobel. Here, the cable lock may be attached to the strobel.

Yet another aspect of the disclosure provides an article of footwear including an upper defining an interior void and a first cable portion. The first cable portion is movable in a first tightening direction to move the upper into a tightened state and is movable in a first loosening direction to move the upper into a loosened state. The article of footwear also includes a second cable portion movable in a second tightening direction movable in a second loosening direction when the first cable portion is moved in the first loosening direction. The article of footwear further includes a cable lock operable in a locked state and an unlocked state. In the locked state the cable lock is operable to restrict movement of the first cable portion in the first loosening direction and the second cable portion in the second loosening direction. In the unlocked state the cable lock is operable to permit movement of the first cable portion in the first loosening direction and the second cable portion in the second loosening direction. The article of footwear also includes a first cable guide attached to the upper and receiving the first cable portion. The first cable guide includes a first convex inner surface operable to engage and direct movement of the first cable relative to the upper. A second cable guide is attached to the upper and receiving the second cable portion. The second cable guide includes a second convex inner surface operable to engage and direct movement of the second cable relative to the upper.

Implementations of the disclosure may include one or more of the following optional features. In some configurations, the second cable portion forms a tightening grip formed as a loop and operable to be moved in a first direction away from the upper to move the second cable portion in the second tightening direction. The article of footwear may also include a release grip operable to be moved away from the upper in a second direction to move the cable lock from the locked state to the unlocked state. The release grip may be separate from the tightening grip. Optionally, the first direction may be different than the second direction. Additionally or alternatively, the cable lock may be disposed remotely from the tightening grip and from the release grip.

In some examples, the article of footwear further includes a sole structure attached to the upper. In this example, the cable lock may be disposed within the sole structure. The sole structure may include a midsole and an outsole. Here, the midsole may include a cavity, the cable lock being disposed within the cavity. In some examples, the cavity opposes the outsole or the upper. The article of footwear may also include a strobel attached to the upper, the cavity opposing the strobel. The cable lock may be attached to the strobel.

In some implementations, an effective length of the second cable portion is increased when the second cable portion is moved in the second tightening direction. An effective length of the first cable portion may be reduced when the first cable portion is moved in the first tightening direction. A portion of the first cable portion may be retracted within the cable lock when the first cable portion is moved in the first tightening direction. A portion of the second cable portion may be retracted within the cable lock when the second cable portion is moved in the second loosening direction. The first cable portion and the second cable portion may be part of the same, unitary cable.

In some configurations, at least one of the first cable guide and the second cable guide includes a substantially C shape. The first cable guide may be disposed along a medial side of the upper and the second cable guide may be disposed along a lateral side of the upper. Here, the first convex surface may oppose the medial side and the second convex surface may oppose the lateral side. Further, the first cable guide may include a first concave surface disposed on an opposite side of the first cable guide than the first convex surface and the second cable guide may include a second concave surface disposed on an opposite side of the second cable guide than the second convex surface. The first concave surface may oppose the lateral side and the second concave surface opposes the medial side. Additionally or alternatively, the first concave surface may oppose the second concave surface in a direction extending across the upper between the medial side and the lateral side.

The details of one or more implementations of the disclosure are set forth in the accompanying drawings and the description below. Other aspects, features, and advantages will be apparent from the description and drawings, and from the claims.

Figure 2:
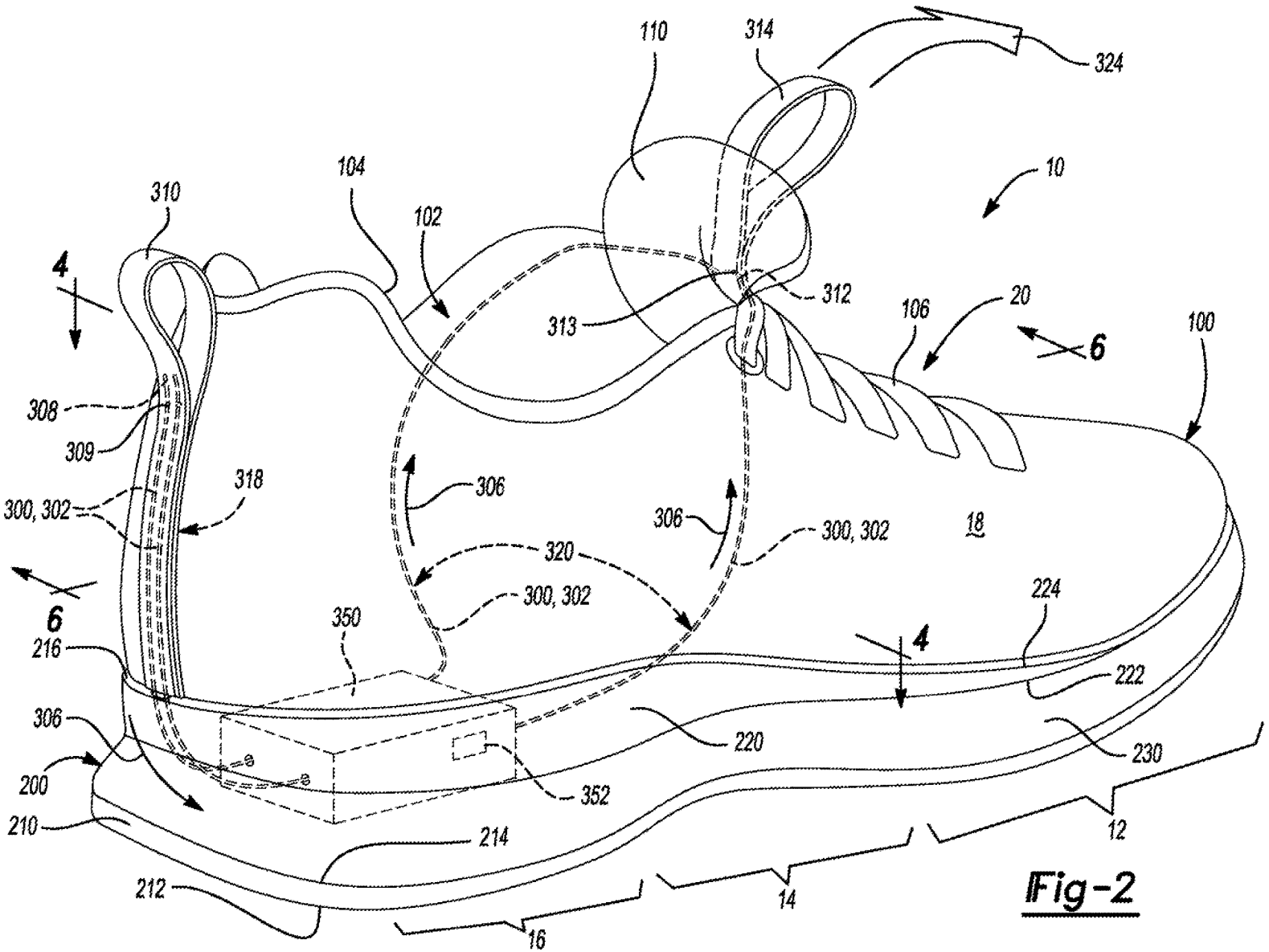
FIG. 2 is a top perspective view of the article of footwear of FIG. 1 showing the upper in a loosened state.

Referring to FIGS. 1-6, in some implementations, an article of footwear 10 is provided and includes an upper 100, a sole structure 200 attached to the upper 100, and a tightening mechanism 300 operable to move the upper 100 between a tightened state (FIG. 1) and a loosened state (FIG. 2). The article of footwear 10 may be divided into one or more portions. The portions may include a forefoot portion 12, a midfoot portion 14 and a heel portion 16. The forefoot portion 12 may correspond with toes and joints connecting metatarsal bones with phalanx bones of a foot. The midfoot portion 14 may correspond with an arch area of the foot, and the heel portion 16 may correspond with rear portions of the foot, including a calcaneus bone. The footwear 10 may include lateral and medial sides 18, 20, respectively, corresponding with opposite sides of the footwear 10 and extending through the portions 12, 14, 16.

The upper 100 includes interior surfaces that define an interior void 102 configured to receive and secure a foot for support on the sole structure 200. An ankle opening 104 in the heel portion 16 may provide access to the interior void 102. For example, the ankle opening 104 may receive a foot to secure the foot within the void 102 and facilitate entry and removal of the foot from and to the interior void 102. In some examples, one or more fasteners 106 extend along the upper 100 to adjust a fit of the interior void 102 around the foot and accommodate entry and removal therefrom. For instance, tightening of the fasteners 106 cinches the upper 100 to close the interior void 102 around the foot while loosening of the fasteners 106 relaxes the upper 100 to open the interior void 102 for removal of the foot therefrom. The upper 100 may include apertures such as eyelets and/or other engagement features such as fabric or mesh loops that receive the fasteners 106. The fasteners 106 may be operatively connected to the tightening mechanism 300 to automatically move the upper 100 between the tightened state (FIG. 1) and the loosened state (FIG. 2) when the tightening mechanism moves between corresponding ones of a tightened state and a loosened state.

The upper 100 may include a tongue portion 110 that extends between the interior void 102 and the fasteners 106. The upper 100 may be formed from one or more materials that are stitched or adhesively bonded together to form the interior void 102. Suitable materials of the upper may include, but are not limited, textiles, foam, leather, and synthetic leather. The materials may be selected and located to impart properties of durability, air-permeability, wear-resistance, flexibility, and comfort.

In some implementations, the sole structure 200 includes an outsole 210 and a midsole 220 arranged in a layered configuration. For example, the outsole 210 engages with a ground surface during use footwear 10 and the midsole 220 is disposed between the upper 100 and the outsole 210. In some examples, the sole structure 200 may also incorporate additional layers such as an insole 216 or sockliner that may reside within the interior void 102 of the upper 100 to receive a plantar surface of the foot to enhance the comfort of the footwear 10. In some examples, a sidewall 230 (e.g., wall 230) of the midsole 220 extends between the upper 100 and the outsole 210 and at least partially surrounds a cavity 240 (FIGS. 5 and 6) therebetween.

In some examples, the outsole 210 includes a ground-engaging surface 212 and an opposite inner surface 214. The outsole 210 may be attached to the upper 100 via the midsole 220. For example, the sidewall 230 of the midsole 220 may extend from the perimeter of the outsole 210 and may be attached to the upper 100. The outsole 210 generally provides abrasion-resistance and traction with the ground surface and may be formed from one or more materials that impart durability and wear-resistance, as well as enhance traction with the ground surface. For example, rubber may form at least a portion of the outsole 210.

The midsole 220 may include a bottom surface 222 and a footbed 224 disposed on an opposite side of the midsole 220 than the bottom surface 222. Stitching or adhesives may secure the midsole 220 to the upper 100. In addition, the midsole 220 may be attached to a strobel (not shown) disposed generally between the upper 100 and the midsole 220. The footbed 224 may be contoured to conform to a profile of the bottom surface (e.g., plantar) of the foot. In some examples, the insole 216 or sockliner may be disposed on the footbed 224 under the foot within at least a portion of the interior void 102 of the upper 100. One or more polymer foam materials may form the sidewall 230 to provide resilient compressibility under an applied load to attenuate ground-reaction forces. In some examples, the sidewall 230 extends through the portions 12, 14, 16 of the footwear 10 between the inner surface 214 of the outsole 210 and the upper 100.

In some implementations, the tightening mechanism 300 includes a tensioning cable 302 movable in a tightening direction 304 to move the tightening mechanism 300 into a tightened state and movable in a loosening direction 306 to move the tightening mechanism 300 into the loosened state. In some examples, the tensioning cable 302 is a continuous loop extending between a first end 308 operatively connected at an attachment location 309 to a tightening grip 310 attached to the upper 100 in the heel portion 16 and a second end 312 operatively connected at an attachment location 313 to a loosening grip 314 attached to the upper 100 (e.g., tongue portion 110) in the midfoot portion 14 and also operatively connected to the fasteners 106. For example, the second end 312 may be attached to the fasteners 106 in an area proximate to the loosening grip 314 such that when the tensioning cable 302 is placed under tension, a force is applied to the fasteners 106 via the cable 302, thereby causing the fasteners 106 to constrict the upper 100 around a foot of a wearer. The tensioning cable 302 may extend through a locking device or cable lock 350 disposed in the sole structure 200 between the tightening grip 310 and the loosening grip 314 to define a first effective length 318 between the locking device 350 and the tightening grip 310 and a second effective length 320 between the locking device 350 and the loosening grip 314.

The tensioning cable 302 may be highly lubricious and/or may be formed from one or more fibers having a low modulus of elasticity and a high tensile strength. For instance, the fibers may include high modulus polyethylene fibers having a high strength-to-weight ratio and a low elasticity. Additionally or alternatively, the cable 302 may be formed from a molded monofilament polymer and/or a woven steel with or without other lubrication coating. In some examples, the cable 302 includes multiple strands of material woven together.

The tensioning cable 302 may be routed through various channels or panels formed by the upper 100 and the sole structure 200. In some implementations, the outsole 210 and the midsole 220 cooperate to provide passages for routing portions of the tensioning cable 302 proximate to the locking device 350 while the upper 100 defines passages for routing portions of the tensioning cable 302 to the ends 308, 312 operatively connected to respective ones of the tightening grip 310 and the loosening grip 314, as well as to the fasteners 106. For instance, the lateral side 18 and the medial side 20 of the upper 100 may each define a passage between interior and exterior surfaces thereof for guiding portions of the tensioning cable 302 along the second length 320. Similarly, the upper 100 may define a passage along the heel portion for guiding portions of the tensioning cable 302 along the first length 318. In some configurations, the first length 318 of the tensioning cable 302 is routed through passages provided by the outsole 210 and the midsole 220 and exterior passages along exterior surfaces of the upper 100 in the heel portion 16. For instance, a fabric material may be attached to the exterior surface of the upper 100 to define a sleeve or passage for guiding and enclosing portions of the tensioning cable 302 that extend out of the sole structure 200 and operably connect to the tightening grip 310 at the first end 308. In some examples, the tightening grip 310 integrally forms the sleeve or passage for guiding and enclosing the portions of the tensioning cable 302 along the first length 318 that extend out of the sole structure 200.

Figure 3:
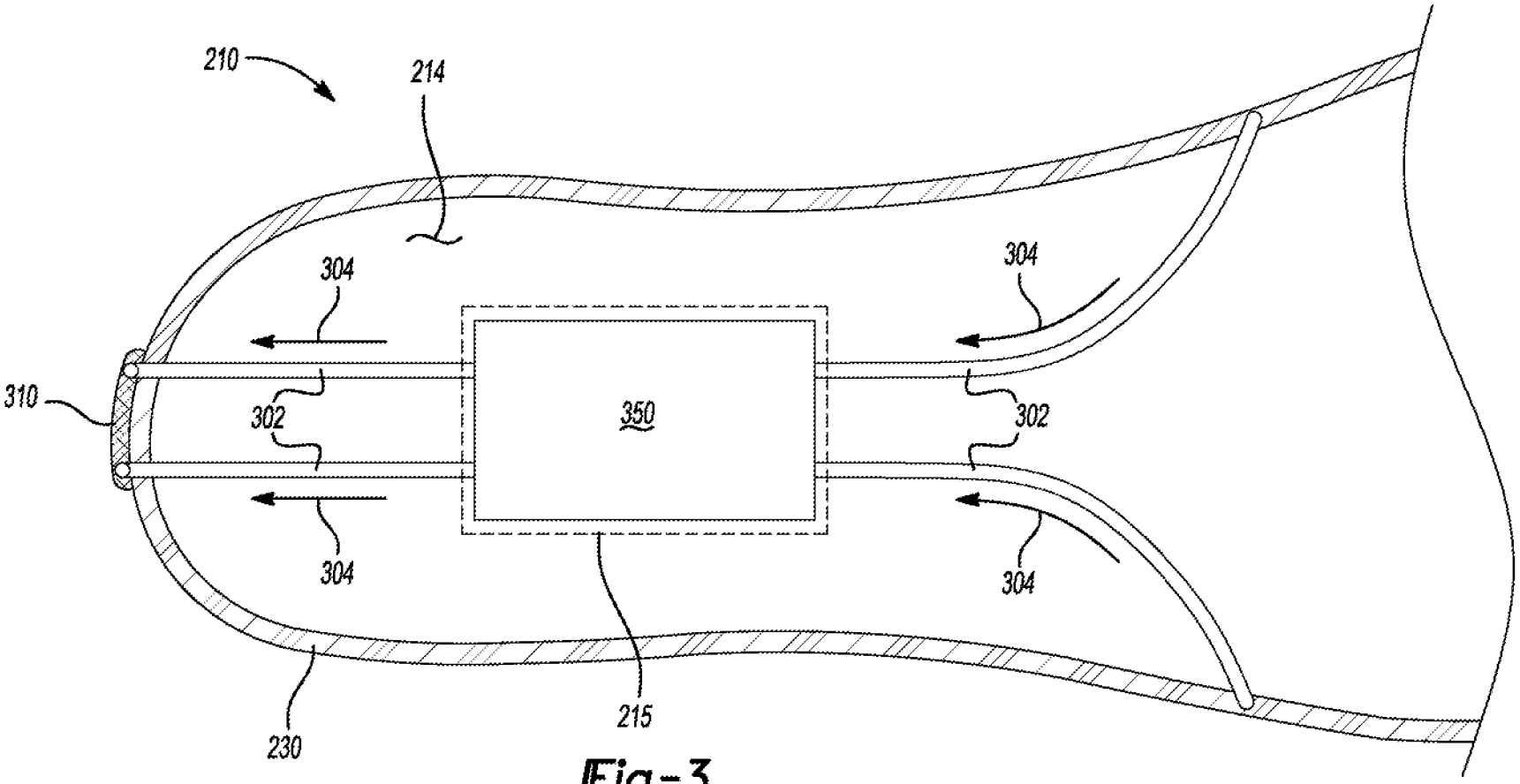
FIG. 3 is a partial cross-sectional view taken along line 3-3 of FIG. 1 showing a tensioning cable moving in a tightening direction.
Figure 5:
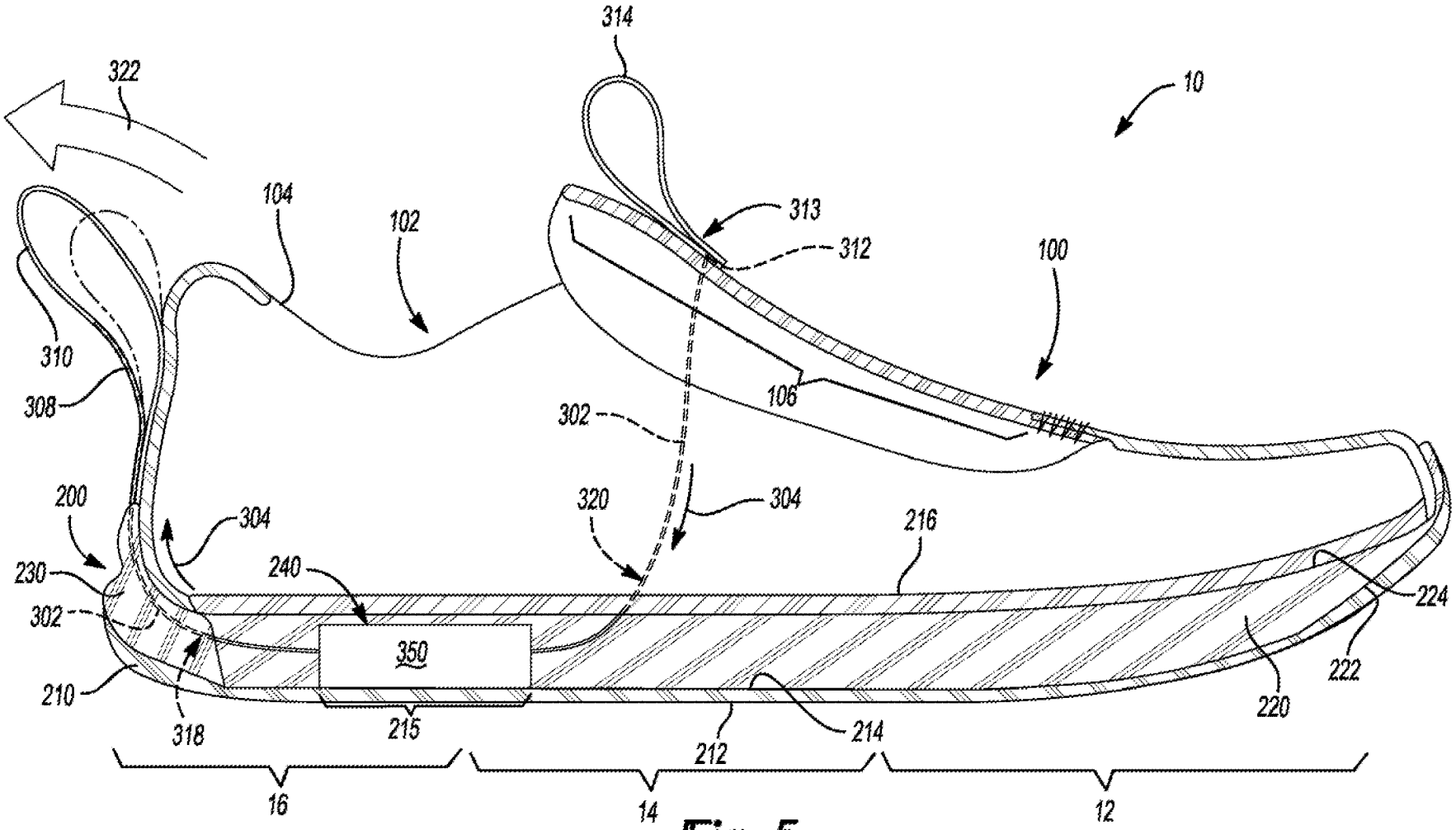
FIG. 5 is a cross-sectional view taken along line 5-5 of FIG. 1 showing a tensioning cable moving in a tightening direction in response to pulling a tightening grip.

Referring to FIG. 1, the tensioning cable 302 is movable in the tightening direction 304 when a pulling force 322 is applied to the tightening grip 310 to pull the tightening grip 310 away from the upper 100 to tighten the fasteners 106, and thereby move the upper 100 into the tightened state. For example, once a foot is received by the interior void 102 and supported upon the sole structure 200, the upper 100 may be automatically tightened to secure the fit of the interior void 102 around the foot by applying the pulling force 322 to the tightening grip 310 without the need of having to manually tie shoe laces or manually fasten other fasteners to tighten the upper 100. FIG. 3 provides a cross-sectional view taken along line 3-3 of FIG. 1 showing the tensioning cable 302 moving through the locking device 350 in the tightening direction 304 along the inner surface 214 of the outsole 210. Referring to FIG. 5, a cross-sectional view taken along line 5-5 of FIG. 1 shows the tensioning cable 302 moving in the tightening direction 304 to cause the first length 318 of the tensioning cable 302 to increase and the second length 320 to decrease. Here, the decrease in the second length 320 is operative to tension the fasteners 106 to cinch and tighten the upper 100 around the foot such that the foot is secured within the interior void 102 while supported upon the sole structure 200. Namely, decreasing the effective length of the second length 320 exerts a tensioning force on the fasteners 106, thereby causing the fasteners 106 to cinch and tighten the upper 100 around the foot, as the second length 320 is attached to the fasteners 106.

In some examples, a desired fit of the interior void 102 around the foot is adjustable based upon a magnitude of the pulling force 322 applied to the tightening grip 310. For instance, increasing the magnitude of the pulling force 322 may move the tensioning cable 302 further in the tightening direction 302 such that the tightening of the fasteners 106 along the upper 100 increases to achieve a tighter fit of the interior void 102 around the foot. Additionally or alternatively, the fit of the interior void 102 around the foot may be adjustable based upon a duration of the pulling force 322 applied to the tightening grip 310. For instance, pulling forces 322 applied to the tightening grip 310 for longer durations may result in the tensioning cable 302 moving a further distance in the tightening direction 304 to achieve a tighter fit of the interior void 102 around the foot.

Figure 4:
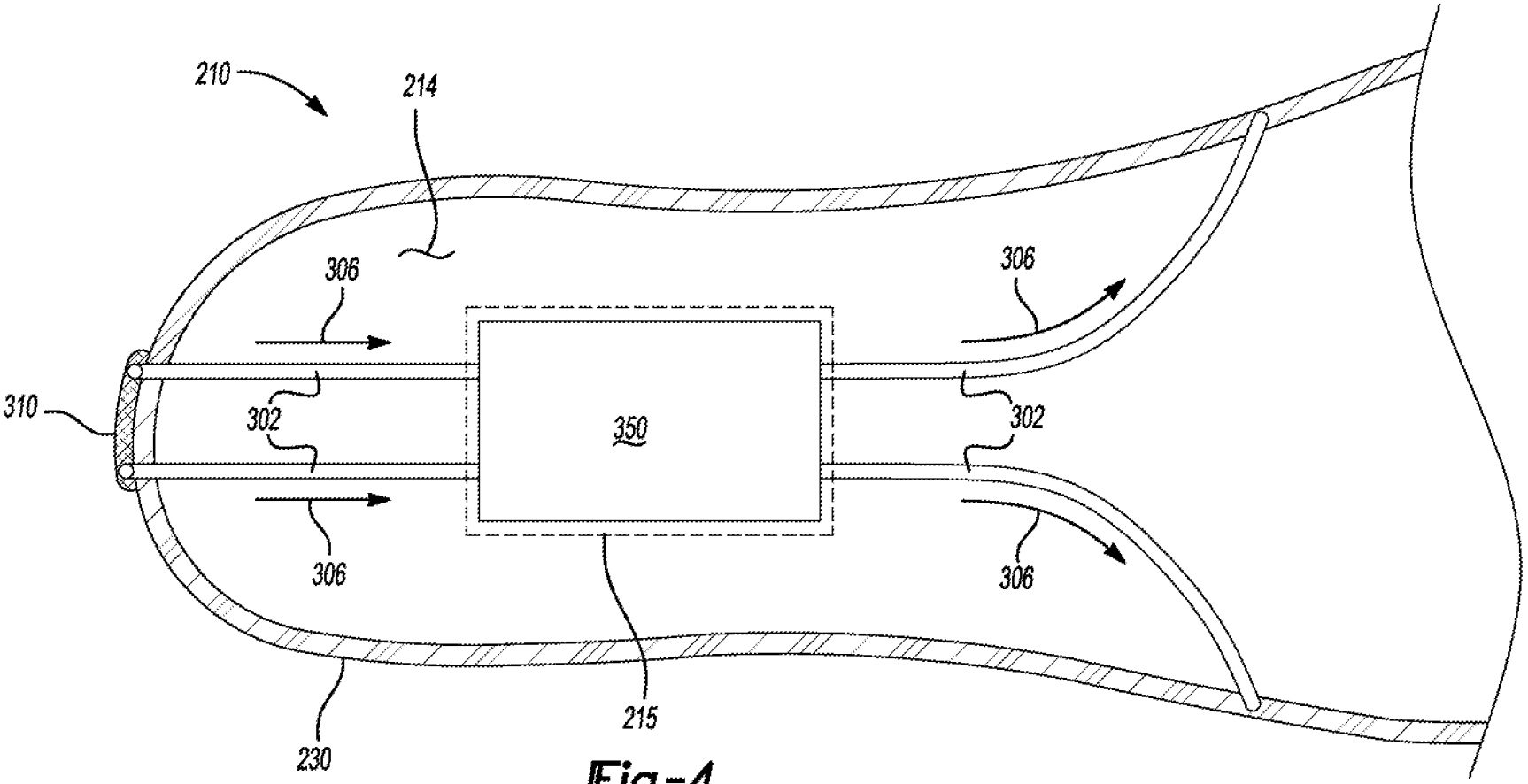
FIG. 4 is a partial cross-sectional view taken along line 4-4 of FIG. 2 showing a tensioning cable moving in a loosening direction.
Figure 6:
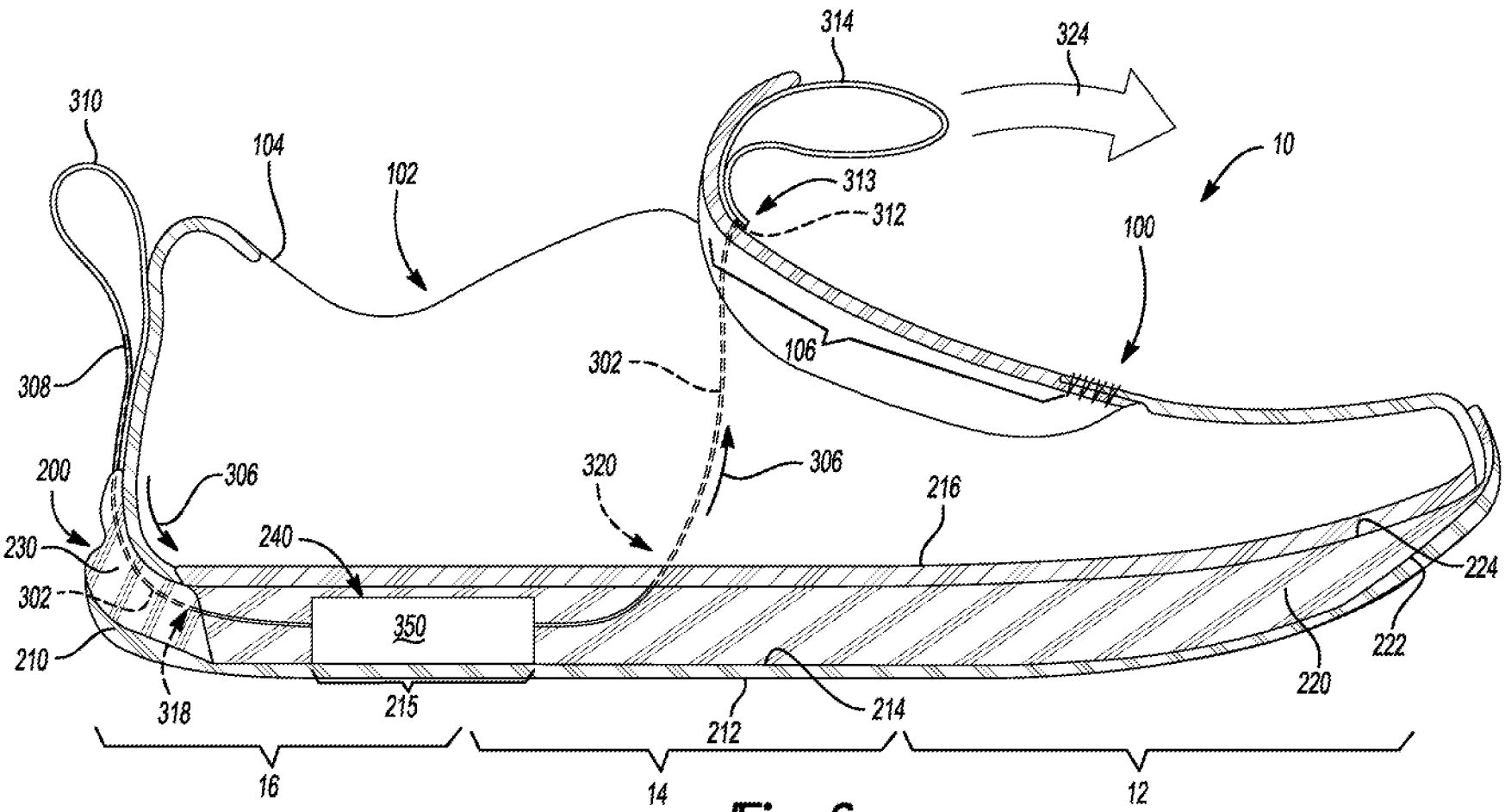
FIG. 6 is a cross-sectional view taken along line 6-6 of FIG. 2 showing a tensioning cable moving in a loosening direction in response to pulling a loosening grip.

Referring to FIG. 2, the tensioning cable 302 is movable in the loosening direction 306 when a pulling force 324 is applied to the loosening grip 314 to pull the loosening grip away from the upper 100 to loosen the fasteners 106, and thereby move the upper 100 into the loosened state. For example, removal of the foot from the footwear 100 while the upper 100 is in the tightened state of FIG. 1 may be facilitated by applying the pulling force 324 on the loosening grip 314 to automatically loosen the upper 100, and thereby open the interior void 102, without the need of having to untie shoe laces or unfasten one or more fasteners to loosen the upper 100. FIG. 4 provides a cross-sectional view taken along line 4-4 of FIG. 2 showing the tensioning cable 302 moving through the locking device 350 in the loosening direction 306 along the inner surface 214 of the outsole 210. Referring to FIG. 6, a cross-sectional view taken along line 6-6 of FIG. 2 shows the tensioning cable 302 moving in the loosening direction 306 to cause the first length 318 of the tensioning cable 302 to decrease and the second length 320 to increase. Here, the increase to the second length 320 allows the fasteners 106 to relax to facilitate a transition of the upper 100 from the tightened state to the loosened state such that the foot can be removed from the interior void 102 through the ankle opening 104.

In some implementations, the inner surface 214 of the outsole 210 defines a receiving area 215 that receives the locking device 350 therein. In some configurations, the receiving area 215 is disposed in the heel portion 16 of the footwear 10. In other configurations, the receiving area 215 is disposed in the forefoot portion 14 of the footwear 10. The receiving area 215 may also be disposed at a location that overlaps both the heel portion 16 and the forefoot portion 14 of the footwear 10. In some examples, the bottom surface 222 of the midsole 220 and the inner surface 214 of the outsole 210 define the cavity 240 therebetween and the locking device 350 is disposed within the cavity 240. Other implementations can include the locking device 350 disposed upon the upper 100 along one of the lateral side 18, the medial side 20, or along the rear of the footwear 10 at the heel portion 16.

The locking device 350 is operable between a locked state restricting movement of the tensioning cable 302 in the loosening direction 306 and an unlocked state permitting movement of the tensioning cable 302 in both the loosening direction 306 and the tightening direction 304. In some configurations, the locking device 350 is biased into the locked state. In these configurations, the locking device 350 may include a release mechanism 352 operable to transition the locking device 350 from the locked state to the unlocked state. For example, a force can be applied to the release mechanism 352 to transition the locking device 350 from the locked state to the unlocked state.

In some implementations, the locking device 350 permits movement of the tensioning cable 302 in the tightening direction 304 when the locking device 350 is in the locked state. This arrangement allows the tensioning cable 302 to move in the tightening direction 304 each time the pulling force 322 is applied to the tightening grip 310 while restricting movement in either the tightening direction 304 or the loosening direction 306 when the pulling force 322 is released. In doing so, the interior void 102 can be incrementally tightened around the foot until a desired fit is achieved. In these implementations, the locking device 350 must transition from the locked state to the unlocked state to permit the tensioning cable 302 to move in the loosening direction 306 when the pulling force 324 is applied to the loosening grip 314. In other words, the tightening cable 302 is restricted from moving in the loosening direction 306 when the pulling force 324 is applied to the loosening grip 314 unless the locking device 350 is in the unlocked state.

In other implementations, the locking device 350 also restricts movement of the tensioning cable 302 in the tightening direction 304 when the locking device 350 is in the locked state. In this arrangement, the tensioning cable 302 neither moves in the tightening direction 304 when the pulling force 322 is applied to the tightening grip 310 nor moves in the loosening direction 306 when the pulling force 324 is applied to the loosening grip 314 while the locking device 350 is in the locked state. Thus, in order to move the upper 100 from the loosened state to the tightened state, the locking device 350 must first transition from the locked state to the unlocked state before the pulling force 322 can be applied to the tightening grip 310 to effect movement of the tensioning cable 302 in the tightening direction 304. Likewise, in order to move the upper 100 from the tightened state to the loosened state to facilitate removal of the foot from the footwear, the locking device 350 must transition from the locked state to the unlocked state before the pulling force 324 can be applied to the loosening grip 314 to effect movement of the tensioning cable 302 in the loosening direction 306.

Figure 9:
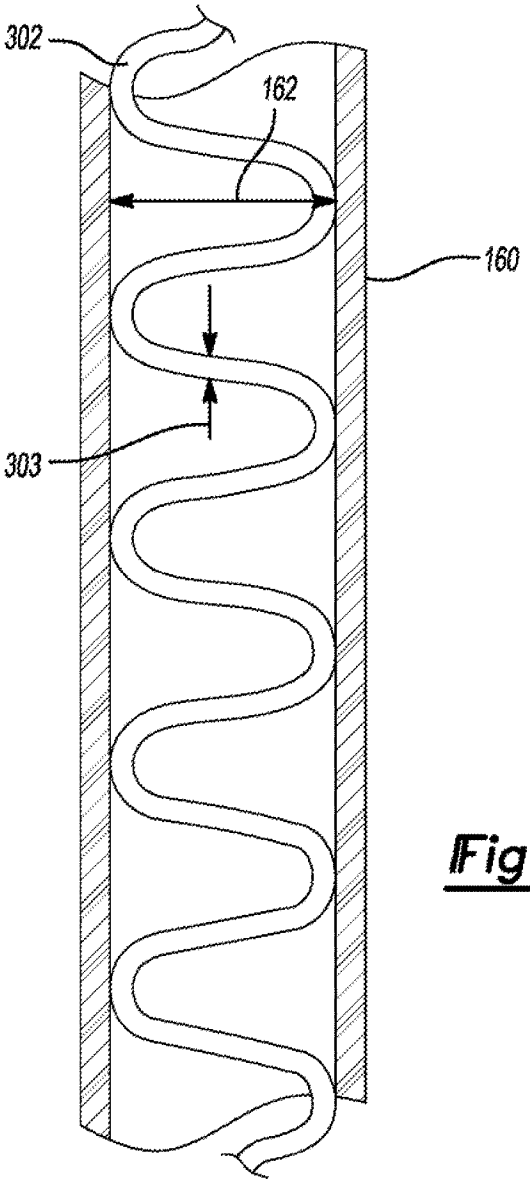
FIG. 9 is a cross-sectional view taken along line 9-9 of FIG. 8 showing the first conduits accommodating bunching by the tensioning cable when the tensioning cable is moved in the tightening direction.
Figure 12:
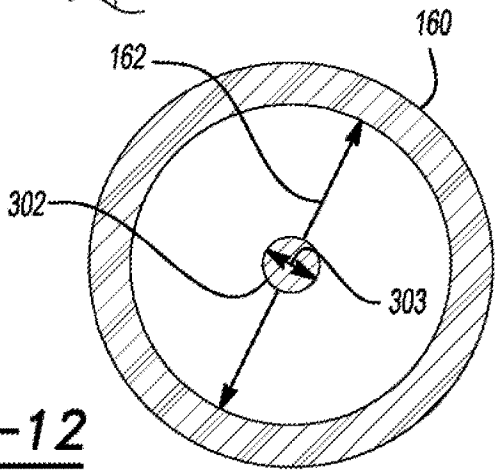
FIG. 12 is a cross-sectional view taken along line 12-12 of FIG. 10 showing one of the first conduits having an inner diameter greater than an outer diameter of the tensioning cable.
Figure 10:
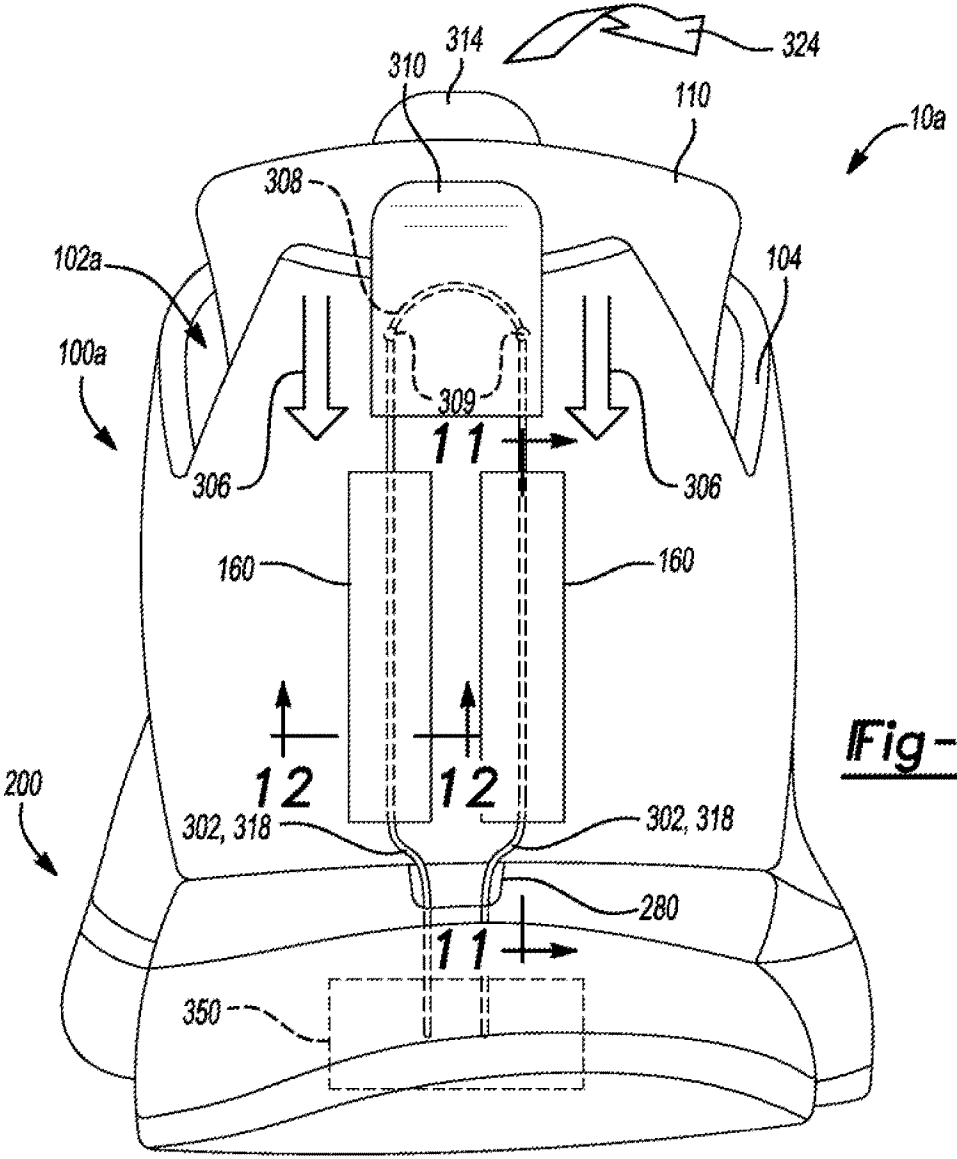
FIG. 10 is a rear view of the article of footwear of FIG. 7 showing first conduits receiving portions of a tensioning cable moving in a loosening direction.
Figure 13:
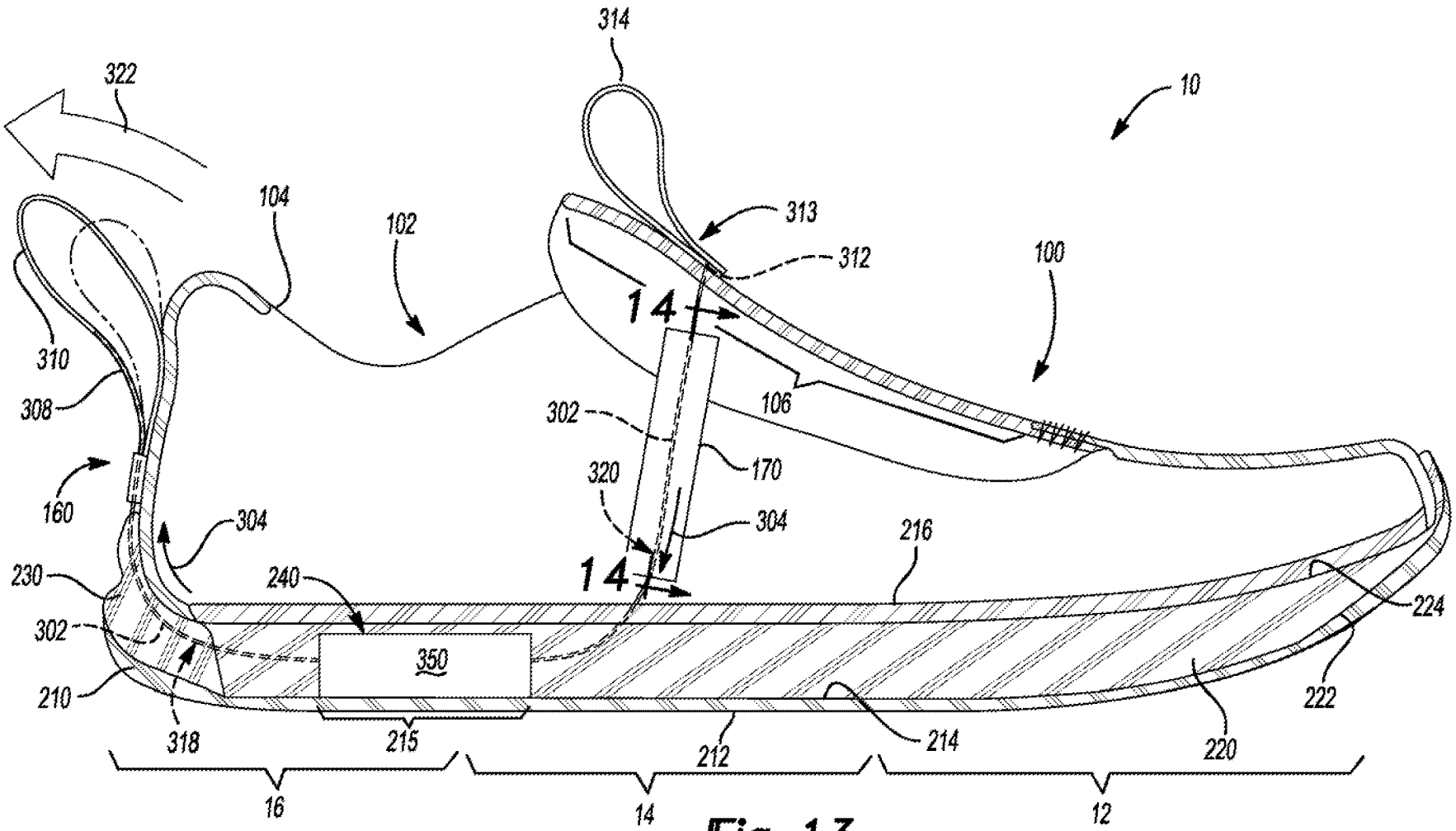
FIG. 13 is a cross-sectional view taken along line 13-13 of FIG. 7 showing first and second conduits receiving respective portions of the tensioning cable when the tensioning cable moves in the tightening direction in response to pulling a tightening grip.
Figure 14:
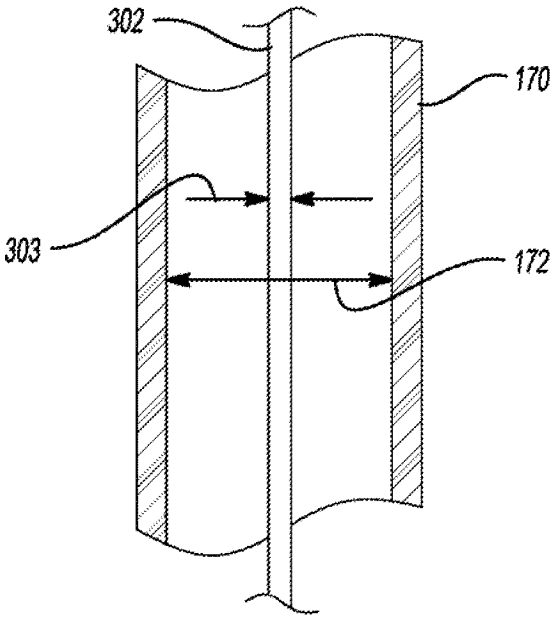
FIG. 14 is a cross-sectional view taken along line 14-14 of FIG. 13 showing the portion of the tensioning cable received by the second conduit being substantially taught when the tensioning cable is moved in the tightening direction.

Referring to FIGS. 7-16, in some implementations, an article of footwear 10*a* includes an upper 100*a*, a sole structure 200 attached to the upper 100*a*, and a tightening mechanism 300 operable to move the upper 100*a* between a tightened state (FIGS. 8 and 13) and a loosened state (FIGS. 10 and 14). In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The sole structure 200 may include the outsole 210 and the midsole 220 arranged in the layered configuration. The outsole 210 includes the inner surface 214 disposed on the opposite side of the outsole 210 than the ground-engaging surface 212, while the midsole 220 includes the bottom surface 222 disposed on the opposite side of the midsole 220 than the footbed 224. The insole 216 or sockliner is received within an interior void 102*a* upon the footbed 224.

The upper 100*a* is formed from the one or more flexible materials to form the interior void 102*a* and the one or more fasteners 106 extending along the upper 100*a* may operably connect to the tensioning mechanism to adjust the fit of the interior void 102*a* around the foot to accommodate entry and removal therefrom. The tightening mechanism 300 includes the tensioning cable 302 extending between the first end 308 operably connected to the tightening grip 310 at one or more corresponding attachment locations 309 and the second end 312 operably connected to the loosening grip 314 at one or more corresponding attachment locations 313, as well as operably connected to the fasteners 106. For example, the second end 312 may be attached to the fasteners 106 in an area proximate to the loosening grip 314 such that when the tensioning cable 302 is placed under tension, a force is applied to the fasteners 106 via the cable 302, thereby causing the fasteners 106 to constrict the upper 100*a* around a foot of a wearer in a similar fashion as described above with respect to the article of footwear 10.

The tensioning cable 302 may include the continuous loop defining the first length 318 disposed between the locking device 350 and the tightening grip 310 and the second length 320 disposed between the locking mechanism 350 and the loosening grip 314. Movement of the tensioning cable 302 in the tightening direction 304 causes the upper 100*a* to move into the tightened state to close the interior void 102*a* around a foot of a user and movement of the tensioning cable 302 in the loosening direction 306 causes the upper 100*a* to move into the loosened state to relax the fit of the interior void 102*a* around a foot of a user. The locking device 350 may be received by the receiving area 215 upon the inner surface 214 of the outsole 210 and may be enclosed within the cavity 240 defined by the bottom surface 222 of the midsole 220 and the inner surface 214 of the outsole. In some examples, the locking device 350 is biased in the locked state to restrict movement of the tensioning cable 302 in both the tightening and loosening directions 306, 304. In other examples, the locking device 350 permits movement of the tensioning cable 302 in only the loosening direction 306. The locking device 350 may include the release mechanism or cord 352 configured to transition the locking device 350 from the locked state to the unlocked state to thereby permit the tensioning cable 302 to move in both directions 304, 306, as described above with respect to the article of footwear 10.

Figure 7:
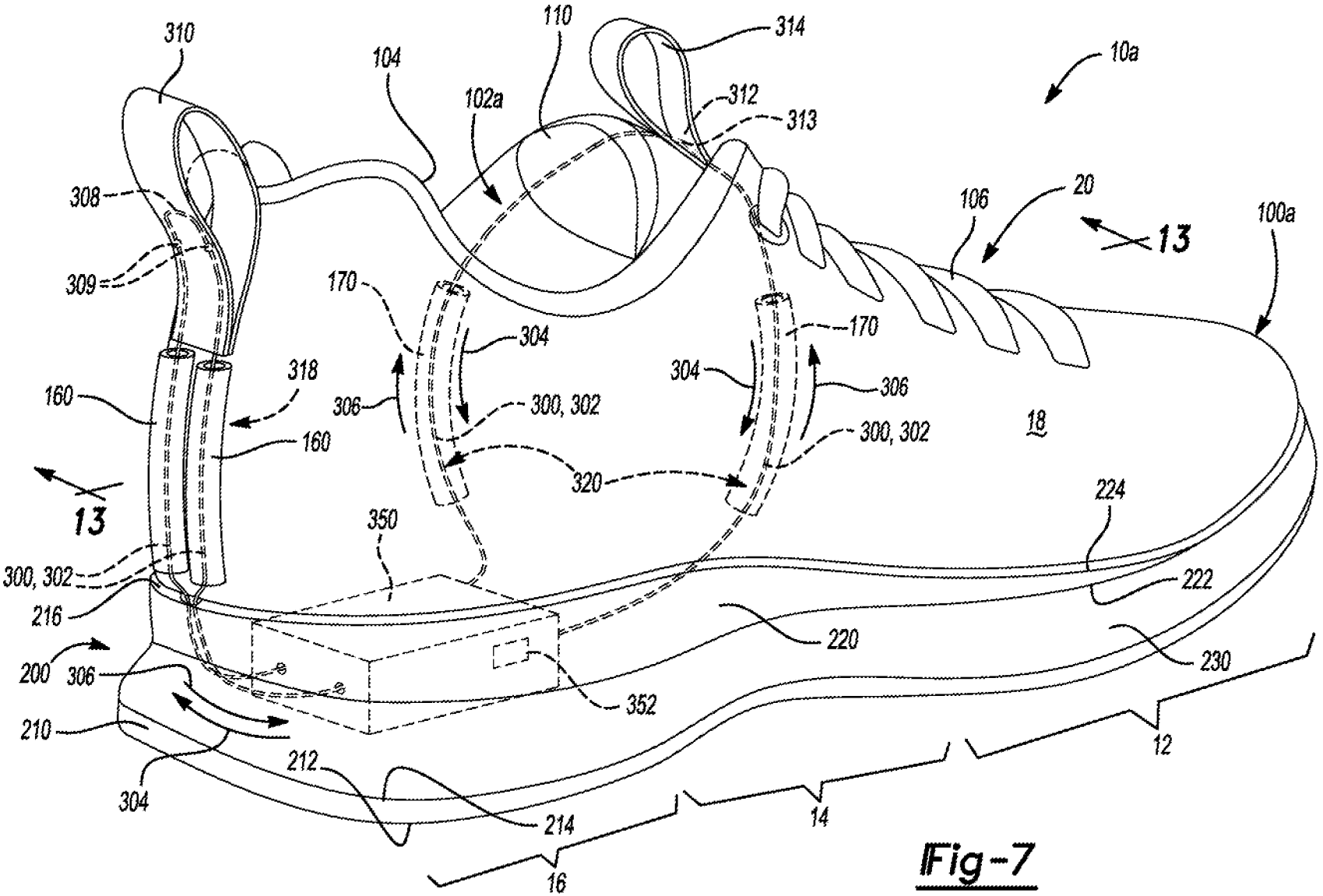
FIG. 7 is a top perspective view of an article of footwear having an upper in a tightened state in accordance with principles of the present disclosure.

In some implementations, a first conduit 160 surrounds a portion of the tensioning cable 302 along the first length 318 when the tensioning cable 302 moves relative the first conduit 160. The first conduit 160 is operable to accommodate bunching by the tensioning cable 302 following movement of the tensioning cable 302 in the tightening direction 304. FIG. 7 shows the footwear 10*a* including a pair of first conduits 160 each receiving a respective portion of the tensioning cable 302 along the first length 318 and disposed upon a heel end of the upper 100. While the example of FIG. 7 includes the pair of first conduits 160 attached to the exterior of the upper 100, other examples can include the first conduits 160 received within a passage formed within the upper 100 to conceal the first conduits 160. The first conduits 160 may be formed from one or more materials that impart properties of flexibility and durability while reducing friction between the tensioning cable 302 and interior surfaces of the first conduits 160 when the tensioning cable 302 moves relative to and within the first conduits 160. In some examples, interior surfaces of the first conduits 160 are coated to reduce friction with the tensioning cable 302.

Additionally or alternatively, a second conduit 170 may surround a portion of the tensioning cable 302 along the second length 320 when the tensioning cable 302 moves relative to the second conduit 170. The second conduit 170 is operable to accommodate bunching by the tensioning cable 302 following movement of the tensioning cable in the loosening direction 306. FIG. 7 also shows the footwear 10*a* as including a pair of second conduits 170 each receiving a respective portion of the tensioning cable 302 along the first length 320. For instance, one of the second conduits 170 extends along the lateral side 18 of the upper 100*a* while the other one of the second conduits 170 extends along the medial side 20 of the upper 100. The second conduits 170 may be concealed within passages formed within the upper 100*a* along respective ones of the lateral side 18 and the medial side 20. Alternatively, at least one of the second conduits 160 may be attached to the exterior of the upper 100*a*. The second conduits 170 may be formed from one or more materials that impart properties of flexibility and durability while reducing friction between the tensioning cable 302 and interior surfaces of the second conduits 170 when the tensioning cable 302 moves relative to the second conduits 170. In some examples, coatings are applied to interior surfaces of the second conduits 170 to reduce friction with tensioning cable 302.

Figure 8:
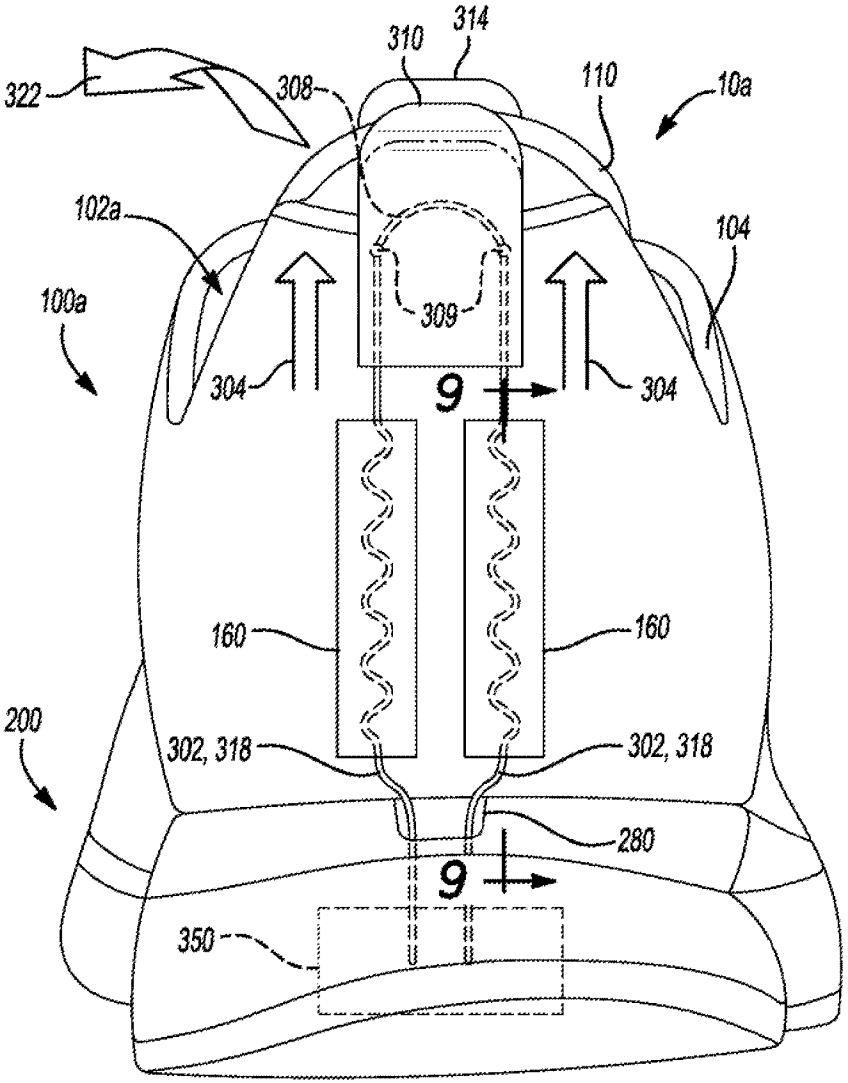
FIG. 8 is a rear view of the article of footwear of FIG. 7 showing first conduits receiving portions of a tensioning cable moving in a tightening direction.

FIG. 8 provides a rear perspective view of the footwear 10*a* of FIG. 7 showing the upper 100*a* transitioning into the tightened state responsive to the pulling force 322 applied to the tightening grip 310. The tensioning cable 302 may extend along the first length 318 through one or more passages formed through the sole structure 200 (e.g., outsole 210 and/or midsole 220) and exit the sole structure 200 through an opening 280 formed therethrough. The pair of first conduits 160 may each surround a respective portion of the tensioning cable 302 along the first length 318. While FIG. 8 shows the first conduits 160 each defining lengths extending along the back heel end of the upper 100*a*, at least one of the first conduits 160 may extend into the sole structure 200 through the opening 280. The tensioning cable 302 may secure to the tightening grip 310 proximate to the first end 308 at two attachment locations 309 by stitching or other suitable securing techniques.

When the locking device 350 is in the unlocked state, or otherwise permits movement of the tensioning cable 302 in the tightening direction 304 while in the locked state, the tensioning cable 302 moves in the tightening direction 304 responsive to applying the pulling force 322 to the tightening grip 310. Movement of the tensioning cable 302 in the tightening direction 304 causes the upper 100 to move to the tightened state for closing the interior void 102*a* around the foot. As with the footwear 10 of FIGS. 1-6 described above, movement of the tensioning cable 302 in the tightening direction 304 causes the first length 318 to increase and the second length 320 to decrease (shown in FIG. 13). The first conduits 160 are each operable to accommodate bunching by the tensioning cable 302 along the first length 318 once the first length 318 is increased (i.e., caused by the tensioning cable 302 moving in the tightening direction 304) once the force applied to the tightening grip 310 is removed. Without the use of the first conduits 160 to accommodate bunching by the tensioning cable 302, increases to the first length 318 could result in the tensioning cable 302 becoming tangled and/or being susceptible to catching on features such that the tensioning cable 302 may be inhibited from responsively and fluently moving in either of the directions 304, 306 when desired.

FIG. 9 provides a partial cross-sectional view taken along line 9-9 of FIG. 8 showing bunching of the tensioning cable 302 accommodated by one of the first conduits 160 following movement of the tensioning cable 302 in the tightening direction 304 to account for the increase in the first length 318 upon removal of the force applied to the tightening grip 310. The first conduit 160 includes an inner diameter 162 that is greater than an outer diameter 303 of the tensioning cable 302 to receive a portion of the tensioning cable 302 along the first length 318 therein and accommodate bunching of the received portion of the tensioning cable 302. Accordingly, the bunched portion of the tensioning cable 302 received by the first conduit 160 is associated with a length greater than a length of the first conduit 160.

Figure 11:
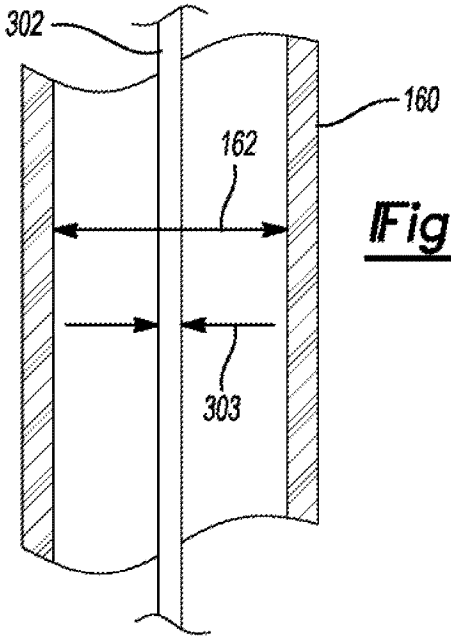
FIG. 11 is a cross-sectional view taken along line 11-11 of FIG. 10 showing the portion of the tensioning cable received by one of the first conduits being substantially taught when the tensioning cable is moved in the loosening direction.

FIG. 10 provides a rear perspective view of the footwear 10*a* of FIG. 7 as the upper 100*a* transitions into the loosened state responsive to the pulling force 324 applied to the loosening grip 310 to move the tensioning cable 304 in the loosening direction 306 while the locking device 350 is in the unlocked state. By contrast to movement of the tensioning cable 302 in the tightening direction 304 to move the footwear 10*a* to the tightened state of FIG. 8, movement of the tensioning cable 302 in the loosening direction 306 causes the upper 100*a* to move to the loosened state for relaxing the fit of the interior void 102*a* around a foot. For instance, FIG. 10 shows the tongue portion 110 of the upper 100*a* moving away from the ankle opening 104 to increase the size of the interior void 102*a* to facilitate removal of a foot from the footwear 10*a*, for example. As with the footwear 10 of FIGS. 1-6 described above, movement of the tensioning cable 302 in the loosening direction 306 causes the first length 318 to decrease as the second length increases 320 (as shown in FIG. 14). As result of the first length 318 decreasing during movement of the tensioning cable 302 in the loosening direction 306, any prior bunching of the tensioning cable 302 accommodated by the first conduits 160 that occurred while the upper 100 was in the tightened state gradually disperses until the corresponding portions of the tensioning cable 302 received by the first conduits 160 are substantially taut. FIG. 11 provides a partial cross-sectional view taken along line 11-11 of FIG. 10 showing the portion of the tensioning cable 302 received by one of the first conduits 160 being substantially taut when the first length 318 decreases by movement of the tensioning cable 302 in the loosening direction 306. FIG. 12 provides a cross-sectional view taken along line 12-12 of FIG. 10 showing the first conduit 160 having the inner diameter 162 that is greater than the outer diameter 303 of the tensioning cable 302 to accommodate bunching by the tensioning cable 302 (FIGS. 8 and 9) as the first length 318 increases following movement of the tensioning cable in the tightening direction 302.

FIG. 13 provides a cross-sectional view taken along line 13-13 of FIG. 7 showing the upper 100*a* transitioning into the tightened state responsive to the pulling force 322 applied to the tightening grip 310. The tensioning cable 302 may extend along the second length 320 through one or more passages formed through the sole structure 200 (e.g., outsole 210 and/or midsole 220) and along the lateral side 18 and the medial side 20 of the upper 100*a*. While FIG. 13 shows the second conduit 170 defining a length extending along the medial side 20 of the upper 100*a*, at least one of the second conduits 170 may extend into the sole structure 200. The tensioning cable 302 may be secured to the loosening grip 314 proximate to the second end 312 at one or more attachment locations 313 by stitching or other suitable securing techniques.

When the locking device 350 is in the unlocked state, or otherwise permits movement of the tensioning cable 302 in the tightening direction 304 while in the locked state, the tensioning cable 302 moves in the tightening direction 304 responsive to applying the pulling force 322 to the tightening grip 310. Movement of the tensioning cable 302 in the tightening direction 304 causes the upper 100*a* to move to the tightened state for closing the interior void 102*a* around the foot. As with the footwear 10 of FIGS. 1-6 described above, movement of the tensioning cable 302 in the tightening direction 304 causes the first length 318 to increase (as shown in FIG. 8) and the second length 320 to decrease. This decrease to the second length 320 results in portions of the tensioning cable 302 along the second length 320 being substantially taut while tensioning the fasteners 106 to move the upper 100*a* into the tightened state.

FIG. 14 provides a partial cross-sectional view taken along line 14-14 of FIG. 13 showing the portion of the tensioning cable 302 received by the one of the second conduits 170 along the medial side 20 of the upper 100*a* being substantially taut when the second length 320 decreases by movement of the tensioning cable 302 in the tightening direction 304. As with the first conduits 160, the second conduits 170 also define an inner diameter 172 that is greater than the outer diameter 303 of the tensioning cable 302 to accommodate bunching by the tensioning cable (FIGS. 15 and 16) when the tensioning cable 302 transitions to movement in the loosening direction 306 to thereby cause the second length 320 to increase.

Figure 15:
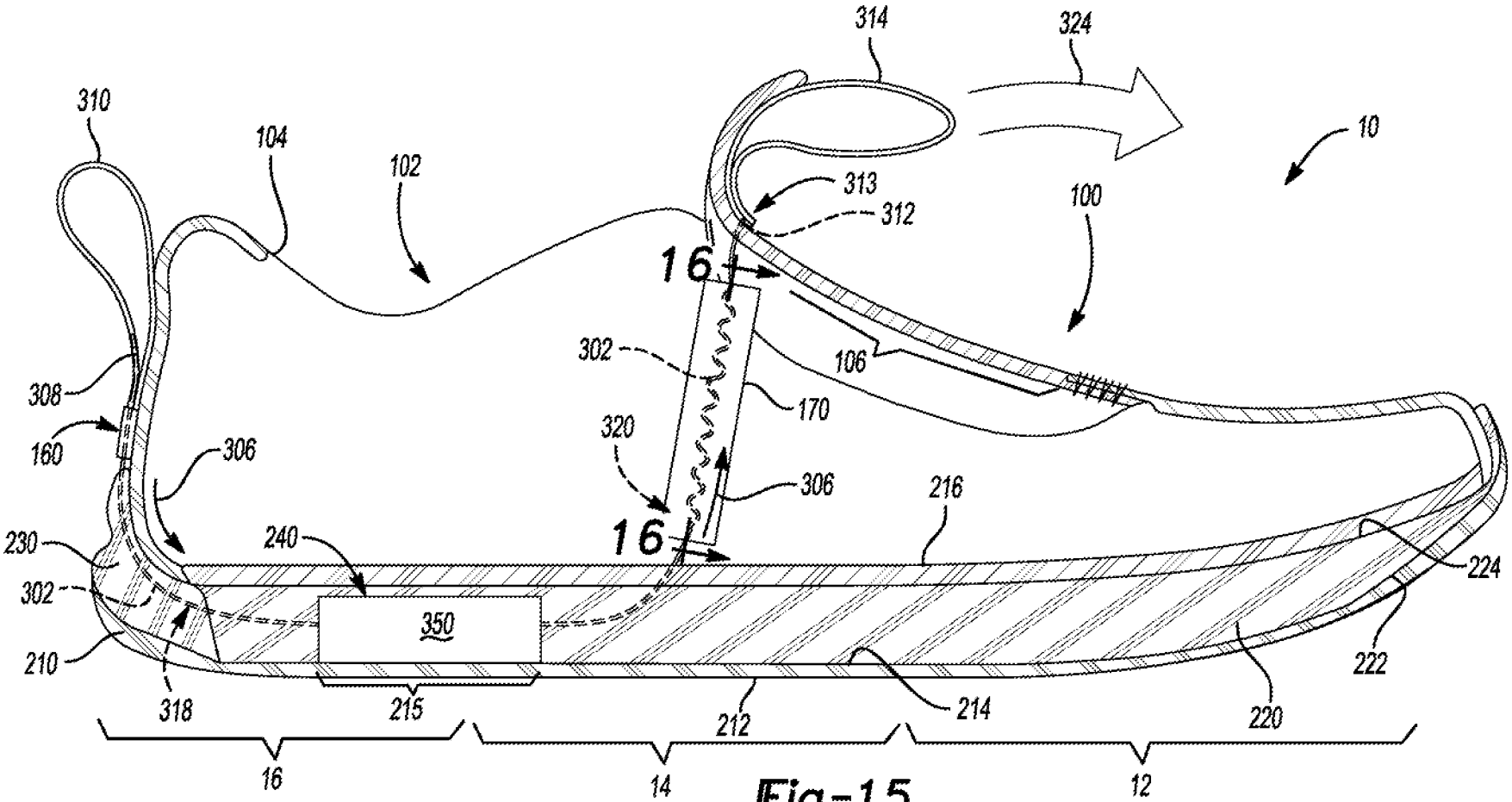
FIG. 15 is an alternate cross-sectional view taken along line 14-14 of FIG. 7 showing first and second conduits receiving respective portions of the tensioning cable when the tensioning cable moves in the loosening direction in response to pulling a loosening grip.

FIG. 15 provides an alternate cross-sectional view taken along line 13-13 of FIG. 7 showing the upper 100*a* transitioning into the loosened state responsive to the pulling force 324 applied to the loosening grip 314. As with the footwear 10 of FIGS. 1-6 described above, movement of the tensioning cable 302 in the loosening direction 306 causes the second length 320 to increase to allow the fasteners 106 to relax and thereby facilitate a transition of the upper 100*a* from the tightened state to loosened state such that a foot can be more easily removed from the interior void 102*a*. The second conduits 170 are each operable to accommodate bunching by the tensioning cable 302 along the second length 320 as the second length 320 increases following movement of the tensioning cable 302 in the loosening direction 306 and removal of the release force applied to the loosening grip 314. Without the use of the second conduits 170 to accommodate bunching by the tensioning cable 302, increases to the second length 320 can result in the tensioning cable 302 becoming tangled and/or being susceptible to catching on features of the footwear 10*a* such that the tensioning cable 302 may be inhibited from responsively and fluently moving in either of the directions 304, 306 when desired.

Figure 16:
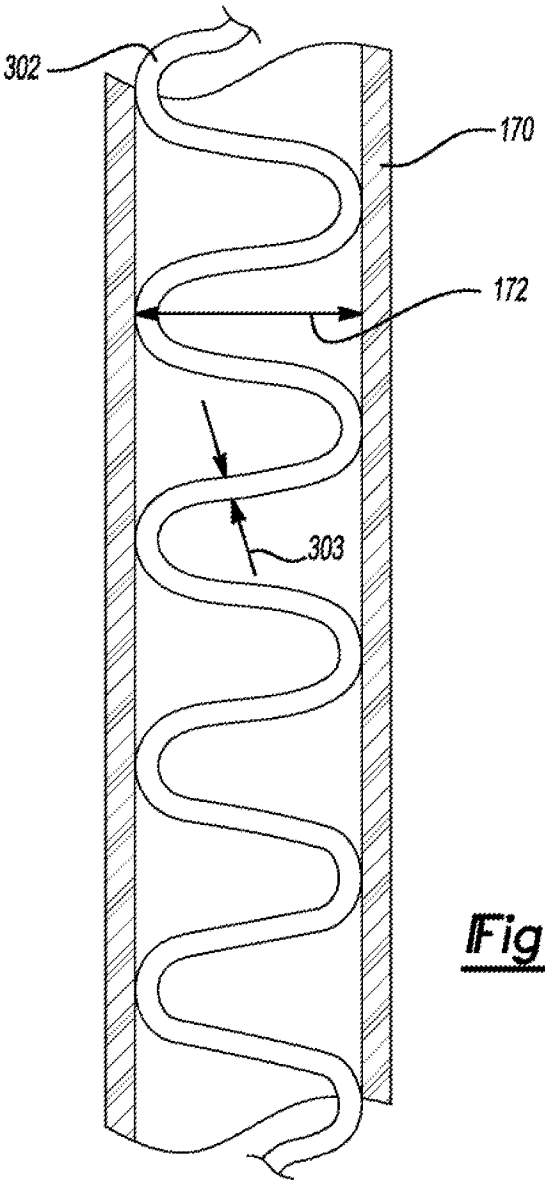
FIG. 16 is a cross-sectional view taken along line 16-16 of FIG. 15 showing the second conduit accommodating bunching by the tensioning cable when the tensioning cable is moved in the loosening direction.

FIG. 16 provides a partial cross-sectional view taken along line 16-16 of FIG. 15 showing the bunching of the tensioning cable 302 accommodated by one of the second conduits 170 along the medial side 20 of the upper 100*a* following movement of the tensioning cable 302 in the loosening direction 306 (i.e., after the second length 320 is increased and the force applied to the loosening grip 314 is removed). The second conduit 170 includes the inner diameter 172 greater than the outer diameter 303 of the tensioning cable 302 to receive a portion of the tensioning cable 302 along the second length 320 therein and accommodate bunching of the received portion of the tensioning cable 302. Accordingly, the bunched portion of the tensioning cable 302 received by the second conduit 170 is associated with a length greater than a length of the first conduit 170.

Figure 20:
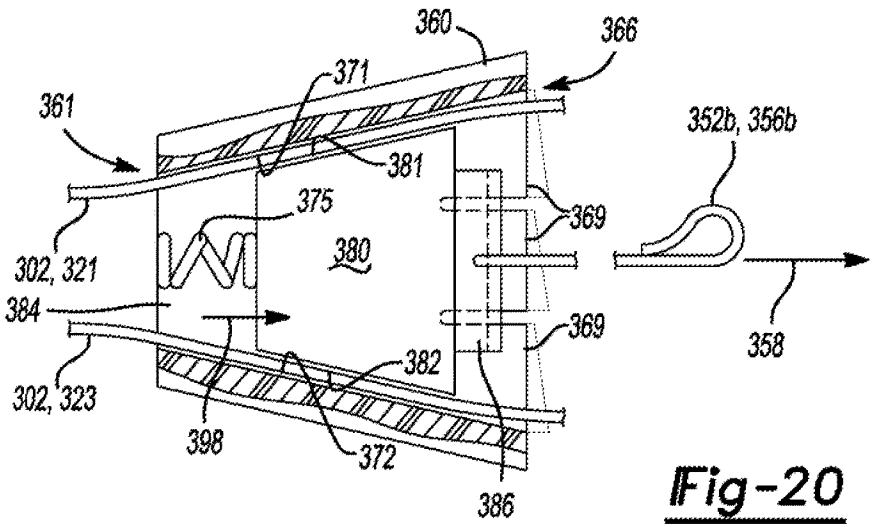
FIG. 20 is a partial top sectional view of the locking device of FIG. 17 showing a housing having a portion removed to expose a locking member slidably disposed within the housing when the locking member is in an unlocked position.
Figure 21:
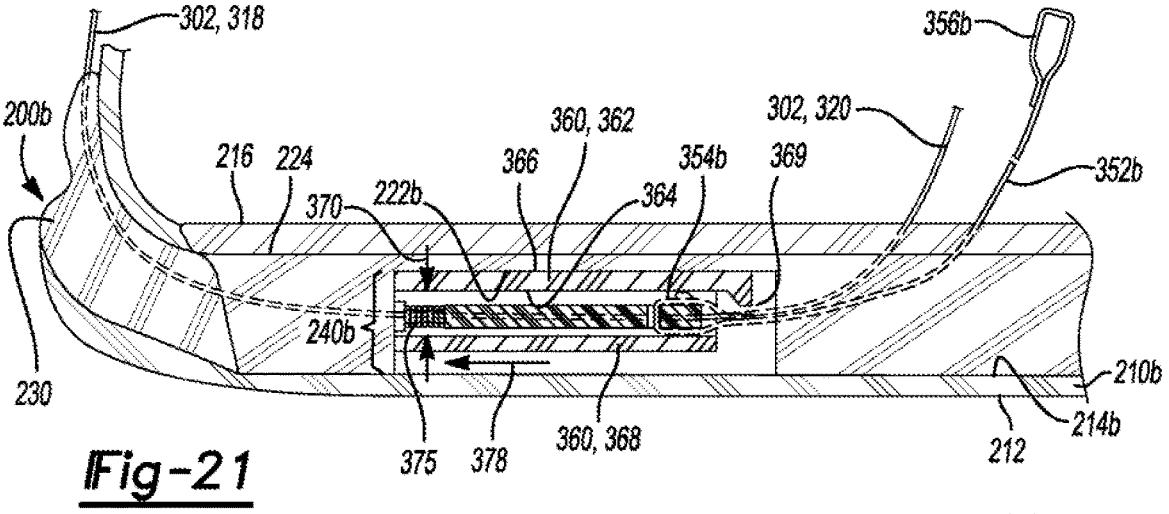
FIG. 21 is a partial cross-sectional view taken along line 21-21 of FIG. 17 showing the locking device disposed between an outsole and a midsole when the locking device is biased is the locked state.
Figure 22:
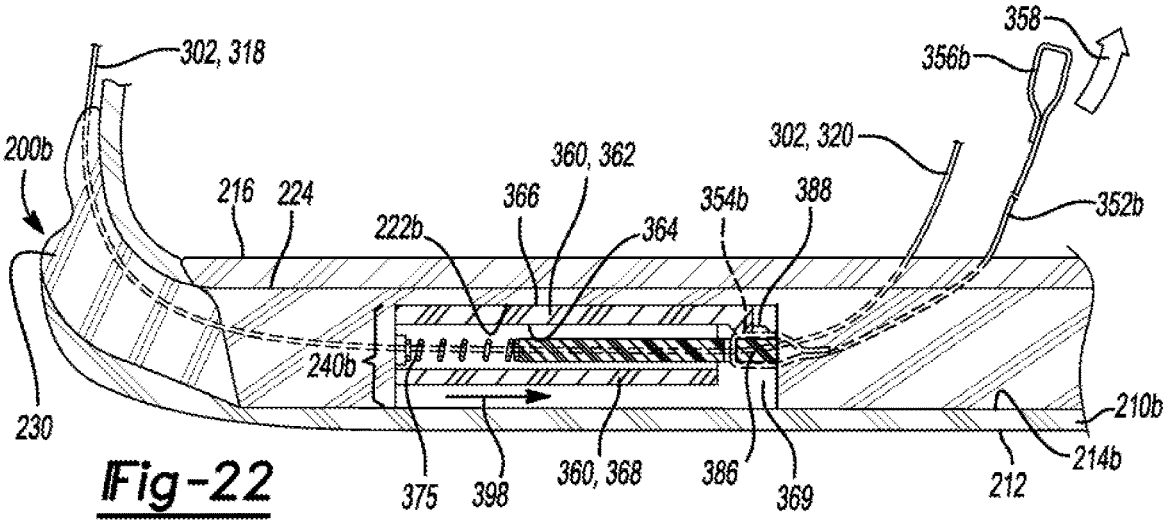
FIG. 22 is a partial cross-sectional view taken along line 21-21 of FIG. 17 showing the locking device disposed between an outsole and a midsole when the locking device is in the unlocked state.

Referring to FIGS. 17-23, in some implementations, an article of footwear 10*b* includes an upper 100*b*, a sole structure 200*b* attached to the upper 100*b*, and a tightening mechanism 300 operable to move the upper 100*b* between a tightened state (FIG. 21) and a loosened state (FIG. 22). In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

The sole structure 200*b* may include an outsole 210*b* and a midsole 220*b* arranged in a layered configuration. The outsole 210*b* includes an inner surface 214*b* disposed on the opposite side of the outsole 210*b* than the ground-engaging surface 212, while the midsole 220*b* includes a bottom surface 222*b* disposed on the opposite side of the midsole 220*b* than the footbed 224. The insole 216 or sockliner is received within an interior void 102*b* upon the footbed 224.

The upper 100*b* may be formed from the flexible material forming the upper 100 of FIGS. 1-6 to form the interior void 102*b* and to transition between a tightened state and a loosened state for adjusting the fit of the interior void 102*b* around the foot. The fasteners 106 extending along the upper 100*b* may operably connect to the tensioning mechanism 300 for automatically moving the upper 100*b* between the tightened state and the loosened state to accommodate entry and removal from the footwear 10*b*. The tightening mechanism 300 includes the tensioning cable 302 extending between the first end 308 operably connected to the tightening grip 310 at one or more corresponding attachment locations 309 and the second end 312 operably connected to the loosening grip 314 at one or more corresponding attachment locations 313. For example, the second end 312 may be attached to the fasteners 106 in an area proximate to the loosening grip 314 such that when the tensioning cable 302 is placed under tension, a force is applied to the fasteners 106 via the cable 302, thereby causing the fasteners 106 to constrict the upper 100*b* around a foot of a wearer in a similar fashion as described above with respect to the article of footwear 10.

The tensioning cable 302 may include the continuous loop defining the first length 318 disposed between a locking device or cable lock 350*b* and the tightening grip 310 and the second length 320 disposed between the locking mechanism 350*b* and the loosening grip 314. Movement of the tensioning cable 302 in the tightening direction 304 causes the upper 100*b* to move into the tightened state to close the interior void 102*b* around a foot of a user and movement of the tensioning cable 302 in the loosening direction 306 causes the upper 100*b* to move into the loosened state to relax the fit of the interior void 102*b* around a foot of a user.

In some implementations, the footwear 10*b* includes at least one of the first conduits 160 and/or at least one of the second conduits 170 of FIGS. 7-16 each configured to receive and surround portions of the tensioning cable 302 along respective ones of the first length 318 and the second length 320 when the tensioning cable 302 moves relative to the conduits 160, 170. As shown in FIG. 9, the first conduit 160 is configured to accommodate bunching by the tensioning cable 302 along the first length 318 that increases when the tensioning cable 302 is moved in the tightening direction 304, while FIG. 14 shows the portion of tensioning cable 302 received by the second conduit 170 being substantially taut along the second length 320 that simultaneously decreases during movement by the tensioning cable 302 in the tightening direction 304. Conversely, when movement of the tensioning cable 302 in the loosening direction 304 causes the first length 318 to decrease and the second length 320 to increase, FIG. 11 shows the portion of the tensioning cable 302 received by the first conduit 160 being substantially taught along the decreasing first length 318 and FIG. 16 shows the second conduit 170 accommodating bunching by the tensioning cable 302 along the increasing second length 320. As described above with reference to the footwear 10*a* of FIGS. 7-16, the conduits 160, 170 may each define a respective inner diameter 162, 172 that is greater than the outer diameter 303 of the tensioning cable 302 to accommodate the bunching by the tensioning cable 302 following movement by the tensioning cable 302 in respective ones of the tightening direction 304 and the loosening direction 306. Moreover, the conduits 160, 170 may be formed from the one or more materials that impart properties of flexibility and durability while reducing friction between the tensioning cable 302 and the respective interior surfaces of the conduits 160, 170 during relative movement by the tensioning cable 302. In some examples, interior surfaces of at least one of the conduits 160, 170 are coated to reduce friction with the tensioning cable 302.

Figure 17:
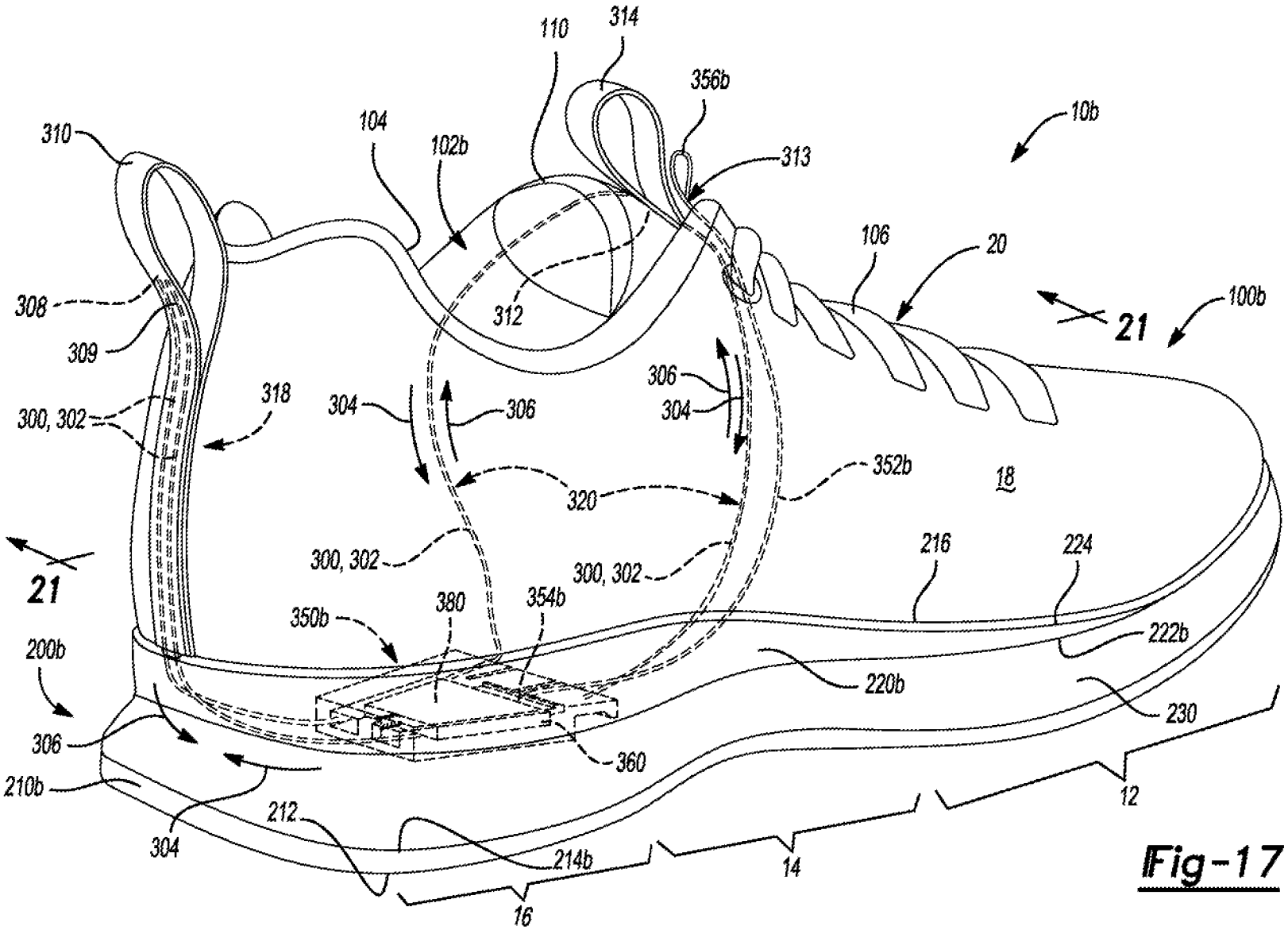
FIG. 17 is a top perspective view of an article of footwear having a locking device movable between a locked state to restrict movement of a tensioning cable and an unlocked state to permit movement of the tensioning cable in accordance with principles of the present disclosure.

The locking device 350*b* may be disposed between the outsole 210*b* and the midsole 220*b* of the footwear 10*b* and may be biased in a locked state to restrict movement of the tensioning cable 302 in at least the loosening direction 306. A release mechanism 352*b* may transition the locking device 350*b* from the locked state to the unlocked state to thereby permit the tensioning cable 302 to move in both directions 304, 306. For instance, the release mechanism 352*b* may include a release cord or cable 352*b* operable to transition the locking device 350*b* from the locked state to the unlocked state when the release cord 352*b* is pulled. The release cord 352*b* may extend through passages formed by the upper 100*b* from a first end 354*b* attached to the locking device 350*b* to a second end 356*b* exposed from the upper 100*b* to permit a user to grip and pull the release cord 352*b* for moving the locking device 350*b* from the locked state to the unlocked state. In some examples, the second end 356*b* of the release cord 352*b* includes a loop and/or gripping feature located remotely from the locking device 350*b* to allow a user to grip and pull the release cord 352*b* when it is desirable to move the locking device 350*b* into the unlocked state and/or release the locking device 350*b* from the unlocked state. FIG. 17 shows the second end 356*b* of the release cord 352*b* located proximate to the loosening grip 314 such that the pulling force 324 can be subsequently applied to the loosening grip 314 once the release cord 352*b* moves the locking device 350*b* to the unlocked state. In other examples, the second end 356*b* of the release cord 352*b* can be disposed proximate to other regions of the footwear 10*b* such as at or near the ankle opening 104, the tightening grip 310, the lateral side 18, or the medial side 20 of the upper 100*b*, or the sole structure 200*b*.

Figure 18:
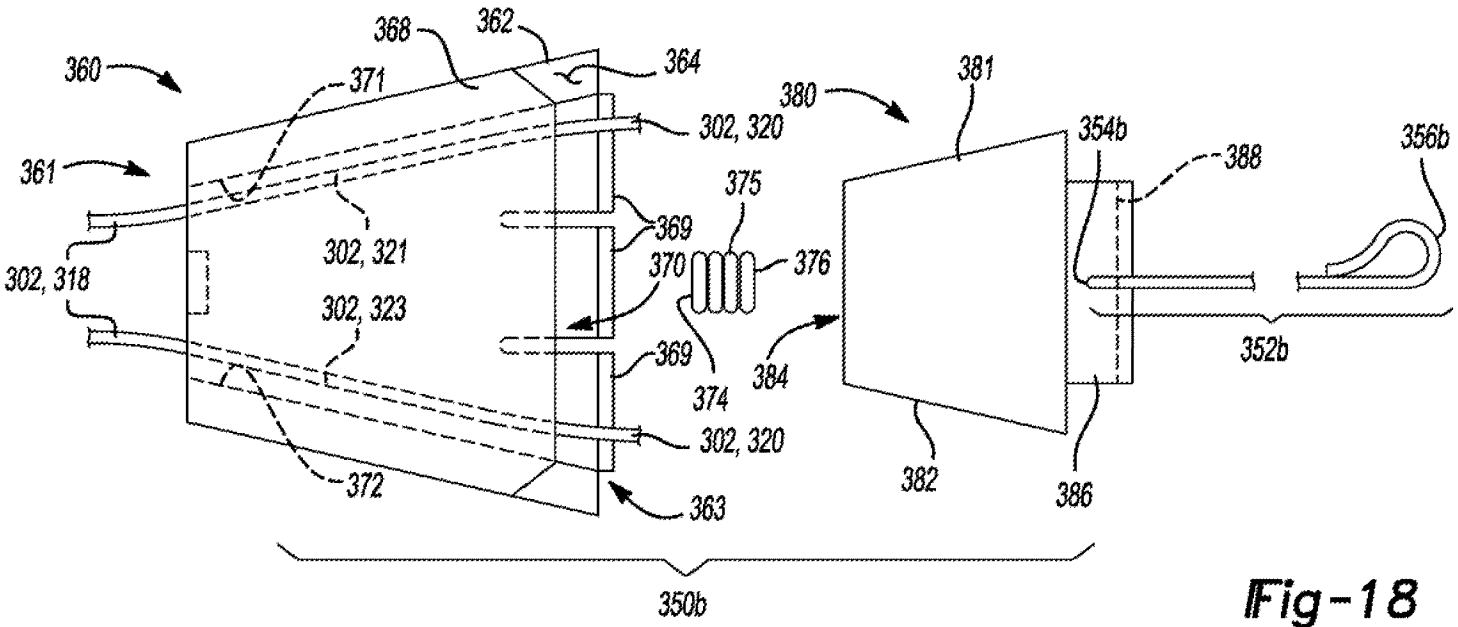
FIG. 18 is an exploded view of the locking device of FIG. 17 showing a housing and a locking member of the locking device.

In some implementations, the locking device 350*b* includes a housing 360 and a locking member or lock member 380 slidably disposed within the housing 360. FIG. 18 provides an exploded view of the locking device 350*b* of FIG. 17 showing the locking member 380 removed from the housing 360. The housing 360 defines a length extending between a first end 361 opposing the heel end of the footwear 10*b* and a second end 363 opposing the toe end of the footwear 10*b* when housing 360 is disposed within the cavity 240*b* of the sole structure 200*b*. The housing 360 includes a base portion 362 having a cable-receiving surface 364 and a sole-engaging surface 366 (FIGS. 21-23) disposed on an opposite side of the base portion 362 than the cable-receiving surface 364 and opposing the bottom surface 222*b* of the midsole 220*b* or the insole 216. The housing 360 also includes a cover portion 368 opposing the cable-receiving surface 364 of the base portion 362 to define a locking member cavity 370 therebetween that is configured to receive the locking member 380 and the tensioning cable 302. In some configurations, the locking member cavity 370 is bounded by a first engagement surface 371 and a second engagement surface 372 that converge toward one another such that the locking member cavity 370 is associated with a wedge-shaped configuration tapering toward the first end 361 of the housing 360. Accordingly, the first engagement surface 371 and the second engagement surface 372 include corresponding sidewalls of the housing 360 converging toward one another and extending between the cover portion 368 portion and the cable-receiving surface 364 of the base portion 362 to define the locking member cavity 370.

The continuous loop tensioning cable 302 extends thru the locking member cavity 370 and includes a first portion 321 extending along the first engagement or lock surface 371 and a second portion 323 extending along the second engagement or lock surface 372. The tensioning cable 302 (e.g., first portion 321 and second portion 323) exits out the first end 361 of the housing 360 to define the first length 318 between the locking device 350*b* and the tightening grip 310, and exits out the second end 363 of the housing 360 to define the second length 320 between the locking device 350*b* and the loosening grip 314.

In some implementations, the locking member 380 includes a first lock surface 381 opposing the first engagement surface 371 of the housing 360 and a second lock surface 382 opposing the second engagement surface 372 of the housing 360 when the locking member 380 is disposed within the locking member cavity 370 of the housing 360. In some examples, the first lock surface 381 and the second lock surface 382 converge toward one another. Additionally or alternatively, the first lock surface 381 may be substantially parallel to the first engagement surface 371 and the second lock surface 382 may be substantially parallel to the second engagement surface 372. A biasing member 375 (e.g., a spring) may include a first end 374 attached to the housing 360 and a second end 376 attached to a first end 384 of the locking member 380 to attach the locking member 380 to the housing 360.

Figure 19:
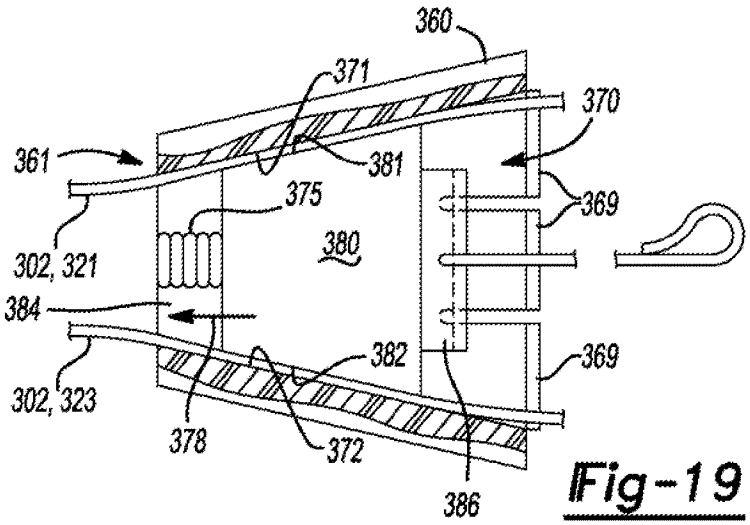
FIG. 19 is a partial top sectional view of the locking device of FIG. 17 showing a housing having a portion removed to expose a locking member slidably disposed within the housing when the locking member is in a locked position.

In some implementations, the locking member 380 is slidably disposed within the housing 360 and is movable between a locked position (FIG. 19) associated with the locked state of the locking device 350*b* and an unlocked position (FIG. 20) associated with the unlocked state of the locking device 350*b*. In some examples, the release mechanism 352 (e.g., release cord 352*b*) is operable to move the locking member 380 from the locked position (FIG. 19) to the unlocked position (FIG. 20). In some configurations, the locking member 380 includes a tab portion 386 extending from an opposite end of the locking member 380 than the first end 384. As shown in FIG. 19, the first end 354*b* of the release cord 352*b* may be attached to the tab portion 386 of the locking member 380. The tab portion 386 may include a retention feature 388 operable to engage one or more retention features 369 associated with the housing 360 to maintain the locking device 350*b* in the unlocked state and may be disposed on an opposite end of the locking member 390 than the biasing member 375, as will be described in detail below.

FIG. 19 provides a partial cross-sectional view of the locking device 350*b* of FIG. 17 with the cover portion 368 of the housing 360 removed to show the locking member 380 disposed within the locking member cavity 370 of the housing 360 while in the locked position. In some examples, the locking member 380 is biased into the locked position. For instance, FIG. 19 shows the biasing member 375 exerting a biasing force (represented in a direction 378) upon the locking member 380 to urge the first end 384 of the locking member 380 toward the first end 361 of the housing 360, and thereby bias the locking member 380 into the locked position. While in the locked position, the locking member 380 restricts movement of the tensioning cable 302 relative to the housing 360 by pinching the first portion 321 of the tensioning cable 302 between the first lock surface 381 and the first engagement surface 371 and pinching the second portion 323 of the tensioning cable 302 between the second lock surface 382 and the second engagement surface 372. Accordingly, the locked position of the locking member 380 restricts the tensioning cable 302 from moving in the loosening direction 306 when the pulling force 358 is applied to the loosening grip 314. The locking member 380 permits movement of the tensioning cable 302 when the pulling force 324 is applied to the tightening grip 322, as this direction causes the tensioning cable 302 to apply a force on the locking member 380 due to the generally wedge shape of the locking member 380, thereby moving the locking member 380 into the unlocked state. The locking member 380 automatically returns to the locked state once the force applied to the tightening grip 322 is released due to the forces imparted on the locking member 380 by the biasing member 375.

FIG. 20 provides a partial cross-sectional view of the locking device 350*b* of FIG. 17 with the cover portion 368 of the housing 360 removed to show the locking member 380 disposed within the locking member cavity 370 of the housing 360 while in the unlocked position. In some examples, the release cord 352*b* attached to the tab portion 386 of the locking member 380 is operable to apply a release force 398 of a predetermined magnitude upon the locking member 380 to move the locking member 380 away from the first engagement surface 371 and the second engagement surface 372 relative to the housing 360. Here, the release force 398 is sufficient to overcome the biasing force 378 of the biasing member 375 to permit the locking member 380 to move relative to the housing 360 such that the pinching upon the first portion 321 of the tensioning cable 302 between the first lock surface 381 and the first engagement surface 371 and the pinching upon the second portion 323 of the tensioning cable 302 between the second lock surface 382 and the second engagement surface 372 is released. In some examples, the biasing force 378 causes the locking member 380 to transition back to the locked position when the release force 398 applied by the release cord 352*b* is released. The release cord 352*b* may apply the release force 398 when a pulling force 358 of sufficient magnitude is applied to pull the release cord 352*b* away from the upper 100*b* relative to the view of FIG. 17. For example, a user may grasp the second end 356*b* of the release cord 352*b* and apply the pulling force 358 to transition the locking member 380 from the locked position to the unlocked position. In one configuration, the release cord 352*b* is attached to the locking member 380 at an opposite end than the biasing member 375, as shown in FIG. 19.

While in the unlocked position, the locking member 380 permits movement of the tensioning cable 302 relative to the housing 360 by allowing the first portion 321 of the tensioning cable 302 to freely move between the first lock surface 381 and the first engagement surface 371 and allowing the second portion 323 of the tensioning cable 302 to freely move between the second lock surface 382 and the second engagement surface 382. In contrast to the locked position of locking member 380 of FIG. 19 restricting movement of the tensioning cable 302, the unlocked position of the locking member 380 permits movement of the tensioning cable 302 in both the tightening direction 304 and the loosening direction 306 when the pulling forces 322, 324 are applied to respective ones of the tightening grip 322 and the loosening grip 324. As with the footwear 10 of FIGS. 1-6 described above, movement of the tensioning cable 302 in the tightening direction 304 causes the second length 320 of the tensioning cable 302 to decrease to tension the fasteners 106 and thereby move the upper 100*b* into the tightened state for closing the interior void 102*b* around the foot; while movement of the tensioning cable 302 in the loosening direction 306 causes the second length 320 to increase to allow the fasteners 106 to relax and thereby facilitate a transition of the upper 100*b* from the tightened state to the loosened state such that the foot can be removed from the interior void 102*b*.

FIG. 21 provides a partial cross-sectional view taken along line 21-21 of FIG. 17 showing the locking device 350*b* in the locked state to restrict movement of the tensioning cable 302 in the loosening direction 306. The locking device 350*b* is disposed within the cavity 240*b* defined by the bottom surface 222*b* of the midsole 220*b* and the inner surface 214*b* of the outsole 210*b*. More particularly, the bottom surface 366 of the base portion 362 of the housing 360 is in opposed contact with the bottom surface 222*b* of the midsole 220*b*. In other examples, the midsole 220*b* may include a hollow region between the footbed 224 and the bottom surface 222*b* to define the cavity 240*b* for receiving the locking device 350*b*. The example shows the locking member 380 biased into the locked position by the biasing force 378 applied by the biasing member 375.

FIG. 22 provides an alternative partial cross-sectional view taken along line 21-21 of FIG. 17 showing the locking device 350*b* in the unlocked state to permit movement of the tensioning cable 302 in both the tightening direction 304 and the loosening direction 306. The locking member 380 may transition from the locked position of FIG. 21 to the unlocked position of FIG. 22 when the release mechanism 352 (e.g., release cord 352*b*) applies the release force 378 upon the locking member 380 to overcome the biasing force 378, and thereby cause the locking member 380 to move in a direction (e.g., toward the toe end of the footwear relative to the view of FIG. 22) away from the first engagement surface 371 and the second engagement surface 372 relative to the housing 360.

The release cord 352*b* may apply the release force 398 responsive to a pulling force 358 applied to the release cord 352*b* at the second end 356 to pull the release cord 352*b* away from the upper 100*b* relative to the view of FIG. 17. In some examples, the release cord 352*b* is leveraged by the retention feature 369 of the housing 360 when the pulling force 358 is applied. The leveraging provided by the retention feature 369 advantageously permits the release cord 352*b* to apply the release force 398 upon the locking member in a direction opposite to the direction of the biasing force 378 such that the locking member 380 moves away from the engagement surfaces 371, 372 relative to the housing 360. Accordingly, the release cord 352*b* can be pulled over a wide range of directions from the upper 100 to transition the locking member 380 from the locked position to the unlocked position.

In some examples, at least one of the retention features 369 of the housing 360 engages the retention feature 388 of the locking member 380 when release force 390 moves the locking member 380 a predetermined distance away from the first engagement surface 371 and the second engagement surface 372 of the housing 360. Here, the engagement between the retention feature 388 of the locking member 380 and the at least one retention feature 369 of the housing is operable to maintain the locking member 380 in the unlocked position once the release force 390 is released. The biasing force 378 of the biasing member 375 may pull the retention feature 388 of the locking member 380 into engagement with the retention feature 369 of the housing 360 after the locking member 380 moves the predetermined distance and the release force 398 is no longer applied.

In some scenarios, a pulling force 358 associated with a first magnitude may be applied to the release cord 352*b* to move the locking member 380 away from the engagement surfaces 371, 372 by a distance less than the predetermined distance such that the retention features 388, 369 do not engage. In these scenarios, the pulling force 358 associated with the first magnitude can be maintained when it is desirable to move the tensioning cable 302 in the loosening direction 306 (e.g., by applying the pulling force 324 to the loosening grip 314) or the tightening direction 304 (e.g., by applying the pulling force 322 to the tightening grip 310) for adjusting the fit of the interior void 102*b* around the foot. Once the desired fit of the interior void 102*b* around the foot is achieved, the pulling force 358 can be released to cause the locking member 380 to transition back to the locked position so that movement of the tensioning cable 302 is restricted and the desired fit can be sustained. In other scenarios, a pulling force 358 associated with a second magnitude greater than the first magnitude can be applied to the release cord 352*b* to move the locking member 380 by the predetermined distance away from the engagement surfaces 371, 372 to cause the corresponding retention features 369, 388 to engage. In these scenarios, engagement between the corresponding retention features 369, 388 is operable to maintain the locking member in the unlocked position when the pulling force 358 is released.

Figure 23:
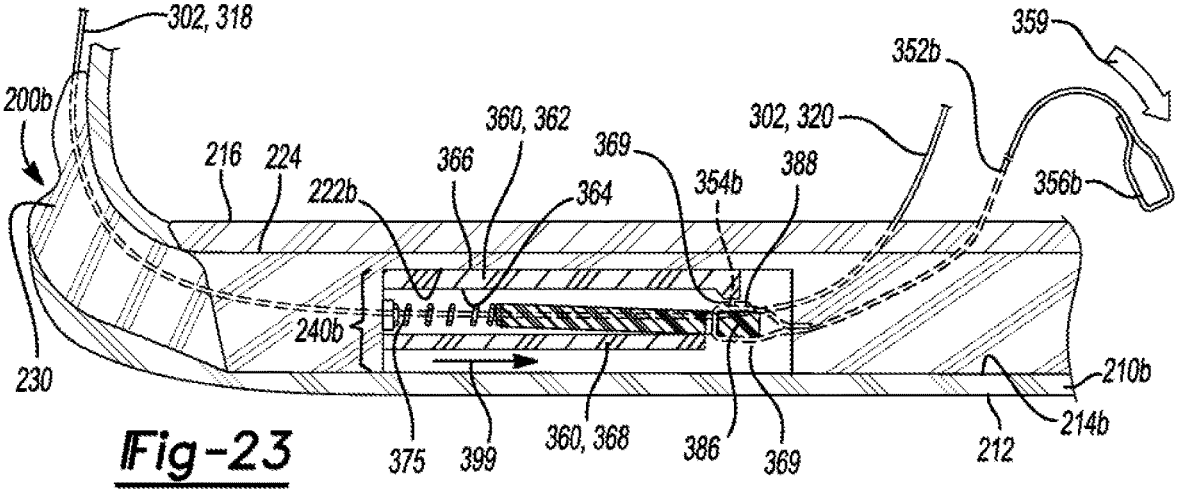
FIG. 23 is a partial cross-sectional view taken along line 21-21 of FIG. 17 showing the locking device disposed between an outsole and a midsole and a release mechanism operable to transition the locking device from the locked state to the unlocked state when a force is applied to the release mechanism.

FIG. 23 provides an alternative partial cross-sectional view taken along line 21-21 of FIG. 17 showing retention feature 388 of the locking member 380 disengaging from the retention feature 369 of the housing 360 to release the locking member 380 from the unlocked position and thereafter move to the locked position. A directional pulling force 359 may be applied to the release cord 352*b* to cause the locking member 380 to move in a direction away from the base portion 362 of the housing 360, and thereby cause the corresponding retention features 369, 388 to disengage. In some examples, the base portion 362 of the housing 360 is at a fixed position relative to the sole structure 200*b* and the tab portion 386 of the locking member 380 interacts with the base portion 362 responsive to the directional pulling force 359 applied to the release cord 352*b*. The interaction between the tab portion 386 and the base portion 362 of the housing 360 may cause the tab portion 386 to flex relative to the locking member 380 and move from a rest state to a flexed state to permit the retention feature 388 disposed on the tab portion 386 to move away and dislodge from the retention feature 369 associated with the housing 360 such that biasing force 378 can slidably move the locking member 380 relative to the housing 360 and into the locked position when the directional pulling force 359 is released.

Referring to FIGS. 24-28, in some implementations, an article of footwear 10*c* includes an upper 100*c*, a sole structure 200*c* attached to the upper 100*c*, and a tightening mechanism 300 operable to move the upper 100*c* between a tightened state and a loosened state. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

The sole structure 200*c* may include an outsole 210*c* and a midsole 220*c* arranged in a layered configuration. The outsole 210*c* includes an inner surface 214*c* disposed on the opposite side of the outsole 210*c* than the ground-engaging surface 212, while the midsole 220*c* includes a bottom surface 222*c* disposed on the opposite side of the midsole 220*c* than the footbed 224. The insole 216 or sockliner is received within an interior void 102*c* upon the footbed 224.

The upper 100*c* may be formed from the flexible material forming the upper 100 of FIGS. 1-6 to form the interior void 102*c* and to transition between a tightened state and a loosened state for adjusting the fit of the interior void 102*c* around the foot. The fasteners 106 extending along the upper 100*c* may operably connect to the tensioning mechanism 300 for automatically moving the upper 100*c* between the tightened state and the loosened state to accommodate entry and removal from the footwear 10*c*. The tightening mechanism 300 includes the tensioning cable 302 extending between the first end 308 operably connected to the tightening grip 310 at one or more corresponding attachment locations 309 and the second end 312 operably connected to the loosening grip 314 at one or more corresponding attachment locations 313. In addition, the second end 312 may be attached to the fasteners 106 in an area proximate to the loosening grip 314 such that when the tensioning cable 302 is placed under tension, a force is applied to the fasteners 106 via the cable 302, thereby causing the fasteners 106 to constrict the upper 100*c* around a foot of a wearer. The tensioning cable 302 may include the continuous loop defining the first length 318 between a locking device 350*c* and the tightening grip 310 and the second length 320 between the locking mechanism 350*c* and the loosening grip 314. Movement of the tensioning cable 302 in the tightening direction 304 causes the upper 100*c* to move into the tightened state to close the interior void 102*c* around the foot and movement of the tensioning cable 302 in the loosening direction 306 causes the upper 100*c* to move into the loosened state to relax the fit of the interior void 102*c* around the foot.

In some implementations, the footwear 10*c* includes at least one of the first conduits 160 and/or at least one of the second conduits 170 of FIGS. 7-16 each configured to receive and surround portions of the tensioning cable 302 along respective ones of the first length 318 and the second length 320 when the tensioning cable 302 moves relative to the conduits 160, 170. As shown in FIG. 9, the first conduit 160 is configured to accommodate bunching by the tensioning cable 302 along the first length 318 that increases following movement of the tensioning cable 302 in the tightening direction 304, while FIG. 14 shows the portion of tensioning cable 302 received by the second conduit 170 being substantially taut along the second length 320 that simultaneously decreases during movement by the tensioning cable 302 in the tightening direction 304. Conversely, when movement of the tensioning cable 302 in the loosening direction 304 causes the first length 318 to decrease and the second length 320 to increase, FIG. 11 shows the portion of the tensioning cable 302 received by the first conduit 160 being substantially taught along the decreasing first length 318 and FIG. 16 shows the second conduit 170 accommodating bunching by the tensioning cable 302 along the increasing second length 320. As described above with reference to the footwear 10*a* of FIGS. 7-16, the conduits 160, 170 may each define a respective inner diameter 162, 372 that is greater than the outer diameter 303 of the tensioning cable 302 to accommodate the bunching by the tensioning cable 302 during relative movement by the tensioning cable 302 in respective ones of the tightening direction 304 and the loosening direction 306. Moreover, the conduits 160, 170 may be formed from the one or more materials that impart properties of flexibility and durability while reducing friction between the tensioning cable 302 and the respective interior surfaces of the conduits 160, 170 during relative movement by the tensioning cable 302. In some examples, interior surfaces of at least one of the conduits 160, 170 are coated to reduce friction with the tensioning cable 302.

Figure 24:
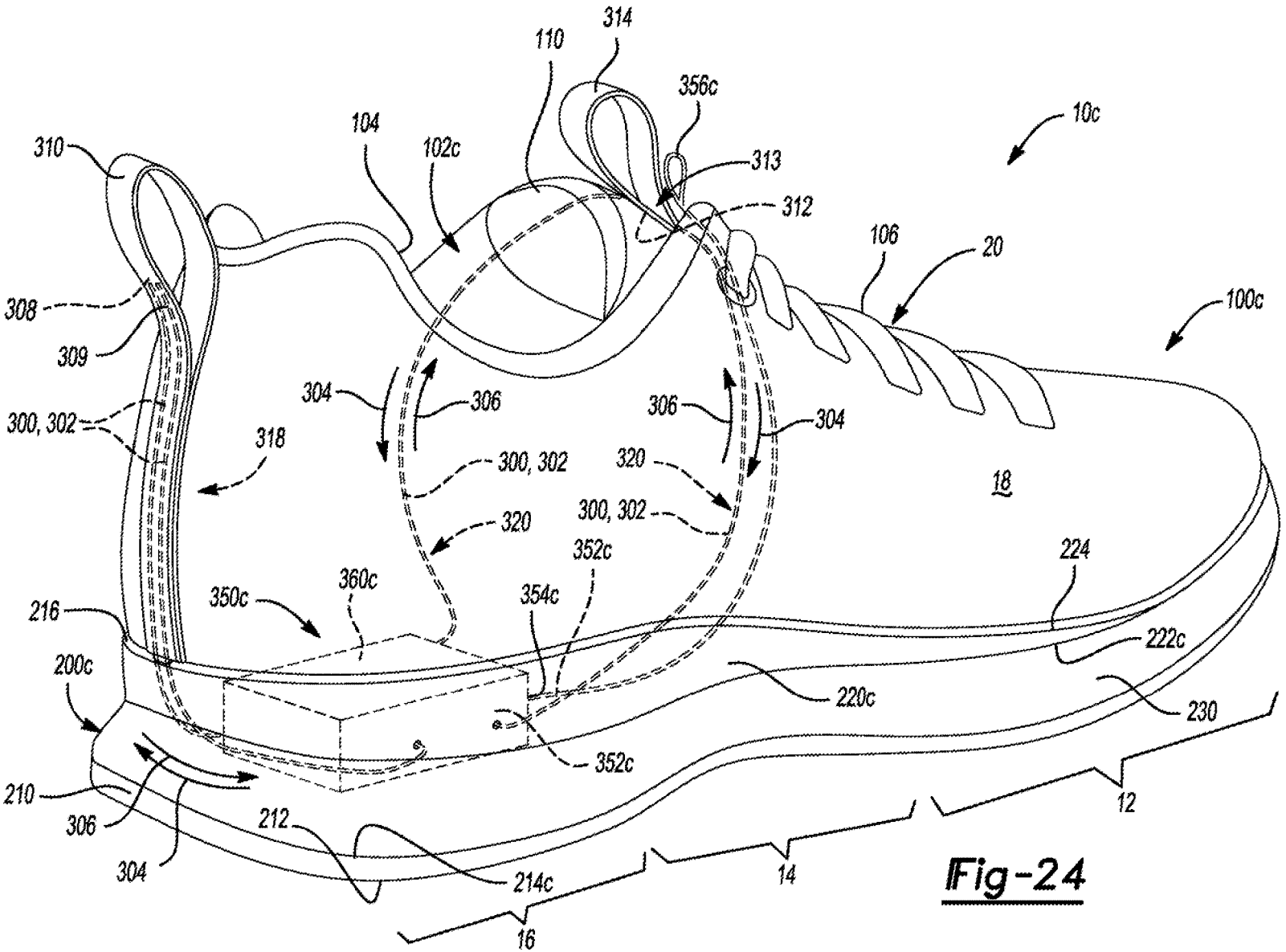
FIG. 24 is a top perspective view of an article of footwear having a locking device movable between a locked state to restrict movement of a tensioning cable and an unlocked state to permit movement of the tensioning cable in accordance with principles of the present disclosure.
Figure 25:
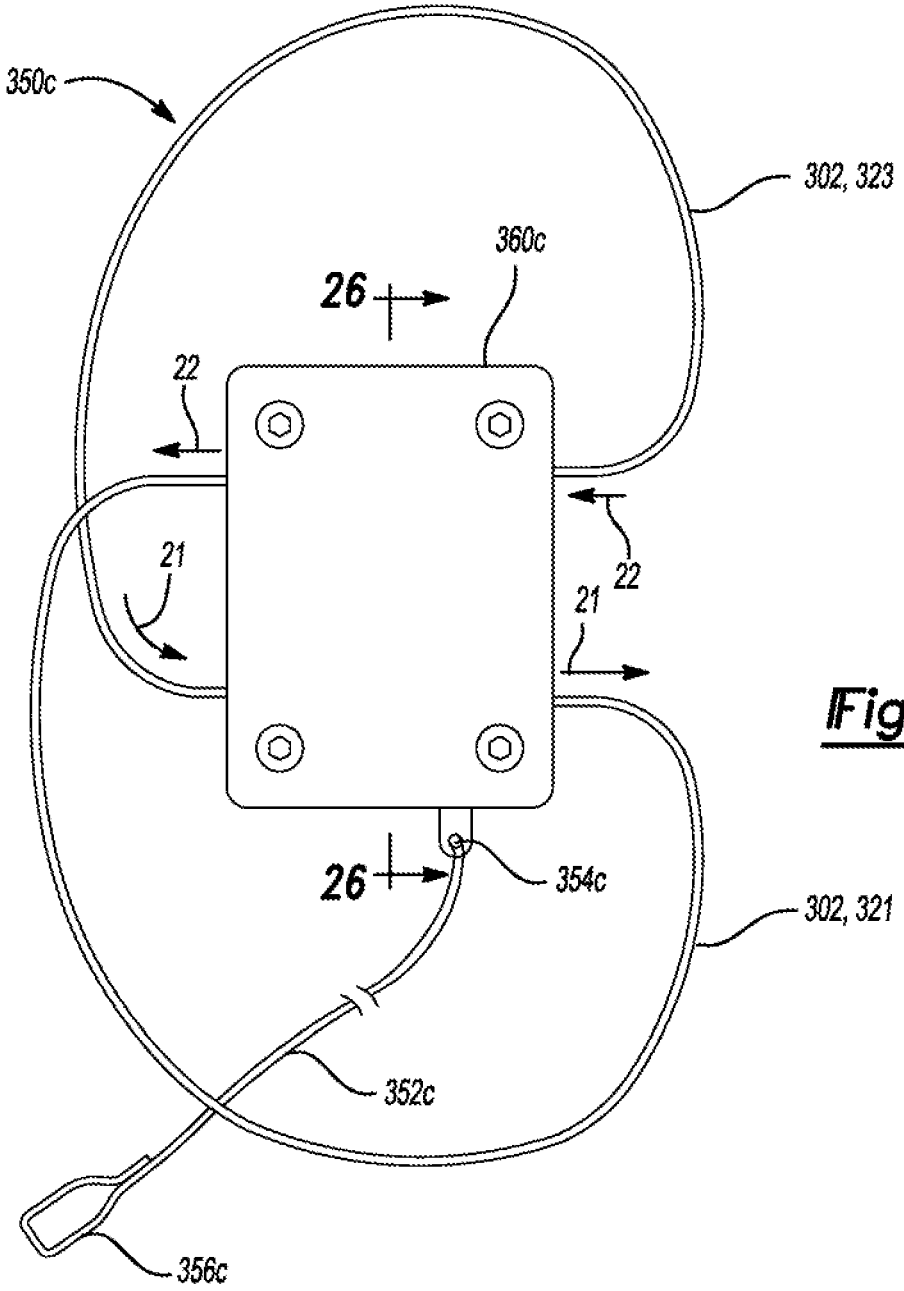
FIG. 25 is a top view of the locking device of FIG. 24 showing a housing of the locking device receiving first and second portions of a tensioning cable.

The locking device or cable lock 350*c* may be disposed between the outsole 210*c* and the midsole 220*c* of the footwear 10*c* and may be biased in a locked state to restrict movement of the tensioning cable 302 in the loosening direction 306. The outsole 210*c* supports the locking device 350*c* in some examples. FIG. 25 provides a top view of the locking device 350*c* of FIG. 24 showing a housing 360*c* receiving a first portion 321 and a second portion 323 of the continuous loop tensioning cable 302. The first portion 321 of the tensioning cable 302 may approach the housing 360*c* from a first direction 21 and the second portion 323 of the tensioning cable 302 may approach the housing 360*c* from a second direction 22 opposite to the first direction 21.

In some configurations, the locking device 350*c* permits movement of the tensioning cable 302 in the tightening direction 304 while in the locked state. A release mechanism 352*c* may transition the locking device 350*c* from the locked state to the unlocked state to thereby permit the tensioning cable 302 to move in both directions 304, 306. For instance, the release mechanism 352*c* may include a release cord operable to transition the locking device 350*c* from the locked state to the unlocked state when the release cord 352*c* is pulled. The release cord 352*c* may extend through passages formed by the upper 100*b* from a first end 354*c* attached to the locking device 350*c* to a second end 356*c* exposed from the upper 100*c* to permit a user to grip and pull the release cord 352*c* for moving the locking device 350*c* from the locked state to the unlocked state. In some examples, the second end 356*c* of the release cord 352*c* includes a loop and/or gripping feature to allow a user to grip and pull the release cord 352*c* when it is desirable to move the locking device 350*c* into the unlocked state. FIG. 24 shows the second end 356*c* of the release cord 352*c* located proximate to the loosening grip 314 such that the pulling force 324 can be subsequently applied to the loosening grip 314 once the release cord 352*c* moves the locking device 350*c* to the unlocked state. In other examples, the second end 356*c* of the release cord 352*c* can be disposed proximate to other regions of the footwear 10*c* such as at or near the ankle opening 104, the tightening grip 310, the lateral side 18 or the medial side 20 of the upper 100*c*, or the sole structure 200*c*.

Figure 26:
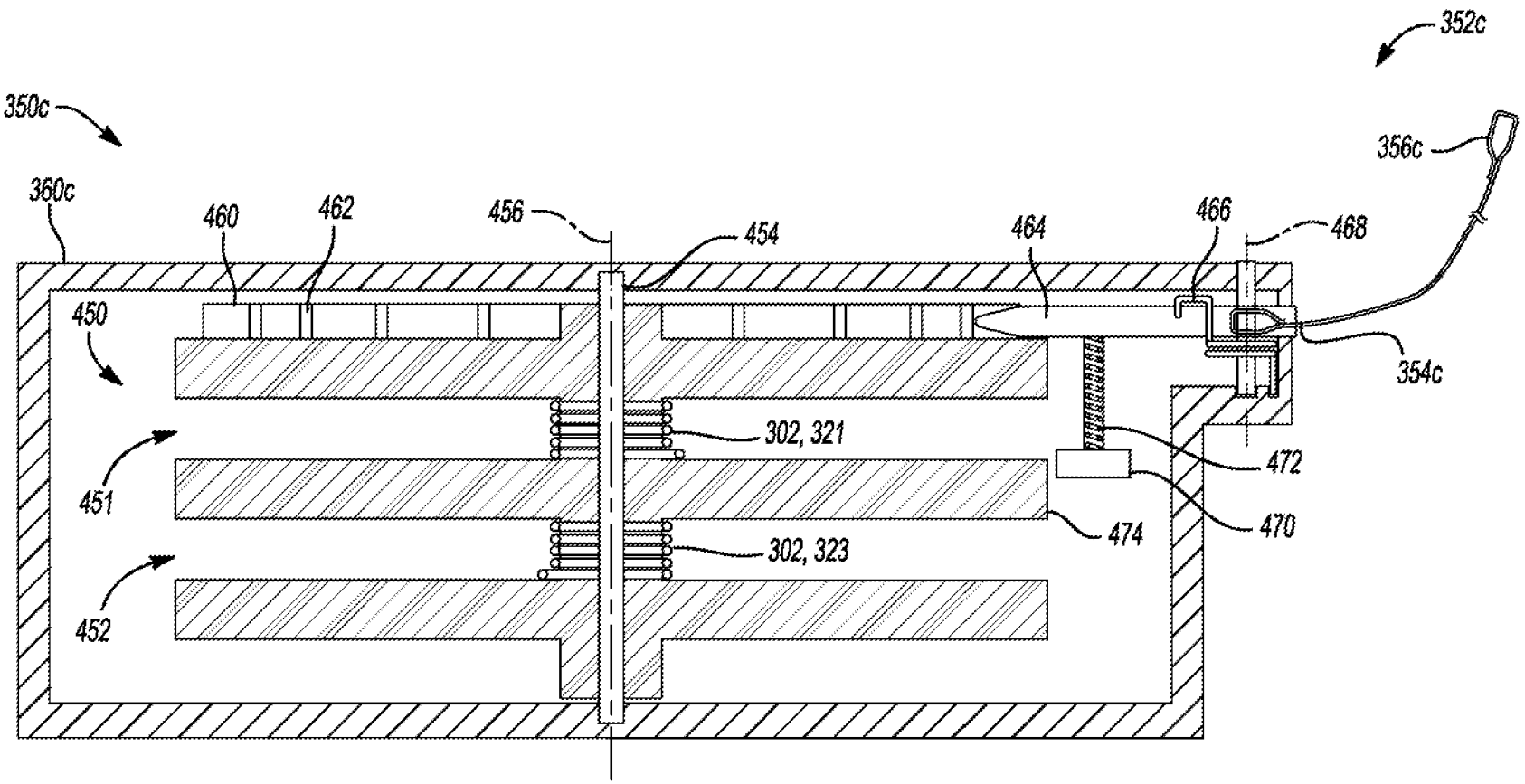
FIG. 26 is a cross-sectional view taken along line 26-26 of FIG. 25 showing a spool, a ratchet mechanism, and a pawl supported by a housing of the locking device.

The locking device 350*c* includes the housing 360*c* and a spool 450 supported by the housing 360*c*. FIG. 26 provides a cross-sectional view taken along line 26-26 of FIG. 25 showing an axle 454 supporting the spool 450 within the housing 360*c* to permit the spool 450 to rotate relative to the housing 360*c* about an axis of rotation 456. In some examples, the spool 450 rotates relative to the housing 360*c* in a first direction 404 (FIG. 27) when the tensioning cable 302 moves in the tightening direction 304 and in an opposite second direction 406 (FIG. 28) when the tensioning cable 302 moves in the loosening direction 306. The spool 450 includes a first channel 451 configured to collect the first portion 321 of the tensioning cable 302 and a second channel 452 configured to collect the second portion 323 of the tensioning cable 302. The first portion 321 may approach the first channel 451 of the spool 450 from the first direction 21 (FIG. 25) and the second portion 323 may approach the second channel 452 of the spool 450 from the second direction 22 (FIG. 25). The first direction 21 and the second direction 22 may be opposite to one another. The locking device 350*c* also includes a ratchet mechanism 460 supported for common rotation with the spool 450 about the axis of rotation 456 and having a plurality of teeth 462 positioned circumferentially around the axis of the ratchet mechanism 460.

Figure 27:
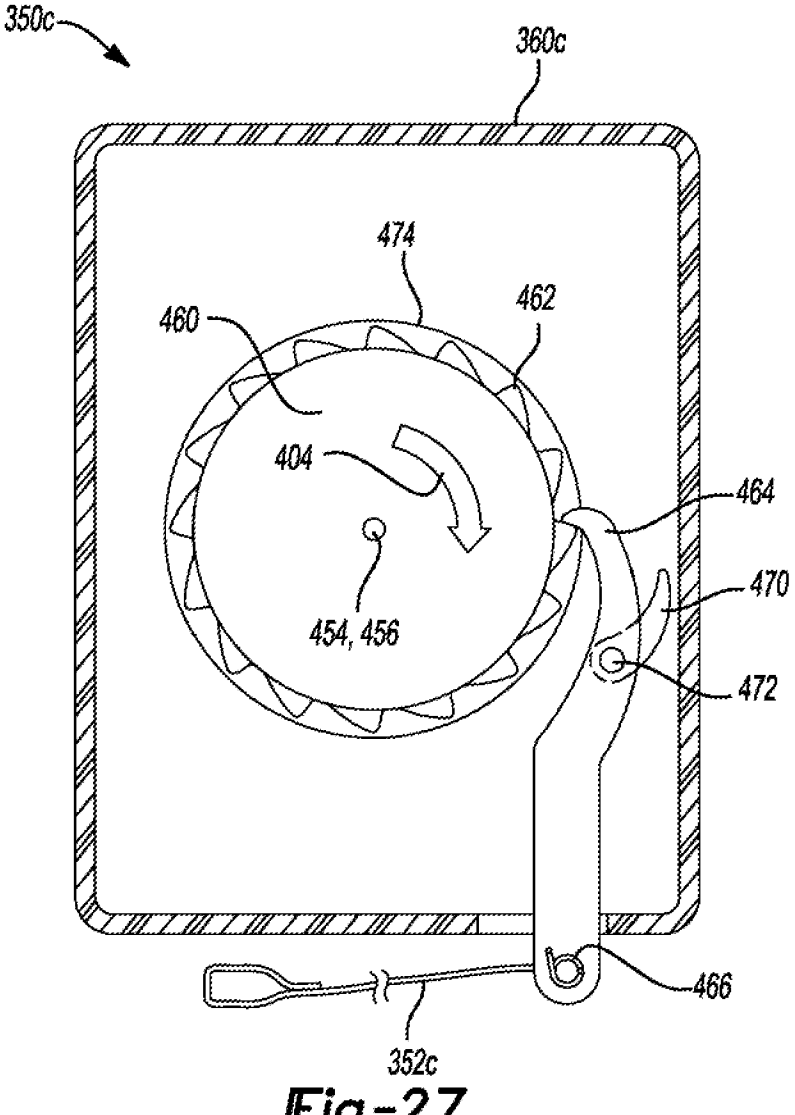
FIG. 27 is a partial top sectional view of the locking device of FIG. 25 showing a portion of the housing removed and a first pawl engaged with teeth of a ratchet mechanism when the locking device in the locked state.

In some implementations, the locking device 350*c* includes a first pawl 464 supported by the housing 360*c* and a first pawl spring 466 configured to bias the first pawl 464 into engagement with the plurality of teeth 462 of the ratchet mechanism 460. The first pawl spring 466 may bias the first pawl 464 about a pawl axis of rotation 468 extending substantially parallel to the axis of rotation 456 of the spool 450. The engagement between the first pawl 464 and the plurality of teeth 462 operates the locking device 350*c* in the locked state to restrict movement by the tensioning cable 302 in the loosening direction 306. FIG. 27 provides a top view of the locking device 350*c* while in the locked state with the first pawl 464 engaging the teeth 462 of the ratchet mechanism 460 to selectively restrict the spool 450 from rotating in the second direction 406 (FIG. 28) to restrict the tensioning cable 302 from moving in the loosening direction 306. In the example shown, the plurality of teeth 462 are sloped to permit the spool 450 to rotate in the first direction 404 when the first pawl 464 is engaged with the teeth 462, thereby permitting the tensioning cable 302 to move in the tightening direction 304 responsive to the pulling force 322 applied to the tightening grip 310. In some examples, the first channel 451 of the spool 450 collects the first portion 321 of the tensioning cable 302 while the second channel 452 of the spool 450 simultaneously releases the second portion 323 of the tensioning cable 302 as the spool 450 rotates in the first direction 404. In other examples, the first channel 451 releases the first portion 321 of the tensioning cable 302 while the second channel simultaneously collects the second portion 323 of the tensioning cable 302 as the spool 450 rotates in the first direction 404.

As with the footwear 10 of FIGS. 1-6 described above, movement of the tensioning cable 302 in the tightening direction 304 causes the second length 320 of the tensioning cable 302 to decrease to tension the fasteners 106 and thereby move the upper 100*c* into the tightened state for closing the interior void 102*a* around the foot. Accordingly, the tensioning cable 302 incrementally moves in the tightening direction 304 during each successive engagement between the first pawl 464 and the teeth 462 to thereby incrementally increase the tension applied to the fasteners 106 for tightening the fit of the interior void 102*c* around a foot as the upper 100*c* moves into the tightened state.

Figure 28:
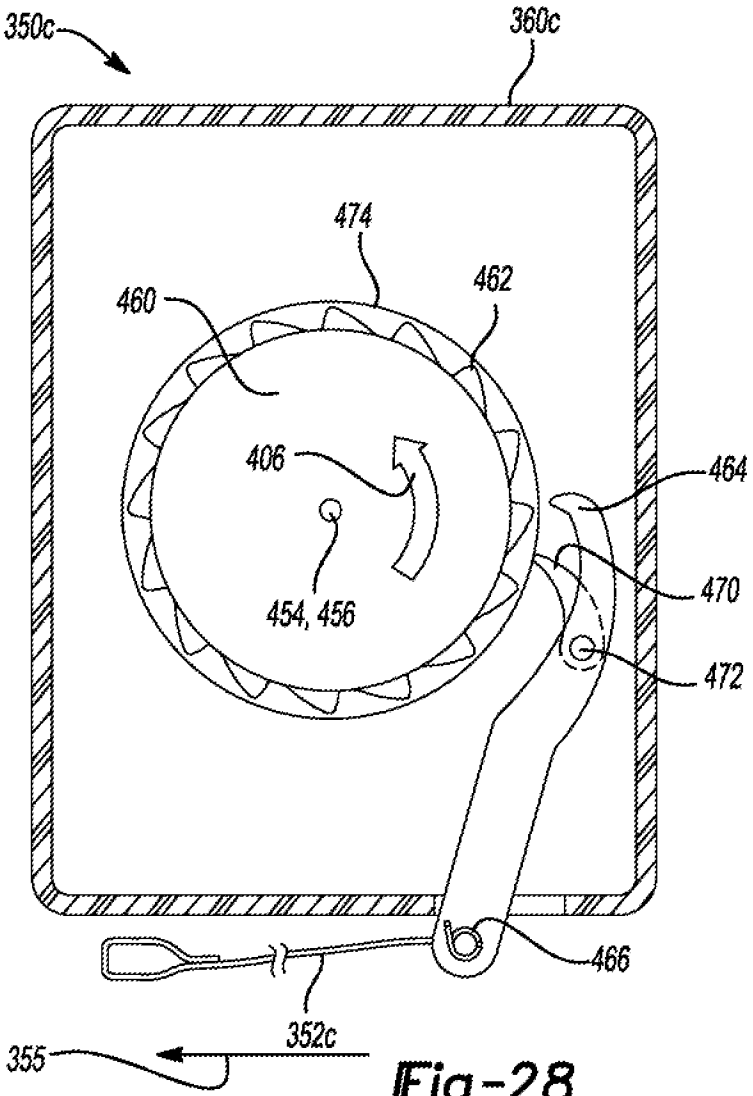
FIG. 28 is a partial top sectional view of the locking device of FIG. 26 showing the portion of the housing removed and a first pawl disengaged from teeth of a ratchet mechanism when the locking device is in the unlocked state.

In some configurations, the first end 354*c* of the release cord 352*c* is attached to the first pawl 464 to allow the release cord 352*c* to selectively disengage the first pawl 464 from the teeth 462 of the ratchet mechanism 460 when a predetermined force 355 (FIG. 28) is applied to the release cord 352*c*. For example, a user may grasp the second end 356*c* of the release cord 352*c* and apply the predetermined force 355 to disengage the first pawl 464 from the teeth 462 of the ratchet mechanism 460. FIG. 28 provides a top view of the locking device 350*c* while in the unlocked state responsive to the release cord 352*c* selectively disengaging the first pawl 464 from the teeth 462 of the ratchet mechanism 460 when the predetermined force 355 is applied to the release cord 352*c*. While the locking device 350*c* is in the unlocked state with the first pawl 464 disengaged from the teeth 462 of the ratchet mechanism 460, the spool 450 is permitted to rotate in the second direction 406 to allow the tensioning cable 302 to rotate in the loosening direction 306 when the pulling force 324 is applied to the loosening grip 314. In some examples, the first channel 451 of the spool 450 collects the first portion 321 of the tensioning cable 302 while the second channel 452 of the spool 450 simultaneously releases the second portion 323 of the tensioning 302 as the spool 450 rotates in the second direction 406. In other examples, the first channel 451 releases the first portion 321 of the tensioning cable 302 while the second channel simultaneously collects the second portion 323 of the tensioning cable 302 as the spool 450 rotates in the second direction 406. As with the footwear 10 of FIGS. 1-6 described above, movement of the tensioning cable 302 in the loosening direction 306 causes the second length 320 to increase to allow the fasteners 106 to relax and thereby facilitate a transition of the upper 100*b* from the tightened state to the loosened state such that the foot can be removed from the interior void 102*a*.

Referring to FIGS. 26 and 28, in some implementations, the locking device 350*c* further includes a second pawl 470 associated with a second pawl spring 472 configured to bias the second pawl 470 into engagement with a control surface 474 associated with the spool 450 when the first pawl 464 is disengaged from the teeth 462 of the ratchet mechanism 460 to permit the spool 450 to rotate in the second direction 406. While the example of FIG. 26 shows the control surface 474 corresponding to an intermediate wall of the spool 450 between the first channel 451 and the second channel 452, the control surface 474 may correspond to an upper wall of the spool 450 opposing the ratchet mechanism 450 or a lower wall of the spool 450 disposed on an opposite side of the spool 450 than the upper wall opposing the ratchet mechanism 460. The second pawl 470 may be rotatably supported by the first pawl 464. When the second pawl 470 is engaged with the control surface 474, the second pawl 470 is operative to control the rotational speed of the spool 450 in the second direction 406 such that the portions 321, 323 of the tensioning cable 302 do not become tangled when collected (e.g., wound) or released (e.g., unwound) from respective ones of the first channel 451 and the second channel 452 of the spool 450 during rotation in the second direction 406. In some configurations, the second pawl 470 remains engaged with the control surface 474 and the first pawl 464 remains disengaged from the teeth 462 of the ratchet mechanism 460 when the predetermined force 355 applied by the release cord 352*c* is released to thereby maintain the locking device 350*c* in the unlocked state. In these configurations, the second pawl 470 may disengage from the control surface 474 and the first pawl 464 may rotate into engagement with the teeth 462 responsive to the spool 450 transitioning for rotation in the first direction 404. For example, the locking device 350*c* may selectively transition back to the locked state when the pulling force 322 is applied to the tightening grip 310 to cause the spool 450 to rotate in the first direction 404 as the tightening cable 302 moves in the tightening direction. In other configurations, the first pawl 464 is biased into engagement with the teeth 462 of the ratchet mechanism 460 and the second pawl 470 disengages from the control surface 474 when the predetermined force 355 applied by the release cord 352*c* is released to thereby automatically transition the locking device 350*c* into the locked state. Referring back to FIG. 27, the second pawl 470 is disengaged from the control surface 474 when the locking device 350*c* is operable in the locked state as the first pawl 464 engages the teeth 462 of the ratchet mechanism 460.

Referring to FIGS. 29-34, in some implementations, an article of footwear 10*d* includes an upper 100*d*, a sole structure 200*d* attached to the upper 100*d*, and a tightening mechanism 300*d* operable to move the upper 100*d* between a tightened state and a loosened state. In view of the substantial similarity in structure and function of the components associated with the article of footwear 10 with respect to the article of footwear 10*d*, like reference numerals are used hereinafter and in the drawings to identify like components while like reference numerals containing letter extensions are used to identify those components that have been modified.

The sole structure 200*d* may include an outsole 210*d* and a midsole 220*d* arranged in a layered configuration. The outsole 210*d* includes an inner surface 214*d* disposed on the opposite side of the outsole 210*d* than the ground-engaging surface 212, while the midsole 220*d* includes a bottom surface 222*d* disposed on the opposite side of the midsole 220*d* than the footbed 224. The insole 216 or sockliner is received within an interior void 102*d* upon the footbed 224.

The upper 100*d* may be formed from the flexible material forming the upper 100 of FIGS. 1-6 to form the interior void 102*d* and to transition between a tightened state and a loosened state for adjusting the fit of the interior void 102*d* around the foot. The fasteners 106 extending along the upper 100*d* may operably connect to the tensioning mechanism 300 for automatically moving the upper 100*d* between the tightened state and the loosened state to accommodate entry and removal from the footwear 10*d* in a similar fashion as described above. The tightening mechanism 300*d* includes a first tensioning cable 302*d* defining a first length 318*d* for the tightening mechanism 300*d* between a locking device 350*d* and the tightening grip 310, and a second tensioning cable 502 defining a second length 320*d* for the tightening mechanism 300*d* between the locking device 350*d* and the loosening grip 314. In some examples, the first tensioning cable 302*d* has a pair of free ends 308*d* and 312*d* operably connected to the tightening grip 310 at one or more corresponding attachment locations 309. In other examples, the first tensioning cable 302*d* includes a continuous loop defining the first length 318*d*. Similarly, the second tensioning cable 502 may include a pair of free ends 508 and 512 operably connected to the loosening grip 314 at one or more corresponding attachment locations 309 or may include a continuous loop defining the second length 320*d*. Further, the ends 508, 512 may be attached to the fasteners 106 in an area proximate to the loosening grip 314 such that when the tensioning cable 302*d* is placed under tension, a force is applied to the fasteners 106 via the cable 302*d*, thereby causing the fasteners 106 to constrict the upper 100*d* around a foot of a wearer.

Movement of the first tensioning cable 302*d* in the tightening direction 304 causes the second tensioning cable 502 to also move in a tightening direction 504 and thereby cause the upper 100*d* to move into the tightened state to close the interior void 102*d* around a foot of a wearer. Conversely, movement by the first tensioning cable 302*d* in the loosening direction 306 and movement by the second tensioning cable 502 in a corresponding loosening direction 506 causes the upper 100*d* to move into the loosened state to relax the fit of the interior void 102*d* around a foot of a wearer.

The tensioning cables 302*d*, 502 may be highly lubricious and/or be formed from one or more fibers having a low modulus of elasticity and a high tensile strength. For instance, the fibers may include high modulus polyethylene fibers having a high strength to weight ratio and very low elasticity. Additionally or alternatively, the cables 302*d*, 502 may be formed from a molded monofilament polymer and/or a woven steel with or without other lubrication coating. In some examples, the cables 302*d*, 502 include multiple strands of material woven together.

In some implementations, the footwear 10*d* includes at least one of the first conduits 160 and/or at least one of the second conduits 170 of FIGS. 7-16 each configured to receive and surround portions of respective ones of the first tensioning cable 302*d* along the first length 318*d* and the second tensioning cable 502 along the second length 320*d* when the tensioning cables 302*d* and 502 move relative to the conduits 160, 170. For instance, the first conduit 160 may accommodate bunching by the first tensioning cable 302*d* along the first length 318*d* that increases when the tensioning cable 302 is moved in the tightening direction 304 (e.g., as shown by tensioning cable 302 in conduit 160 of FIG. 9), while the second conduit 170 may accommodate bunching by the second tensioning cable 502 along the second length 320*d* that simultaneously decreases during movement by the tensioning cable 502 in the tightening direction 504. Conversely, when movement of the tensioning cables 302*d* and 502 in the loosening directions 306 and 506 causes the first length 318*d* to decrease and the second length 320*d* to increase, the portion of the first tensioning cable 302*d* received by the first conduit 160 will become substantially taught along the decreasing first length 318*d*

(e.g., as shown by tensioning cable 302 in conduit 160 of FIG. 11), while the second conduit 170 will accommodating bunching by the second tensioning cable 502 along the increasing second length 320*d*. As described above with reference to the footwear 10*a* of FIGS. 7-16, the conduits 160, 170 may each define a respective inner diameter 162, 172 that is greater than outer diameters of the tensioning cables 302*d* and 502 to accommodate bunching by the tensioning cables 302*d* and 502 during relative movement by the tensioning cables 302*d* and 502 in respective ones of the tightening direction 304, 504 and the loosening direction 306, 506. Moreover, the conduits 160, 170 may be formed from the one or more materials that impart properties of flexibility and durability while reducing friction between the tensioning cables 302*d*, 502 and the respective interior surfaces of the conduits 160, 170 during relative movement by the tensioning cables 302*d*, 502. In some examples, interior surfaces of at least one of the conduits 160, 170 are coated to reduce friction with the corresponding tensioning cable 302*d*, 502.

Figure 29:
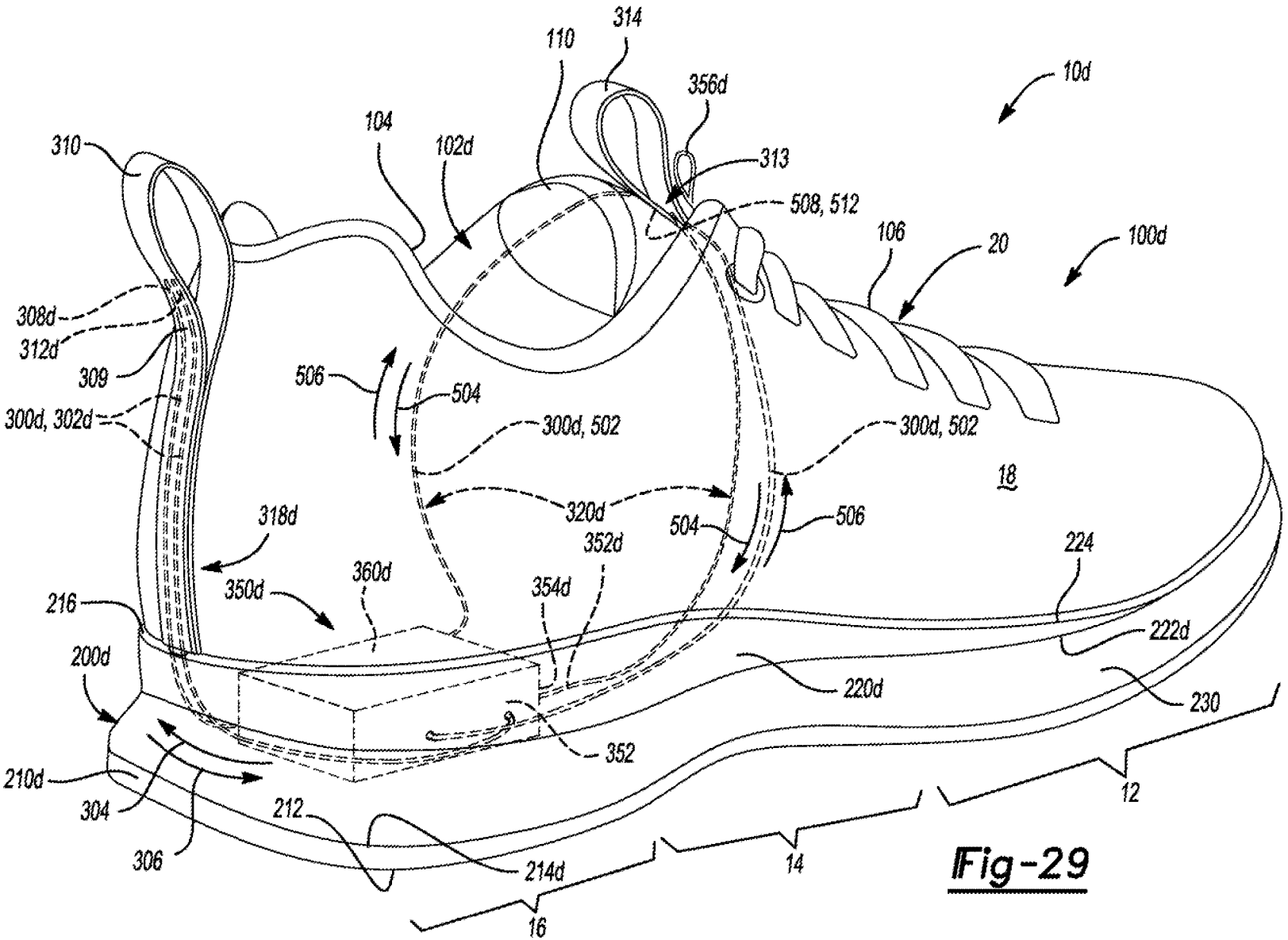
FIG. 29 is a top perspective view of an article of footwear having a locking device movable between a locked state to restrict movement of a tensioning cable and an unlocked state to permit movement of the tensioning cable in accordance with principles of the present disclosure.

The locking device or cable lock 350*d* may be disposed between the outsole 210*d* and the midsole 220*d* of the footwear 10*d* and may be biased in a locked state to restrict movement of the tensioning cables 302*d*, 502 in their respective loosening directions 306, 506. The outsole 210*d* supports the locking device 350*d* in some examples. The first tensioning cable 302*d* and the second tensioning cable 502 each approach and pass through a housing 360*d* of the locking device 350*d* from opposite directions. In on configuration, the housing 360*d* includes a substantially square shape that is approximately three inches (3 in.) long by three inches (3 in.) wide and includes a thickness that is approximately one inch (1 in.). In some configurations, the locking device 350*d* permits movement of the tensioning cables 302*d*, 502 in the tightening directions 304, 504 while in the locked state. A release mechanism 352*d* may transition the locking device 350*d* from the locked state to an unlocked state to thereby permit the tensioning cables 302*d*, 502 to move in both directions 304, 504, 306, 506. For instance, the release mechanism 352*d* may extend through passages formed by the upper 100*d* from a first end 354*d* attached to the locking device 350*d* to a second end 356*d* exposed from the upper 100*d* to permit a user to grip and pull the release cord 352*d* for moving the locking device 350*d* from the locked state to the unlocked state. In some examples, the second end 356*d* of the release cord 352*d* includes a loop and/or gripping feature to allow a user to grip and pull the release cord 352*d* when it is desirable to move the locking device 350*d* into the unlocked state. FIG. 29 shows the second end 356*d* of the release cord 352*d* located proximate to the loosening grip 314 such that the pulling force 324 can be subsequently applied to the loosening grip 314 once the release cord 352*d* moves the locking device 350*d* to the unlocked state. In other examples, the second end 356*d* of the release cord 352*d* can be disposed proximate to other regions of the footwear 10*d* such as at or near the ankle opening 104, the tightening grip 310, the lateral side 18 or the medial side 20 of the upper 100*d*, or the sole structure 200*d*.

Figure 30:
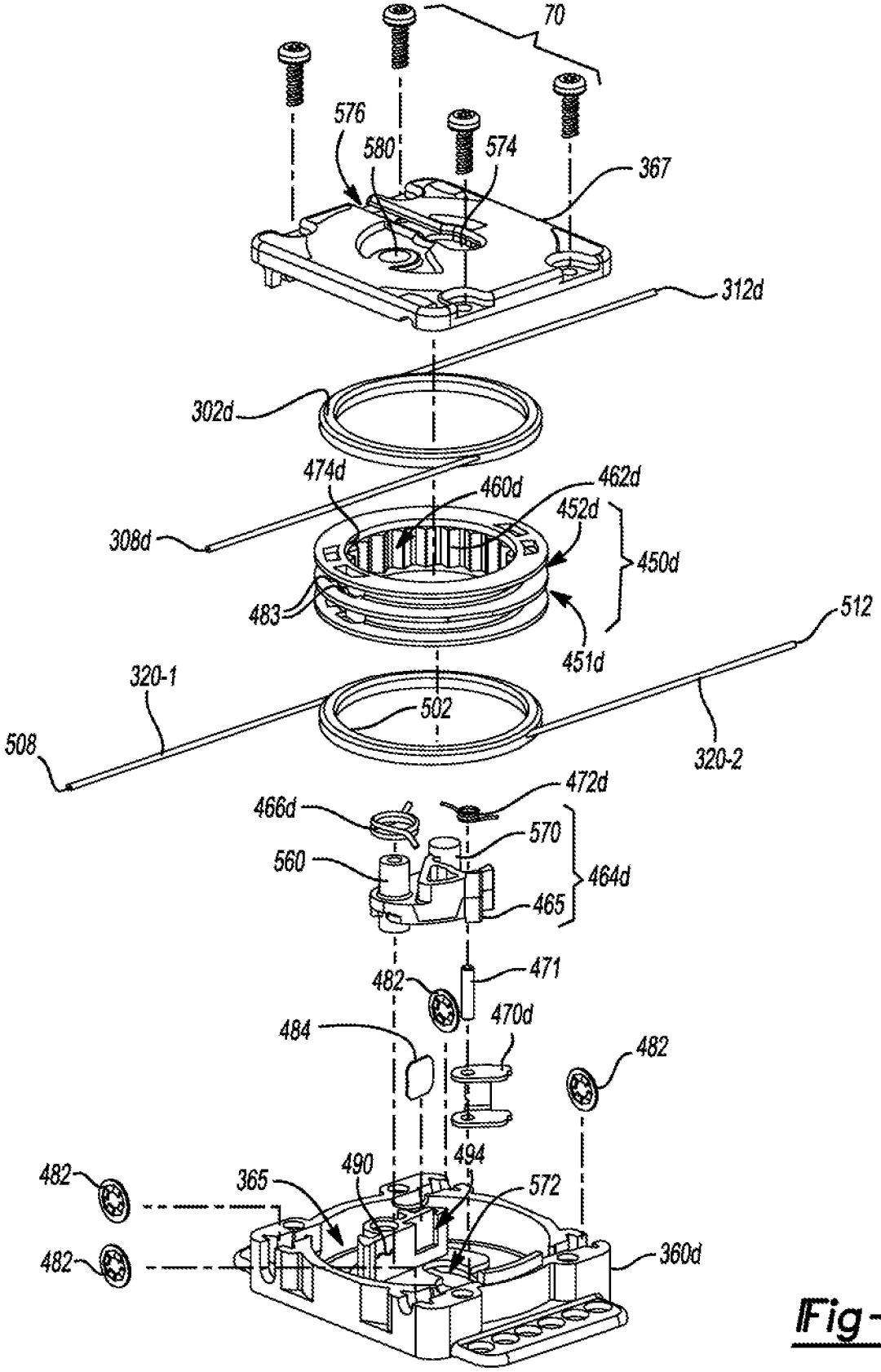
FIG. 30 is an exploded view of the locking device of FIG. 29 showing a housing and a spool adapted to be received within the housing and having a first channel configured to collect a first portion of a tensioning cable and a second channel configured to collect a second portion of the tensioning cable.

FIG. 30 provides an exploded view of the locking device 350*d* of FIG. 29 showing the housing defining a cavity 365 configured to rotatably receive a spool 450*d*, a first pawl 464*d*, and a second pawl 470*d*. The locking device 350*d* may include a lid 367 releasably fastened to the housing 360*d* to prevent access to the cavity 365 when the lid 367 is fastened to the housing 360*d* and allow access to the cavity 365 when the lid 367 is removed from the housing 365. One or more fasteners 70 may extend through the lid 367 and fasten with threaded holes 72 (FIG. 31) in the housing 360*d* to secure the lid 367 to the housing 360*d*.

The spool 450*d* is supported within the cavity 365 of the housing 360 and may rotate relative to the housing 360*d*. In some examples, the spool 450*d* rotates relative to the housing 360*d* in the first direction 404 (FIG. 31) when the first tensioning cable 302*d* moves in the tightening direction 304 and in the opposite second direction 406 (FIG. 31) when the second tensioning cable 502 moves in the loosening direction 506. The spool 450*d* includes a first channel or annular groove 451*d* configured to collect portions of the first tensioning cable 302*d* and a second channel or annular groove 452*d* configured to collect portions of the second tensioning cable 502. The housing 360 may support a plurality of cable retainers 482 such that the ends 308*d*, 312*d*, 508, 512 of the tensioning cables 302*d*, 502 each extend through a respective one of the cable retainers 482.

The spool 450*d* may include one or more anchor slots 483 formed through a divider wall separating the channels 451*d*, 452*d* for attaching each of the tensioning cables 302*d*, 502 to the spool 450*d*. For example, the first tensioning cable 302*d* may attach to one of the anchor slots 483 at a midpoint between the first end 308*d* and the second end 312*d* and the second tensioning cable 502 may attach to another one of the anchor slots 483 at a midpoint between the first end 508 and the second end 512. The locking device 350*d* also includes a ratchet mechanism 460*d* associated with the spool 450*d* and having a plurality of teeth 462 positioned circumferentially around an axis of the ratchet mechanism 460 and protruding radially inward therefrom. In some implementations, the ratchet mechanism 460*d* is integrally formed upon an inner circumferential wall of the spool 450*d* such that the plurality of teeth 462 protrude radially inward from the channels 451*d*, 452*d*. In other examples, the ratchet mechanism 460*d* is supported for common rotation with the spool 450*d*.

Figure 31:
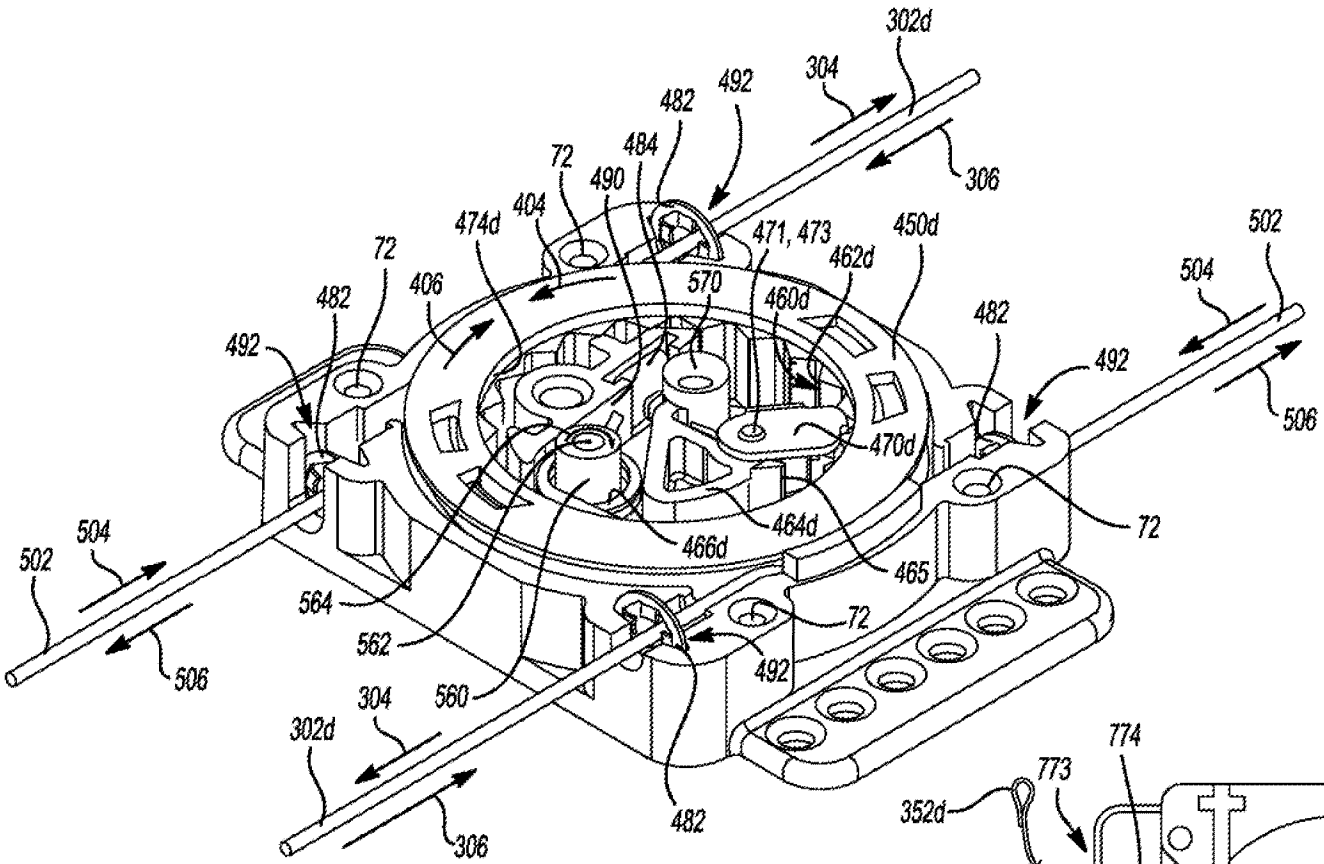
FIG. 31 is a top perspective view of the locking device of FIG. 29 showing a ratchet mechanism having a plurality of teeth and first pawl biased into engagement with the plurality of teeth of the ratchet mechanism to operate the locking device in the locked state.
Figure 32:
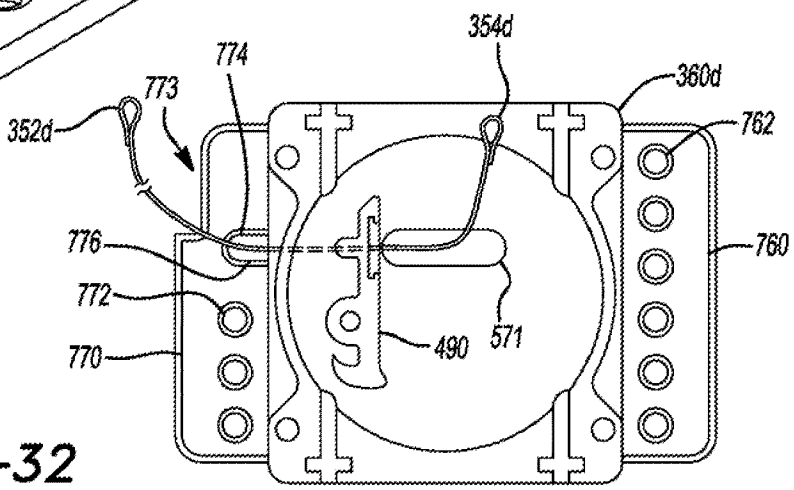
FIG. 32 is a top view of the housing of the locking device of FIG. 29 showing a feed slot and arcuate aperture formed through the housing cooperating to allow a release cord to pass underneath the housing.
Figure 33:
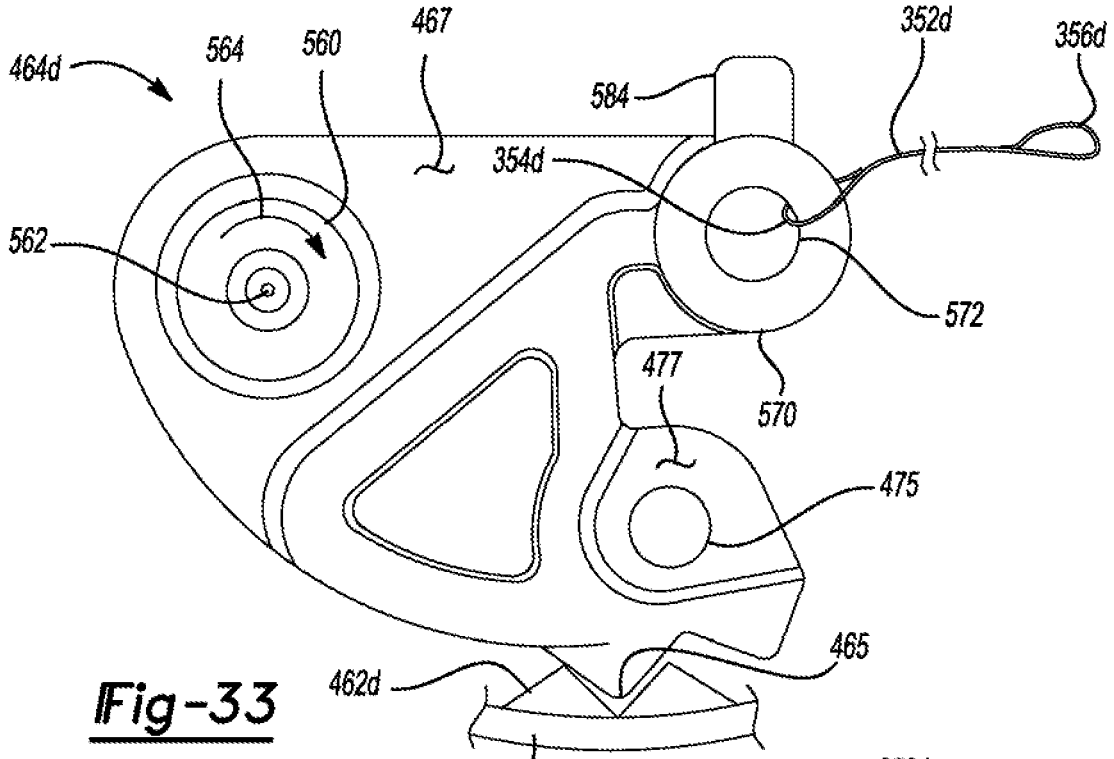
FIG. 33 is a partial top view of the locking device of FIG. 31 showing the locking device in the locked state when the first pawl is engaged with the plurality of teeth of the ratchet mechanism.

In some implementations, the first pawl 464*d* includes a first pawl axle 560 configured to support the first pawl 464*d* within the housing 360*d* to permit the first pawl 464*d* to rotate relative to the housing 360*d* about a first pawl axis of rotation 562 (FIGS. 31-33). A first pawl spring 466*d* may operably connect to the first pawl axle 560 and a retaining wall 490 disposed within the cavity 365 of the housing 360*d* to bias the first pawl 464*d* in a first direction 564 (FIGS. 31 and 32) about the pawl axis of rotation 562. The pawl axis of rotation 562 may be substantially parallel to an axis of rotation of the spool 450*d* when the spool 450*d* is received by the cavity 365 to enclose the first pawl 464*d* and the retaining wall 490 of the housing 360*d*. Accordingly, the first pawl spring 466*d* may interact with the retaining wall 490 and the first pawl 464 to exert a biasing force that causes the first pawl 464*d* to pivot about the pawl axis of rotation 562 in the first direction 564 and into engagement with the plurality of teeth 462*d* of the ratchet mechanism 460*d*, thereby causing the locking device 350*d* to operate in the locked state to restrict movement by the tensioning cables 302*d*, 502 in the loosening directions 306, 506. In some examples, the first pawl 464*d* includes one or more teeth 465 configured to meshingly engage with the plurality of teeth 462*d* of the ratchet mechanism 460*d*. The retaining wall 490 may define a tactile slot 494 configured to receive one or more tactile domes 484. Described in greater detail below with reference to FIGS. 31-33, the first pawl 464*d* may engage the tactile dome(s) 484 to provide a click or other sound that indicates the spool 450*d* has changed positions relative to the housing 360*d* and/or the locking device 350*d* has transitioned from the locked state to the unlocked state.

FIG. 31 provides a perspective view of the locking device 350*d* while in the locked state with the first pawl teeth 465 of the first pawl 464*d* engaging the teeth 462*d* of the ratchet mechanism 460*d* to selectively restrict the spool 450*d* from rotating in the second direction 406 and thereby restrict the tensioning cables 302*d*, 502 from moving in their respective loosening directions 306, 506. The housing 360*d* defines retainer slots 492 each configured to receive and support a respective one of the cable retainers 482 through which the ends 308*d*, 312*d* of the first tensioning cable 302*d* and the ends 508, 512 of the second tensioning cable 502 extend. In some examples, the plurality of teeth 462*d* are sloped to permit the spool 450*d* to rotate in the first direction 404 when the teeth 465 of the first pawl 464*d* are engaged with the teeth 462*d* of the ratchet mechanism 460*d*, thereby permitting the first tensioning cable 302*d* to move in the tightening direction 304 and the second tensioning cable 502 to move in the tightening direction 504 responsive to the pulling force 322 being applied to the tightening grip 310. Here, the first channel 451*d* of the spool 450*d* releases the first tensioning cable 302*d* while the second channel 452*d* of the spool 450*d* simultaneously collects the second tensioning cable 502 as the spool 450*d* rotates in the first direction 404. Accordingly, movement by the tensioning cables 302*d*, 502 in their tightening directions 304, 504 causes the first length 318*d* to increase and the second length 320*d* to decrease to tension the fasteners 106 and thereby move the upper 100*d* into the tightened state for closing the interior void 102*d* around a foot of a user. Thus, the second tensioning cable 502 incrementally moves in the tightening direction 504 during each successive engagement between the first pawl 464*d* (e.g., first pawl teeth 465) and the teeth 462*d* of the ratchet mechanism 460*d* to thereby incrementally increase the tension applied to the fasteners 106 for tightening the fit of the interior void 102*d* around the foot as the upper 100*d* moves into the tightened state.

With reference to FIGS. 30 and 31, a second pawl axle 471 rotatably supports the second pawl 470*d* to the first pawl 464*d* to permit the second pawl 470*d* to rotate relative to both the first pawl 464*d* and the housing 360*d* about a second pawl axis of rotation 473. The second pawl axis of rotation 473 may extend substantially parallel to the first pawl axis of rotation 562 and the axis of rotation of the spool 450*d*. In some examples, the second pawl 470*d* is associated with a second pawl spring 472*d* configured to bias the second pawl 470*d* into engagement with a control surface 474*d* associated with the spool 450*d* when the first pawl 464*d* is disengaged from the teeth 462*d* of the ratchet mechanism 460*d* to permit the spool 450*d* to rotate in the second direction 406.

In some examples, the release cord 352*d* operably connects to an anchor post 570 of the first pawl 464*d* to disengage the first pawl 464*d* from the teeth 462*d* of the ratchet mechanism 460*d* when a predetermined force 355*d* (FIG. 34) is applied to the release cord 352*d*. When the second pawl 470*d* is engaged with the control surface 474*d*, the second pawl 470*d* is operative to control the rotational speed of the spool 450*d* in the second direction 406 such that the tensioning cables 302*d*, 502 do not become tangled when collected (e.g., wound) or released (e.g., unwound) from respective ones of the first channel 451*d* and the second channel 452 of the spool 450*d* during rotation in the second direction 406. In some configurations, the second pawl 470*d* includes two cam surfaces that remain engaged with respective ones of two control surfaces 474*d* when the first pawl 464*d* remains disengaged from the teeth 462*d* (i.e., when the locking device 350*d* is operable in the unlocked state). Each control surface 474*d* may be axially disposed on an opposite side of the ratchet mechanism 460*d* such that the teeth 462*d* are disposed between the control surfaces 474*d* and protrude radially inward therefrom.

FIG. 32 provides a top view of the housing 360*d* showing a pair of mounting flanges 760, 770 disposed on opposite sides of the housing 360*d*. The mounting flanges 760, 770 may rest upon the inner surface 214*d* of the outsole 210*d* (or alternatively upon a strobel 217 in the configuration of FIGS. 42-47 when a drop-in midsole 220*f* is inserted into an interior void 102*f* defined by an upper 100*f*) to mount the locking device 350*d* within the sole structure 200*d*. The strobel 217 can be any support structure forming an underfoot portion of the footwear 10*f* that is at least disposed between the outsole 210*f* and the void 102*f*. In some examples, bonding agents, such as adhesives and/or epoxies, may be applied to the contact surfaces of the flanges 760, 770 and/or the inner surface 214 of the outsole 210 for attaching the housing 360*d* to the inner surface 214*d* of the outsole 210*d*. Additionally or alternatively, the mounting flanges 760, 770 may define one or more mounting holes 762, 772 formed therethrough and configured to receive a fastener (not shown) for mounting the housing 360*d* to the sole structure 200*d*.

FIG. 32 shows the housing 360*d* with the pawls 462*d*, 464*d*, cables 302*d*, 502*d*, and other components of the locking device 350*d* removed to expose an arcuate channel 571 formed through the housing 360*d*. The arcuate channel 571 aligns with an aperture 572 (FIG. 33) defined by the anchor post 570 and permits the release cord 352*d* to pass underneath the housing 360*d* and up through a feed slot 774 defined by the mounting flange 770. The mounting flange 770 also defines a cut-out region 773 proximate to the feed slot 774 to provide more clearance for the release cord 352*d* (and/or a routing tube 325 enclosing a release cord 352*f* of the article of footwear 10*f* of FIGS. 42-47) to extend from the housing 350*d*. The mounting flanges 760, 770 may define a lip around the perimeter of the housing 360*d* so that the housing 360*d* is raised slightly above the sole structure 200*d* (or strobel 217 of the footwear 10*f* of FIGS. 42-47) underneath. Thus, the release cord 352*d* may freely extend underneath the housing 360*d* between the arcuate channel 571 and the feed slot 774. In some examples, the feed slot 774 has a curved edge 776 to prevent the release cord 352*d* from catching or being restricted by the housing 360*d*.

Figure 34:
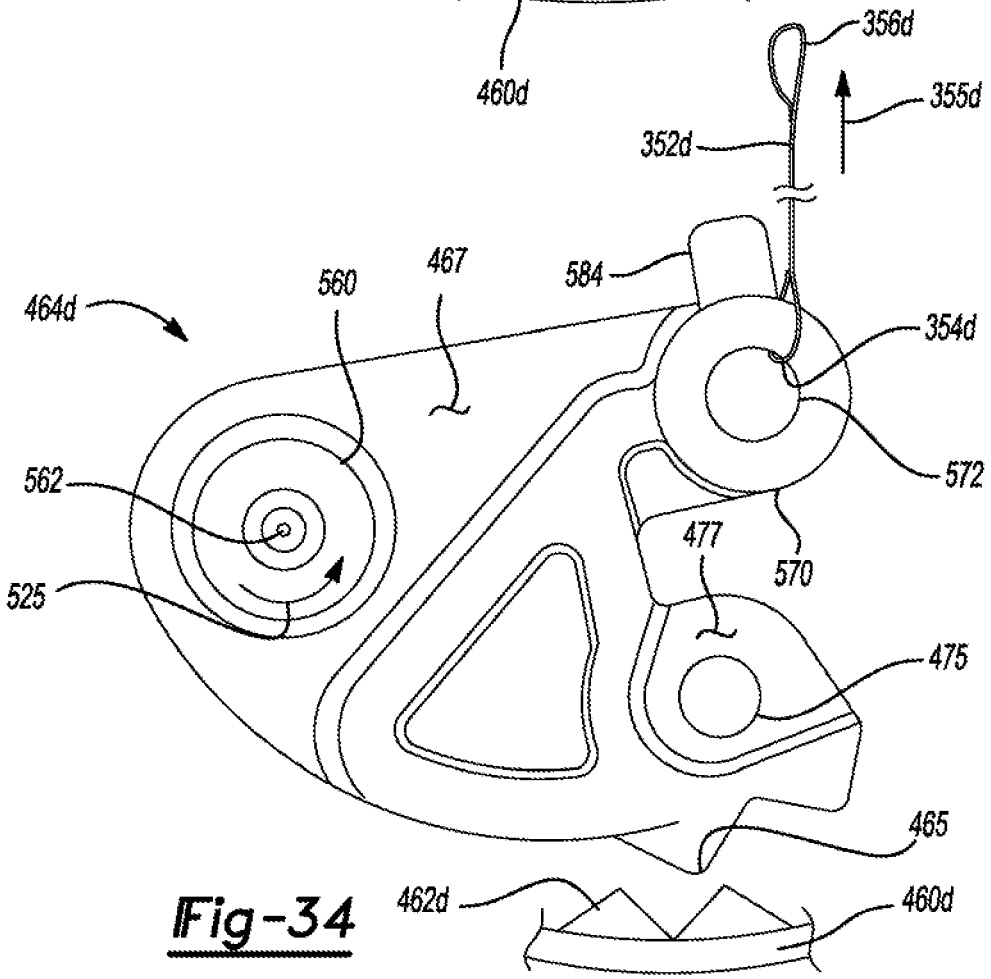
FIG. 34 is a partial top view of the locking device of FIG. 31 showing a release mechanism operable to transition the locking device from the locked state to the unlocked state when a force is applied to the release mechanism to disengage the first pawl from the plurality of teeth of the ratchet mechanism.

FIGS. 33 and 34 each show a top view of the first pawl 462*d* of the locking device 350*d*. The first pawl 467 defines a first receiving surface 467 configured to support the first pawl spring 466*d* (shown in FIGS. 30 and 31). The first pawl axle 560 protrudes from the first receiving surface 467 in a direction substantially perpendicular to the first receiving surface 467. The first pawl axle 560 may be integrally formed with the first pawl 464*d*. The first pawl 462*d* also defines a second receiving surface 477 configured to support the second pawl spring 472*d* (shown in FIGS. 30 and 31). An aperture 475 is formed through the second receiving surface 477 and is configured to receive the second pawl axle 471 (shown in FIGS. 30 and 31). The anchor post 570 may protrude away from the receiving surfaces 467 and 477 in a direction substantially parallel to the first pawl axle 560. The anchor post 570 may define an aperture 572 to provide an attachment location for attaching the first end 354*d* of the release cord 352*d* to the anchor post 570. The anchor post 570 may be integrally formed with the first pawl 464*d*.

Referring to FIG. 33, the first pawl 462*d* is biased into engagement with the plurality of teeth 462*d* of the ratchet mechanism 460*d* when the locking device 350*d* is in the locked state. Here, the first pawl 464*d* pivots and rotates about the first pawl axis of rotation 562 in the first direction 564 such that the teeth 465 of the first pawl 464*d* engage with the teeth 462*d* of the ratchet mechanism 460*d*. In some examples, the first pawl 462*d* includes a tactile protrusion 584 configured to engage with the tactile domes 484 to provide the "click" indicating the incremental change of position in the spool 450*d* during each successive engagement between the first pawl 464*d* and the teeth 462*d*.

Referring to FIG. 34, the first end 354*d* of the release cord 352*d* is attached to the anchor post 570 of the first pawl 464*d* to allow the release cord 352*c* to selectively disengage the first pawl 464*d* from the teeth 462*d* of the ratchet mechanism 460*d* when a predetermined force 355*d* is applied to the release cord 352*c*. For example, a user may grasp the second end 356*d* of the release cord 352*d* and apply the predetermined force 355*d* to disengage the first pawl 464*d* from the teeth 462*d* of the ratchet mechanism 460*d*. Here, the predetermined force 355*d* overcomes the biasing force of the first pawl spring 466*d* to allow the first pawl 464*d* to rotate about the pawl axis of rotation 562 in a second direction 525. Additionally, the tactile protrusion may engage with the tactile dome 484 to provide the "click" when the predetermined force 355*d* moves to the first pawl 464*d* out of engagement with the teeth 462*d* to transition the locking device 350*d* to the unlocked state. FIG. 34 shows the locking device 350*d* of FIG. 29 while in the unlocked state responsive to the release cord 352*d* selectively disengaging the first pawl 464*d* from the teeth 462*d* of the ratchet mechanism 460*d* when the predetermined force 355*d* is applied to the release cord 352*d*. While the locking device 350*d* is in the unlocked state with the first pawl 464*d* disengaged from the teeth 462*d* of the ratchet mechanism 460*d*, the spool 450*d* is permitted to rotate in the second direction 406 to allow the second tensioning cable 402 to rotate in the loosening direction 506 when the pulling force 324 is applied to the loosening grip 314. In some examples, the first channel 451*d* of the spool 450*d* collects the first tensioning cable 302*d* while the second channel 452*d* of the spool 450*d* simultaneously releases the second tensioning cable 502 as the spool 450*d* rotates in the second direction 406. Accordingly, movement of the second tensioning cable 502 in the loosening direction 506 causes the second length 320*d* to increase to allow the fasteners 106 to relax and thereby facilitate a transition of the upper 100*d* from the tightened state to the loosened state such that a foot can be removed from the interior void 102*d*.

Referring back to FIG. 30, the lid 367 and the housing 360*d* of the locking device 350*d* may each include an aperture 580 configured to support the first pawl axle 560 of the first pawl 464*d*. The lid 367 and the housing 360*d* may also each include a corresponding arcuate channel 574, 571 that cooperate to allow the anchor post 570 of the first pawl 464*d* to freely rotate relative to the housing 360*d* and the lid 367 when the first pawl 464*d* pivots about the pawl axis of rotation 562 in either the first direction 404 or the second direction 406.

Figure 35:
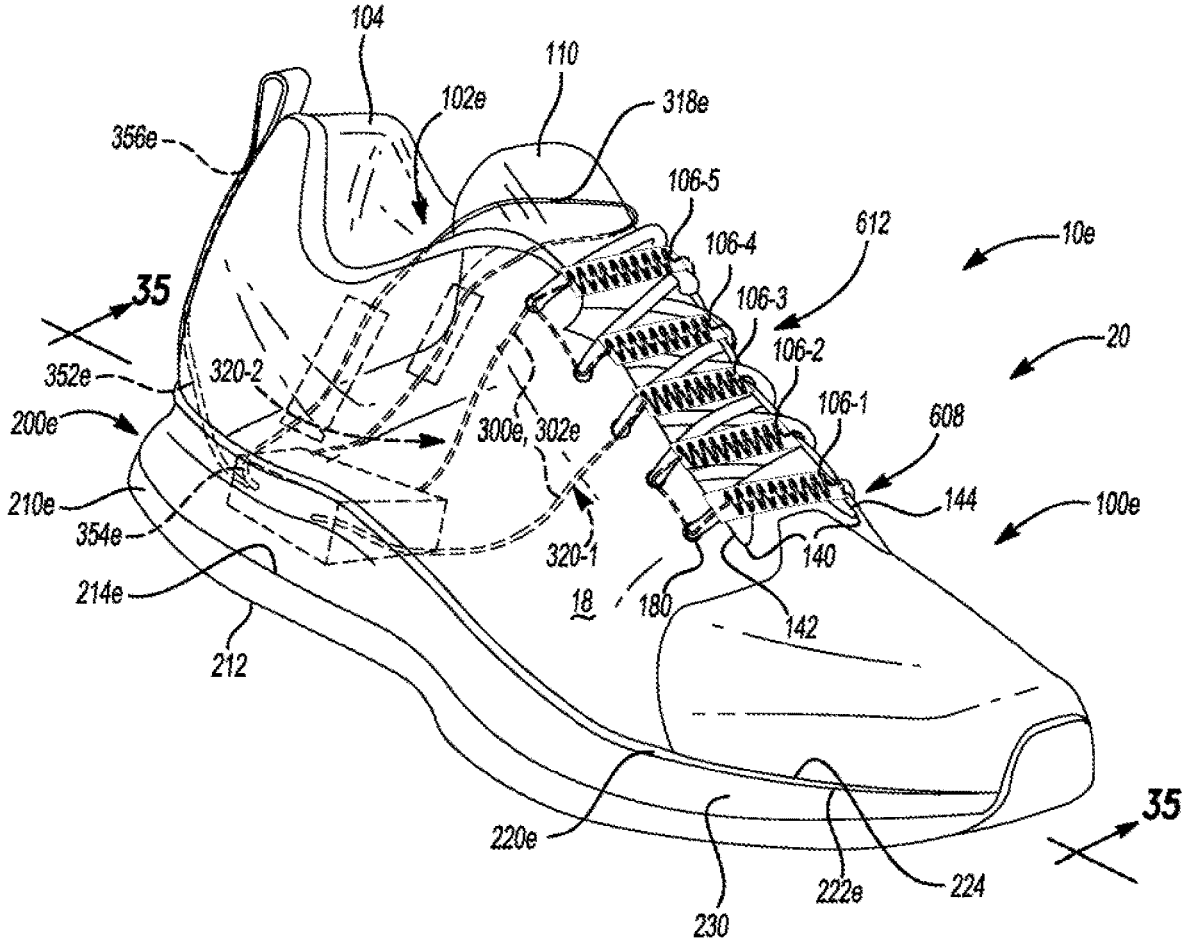
FIG. 35 is a top perspective view of an article of footwear having a locking device movable between a locked state to restrict movement of a tensioning cable and an unlocked state to permit movement of the tensioning cable in accordance with principles of the present disclosure.
Figure 36:
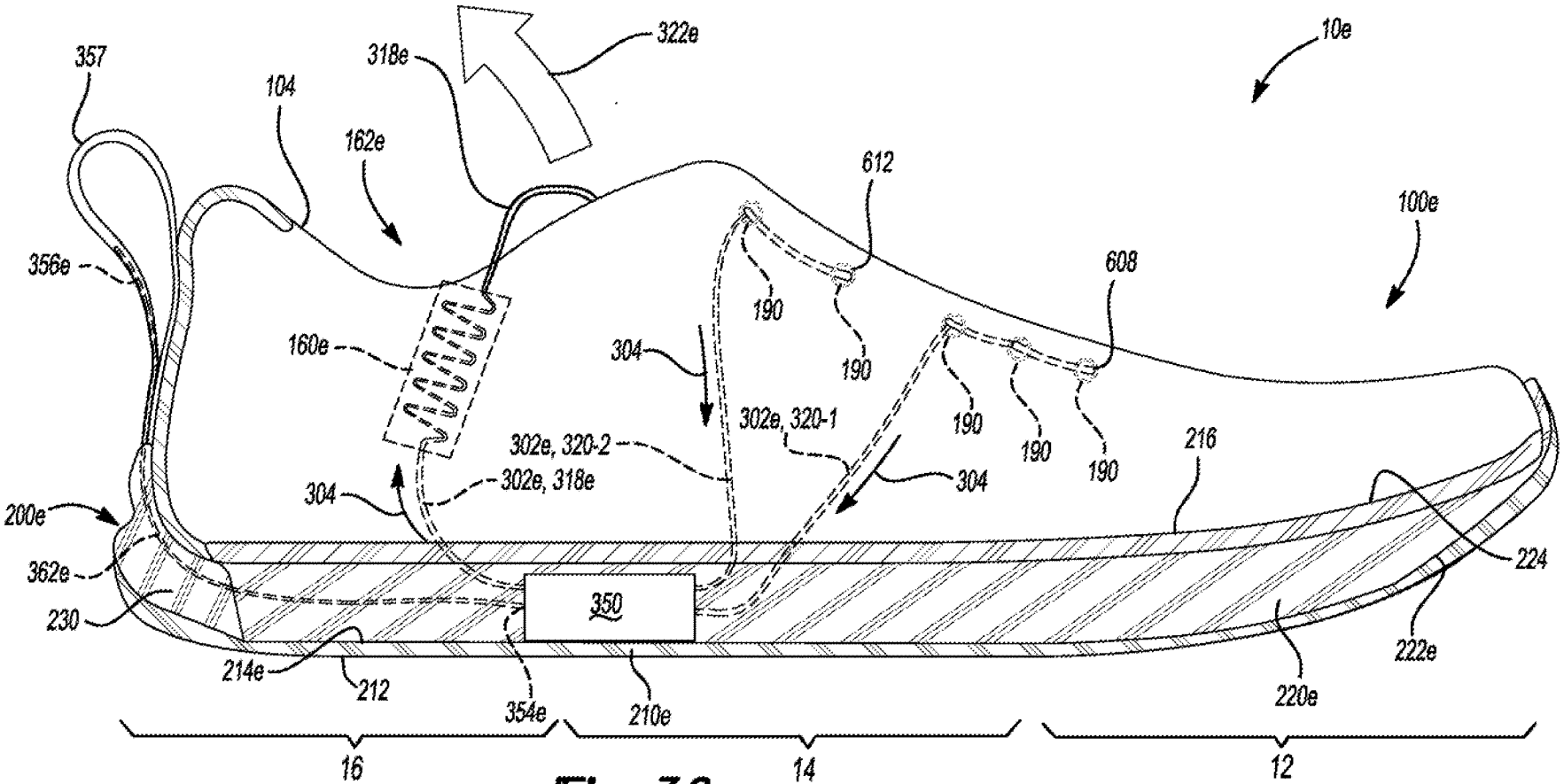
FIG. 36 is a cross-sectional view taken along line 36-36 of FIG. 35 showing a tensioning cable moving in a tightening direction in response to pulling a loop tightening segment of the tensioning cable.
Figure 37:
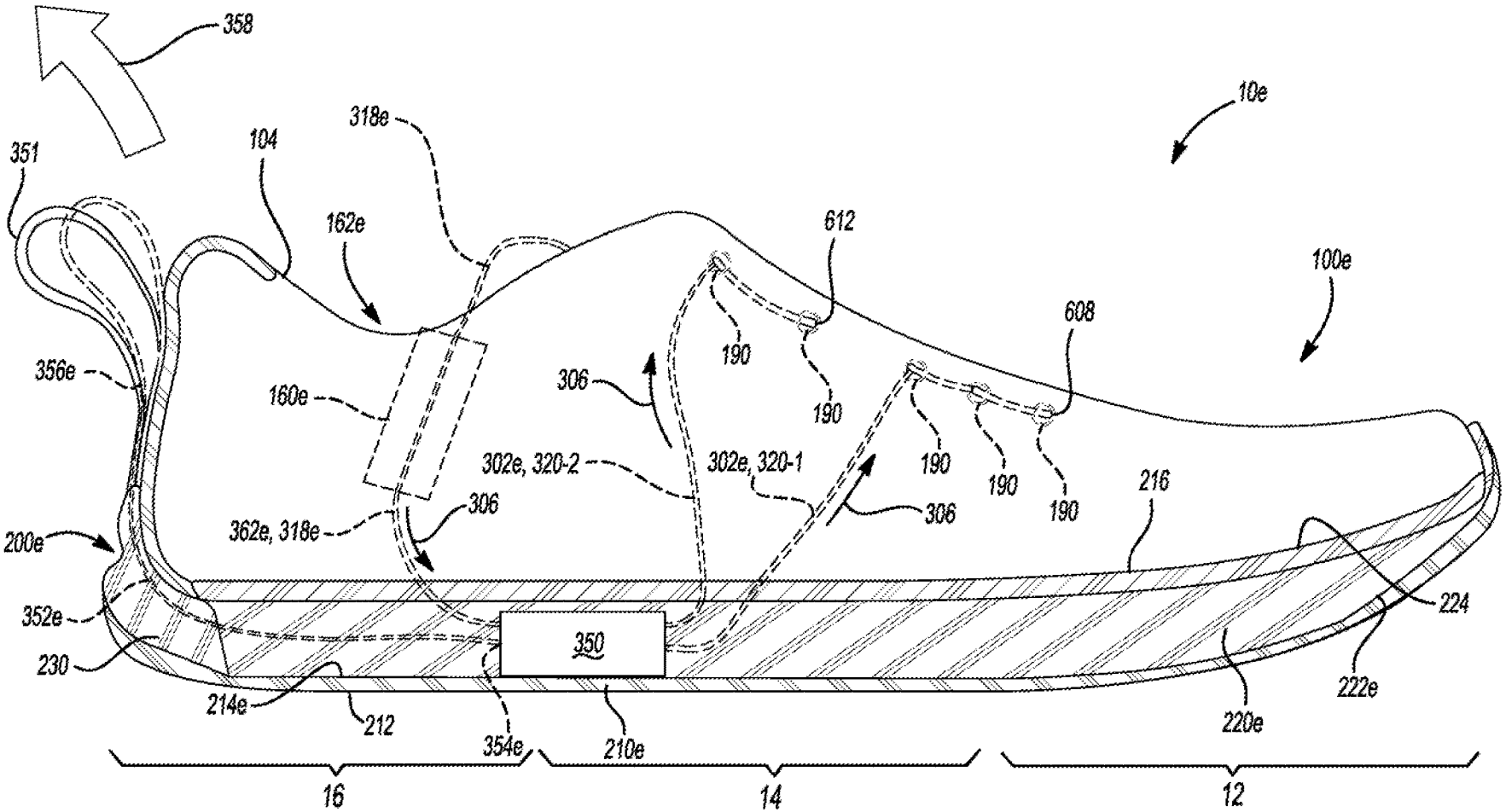
FIG. 37 is an alternate cross-sectional view taken along line 36-36 of FIG. 35 showing a tensioning cable moving in a loosening direction in response to applying a release force to a release cord.

Referring to FIGS. 35-41, in some implementations, an article of footwear 10*e* includes an upper 100*e*, a sole structure 200*e* attached to the upper 100*e*, and a tightening mechanism 300*e* operable to move the upper 100*e* between a tightened state (FIG. 36) and a loosened state (FIG. 37). In view of the substantial similarity in structure and function of the components associated with the article of footwear 10 with respect to the article of footwear 10*e*, like reference numerals are used hereinafter and in the drawings to identify like components while like reference numerals containing letter extensions are used to identify those components that have been modified.

The sole structure 200*e* may include an outsole 210*e* and a midsole 220*e* arranged in a layered configuration. The outsole 210*e* includes an inner surface 214*e* disposed on the opposite side of the outsole 210*e* than the ground-engaging surface 212, while the midsole 220*e* includes a bottom surface 222*e* disposed on the opposite side of the midsole 220*e* than the footbed 224. The insole 216 or sockliner may be received within an interior void 102*e* upon the footbed 224.

The upper 100*e* may be formed from the flexible material forming the upper 100 of FIGS. 1-6 to from the interior void 102*e* and to transition between a tightened state and a loosened state for adjusting the fit of the interior void 102*e* around the foot. The upper 100*e* defines the ankle opening 104 in the heel portion 16 to provide access to the interior void 102*e*. A throat opening 140 corresponding to an instep of the foot, extends between a lateral edge 142 and a medial edge 144 of the upper 100*e* from the ankle opening 104 to an area adjacent the forefoot portion 12. In some examples, the upper 100*e* includes a series of lateral apertures 180 (e.g., eyelets) that extend along the lateral edge 142 of the throat opening 140 and a series of medial apertures 190 (e.g., eyelets) (FIGS. 36-39) that extend along the medial edge 144 of the throat opening 140. In some implementations, the tightening mechanism 300*e* includes at least one tensioning cable 302*e* that routes through the apertures 180, 190 and attaches to the upper 100*e* at one or more locations to automatically move the upper 100*e* between the tightened state and the loosened state when the tightening mechanism 300*e* moves between corresponding ones of a tightened state and a loosened state. For instance, movement by the tightening mechanism 300*e* in the tightened state cinches the upper 100*e* by drawing the lateral and medial edges 142 and 144 toward one another to close or constrict the throat opening 140 such that the interior void 102*e* closes around a foot of a user in a similar fashion as described above with respect to the article of footwear 10-10*d*. Here, the tensioning cable 302*e* is movable in the tightening direction 304 to move the tightening mechanism 300*e* into the tightened state. Conversely, movement by the tightening mechanism 300*e* in the loosened state relaxes the upper 100*e* to open the interior void 102*e* for removal of the foot therefrom. Here, the tensioning cable 302*e* is movable in the loosening direction 306 to move the tightening mechanism 300*e* into the loosened state. In other configurations, the upper 100*e* may include loops or other engagement features instead of the apertures 180, 190.

A plurality of fastening members 106-1, 106-2, 106-3, 106-4, 106-5 may extend across the throat opening 140 between the lateral edge 142 and the medial edge 144 at various positions. For instance, each fastening member 106-1, 106-2, 106-3, 106-4, 106-5 may extend between a corresponding opposing pair of apertures 180, 190. The fastening members 106-1, 106-2, 106-3, 106-4, 106-5 may provide cushioning and disperse tension applied by the tensioning cable 302*e* against a top of a foot of the wearer. The fastening members 106-1, 106-2, 106-3, 106-4, 106-5 may also provide aesthetic qualities by hiding the routing of the tensioning cable 302*e* when extending across the throat opening.

In some implementations, the tensioning cable 302*e* defines a length extending between a first end 308*e* (FIGS.

36-39) and a second end 312*e* (FIGS. 36-39) each operatively connected to the upper 100*e* at a corresponding attachment location 608 and 612 adjacent to the throat opening 140 along one of the medial edge 144 or the lateral edge 142. The locking device or cable lock 350 may be disposed within the midfoot portion 14 of the sole structure 200*e* and the tensioning cable 302*e* may extend through the locking device 350 to define a first lace segment 320-1 between the first end 308*e* of the tensioning cable 302*e* (i.e., at the attachment location 608) and the locking device 350, and a second lace segment 320-2 between the second end 312*e* of the tensioning cable 302*e* (i.e., at the attachment location 612) and the locking device 350. Additionally, the tensioning cable 302*e* defines a loop tightening segment 318*e* that may extend around the tongue portion 110 proximate to where the ankle opening 104 and the throat opening 140 meet (i.e., at a location above the instep of the wearer's foot).

The tensioning cables 302*e* may be highly lubricious and/or be formed from one or more fibers having a low modulus of elasticity and a high tensile strength. For instance, the fibers may include high modulus polyethylene fibers having a high strength to weight ratio and very low elasticity. Additionally or alternatively, the cable 302*e* may be formed from a molded monofilament polymer and/or woven steel with or without other lubrication coating. In some examples, the cable 302*e* includes multiple strands of material woven together.

As with the tensioning cable 302 of FIGS. 1-6, the tensioning cable 302*e* may be routed through various channels or panels formed by the upper 100*e* and the sole structure 200*e*. In some implementations, the outsole 210*e* and the midsole 220*e* cooperate to provide passages for routing portions of the tensioning cable 302*e* proximate to the locking device 350 while the upper 100*e* defines passages for the lace segments 320-1, 320-2 of the tensioning cable 302*e* to the corresponding ends 308*e*, 312*e* operatively connected (e.g., attached) to the upper 100*e* at respective ones of the attachment locations 608, 612, as well as the loop tightening segment 318*e* to an exposed portion extending around the tongue portion 110. For instance, the lateral side 18 and the medial side 20 of the upper 100*e* may each define a corresponding passage between interior and exterior surfaces thereof for guiding portions of the tensioning cable 302*e* along respective ones of the lace segments 320-1, 320-2. These passages may include a greater cross-sectional area than a diameter of the cable 302*e* to accommodate bunching of the cable 302*e* in a similar fashion as described above with respect to conduits 160, 170.

Moreover, the upper 100*e* may define a passage along the heel portion 16 for guiding portions of a release mechanism 352*e* (e.g., release cord) that transitions the locking device 350 from the locked state to the unlocked state for permitting the tensioning cable 302*e* to move in both directions 304, 306. For instance, the release cord 352*e* may be pulled to transition the locking device 350 to the unlocked state and may extend from a first end 354*e* attached to the locking device 350 to a second end 356*e* exposed from the upper 100*e* to permit a user to grip and pull the release cord 352*e* for moving the locking device 350 from the locked state to the unlocked state. In some examples, the second end 356*e* of the release cord 352*e* includes a loop and/or gripping feature to allow a user to grip and pull the release cord 352*e* when it is desirable to move the locking device 350 into the unlocked state and/or release the locking device 350 from the unlocked state. The example footwear 10*e* shows the second end 356*e* of the release cord 352*e* attached to, and enclosed within, a sheath 357 (FIGS. 36 and 37) that allows a user to apply the release force 358 (e.g., predetermined force) (FIG. 37) to the sheath 357 and/or the second end 356*e* of the cable 352*e* to move the locking device 350 to the unlocked state. The sheath 357 may include a fabric material attached to the exterior surface of the upper 100*e* to define a sleeve or passage for guiding and enclosing portions of the release cord 352*e* that extend out of the sole structure 200*e* and operably connect the release cord 352*e* at the second end 356*e*. The sleeve or passage defined by the sheath 357 may include an inner cavity or space having a larger cross-sectional area than an outer diameter of the release cord 352*e* to accommodate bunching by the release cord 352*e* when the pulling force 358 is released and/or to facilitate movement of the cord 352*e* within the passage. In other examples, the second end 356*e* of the release cord 352*e* can be disposed proximate to other regions of the footwear 10*e* such as at or near the tongue portion 110, the lateral side 18 or the medial side 20 of the upper 100*e*, or the sole structure 200*e*.

In some configurations, the tensioning cable 302*e* is movable in the tightening direction 304 when a pulling force 322*e* is applied to the loop tightening segment 318*e* to pull the loop tightening segment 318*e* away from the upper 100*e* to draw the lateral and medial edges 142, 144 of the throat opening 140 together, and thereby move the upper 100*e* into the tightened state. For example, once a foot is received by the interior void 102*e* and supported upon the sole structure 200*e*, the upper 100*e* may be automatically tightened to secure the fit of the interior void 102*e* around the foot by applying the pulling force 322*e* to the loop tightening segment 318*e* without the need of having to manually tie shoe laces or manually fasten other fasteners to tighten the upper 100*e*. FIG. 36 provides a cross-sectional view taken along line 36-36 of FIG. 35 showing the tensioning cable 302*e* moving through the locking device 350 in the tightening direction 304 to cause lengths of the lace segments 320-1, 320-2 of the tensioning cable 302*e* to decrease and the length of the loop tightening segment 318*e* to increase. Here, the decrease in length by the lace segments 320-1, 320-2 is operative to close the throat opening 140, thereby cinching and tightening the upper 100*e* around the foot such that the foot is secured within the interior void 102*e* while supported upon the sole structure 200*e*. As with the pulling force 322 applied to the tightening grip 310 of FIGS. 1-6, the fit of the interior void 102*e* around the foot may be adjustable based upon a magnitude and/or duration of the pulling force 322*e* applied to the loop tightening segment 318*e*.

In some implementations, at least one first conduit 160*e* surrounds a portion of the tensioning cable 302*e* along the loop tightening segment 318*e* when the tensioning cable 302*e* moves relative to the first conduits 160*e*. Here, the first conduit 160*e* accommodates bunching by the tensioning cable 302*e* when the tensioning cable 302*e* moves in the tightening direction 304 in a similar fashion as the first conduits 160 of FIGS. 7-16 (i.e., FIGS. 8, 9, and 13). For instance, FIG. 36 shows the first conduit 160*e* accommodating bunching by the loop tightening segment 318*e* once the pulling force 322*e* is released after moving the cable 302*e* in the tightening direction 304. However, while the first conduit(s) 160 of FIGS. 7-16 extends proximate to the heel portion 16, a pair of first conduits 160*e* of the article of footwear 10*e* extend along respective ones of the lateral and medial sides 18, 20 of the upper 100*e* in a similar fashion as the second conduit(s) 170 of FIGS. 7-16. Without the use of the first conduits 160*e* to accommodate bunching by the tensioning cable 302*e* once the pulling force 322*e* is released, increases to the length of the loop tightening segment 318*e* can result in the tensioning cable 302*e* becoming tangled and/or being susceptible to catching on features of the footwear 10*e* such that the tensioning cable 302*e* may be inhibited from responsively and fluently moving in either of the directions 304, 306 when desired.

FIG. 37 provides an alternate cross-sectional view taken along line 36-36 of FIG. 35 showing the upper 100*e* transitioning to the loosened state responsive to the release force 358 applied to the release cord 352*e*. For instance, as the locking device 350 transitions from the locked state to the unlocked state, the tensioning cable 302*e* is permitted to move in the loosening direction 306 when the foot moves and/or the user pulls the tongue portion 110 to loosen the fit of the interior void 102*e*. Here, movement by the tensioning cable 302*e* in the loosening direction 306 causes the lengths of the segments 320-1, 320-2 to increase to allow the throat opening 140 to open, thereby relaxing the upper 100*e* to facilitate the transition from the tightened state to the loosened state such that a foot can be removed from the interior void 102*e*. Other configurations of the footwear 10*e* may include one or more second conduits 170 surrounding portions of at least one of the segments 320-1, 320-2 to accommodate bunching thereof when the segments 320-1, 320-2 are moved in the loosening direction 306.

Figure 38:
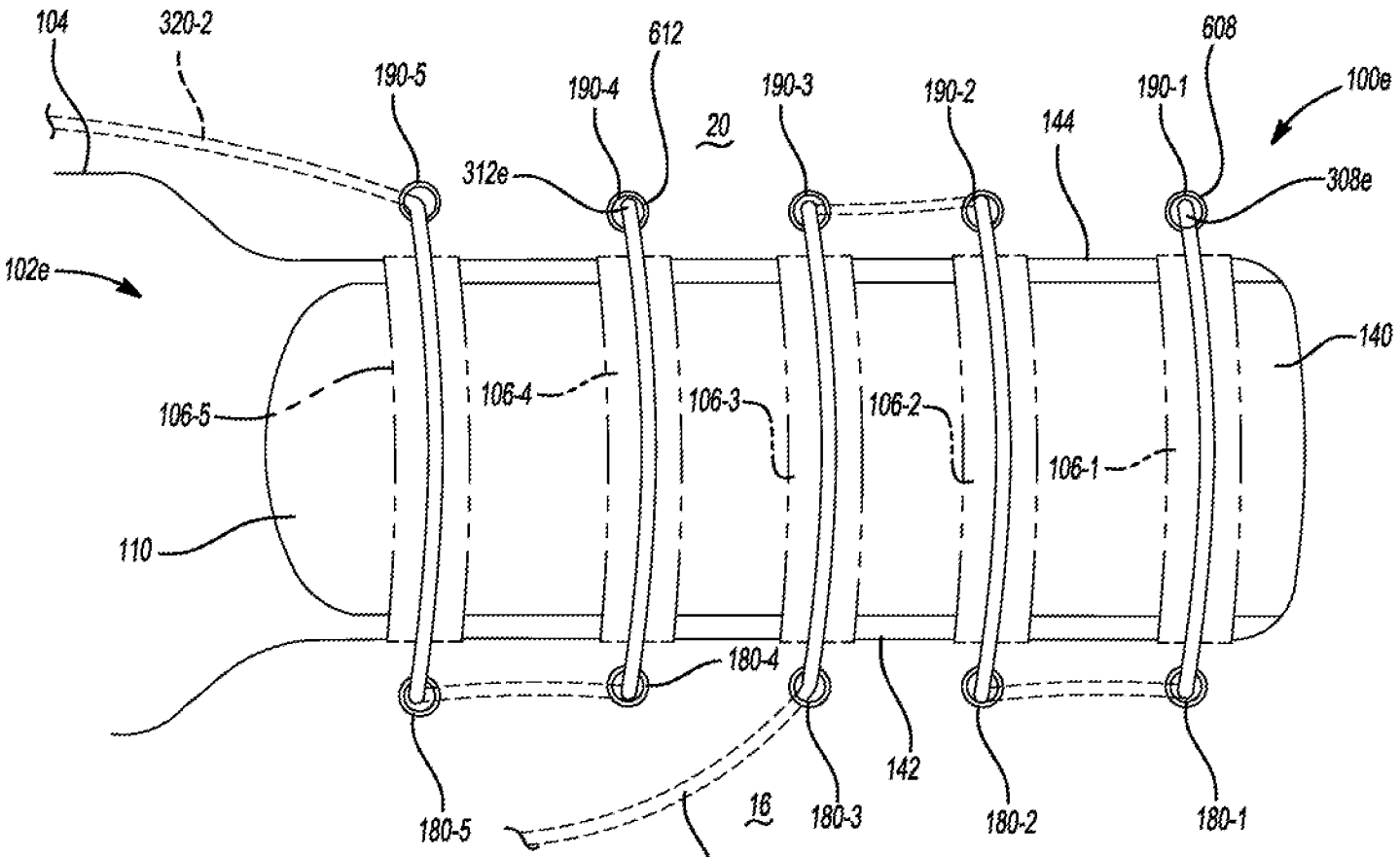
FIG. 38 is a partial top view of an upper of the article of footwear of FIG. 35 showing a first lacing pattern for a first lace segment operatively connected to the upper and a second lacing pattern for a second lace segment operatively connected to the upper.

FIG. 38 is a partial top view of the upper 100*e* showing lacing patterns of the first and second segments 320-1, 320-2 of the tensioning cable 302*e* attached to the upper 100*e* at their corresponding attachment locations 608, 610 disposed adjacent the medial edge 144 of the throat opening 140. In other configurations, at least one of the attachment locations 608, 610 may be disposed adjacent to the lateral edge 142 of the throat opening 140. The fastening members 106-1, 106-2, 106-3, 106-4, 106-5 extending across the throat opening 140 between corresponding opposing pairs of the lateral and medial apertures 180, 190 are shown as phantom lines to provide clarity for depicting the respective lacing patterns of the first and second lace segments 320-1, 320-2. Portions of the segments 320-1, 320-2 extending across the throat opening 140 between the lateral and medial edges 142, 144 may be fed through, and concealed by, the fastening members 106-1, 106-2, 106-3, 106-4, 106-5.

FIG. 38 shows a first lace pattern of the first lace segment 320-1 that extends along the lateral side 18 of the upper 100*e* and fed through a third lateral aperture 180-3, across the throat opening 140 from the lateral edge 142 to the medial edge 144, and through a third medial aperture 190-3 adjacent to the medial edge 144. Thereafter, the first lace segment 320-1 feeds through the upper 100*e* along the medial edge 144 of the throat opening 140 from the third medial aperture 190-3 and out a second medial aperture 190-2, across the throat opening 140 from the medial edge 144 to the lateral edge 142, and through a second lateral aperture 180-2 adjacent the lateral edge 142. Finally, the first lace segment 320-1 feeds through the upper 100*e* along the lateral edge 142 of the throat opening 140 from the second lateral aperture 180-2 and out a first lateral aperture 180-1, across the throat opening 140 from the lateral edge 142 to the medial edge 142, and operatively connects to the upper 100*e* at the attachment location 608 proximate to a first medial aperture 190-1 adjacent the medial edge 144. In some examples, the first end 308*e* of the tensioning cable 302*e* associated with the free end of the first lace segment 320-1 includes a mounting feature (e.g., a ball) having a larger diameter than the corresponding first medial aperture 190-1 for anchoring the first lace segment 320-1 to the upper 100*e* at the attachment location 608. However, the first lace segment 320-1 may operatively connect to the upper 100*e* at the attachment location 608 using any attachment/fastening technique.

A second lace pattern of the second lace segment 320-2 extends along the medial side 20 of the upper 100*e* and feeds through a fifth medial aperture 190-5, across the throat opening 140 from the medial edge 144 to the lateral edge 142, and through a fifth lateral aperture 180-5 adjacent to the lateral edge 142. Thereafter, the second lace segment 320-2 feeds through the upper 100*e* along the lateral edge 142 of the throat opening 140 from the fifth lateral aperture 180-5 and out a fourth lateral aperture 180-4, across the throat opening 140 from the lateral edge 142 to the medial edge 144, and operatively connects to the upper 100*e* at the attachment location 612 proximate to a fourth medial aperture 190-4 adjacent the medial edge 144. In some examples, the second end 312*e* of the tensioning cable 302*e* associated with the free end of the second lace segment 320-2 includes a mounting feature (e.g., a ball) having a larger diameter than the corresponding fourth medial aperture 190-4 for anchoring the second lace segment 320-2 to the upper 100*e* at the attachment location 612. However, the second lace segment 320-2 may operatively connect to the upper 100*e* at the attachment location 612 using any attachment/fastening techniques.

In some implementations, the first lacing pattern associated with the first lace segment 320-1 and the second lacing pattern associated with the second lace segment 320-2 is selected so that a total closure distance between the lateral edge 142 and the medial edge 144 of the throat opening 140 according to the first lacing pattern is approximately equal to a total closure distance between the lateral edge 142 and the medial edge 144 of the throat opening 140 according to the second lacing pattern. Moreover, when the tensioning cable 302*e* moves in the tightening direction 304, a take-up distance of the first lace segment 320-1 is approximately equal to a take-up distance of the second lace segment 320-2. Thus, the take-up distance of the first lace segment 320-1 is approximately equal to the total closure distance between the lateral edge 142 and the medial edge 144 of the throat opening 140 according to the first lacing pattern, while the take-up distance of the second lace segment 320-2 is approximately equal to the total closure distance between the lateral edge 142 and the medial edge 144 of the throat opening 140 according to the second lacing pattern. Accordingly, the lacing patterns associated with the first and second lace segments 320-1, 320-2 of the tensioning cable 302*e* may uniformly distribute tension across the throat opening when the tensioning mechanism 300*e* transitions to the tightened state.

In some implementations, the plurality of fastener members 106-1, 106-2, 106-3, 106-4, 106-5 each define a respective lace position representing locations where the first lace segment 320-1 or the second lace segment 320-1 crosses between the lateral edge 142 and the medial edge 144 of the throat opening. As used herein, the terms lace position and fastener member may be used interchangeably. Here, the fastener members 106-1, 106-2, 106-3, 106-4, 106-5 may provide the footwear 10*e* with a similar visual appearance as a conventional footwear upper with conventional tied laces.

Figure 39:
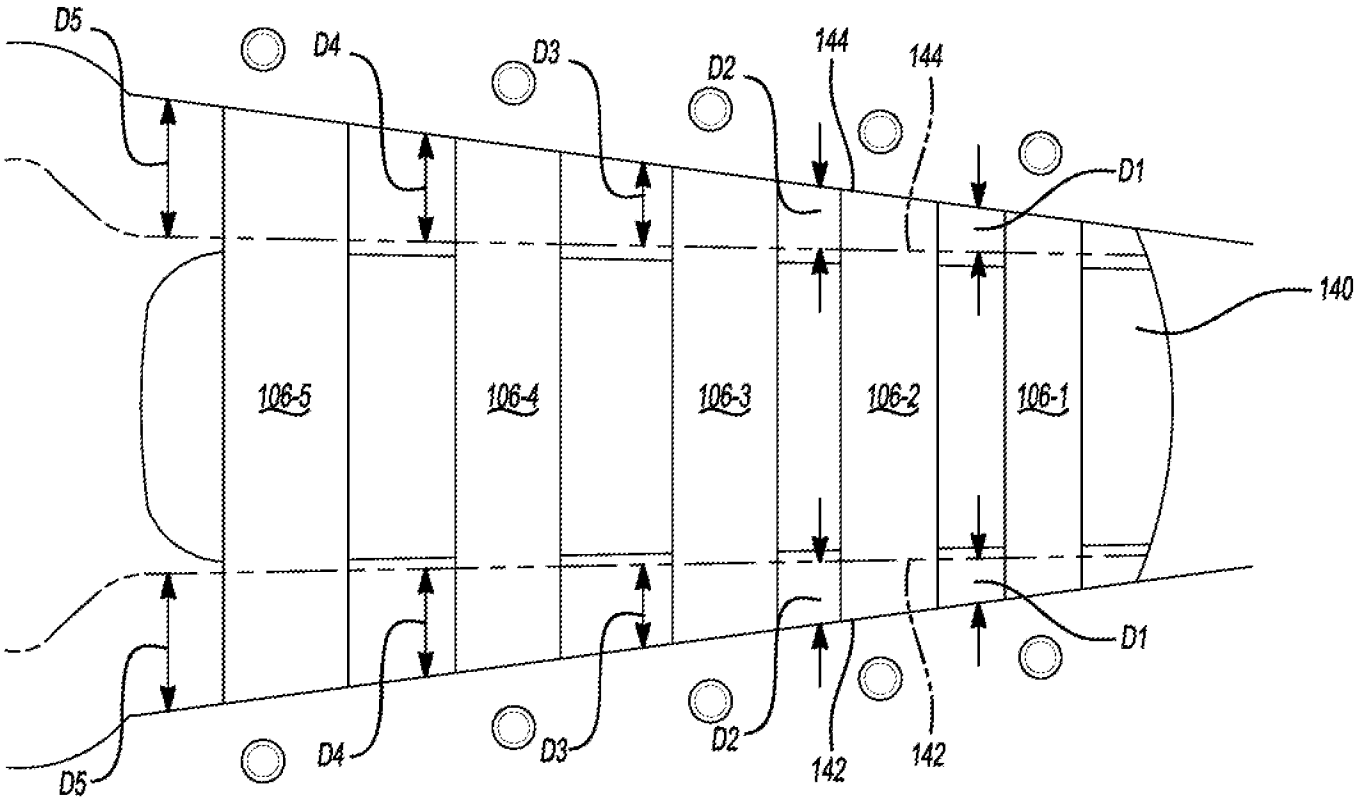
FIG. 39 is a partial top view of an upper of the article of footwear of FIG. 35 showing closure distances defined by a lateral edge and a medial edge for a throat opening defined by the upper.

Referring to FIG. 39, a partial top view of the upper 100*e* shows the first lace position 106-1, the second lace position 106-2, the third lace position 106-3, the fourth lace position 106-4, and the fifth lace position 106-5 extending in sequential order from throat opening 140 at the front or toe end of the footwear 10*e* toward the ankle opening 104. When the throat opening 140 is in a loosened position, the lateral and medial edges 142, 144 of the throat opening 140 are furthest apart from another. The lateral and medial edges 142, 144 of the throat opening 140 are additionally depicted by phantom lines to illustrate the position of the edges 142, 144 when the throat opening 140 is in a tightened position and the edges 142, 144 are closest to one another. Thus, the lateral and medial edges 142, 144 move a predetermined distance when moving between their respective locations in the loosened position and the tightened position, such that the predetermined position is associated with the closure distance that each of the edges 142, 144 travel when transitioning between the loosened position and the tightened position. In some configurations, the first lace position 106-1 can have a first closure distance D1, the second lace position 106-2 can have a second closure distance D2, the third lace position 106-3 can have a third closure distance D3, the fourth lace position 106-4 can have a fourth closure distance D4, and the fifth lace position 106-5 can have a fifth closure distance D5. In these configurations, the closure distances between the lateral and medial edges 142, 144 is about twice the total closure distance for the respective lace position. For instance, the total closure distance between the lateral edge 142 and the medial edge 144 at the fifth lace position 106-5 is about double the fifth closure distance D5. In other words, the lateral edge 142 moves the fifth closure distance D5 between the tightened and loosened positions while the medial edge 144 also moves the fifth closure distance D5 between the tightened and loosened positions.

The take-up distance may refer to a distance that each one of the first lace segment 320-1 and the second lace segment 320-2 moves in the tightening direction 304 as the tightening mechanism transitions from the loosened state to the tightened state. In some examples, the take-up distance for each one of the first lace segment 320-1 and the second lace segment 320-2 refers to the amount of corresponding lace the locking mechanism collects in response to application of the pulling force to the tightening loop segment 318*e*. In some implementations, the take-up distances associated with each of the lace segments 320-1, 320-2 are substantially equal to one another when the tightening mechanism 300*e* is in the tightened state. In these implementations, the take-up distance of the first lace segment 320-1 is substantially equal to the total closure distance between the lateral edge 142 and the medial edge 144 of the throat opening according to the first lacing pattern, while the take-up distance of the second lace segment 320-2 is substantially equal to the total closure distance between the lateral edge 142 and the medial edge 144 of the throat opening according to the second lacing pattern.

In some implementations, when the tightening mechanism 300*e* is in the tightened state, the total closure distance between the lateral edge 142 and the medial edge 144 of the throat opening 140 is equal to twice the sum of the first closure distance D1 of the first lace position 106-1, the second closure distance D2 of the second lace position 106-2, and the third closure distance D3 of the third lace position 106-3. Similarly, the total closure distance between the lateral edge 142 and the medial edge 144 of the throat opening 140 is equal to twice the sum of the fourth closure distance D4 of the fourth lace position 106-4 and the fifth closure distance D5 of the fifth lace position 106-5.

Figure 40:
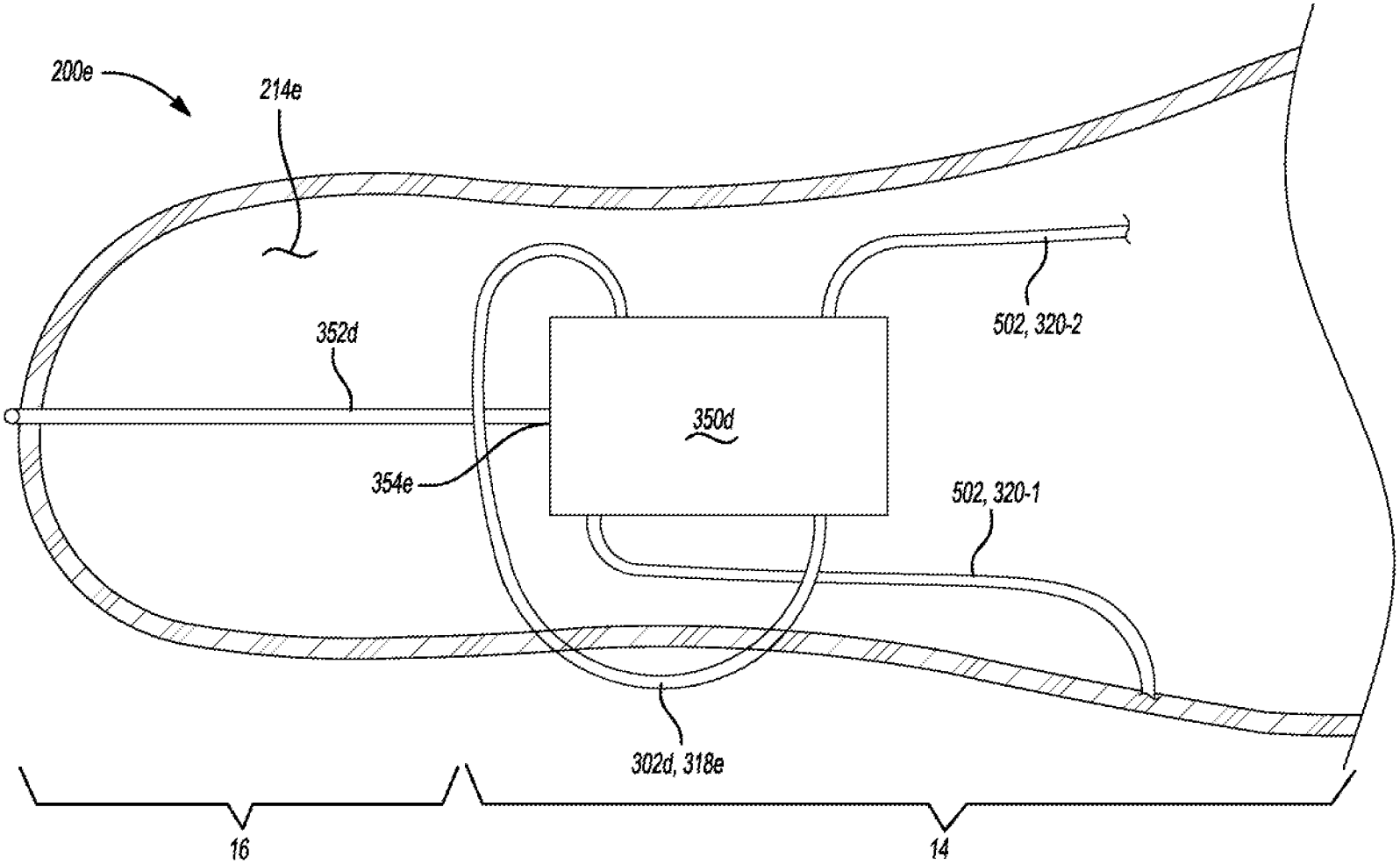
FIG. 40 is a partial cross-sectional top view of an outsole of the article of footwear of FIG. 35 supporting the locking device of FIGS. 29-34.

FIG. 40 provides a partial cross-sectional top view of the sole structure 200*e* with the midsole 220*e* removed and the locking device 350*d* of FIGS. 29-34 disposed upon the inner surface 214*e* of the outsole 210*e* and biased in the locked state to restrict movement of the tensioning cables 302*d*, 502 in their respective loosening directions. In the example shown, the first tensioning cable 302*d* is a continuous loop corresponding to the loop tightening segment 318*e* configured to receive the pulling force 322 for moving the tensioning cables 302, 502 in the tightening direction 304. Moreover, the second tensioning cable 502 includes both free ends 508 and 512 extending out of the locking device 350*d* to define the first lace segment 320-1 extending between the locking device 350*d* and the first end 508, and also the second lace segment 320-2 extending between the locking device 350*d* and the second end 512. Here, the first end 508 and the second end 512 are operatively connected to the upper 100*e* at the corresponding attachment locations 608, 612. The release mechanism 352*d* may extend to the rear of the footwear 10*e* at the heel region 16 for receiving the release force 358 to transition the locking device 350*d* from the locked state to the unlocked state.

Figure 41:
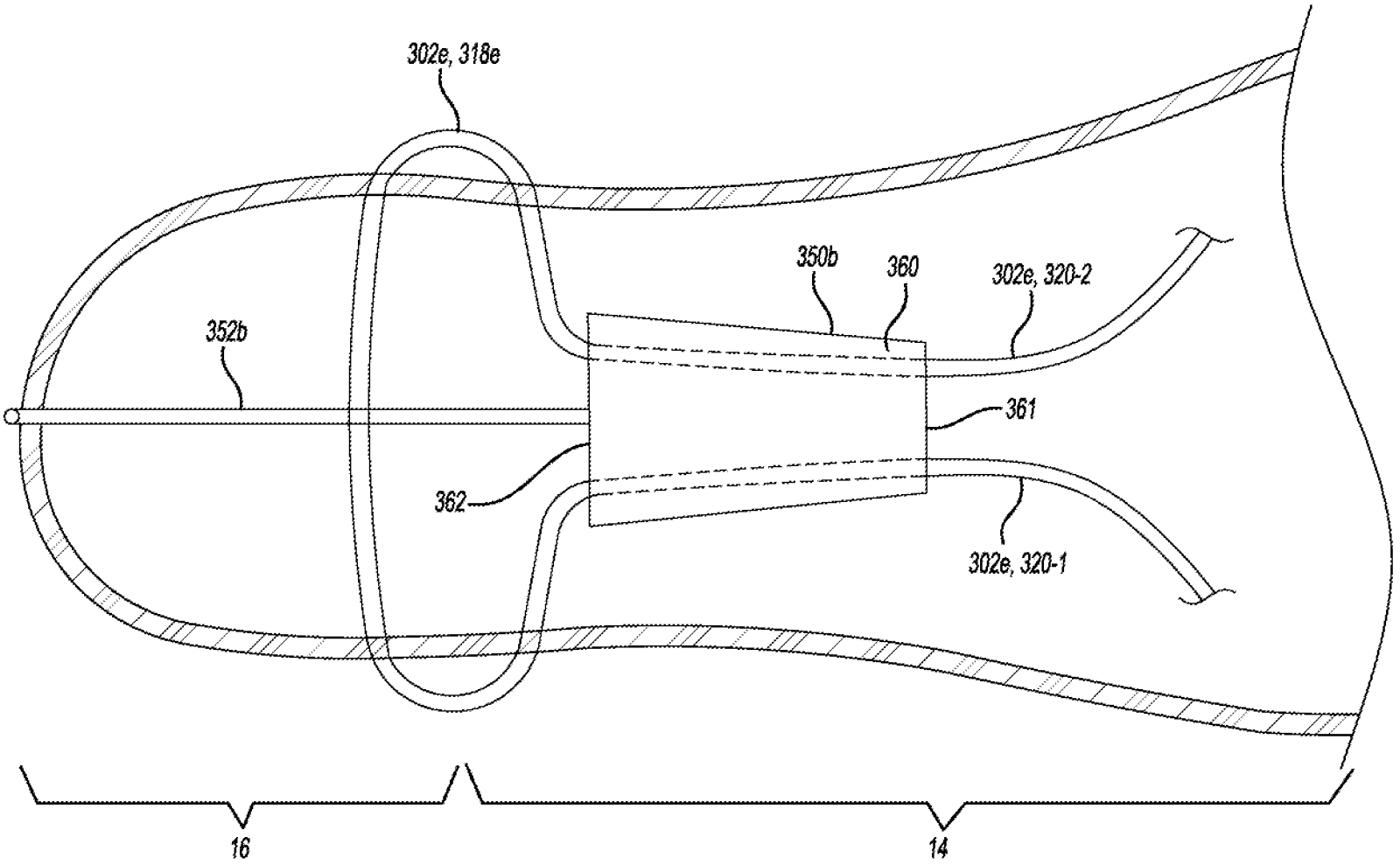
FIG. 41 is a partial cross-sectional top view of an outsole of the article of footwear of FIG. 35 supporting the locking device of FIGS. 17-23.

FIG. 41 provides a partial cross-sectional top view of the sole structure 200*e* with the midsole 220*e* removed and the wedge-shaped locking device 350*b* of FIGS. 17-23 disposed upon the inner surface 214*e* of the outsole 210*e* and biased in the locked state to restrict movement of the tensioning cables 302*d*, 502 in their respective loosening directions. In the example shown, locking device 350*b* is rotated 180-degrees (180°) from the position shown in FIGS. 17-23 such that the first end 361 of the housing 360 opposes the toe end of the footwear 10*e* and the second end 362 of the housing 360 opposes the heel end of the footwear 10*e* when the housing 360 is disposed within the cavity of the sole structure 200*e*. FIG. 41 shows the loop tightening segment 318*e* extending out of the second end 362 of the housing 360 while the first and second lace segments 320-1, 320-2 of the tensioning cable 302*e* extend from the first end 361 of the housing 360 of the wedge-shaped locking device 350*b*. With the second 362 of the housing 360 now opposing the heel end of the footwear 10*e*, release cord 352*b* may extend to the rear of the footwear 10*e* at the heel region 16 for receiving the release force 358 to transition the locking device 350*b* from the locked state to the unlocked state.

While the locking devices or cable locks 350, 350*b*, 350*c*, 350*d* of FIGS. 1-41 described above are described as being disposed within the sole structure 200-200*e* of the footwear 10-10*e* underneath the foot and within the heel portion 16 of the sole structure 200-200*e*, the locking devices 350, 350*b*, 350*c*, 350*d* may be disposed at other locations without departing from the scope of the present disclosure. For instance, the locking devices 350, 350*b*, 350*c*, 350*d* may be located at the midfoot portion 14 or the forefoot portion 12 of the sole structure 200-200*d*, or in other configurations, one of the locking devices 350, 350*b*, 350*c*, 350*d* may be disposed upon exterior surfaces of the footwear 10-10*e*. For instance, the locking devices 350, 350*b*, 350*c*, 350*d* may be disposed upon exterior surfaces of the upper 100 at any suitable location. In some examples, one or more of the locking devices 350, 350*b*, 350*c*, 350*d* are disposed over the top of the foot (e.g., above the instep) on the upper 100 or the tongue portion 110. In other examples, one or more of the locking devices 350, 350*b*, 350*c*, 350*d* are disposed along the heel portion of the upper 100. The routing of the tensioning cable(s) 302-302*d* and/or 502 may be adapted based on the location of the locking device 350, 350*b*, 350*c*, 350*d* so that the upper 100 may be moved between the loosened state and the tightened state. Moreover, the locations of the loosening grip 314 and tightening grip 322 may be disposed at other locations.

Figure 45:
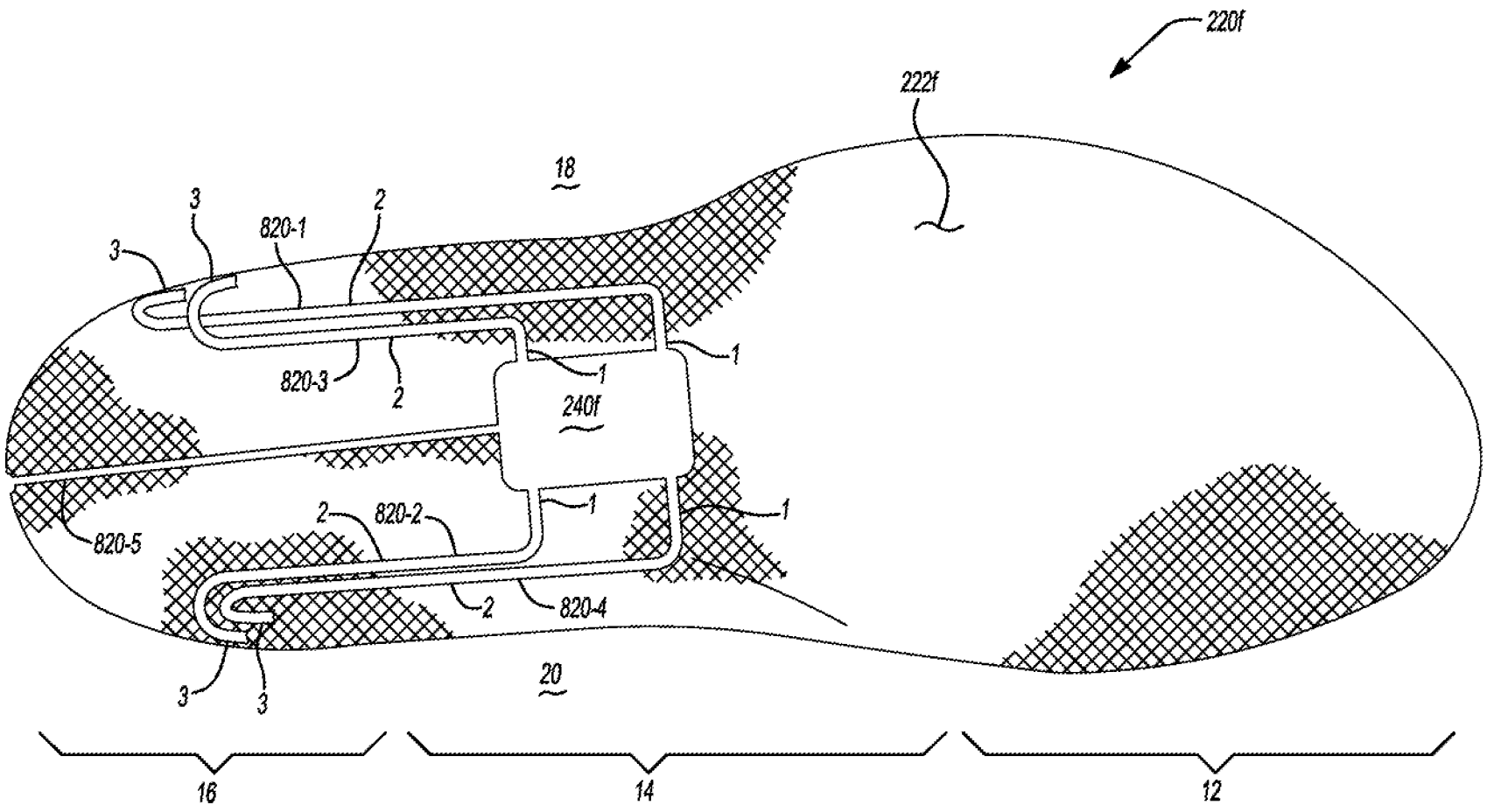
FIG. 45 is a bottom view of a midsole of the article of footwear of FIG. 42 showing a cavity and a plurality of passages formed through the bottom surface of the midsole for receiving the locking device and routing tensioning cables through the midsole.
Figure 46:
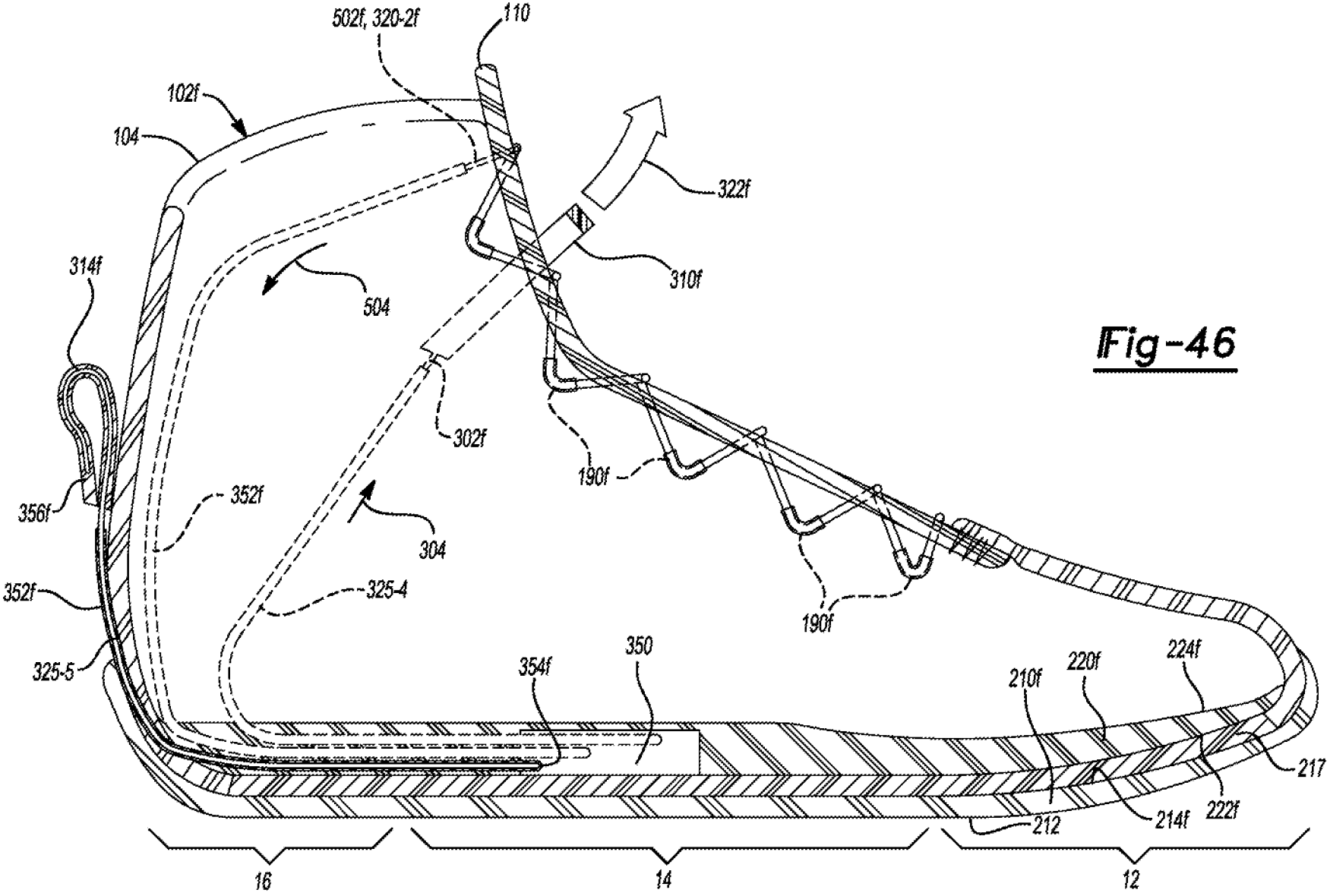
FIG. 46 is a cross-sectional view taken along line 46-46 of FIG. 42 showing first and second tensioning cables moving in tightening directions in response to pulling the first tensioning cable away from the article of footwear.
Figure 47:
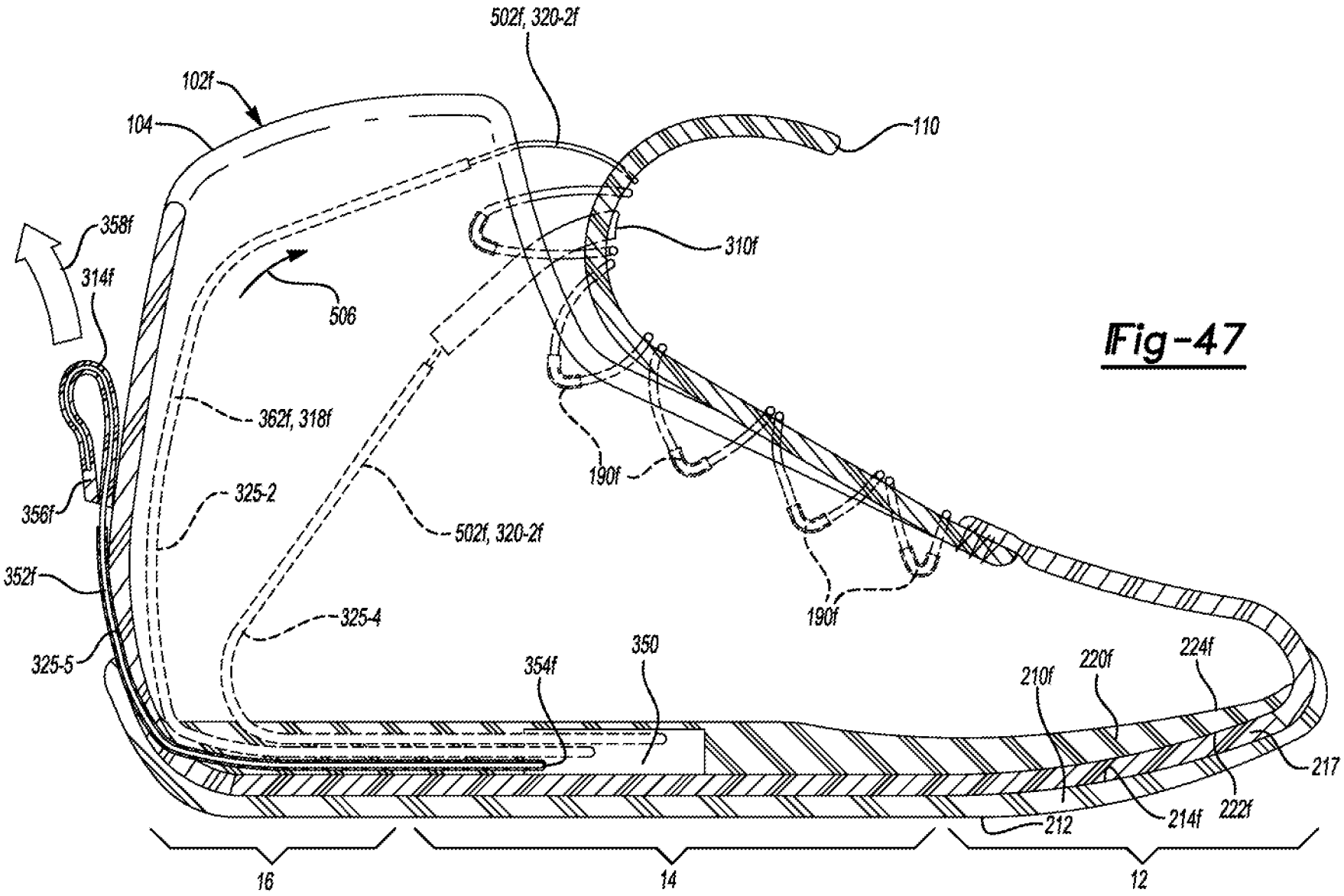
FIG. 47 is an alternate cross-sectional view taken along line 46-46 of FIG. 42 showing first and second tensioning cables moving in loosening directions in response to applying a release force to a release cord.

Referring to FIGS. 42-47, in some implementations, an article of footwear 10*f* includes an upper 100*f*, an outsole 210*f* attached to the upper 100*f*, a midsole 220*f*, and a tightening mechanism 300*f* operable to move the upper 100*f* between a tightened state (FIG. 46) and a loosened state (FIG. 47). In view of the substantial similarity in structure and function of the components associated with the article of footwear 10 with respect to the article of footwear 10*f*, like reference numerals are used hereinafter and in the drawings to identify like components while like reference numerals containing letter extensions are used to identify those components that have been modified.

Figure 42:
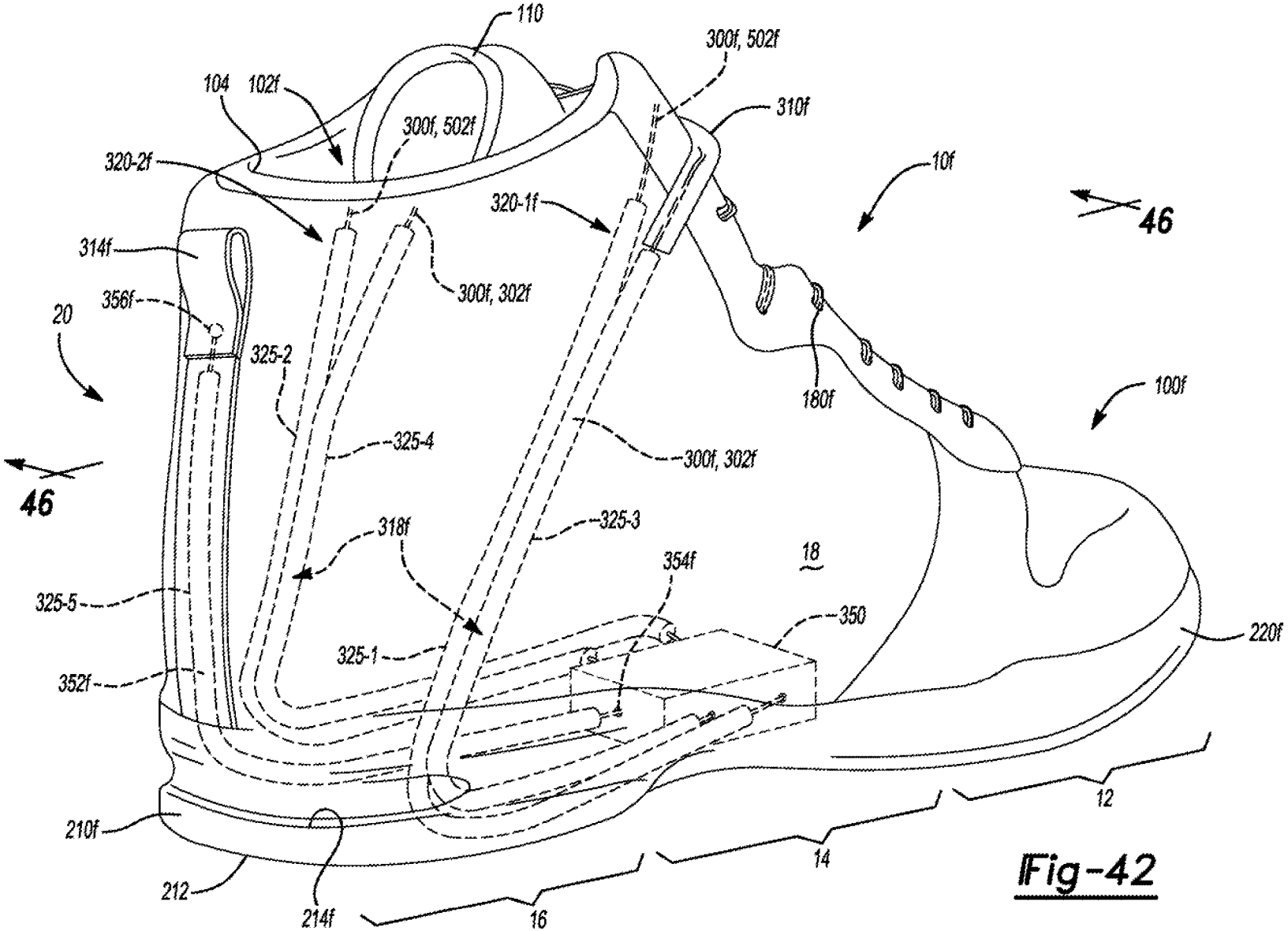
FIG. 42 is a top perspective view of an article of footwear having a locking device movable between a locked state to restrict movement of a tensioning cable and an unlocked state to permit movement of the tensioning cable in accordance with principles of the present disclosure.
Figure 43:
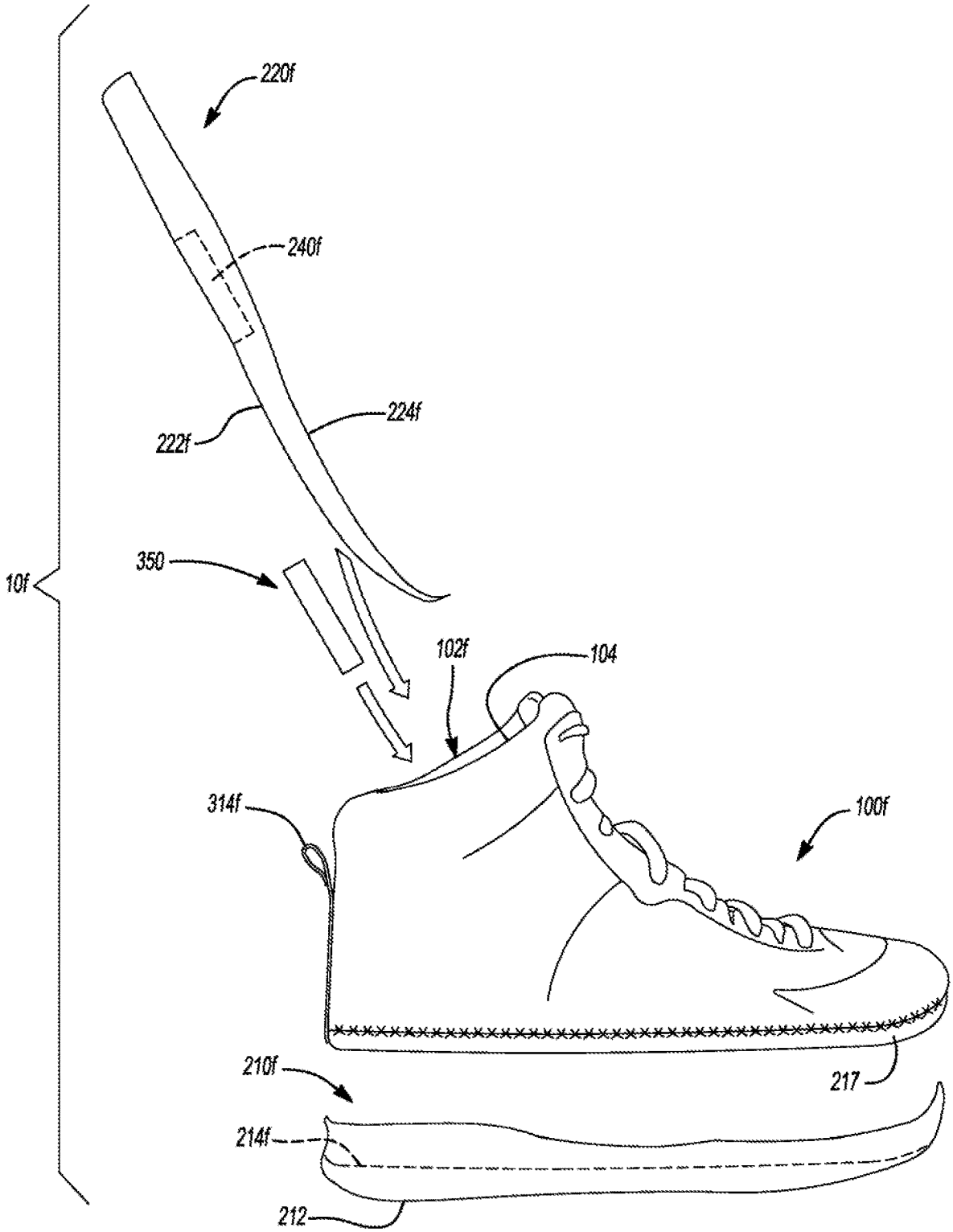
FIG. 43 is an exploded view of the article of footwear of FIG. 42 showing a drop-in midsole inserted into an interior void defined by an upper and an outsole attached to the upper.

The upper 100*f* may be formed from the flexible material forming the upper 100 of FIGS. 1-6 to from an interior void 102*f* and to transition between the tightened state and the loosened state for adjusting the fit of the interior void 102*f* around the foot. The upper 100*f* defines the ankle opening 104 in the heel portion 16 to provide access to the interior void 102*f*. The upper 100*f* further includes a strobel 217 extending around the perimeter of the upper 100*f* and having an interior surface opposing the upper 100*f* and an outer surface opposing the outsole 210*f*. FIG. 43 provides an exploded view of the footwear 10*f* of FIG. 42 showing the midsole 220*f* corresponding to a drop-in midsole received by the interior void 102*f* upon the strobel 217, while the outsole 210*f* attaches to exterior surfaces around the periphery of the upper 100*f* and to the outer surface of the strobel 217. For instance, the outsole 210*f* includes the ground-engaging surface 212 and an inner surface 214*f* disposed on the opposite side of the outsole 210*f* than the ground-engaging surface 212 and opposing the outer surface of the strobel 217. The midsole 220*f* includes a bottom surface 222*f* opposing the strobel 217 and a footbed 224*f* disposed on an opposite side of the midsole 220*f* than the bottom surface 222*f*. In some examples, an insole or sockliner is disposed upon the footbed 224*f* and is configured to receive the bottom surface of a foot. Accordingly, the outsole 210*f*, the strobel 217, and the midsole 220*f* are arranged in a layered configuration with the midsole 220*f* disposed within the interior void 102*f* of the upper 100*f* upon the strobel 217.

Figure 44:
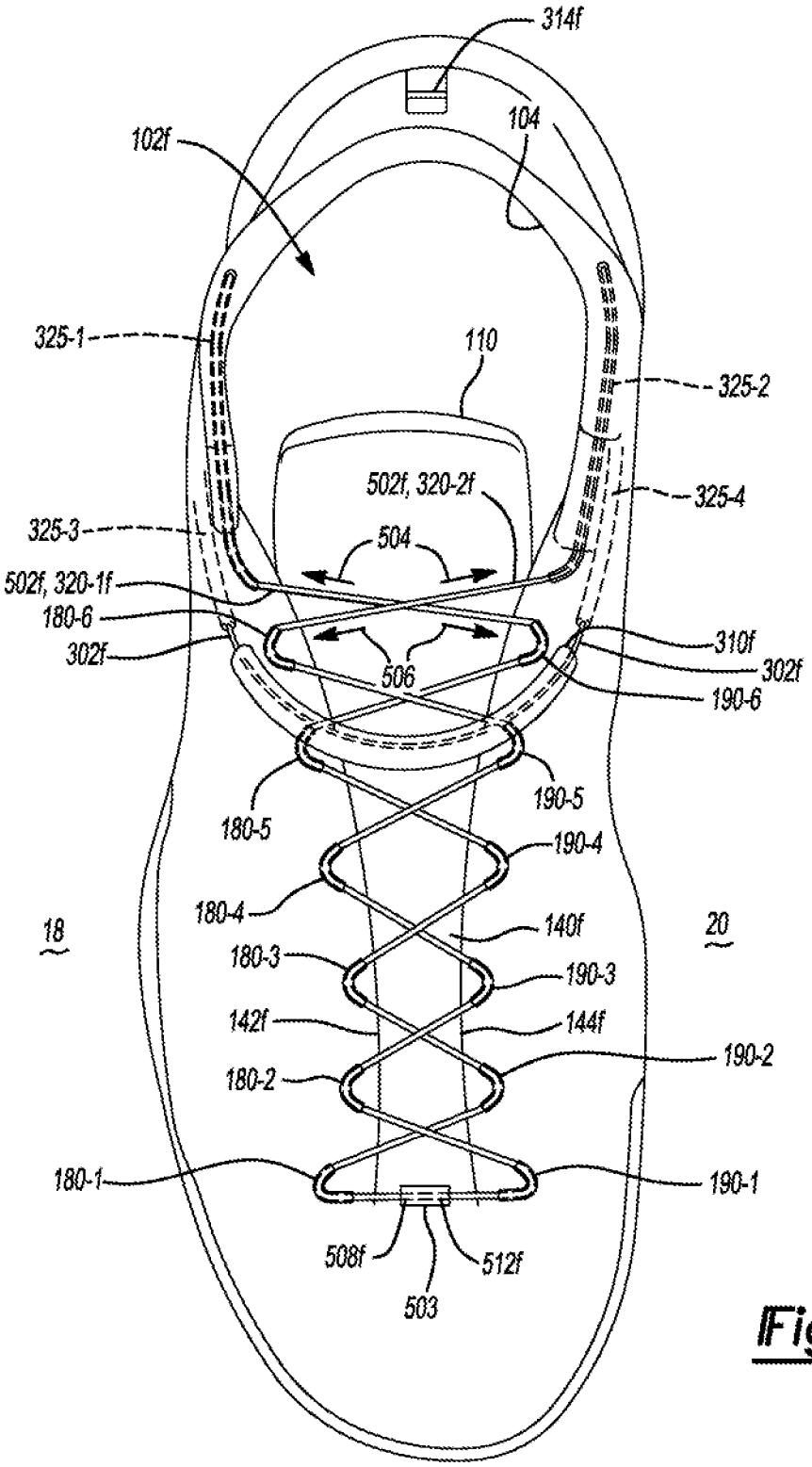
FIG. 44 is a top view of the article of footwear of FIG. 42 showing a first lacing pattern for a first lace segment extending from the locking device and a second lacing pattern for a second lace segment extending from the locking device and operatively connected to the first segment.

FIG. 44 is a top view of the footwear 10*f* showing the upper 100*f* including a throat opening 140*f* corresponding to an instep of the foot and extending between a lateral edge 142*f* and a medial edge 144*f* of the upper 100*f* from the ankle opening 104 to an area adjacent the forefoot portion 12. In some examples, the upper 100*f* includes a series of lateral engagement features or cable guides 180*f* that extend along the lateral edge 142*f* of the throat opening 140*f* and a series of medial engagement features or cable guides 190*f* that extend along the medial edge 144*f* of the throat opening 140*f*. With reference to FIGS. 42 and 44, in some implementations, the tightening mechanism 300*f* includes a first tensioning cable 302*f* defining a length 318*f* extending out of the locking device or cable lock 350, and a second tensioning cable 502*f* that routes through the engagement features or cable guides 180*f*, 190*f* and defines a length extending between a first end 508*f* and a second end 512*f* operatively connected to one another to automatically move the upper 100*f* between the tightened state and the loosened state when the tightening mechanism 300*f* moves between corresponding ones of a tightened state and a loosened state. For instance, movement by the tightening mechanism 300*f* in the tightened state cinches the upper 100*f* by drawing the lateral and medial edges 142*f* and 144*f* toward one another to close or constrict the throat opening 140*f* such that the interior void 102*f* closes around the foot. FIG. 46 shows the first tensioning cable 302*f* and the second tensioning cable 502*f* movable in corresponding tightening directions 304 and 504 to move the tightening mechanism 300*f* into the tightened state. Conversely, movement by the tightening mechanism 300*f* in the loosened state relaxes the upper 100*f* to open the interior void 102*f* for removal of the foot therefrom. FIG. 47 shows the tensioning cables 302*f* and 502*f* movable in corresponding loosening directions 306 and 506 to move the tightening mechanism 300*f* into the loosened state.

In some examples, the first tensioning cable 302*f* is a continuous loop extending from the locking device 350 around the tongue portion 110 proximate to where the ankle opening 104*f* and the throat opening 140*f* meet (i.e., proximate to above the instep of the wearer's foot). The exposed portion of the first tensioning cable 302*f* that extends around the tongue portion 110 may be enclosed within a sheath 310*f*. The sheath 310*f* may include a fabric material that imparts elastic properties and defines a sleeve or passage for guiding and enclosing the exposed portions of the first tensioning cable 302*f*. In some examples, the sheath 310*f* may correspond to a tightening grip that allows a user to apply a pull force 322*f* (FIG. 46) to pull the first tightening cable 302*b* away from the upper 100*f* to draw the lateral and medial edges 142*f*, 144*f* of the throat opening 140*f* together, and thereby move the upper 100*f* into the tightened state. The sheath 310*f* may accommodate bunching of the cable 302*f* after tightening of the cable 302*f* by providing the sheath 310*f* with an inner cavity or space having a larger cross-sectional area than an outer diameter of the cable 302*f* in a similar fashion as described above with respect to the conduits 160, 170.

The locking device 350 may be disposed within the midfoot portion 14 (also referred to as an instep portion) of the footwear 10*f* and the second tensioning cable 502*f* may extend through the locking device 350 to define a first lace segment 320-1*f* between the first end 508*f* of the tensioning cable 502*f* and the locking device 350 and a second lace segment 320-2*f* between the second end 512*f* of the second tensioning cable 502*f* and the locking device 350*f*. Accordingly, both free ends 508*f* and 512*f* may extend out of the locking device 350 and route through the engagement features or cable guides 180*f* and 190*f* before operatively connecting to one another at a distal end of the throat opening 140*f* opposite the ankle opening 104*f* (i.e., in the forefoot portion 12 proximate to and above where the metatarsal bones connect with the phalanx bones of the foot).

Moreover, with continued reference to FIGS. 42 and 44, the upper 100*f* may define a passage along the heel portion 16 for guiding portions of a release mechanism 352*f* (e.g., release cord) that transitions the locking device 350 from the locked state to the unlocked state for permitting the first tensioning cable 302*f* to move in both directions 304, 306 and the second tensioning cable 502*f* to move in both directions 504, 506. For instance, the release cord 352*f* may be pulled to transition the locking device 350 to the unlocked state and may extend from a first end 354*f* attached to the locking device 350 to a second end 356*f* exposed from the upper 100*f* to permit a user to grip and pull the release cord 352*f* for moving the locking device 350 from the locked state to the unlocked state. In some examples, the second end 356*f* of the release cord 352*f* includes a loop and/or gripping feature to allow a user to grip and pull the release cord 352*f* when it is desirable to move the locking device 350 into the unlocked state and/or release the locking device 350 from the unlocked state. The example footwear 10*f* shows the second end 356*f* of the release cord 352*f* attached to, and enclosed within, a sheath 314*f* corresponding to a loosening grip that allows a user to apply a release force 358*f* (FIG. 47) to the sheath 314*f* and/or the second end 356*f* of the cable 352*f* to move the locking device 350 to the unlocked state.

The sheath 314*f* may include a fabric material attached to the exterior surface of the upper 100*f* to define a sleeve or passage for guiding and enclosing portions of the release cord 352*f* that extend out of the midsole 220*f* and operably connect the release cord 352*f* at the second end 356*f*. The sleeve or passage defined by the sheath 314*f* may accommodate bunching by the release cord 352*f* after the release force 358*f* is applied. In other examples, the second end 356*f* of the release cord 352*f* can be disposed proximate to other regions of the footwear 10*f* such as at or near the tongue portion 110, the lateral side 18 of the upper 100*f*, or the medial side 20 of the upper 100*f*.

FIG. 44 shows lacing patterns of the first and second segments 320-1*f*, 320-2*f* of the second tensioning cable 502*f* operatively connected to one another at the distal end of the throat opening 140*f*. In some examples, a connector 503 (e.g., clasp) attaches the free end 508*f* of the first lace segment 320-1*f* to the free end 512*f* of the second lace segment 320-2*f* at a location proximate to the distal end of the throat opening 140*f*. In other examples, the lace segments 320-1*f*, 320-2*f* may be knotted together at the free ends 508*f*, 512*f*. The lateral engagement features 180*f* are disposed adjacent to the lateral edge 142*f* of the throat opening 140*f* and oppose the medial engagement features 190*f* disposed adjacent to the medial edge 144*f* of the throat opening 140*f*. The example shows the engagement features 180*f*, 190*f* including individual sections of tube each having a corresponding inlet for receiving one of the ends 508*f*, 512*f* of the second tensioning cable 502*f* from across the throat opening 140*f* and a corresponding outlet for directing the end 508*f*, 512*f* back across the throat opening 140*f*. In some examples, each engagement feature 180*f*, 190*f* is associated with a section of tubing bent at substantially ninety-degrees (90°) and attached to the upper 100*f*. For instance, the tubing associated with each feature 180*f*, 190*f* may be sewn or adhesively bonded to the upper 100*f* or to an intermediary material attached to the upper 100*f*. The tubing may be formed from a substantially rigid material and may define interior walls configured to facilitate slidability (i.e., relative movement between the segments 320-1*f*, 320-2*f* and the features 180*f*, 190*f*)) of the segments 320-1*f*, 320-2*f* when the second tensioning cable 502*f* moves between the tightening direction 504 and the loosening direction 506. In some examples, the tubing is lined or coated with a low friction material, such as a lubricous polymer (e.g., Teflon™), that facilitates movement of the cable 502*f* therein. In other examples, the engagement features 180*f*, 190*f* include apertures (e.g., eyelets) formed through the upper 100*f* or fabric or mesh loops attached to the upper 100*f* to receive the lace segments 320-1*f*, 320-2*f*.

A first lace pattern of the first lace segment 320-1*f* extends along the lateral side 18 of the upper 100*f*, exits the upper 100*f* proximate to the lateral edge 142*f* of the throat opening 140*f*, and extends across the throat opening 140*f* from the lateral edge 142*f* to the medial edge 144*f*. The first lace segment 320-1*f* is then fed through a sixth medial engagement feature 190-6, across the throat opening 140*f* to the lateral edge 142*f*, and through a fifth lateral engagement feature 180-5 adjacent to the lateral edge 142*f*. The first lace segment 320-1*f* continues zigzagging across the throat opening 140*f* to sequentially feed through a fourth medial engagement feature 190-4, a third lateral engagement feature 180-3, a second medial engagement feature 190-2, and a first lateral engagement feature 180-1 before finally operatively connecting to the second lace segment 320-2*f* at the corresponding free ends 508*f*, 510*f*. The connector 503 may connect the segments 320-1*f*, 320-2*f* together or the segments 320-1*f*, 320-2*f* may be knotted together.

A second lace pattern of the second lace segment 320-2*f* extends along the medial side 20 of the upper 100*f*, exits the upper 100*f* proximate to the medial edge 144*f* of the throat opening 140*f*, and extends across the throat opening 140*f* from the medial edge 144*f* to the lateral edge 142*f*. The second lace segment 320-2*f* is then fed through a sixth lateral engagement feature 180-6, across the throat opening 140*f* to the medial edge 144*f*, and through a fifth medial engagement feature 190-5 adjacent to the medial edge 144*f*. The second lace segment 320-2*f* continues zigzagging across the throat opening 140*f* to sequentially feed through a fourth lateral engagement feature 180-4, a third medial engagement feature 190-3, a second lateral engagement feature 180-2, and a first medial engagement feature 190-1 before finally operatively connecting to the first lace segment 320-1*f* at the corresponding free ends 508*f*, 510*f*. While the example configuration shows the first and second lacing patterns associated with six pairs of opposing engagement features 180*f*, 190*f*, other configurations may include more or less engagement features 180*f*, 190*f*.

In some implementations, the first lacing pattern associated with the first lace segment 320-1*f* and the second lacing pattern associated with the second lace segment 320-2*f* is selected so that a total closure distance between the lateral edge 142*f* and the medial edge 144*f* of the throat opening 140*f* according to the first lacing pattern is approximately equal to a total closure distance between the lateral edge 142*f* and the medial edge 144*f* of the throat opening 140*f* according to the second lacing pattern. Moreover, when the second tensioning cable 502*f* moves in the tightening direction 504, a take-up distance of the first lace segment 320-1*f* is approximately equal to a take-up distance of the second lace segment 320-2*f*. Thus, the take-up distance of the first lace segment 320-1*f* is approximately equal to the total closure distance between the lateral edge 142*f* and the medial edge 144*f* of the throat opening 140*f* according to the first lacing pattern, while the take-up distance of the second lace segment 320-2*f* is approximately equal to the total closure distance between the lateral edge 142*f* and the medial edge 144*f* of the throat opening 140*f* according to the second lacing pattern. Accordingly, the lacing patterns associated with the first and second lace segments 320-1*f*, 320-2*f* of the second tensioning cable 502*f* may uniformly distribute tension across the throat opening when the tensioning mechanism 300*f* transitions to the tightened state.

The tensioning cables 302*f*, 502*f* may be highly lubricious and/or be formed from one or more fibers having a low modulus of elasticity and a high tensile strength. For instance, the fibers may include high modulus polyethylene fibers having a high strength to weight ratio and very low elasticity. Additionally or alternatively, the at least one of the cables 302*f*, 502*f* may be formed from a molded monofilament polymer and/or woven steel with or without other lubrication coating. In some examples, at least one of the cables 302*f*, 502*f* includes multiple strands of material woven together.

In some implementations, one or more routing tubes 325-1, 325-2, 325-3, 325-4 are configured to receive portions of the tensioning cables 302*f*, 504*f* for routing the cables 302*f*, 504*f* through the footwear 10*f*. Each routing tube 325-1, 325-2, 325-3, 325-4 may include an inner diameter that is greater than an outer diameter of the received portion of the corresponding tensioning cable 302*f*, 504*f*. In some examples, the routing tubes are operable to facilitate movement of the cables 302*f*, 504*f* relative to the upper 100*f* when the cables 302*f*, 504*f* are moved in the tightening directions 304, 504 and the loosening directions 306, 506.

With reference to FIGS. 42 and 44, a first routing tube 325-1 is operable to receive and route a portion of the first lace segment 320-1*f* and a second routing tube 325-2 is operable to receive and route a portion of the second lace segment 320-2*f* through the midsole 220*f* and the upper 100*f*. Similarly, a third routing tube 325-3 is operable to receive and route a lateral portion of the first tensioning cable 302*f* and a fourth routing tube 325-4 is operable to receive and route a medial portion of the first tensioning cable 302*f* through the midsole 220*f* and the upper 100*f*. Moreover, a fifth routing tube 325-5 may receive and route a portion of the release cord 352*f*. While the examples show the tubes 325-1, 325-2, 325-3, 325-4 all extending through passages formed through the upper 100 from the heel portion 16 of the midsole 220*f* toward the ankle opening 104 of the upper 100*f* at the midfoot portion 14, one or more of the tubes may be disposed on an exterior surface of the upper 100*f* or disposed on an interior surface of the upper 100*f* within the interior void 102*f*.

In some implementations, the midsole 220*f* defines the cavity 240*f* (FIGS. 43 and 45) for encapsulating the locking device 350 as well as passages/channels for routing the cables 302*f*, 502*f* therethrough. FIG. 45 provides a bottom view of the midsole 220*f* showing the cavity 240*f* and multiple passages 820-1, 820-2, 820-3, 820-4, 820-5 formed in the bottom surface 222*f* of the midsole 220*f*. For clarity, the locking device 350, the cables 302*f*, 502*f*, and the release cord 352*f* are removed from the view of FIG. 45. The cavity 240*f* is configured to receive the locking device 350 such that a bottom surface of the locking device 350 is disposed upon the strobel 217 within the midfoot portion 14 of the footwear 10*f*. In some examples, the midsole 220*f* is neither bonded to the strobel 217 nor the locking device 350, whereas the locking device 350 attaches/bonds to the strobel 217. For instance, the locking device 350 may correspond to the locking device 350*d* of FIGS. 29-34 such that the housing 360*d* attaches to the strobel 217 within the midfoot portion 14 and the release cord 352*f* routes under the housing 360*d* via the arcuate aperture 571 and thru the feed slot 774 (FIG. 32) before routing through the passage 820-5 (and corresponding routing tube 325-5) formed in the bottom surface 222*f* of the midsole 220*f*.

Passages 820-1 and 820-2 are configured to receive and route the lace segments 320-1*f* and 320-2*f* of the second tensioning cable 302*f* that extend out of the locking device 350. Here, the passage 820-1 may receive portions of the routing tube 325-1 having the first lace segment 320-1*f* enclosed therein, and the passage 820-2 may receive portions of the routing tube 325-2 having the second lace segment 320-2 enclosed therein. In some implementations, the first passage 820-1 and corresponding first routing tube 325-1 each include a first portion 1 extending from the locking device 350 toward the lateral side 18 of the midsole 220*f* to a first bend section, a second portion 2 extending from the first bend section toward the heel portion 16 to a second bend section, and a third portion 3 extending from the second bend section toward the ankle opening 104 (FIG. 45). The third portion 3 of the routing tube 325-1 may exit the passage 820-1 of the midsole 220*f* and enter the corresponding passage formed through the upper 100*f* that extends along the lateral side 18 of the upper 100*f*. Likewise, the second passage 820-2 and corresponding second routing tube 325-2 may each include a first portion 1 extending from the locking device 350 toward the medial side 20 of the midsole 220*f* to a first bend section, a second portion 2 extending from the first bend section toward the heel portion 16 to a second bend section, and a third portion 3 extending from the second bend section toward the ankle opening 104. The third portion 3 of the routing tube 325-2 may exit the passage 820-2 of the midsole 220*f* and enter the corresponding passage formed through the upper 100*f* that extends along the medial side 20 of the upper 100*f*. Accordingly, and with reference to FIG. 42, the upper 100*f* defines passages for the lace segments 320-1*f*, 320-2*f* of the second tensioning cable 502*f* to exposed portions prior to routing through the engagement features 180*f*, 190*f* disposed along the lateral and medial sides 142*f*, 144*f* of the throat opening 140*f*.

FIG. 45 also shows passages 820-3 and 820-4 configured to receive and route lateral and medial portions along the length 318*f* of the first tensioning cable 302*f* that extend out of the locking device 350. Here, the passage 820-3 may receive portions of the routing tube 325-3 having the lateral portion of the first tensioning cable 302*f* enclosed therein, and the passage 820-4 may receive portions of the routing tube 325-2 having the medial portion of the first tensioning cable 302*f* enclosed therein. In some implementations, the third passage 820-3 and corresponding third routing tube 325-3 each include a first portion 1 extending from the locking device 350 toward the lateral side 18 of the midsole 220*f* to a first bend section, a second portion 2 extending from the first bend section toward the heel portion 16 to a second bend section, and a third portion 3 extending from the second bend section toward the ankle opening 104. The third portion 3 of the routing tube 325-3 may exit the passage 820-3 of the midsole 220*f* and enter the corresponding passage formed through the upper 100*f* that extends along the lateral side 18 of the upper 100*f*. Likewise, the fourth passage 820-4 and corresponding fourth routing tube 325-4 may each include a first portion 1 extending from the locking device 350 toward the medial side 20 of the midsole 220*f* to a first bend section, a second portion 2 extending from the first bend section toward the heel portion 16 to a second bend section, and a third portion 3 extending from the second bend section toward the ankle opening 104. The third portion 3 of the routing tube 325-4 may exit the passage 820-4 of the midsole 220*f* and enter the corresponding passage formed through the upper 100*f* that extends along the medial side 20 of the upper 100*f*. Accordingly, and with reference to FIG. 42, the upper 100*f* defines passages extending along the lateral and medial sides 18, 20 for routing the first tensioning cable 302*f* to the exposed portion that extends around the tongue portion 110.

Portions of the routing tubes 325-1, 325-2, 325-3, 325-4, 325-5 extending through the corresponding passages 820-1, 820-2, 820-3, 820-4, 820-5 formed in the bottom surface 222*f* of the midsole 220*f* may attach to surfaces of the strobel 217 at one or more locations and/or to opposing surfaces of the midsole 220*f*. The routing tubes 325-1, 325-2, 325-3, 325-4, 325-5 may be formed from a substantially rigid material and may define interior walls configured to facilitate movement of the cables 302*f*, 504*f* between their corresponding tightening directions 304, 504 and loosening directions 306, 506. In some examples, the tubes 325-1, 325-2, 325-3, 325-4, 325-5 are lined or coated with a low friction material, such as a lubricous polymer (e.g., Teflon™), that facilitates movement of the cables 302*f*, 504*f* therethrough.

In some configurations, once a foot is received by the interior void 102*f* and supported upon footbed 224*f* of the midsole 220*f*, the upper 100*f* may be automatically tightened to secure the fit of the interior void 102*f* around the foot by applying the pulling force 322*f* to the first tensioning cable 302*b* without the need of having to manually tie shoe laces or manually fasten other fasteners to tighten the upper 100*f*. FIG. 46 provides a cross-sectional view taken along line 46-46 of FIG. 42 showing the first tensioning cable 302*f* moving through the locking device 350 in the tightening direction 304 to cause the length of the second tensioning cable 502*f* to move in the tightening direction 504, and thereby cause the lengths of the lace segments 320-1*f*, 320-2*f* of the second tensioning cable 502*f* to decrease and the length 318*f* of the first tensioning cable 302*f* to increase. Here, the decrease in length by the lace segments 320-1, 320-2 is operative to close the throat opening 140*f* by cinching and tightening the upper 100*f* around the foot such that the foot is secured within the interior void 102*f* while supported upon the footbed 224*f* of the midsole 220*f*. As with the pulling force 322 applied to the tightening grip 310 of FIGS. 1-6, the fit of the interior void 102*f* around the foot may be adjustable based upon a magnitude and/or duration of the pulling force 322*f* applied to the first tensioning cable 302*f*. In some scenarios, the user grips the sheath 310*f* enclosing the exposed portion of the first tensioning cable 302*f* that extends around the tongue portion 110 to apply the pulling force 322*f*.

FIG. 47 provides an alternate cross-sectional view taken along line 46-46 of FIG. 42 showing the upper 100*f* transitioning to the loosened state responsive to the release force 358*f* applied to the release cord 352*f*. For instance, as the locking device 350 transitions from the locked state to the unlocked state, the tensioning cables 302*f*, 502*f* are permitted to move in the loosening directions 306, 506 when the foot moves and/or a user pulls the tongue portion 110 to loosen the fit of the interior void 102*f*. Here, movement by the second tensioning cable 502*f* in the loosening direction 506 causes the lengths of the segments 320-1*f*, 320-2*f* to increase to allow the throat opening 140*f* to open, thereby relaxing the upper 100*f* to facilitate the transition from the tightened state to the loosened state such that a foot can more easily be removed from the interior void 102*f*. The routing tubes 325-2, 325-4 may permit the cables 502*f*, 302*f* to freely move when the locking device 350 is in the unlocked state. The example locking device 350 of the footwear 10*f* of FIGS. 42-47 may include any of the locking devices 350-350*d* described above or the locking device 350*e* described below.

While the locking device 350 of FIGS. 42-47 described above is described as being disposed within the interior void 102*f* of the upper 100*f* in the midfoot portion 14 and between the midsole 220*f* and the strobel 217, the locking device 350 may be disposed at other locations without departing from the scope of the present disclosure. For instance, the location of the locking device 350 under the foot may shift from the midfoot portion 14 to either one of the forefoot portion 12 or the heel portion 16. In other configurations, the locking device 350 may be disposed upon exterior surfaces of the upper 100*f* at any suitable location, such as over the top of the foot (e.g., above the instep) on the upper 100*f* or the tongue portion 110, or along the heel portion of the upper 100*f*. For instance, the wedge-shaped locking device 350*b* of FIGS. 17-23 or the locking device 350*e* of FIG. 59 may be suitable candidates for being located on exterior surfaces of the upper 100*f* due to the package side of these devices 350*b*, 350*e*. The routing of the tensioning cable(s) 302*f*, 502*f* may be adapted to accommodate a change in location for the locking device 350*c* (e.g., disposed upon the upper 100*f* over the foot or along the heel portion 16) so that the upper 100*f* may be moved between the loosened state and the tightened state. The sheath 314*f* enclosing the second end 356*f* of the release cord 352*f* may be disposed at the lateral side 18 or the medial side 20 of the upper 100*f*, or any other suitable location, when the locking device 350 is disposed on the upper 100*f* at the heel portion 16. For example, the release cord 352*f* could be maintained in the same position as shown in FIG. 42, with the locking device 350 being positioned generally between the release cord 352*f* and the outsole 210*f* along a heel portion of the upper 100*f*.

Figure 51:
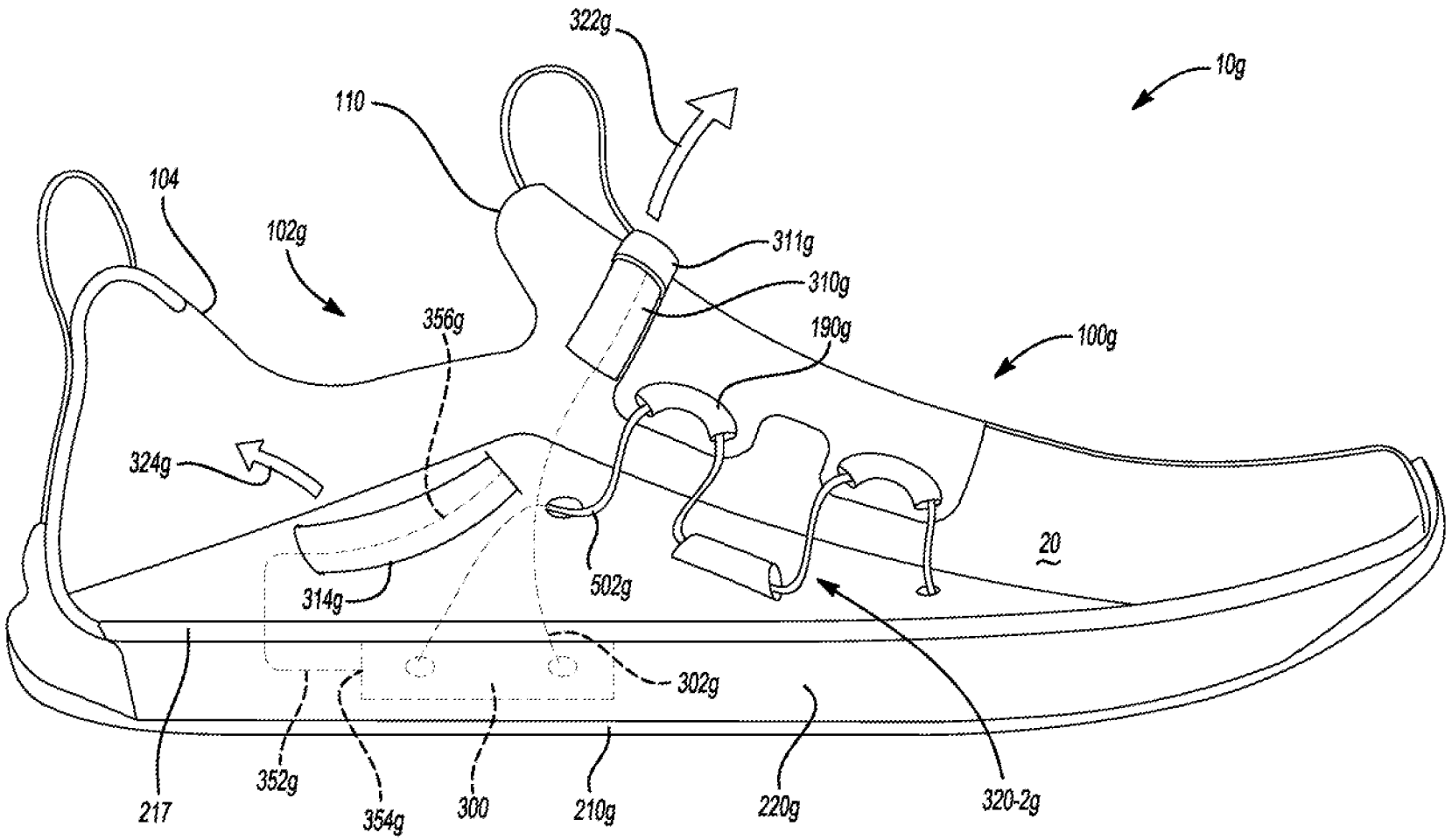
FIG. 51 is an alternate view of the article of footwear of FIG. 48 showing a loosening grip operable to transition the locking device from the locked state to the unlocked state substantially aligned with a tightening grip operable to move the upper from a loosened state to a tightened state.
Figure 52:
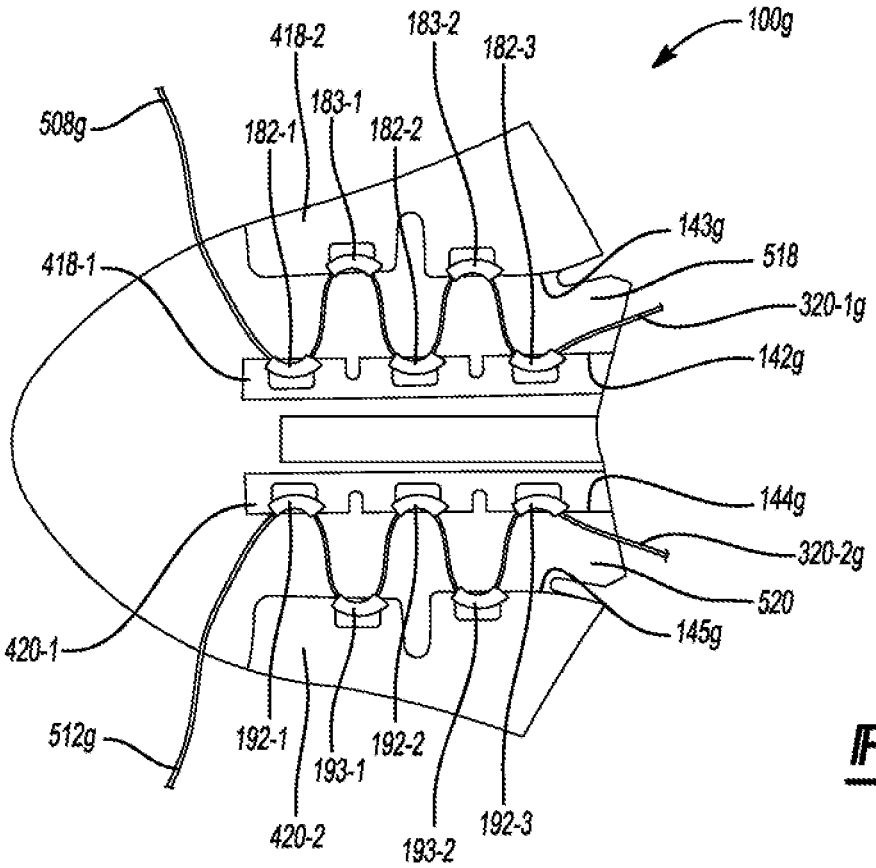
FIG. 52 is a top view of a pattern of an upper of the article of footwear of FIG. 48 while in a loosened state.
Figure 53:
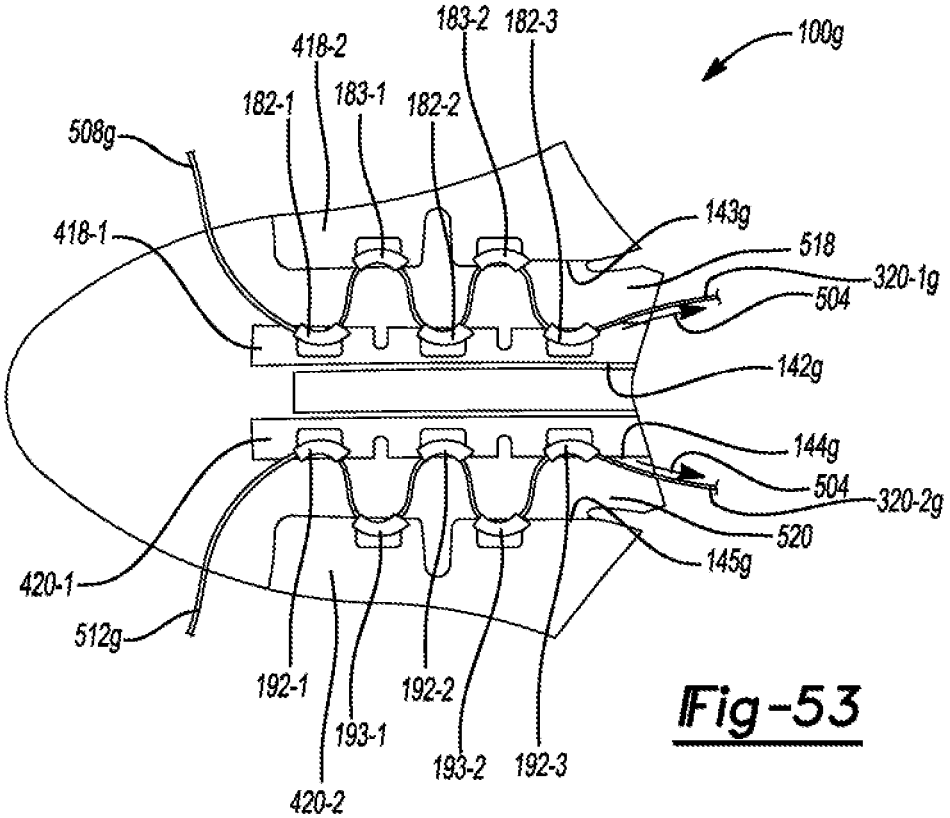
FIG. 53 is a top view of a pattern of an upper of the article of footwear of FIG. 48 while in a tightened state.

Referring to FIGS. 48-54, in some implementations, an article of footwear 10*g* includes an upper 100*g*, an outsole 210*g* attached to the upper 100*g*, a midsole 220*g*, and a tightening mechanism 300*g* to move the upper 100*g* between a loosened state (FIG. 52) and a tightened state (FIG. 53). In view of the substantial similarity in structure and function of the components associated with the article of footwear 10 with respect to the article of footwear 10*g*, like reference numerals are used hereinafter and in the drawings to identify like components while like reference numerals containing letter extensions are used to identify those components that have been modified.

Figure 48:
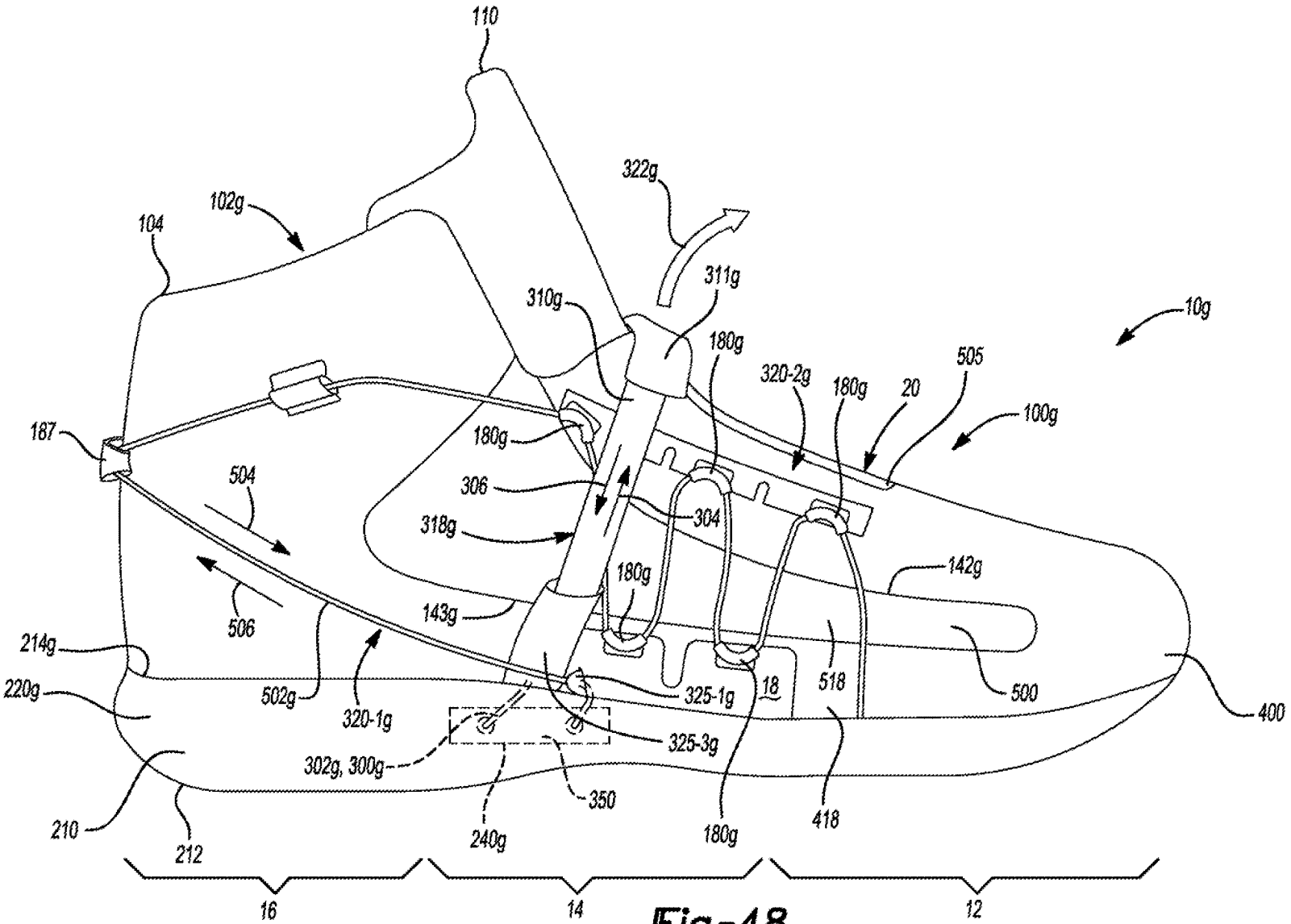
FIG. 48 is a top perspective view of an article of footwear having a locking device movable between a locked state to restrict movement of a tensioning cable and an unlocked state to permit movement of the tensioning cable in accordance with principles of the present disclosure.
Figure 49:
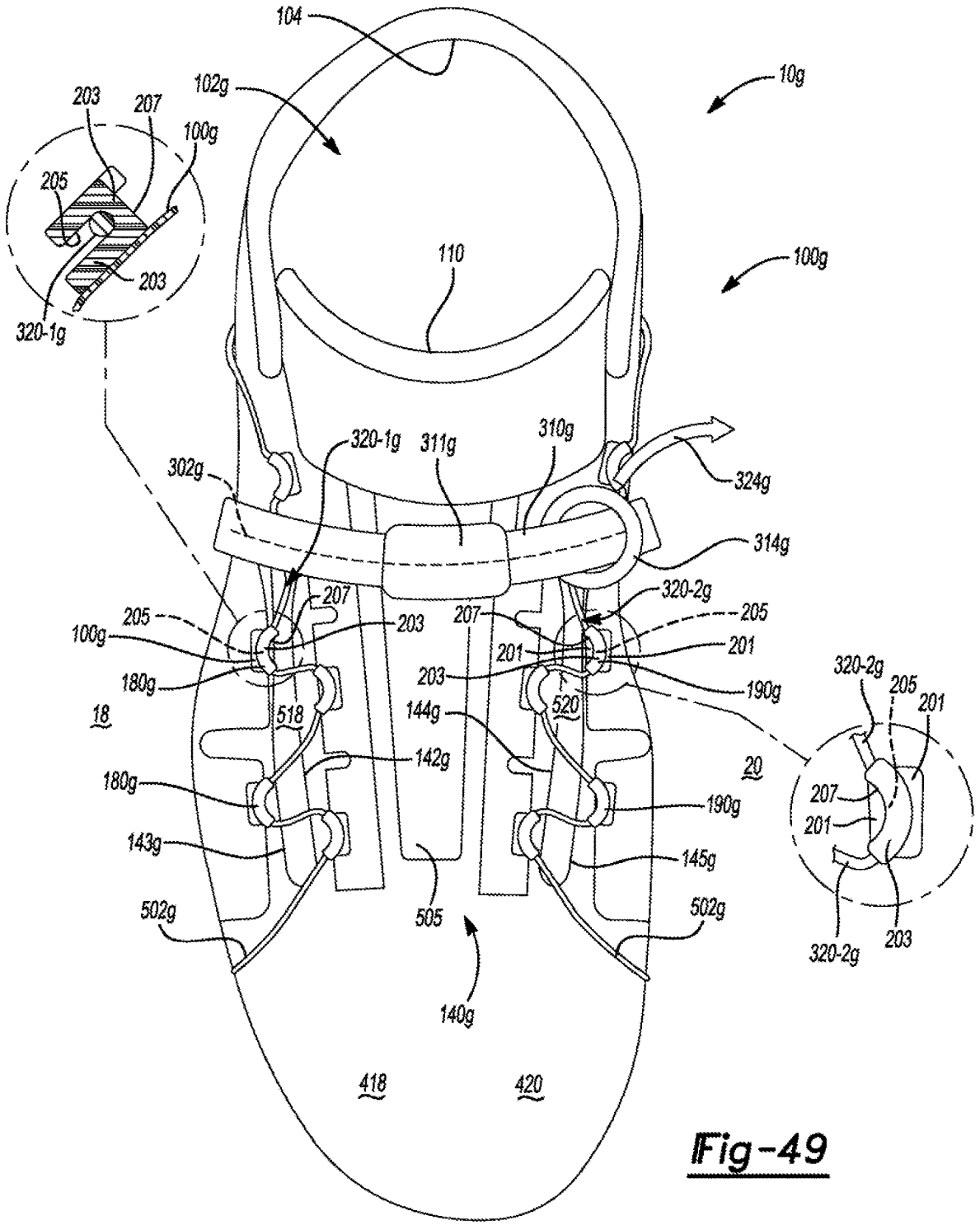
FIG. 49 is a top perspective view of the article of footwear of FIG. 48 showing a tensioning cable having lateral and medial lace segments operable to move the upper from a loosened state to a tightened state when the tensioning cable moves in a tightening direction.
Figure 50:
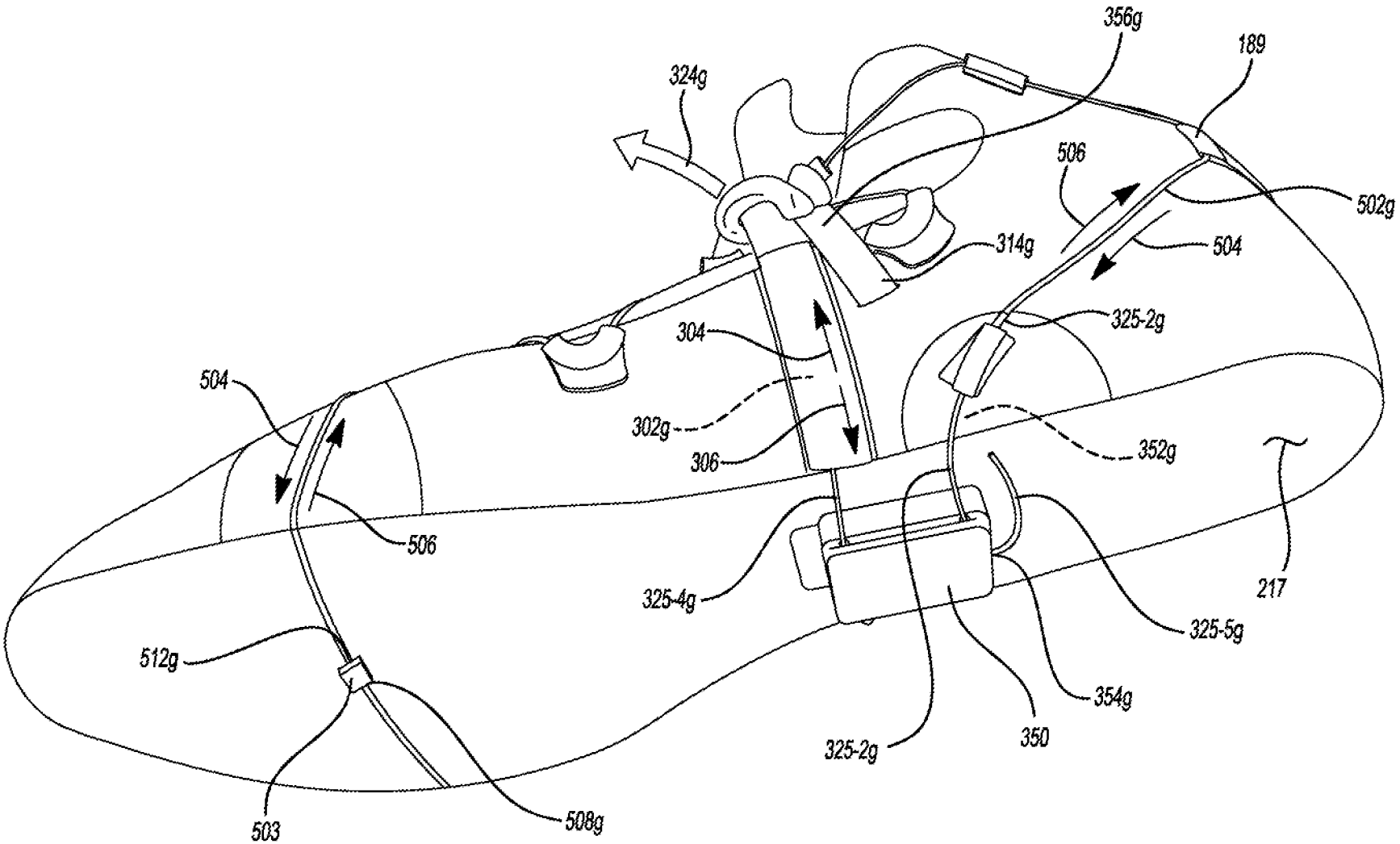
FIG. 50 is a bottom perspective view of the article of footwear of FIG. 48 showing a sole structure removed from an upper to expose the locking device disposed on a bottom surface of a strobel.

The upper 100*g* may be formed from the flexible material forming the upper 100 of FIGS. 1-6 to form an interior void 102*g* and to transition between the tightened state and the loosened state for adjusting the fit of the interior void 102*g* around the foot. The upper 100*g* defines the ankle opening 104 in the heel portion 16 to provide access to the interior void 102*g*. The upper 100*g* further includes a strobel 217 (FIG. 50) extending around the perimeter of the upper 100*g* and having an interior surface opposing the upper 100*g* and an outer surface opposing the outsole 210*g*. FIG. 50 provides a bottom perspective view of the footwear 10*g* of FIGS. 48 and 49 showing the outsole 210*g* and the midsole 220*g* detached/removed from the upper 100*g* to expose the outer surface of the strobel 217 having a locking device 350 disposed thereon. In some configurations, the locking device 350 includes the locking device 350*d* of FIGS. 29-34 but could include any of the locking devices 350-350*c* described above or the locking device 350*e* described below.

As with the midsole 220*f* of FIGS. 43 and 45, the midsole 220*g* may define a corresponding cavity 240*g* (FIG. 54) for encapsulating the locking device 350 as well as passages/channels for routing cables 302*g*, 502*g* of the tensioning mechanism 300*g*. Because the locking device 350 is attached to the strobel 217, the cavity 240*g* is formed in a surface of the midsole 220*f* that opposes the strobel 217. Namely, the cavity 240*g* is formed in a top surface of the midsole 220*f* that opposes the upper 100*g*. Conversely, the cavity 240 of the article of footwear 10 is formed on an opposite side of the midsole 220 (i.e., a bottom surface) and opposes the outsole 210 (FIG. 5). Similar arrangements are shown in FIGS. 13, 21-23, 36, and 46. In each of the foregoing arrangements, the locking device 350 could be located within a cavity 240 located on a top surface of the respective midsole 220 or, alternatively, could be located within a cavity 240 located on a bottom surface of the respective midsole 220. Further, the cavity 240*g* could be located on a bottom surface of the midsole 220*f* and the locking device 350 could alternatively be attached to the outsole 210*g* rather than the strobel 217.

The outsole 210*g* may further define an aperture/cavity that aligns with the cavity 240*g* of the midsole 220*g* to accommodate at least a portion of the locking device 350 and/or make visible a bottom surface of the locking device 350 when viewed through the ground-engaging surface 212. In other configurations, the midsole 220*g* corresponds to a drop-in midsole received by the interior void 102*g* upon the interior surface of the strobel 217, while the outsole 210*g* attaches to exterior surfaces around the periphery of the upper 100*g* and to the outer surface of the strobel 217, in a similar fashion as described with respect to the article of footwear 10*f*.

The example upper 100*g* may be formed from a combination of one or more substantially inelastic or non-stretchable materials 400 and one or more substantially elastic or stretchable materials 500 disposed in different regions of the upper 100*g* to facilitate movement of the upper 100*g* between the tightened state and the loosened state. The one or more elastic materials 500 may include any combination of one or more elastic fabric such as, without limitation, spandex, elastane, rubber or neoprene. The one or more non-elastic materials may include any combination of one or more of thermoplastic polyurethanes, nylon, leather, vinyl, or another material/fabric that does not impart properties of stretchability. For example, the lateral side 18 of the upper 100*g* may include an elastic lateral region 518 formed from the one or more elastic materials 500 and a non-elastic lateral region 418 formed from the one or more non-elastic materials 400. In the examples shown, the non-elastic lateral region 418 surrounds the elastic lateral region 518. For instance, the non-elastic lateral region 418 extends along and borders an upper lateral edge 142*g* and a lower lateral edge 143*g* of the elastic lateral region 518.

Likewise, the medial side 20 of the upper 100*g* may include an elastic medial region 520 formed from the one or more elastic materials 500 and a non-elastic medial region 420 formed from the one or more non-elastic materials 400. In the examples shown, the non-elastic medial region 420 surrounds the elastic medial region 520. For instance, the non-elastic medial region 420 extends along and borders an upper medial edge 144*g* and a lower medial edge 145*g* of the elastic medial region 520. In some configurations, an instep region 505 formed from the one or more elastic materials 500 extends along the upper 100*g* from the ankle opening 104 through the forefoot region 12 and between the non-elastic lateral and medial regions 418, 420 to bisect the lateral and medial sides 18 and 20 of the upper 100*g*. In other configurations, the elastic instep region 505 is omitted and the non-elastic lateral and medial regions 418, 420 cooperate to cover the instep of the foot within the interior void 102*g*. In some configurations, the entire upper 100*g* is formed from the one or more elastic materials 500 and the one or more non-elastic materials 400 are attached (e.g., bonded or fastened) to the elastic material at predetermined locations to define the various regions 418, 420, 502, 518, 520 of the upper 100*g*.

FIG. 49 is a top view of the footwear 10*g* showing the upper 100*g* including a throat closure 140*g* corresponding to an instep of a foot and extending between the lower lateral edge 143*g* of the elastic lateral region 518 and the lower medial edge 145*g* of the elastic medial region 520 and from the ankle opening 104 to an area adjacent the forefoot portion 12. In some examples, the throat closure 140*g* of the upper 100*g* integrally forms the tongue portion 110 from the one or more non-elastic materials 400. Thus, the throat closure 140*g* may define a portion of the interior void 102*g* and enclose a foot therein when the upper 100*g* is in either one of the tightened state or the loosened state. In some examples, the lateral side 18 of the upper 100*g* includes a series of lateral engagement features or cable guides 180*g* that extend along the throat closure 140*g* and the medial side 20 of the upper 100*g* includes a series of medial engagement features or cable guides 190*g* that extend along the throat closure 140*g*.

As shown in FIG. 49, the cable guides 180*g*, 190*g* may each include a base 201 and a flange 203 extending from the base 201. As shown in FIG. 49, the base 201 may be attached to the upper 100*g* via a suitable adhesive such that the flange 203 extends from the upper 100*g*. The flange 203 may be integrally formed with the base 201 and may include an arcuate inner surface 205 having a convex shape. The base 201 and, thus, the flange 203 may be formed from a low-friction material such as, for example, Nylon. Further, the base 201 and flange 203 may be formed from a relatively rigid material to restrict movement of the flange 203 relative to the base 203 to allow the flange 203 to remain in a desired position relative to the upper 100*g*, thereby allowing the flange 203 to adequately guide the cables 320-1*g*, 320-2*g* relative to the upper 100*g*. Finally, the flange 203 may include an arcuate outer surface that is substantially parallel to the inner surface 205 and includes a concave shape. The convex inner surface 205 and the concave outer surface 207 may cooperate to provide the cable guides 180*g*, 190*g* with an overall curved profile such that the convex inner surface 203 includes a substantial C-shape that serves to receive and guide the cable 320-1*g*, 320-2*g*, as shown in FIG. 49.

In one configuration, the cables 320-1*g*, 320-2*g* enter a respective cable guide 180*g*, 190*g*, extend along the convex inner surface 205, and exit the respective cable guide 180*g*, 190*g* at a tangent to the inner surface 205. As shown in FIG. 49, the cable guides 180*g* may be positioned on the upper 100*g* such that the convex inner surface 205 opposes the lateral side 18 and the concave outer surface 207 opposes the medial side 20. Similarly, the cable guides 190*g* may be positioned such that the convex inner surface 205 opposes the medial side 20 and the concave outer surface 207 opposes the lateral side 18. While the cable guides 180*g*, 190*g* are shown and described as being open and as having C-shapes, one or more of the cable guides 180*g*, 190*g* could be formed from curved tubing (FIG. 51) such that the inner surface is defined by an inner surface of the curved tubing. In such a configuration, the tubing could be formed at the same or similar radius as the inner surface 205.

With reference to FIGS. 48-50, in some implementations, the tightening mechanism 300*g* includes a first tensioning cable 302*g* defining a length 318*g* extending out of the locking device 350, and a second tensioning cable 502*g* that routes through the engagement features 180*g*, 190*g* and defines a length extending between a first end 508*g* and a second end 512*g* operatively connected to one another to automatically move the upper 100*g* between the tightened state and the loosened state when the tightening mechanism 300*g* moves between corresponding ones of a tightened state and a loosened state. The first and second free ends 508*g*, 512*g* may operatively connect to one another along the bottom surface of the strobel 217 within the forefoot region 12 of the footwear 10*g*. For instance, movement by the tightening mechanism 300*g* in the tightened state draws one or both of the upper and lower lateral edges 142*g*, 143*g* of the elastic lateral region 518 toward one another while simultaneously drawing one or both of the upper and lower medial edges 144*g*, 145*g* of the elastic lateral region 520 toward one another to constrict the throat closure 140*g* such that the interior void 102*g* closes around a foot of a user. Here, the widths of the elastic lateral region 518 (i.e., measured by the distance between the upper and lower lateral edges 142*g*, 143*g*) and the elastic medial region 520 (i.e., measured by the distance between the upper and lower medial edges 144*g*, 145*g*) may decrease when the tightening mechanism 300*g* moves toward the tightened state to tighten the fit of the upper 100 against a foot within the interior void

102*g*. FIGS. 48 and 50 show the first tensioning cable 302*g* and the second tensioning cable 502*g* movable in the corresponding tightening directions 304 and 504 to move the tightening mechanism 300*g* into the tightened state. Conversely, movement by the tightening mechanism 300*g* toward the loosened state relaxes the upper 100*g* to loosen the throat closure 140*g*, and thereby enlarge the volume of the interior void 102*g* for removal of a foot therefrom. FIGS. 48 and 50 show the first tensioning cable 302*g* and the second tensioning cable 502*g* movable in the corresponding loosening directions 306 and 506 to move the tightening mechanism 300*g* into the loosened state.

In some examples, the first tensioning cable 302*g* is a continuous loop extending from the locking device 350 (e.g., locking device 350*d*) around the tongue portion 110 proximate to where the ankle opening 104*g* and the throat closure 140*g* meet (i.e., proximate to an area above an instep of a wearer's foot). The exposed portion of the first tensioning cable 302*g* that extends around the tongue portion 110 may be enclosed within a sheath 310*g*. The sheath 310*g* may include a fabric material that imparts elastic properties and defines a sleeve or passage for guiding and enclosing the exposed portions of the first tensioning cable 302*g*. Further, the sheath 310*g* may include an inner cavity or space having a larger cross-sectional area than an outer diameter of the cable 302*g* to accommodate bunching of the cable 302*g*, in a similar fashion as described above with respect to the conduits 160, 170.

The sheath 310*g* may additionally be formed from a material and/or a weave that allows the sheath 310*g* to move from a relaxed state to a stretched or expanded state when the sheath 310*g* is moved in a direction away from the upper 100*g* (i.e., when the cable 302*g* is moved in the tightening direction 304). When the force moving the sheath 310*g* away from the upper 100*g* is removed, the material and/or weave of the sheath 310*g* automatically causes the sheath 310*g* to move back to the relaxed state and accommodate bunching by the cable 302*g* therein. In one example, the material of the sheath 310*g* may include elastic that causes the sheath 310*g* to automatically move back to the relaxed state from the expanded state once the force moving the sheath 310*g* away from the upper 100*g* is removed. At this point, the effective length of the cable 302*g* is lengthened and the effective length of the cable 502*g* is reduced. The increase in the effective length of the cable 302*g* is accounted for by the sheath 310*g*, which allows the cable 302*g* to bunch therein. This bunching is caused by the effective length of the cable 302*g* being longer than a length of the sheath 310*g*. The term "effective length" refers to a length of the cables 302*g*, 502*g* relative to the lock device 350. For example, the effective length of the cable 302*g* is increased when more of the cable 302*g* is spooled out from the lock device 350 when the cable 302*g* is pulled in the tightening direction 304.

In the example shown, a separate tightening grip 311*g* operatively connects to the sheath 310*g* at an attachment location proximate to the tongue portion 110 to allow a user to apply a pull force 322*g* (FIG. 48) to pull the first tightening cable 302*g* away from the upper 100*g*, and thereby constrict the elastic lateral and medial regions 518, 520 by simultaneously drawing the corresponding upper and lower lateral edges 142*g*, 143*g* and the corresponding upper and lower medial edges 144*g*, 145*g* toward one another to move the upper 100*g* into the tightened state. Other configurations may include operatively connecting the tightening grip 311*g* to other portions of the sheath 310*g* along the length 318*g* of the first tensioning cable 302*g*. In some implementations, the separate tightening grip 311*g* is omitted and the sheath 310*g* corresponds to the tightening grip by allowing a user to grasp and apply the pull force 322*g* to pull the first tightening cable 302*g* away from the upper 100*g*.

The locking device 350 may be disposed within the midfoot portion 14 (also referred to as an instep portion) of the footwear 10*g* and the second tensioning cable 502*g* may extend through the locking device 350 to define a first lace segment 320-1*g* between the first end 508*g* of the tensioning cable 502*g* and the locking device 350, and a second lace segment 320-2*g* between the second end 512*g* of the second tensioning cable 502*g* and the locking device 350. The first lace segment 320-1*g* may correspond to a lateral lace segment 320-1*g* that extends out of the locking device 350 and routes through the lateral engagement features 180*g*, while the second lace segment 320-2*g* may correspond to a medial lace segment 320-2*g* that extends out of the locking device 350 and routes through the medial engagement features 190*g*. Accordingly, both free ends 508*g* and 512*g* may extend out of the locking device 350 and route through their corresponding engagement features 180*g* and 190*g* before operatively connecting to one another beneath the strobel 217 in the forefoot portion 12 proximate to and above where the metatarsal bones connect with the phalanx bones of the foot.

Moreover, with continued reference to FIG. 50, the upper 100*g* may define a passage along the medial side 20 for guiding portions of a release mechanism 352*g* (e.g., release cord) that transitions the locking device 350 from the locked state to the unlocked state for permitting the first tensioning cable 302*g* to move in both directions 304, 306 and the second tensioning cable 502*g* to move in both directions 504, 506. For instance, the release cord 352*g* may be pulled to transition the locking device 350 to the unlocked state and may extend from a first end 354*g* attached to the locking device 350 to a second end 356*g* exposed from the upper 100*g* to permit a user to grip and pull the release cord 352*g* for moving the locking device 350 from the locked state to the unlocked state. In some examples, the second end 356*g* of the release cord 352*g* includes a loop and/or gripping feature to allow a user to grip and pull the release cord 352*g* when it is desirable to move the locking device 350 into the unlocked state and/or release the locking device 350 from the unlocked state. The example footwear 10*g* shows the second end 356*g* of the release cord 352*g* attached to, and enclosed within, a sheath 314*g* corresponding to a loosening grip that allows a user to apply a pulling force 324*g* (FIG. 50) to the sheath 314*g* and/or the second end 356*g* of the cable 352*g* to move the locking device 350 to the unlocked state by moving the loosening grip in a direction away from the upper 100*g*. The sheath 314*g* may include a fabric material attached to the exterior surface of the upper 100*g* to define a sleeve or passage for guiding and enclosing portions of the release cord 352*g* that extend out of the midsole 220*g* and operably connect the release cord 352*g* at the second end 356*g*. The sleeve or passage defined by the sheath 314*g* may accommodate bunching by the release cord 352*g* after the release force 324*g* is applied. In other examples, the second end 356*g* of the release cord 352*g* can be disposed proximate to other regions of the footwear 10*g* such as at or near the tongue portion 110, the lateral side 18 of the upper 100*g*, or the heel portion 16 the upper 100*g*.

FIG. 51 shows a perspective view of an alternative configuration of the footwear 10*g* showing the release cord 352*g* extending out of a passage along the medial side 20 of the upper 100*g* and the first tensioning cable 302*g* extending into a corresponding passage defined by the upper 100*g* to provide the appearance that the first tensioning cable 302g and the release cord 352g correspond to the same cable/cord. Here, the exposed portion of the first tensioning cable 302g extending around the tongue portion 110 is substantially aligned with the exposed portion of the release cord 352g. The first tensioning cable 302g may be enclosed within the sheath 310g and may optionally include the tightening grip 311g for allowing the user to apply the pull force 322g, and the release cord 352g may be enclosed within the sheath 314g and have the second end 356g attached to the upper 100g to provide the loosening grip that allows the user to apply the pulling force 324g for moving the locking device 350 from the locked state to the unlocked state. The sheaths 310g, 314g may define a substantially equal thickness and a substantially equal width. Thus, in addition to forming the loosening grip, attaching the second end 356g of the release cord 352g to the upper 100g at the attachment location along the medial side 20 gives the perception that the two sheaths 310g, 314g are both routing exposed portions of the same cable/cord, despite the fact that the release cord 352g and the first tensioning cable 302g operate independently from one another. While not shown in the alternative configuration, the first end 354g of the release cord 352g attaches to the locking device 350. Additionally, the medial lace segment 320-2g of the second tensioning cable 502g extends from the locking device 350 through a corresponding passage defined by the upper 100g and routes through the medial engagement features 190g as discussed above.

FIGS. 52 and 53 show the pattern of the upper 100g prior to attaching the upper 100g to the sole structure 200g to form the article of footwear 10g. The elastic lateral region 518 includes the upper lateral edge 142g and the lower lateral edge 143g surrounded by the non-elastic lateral region 418, and the elastic medial region 520 include the upper medial edge 144g and the lower medial edge 145g surrounded by the non-elastic medial region 420. In the example shown, the non-elastic lateral region 418 includes an upper portion 418-1 extending adjacent to the upper lateral edge 142g of the elastic lateral region 518 and a lower portion 418-2 extending adjacent to the lower lateral edge 143g of the elastic lateral region 518. Similarly, the non-elastic medial region 420 includes an upper portion 420-1 extending adjacent to the upper medial edge 144g of the elastic medial region 520 and a lower portion 420-2 extending adjacent to the lower medial edge 143g of the elastic medial region 520. Additional layers formed from the one or more non-elastic materials 400 may be applied over portions of the elastic lateral and medial regions 518, 520 and/or portions of the non-elastic lateral and medial regions 418, 420 to provide reinforcement and aesthetic properties as evidenced by the footwear 10g depicted in FIGS. 48-50.

With continued reference to FIGS. 52 and 53, the lateral and medial segments 320-1g, 320-2g of the second tensioning cable 502g route through corresponding ones of the lateral engagement features 180g and the medial engagement features 190g disposed along the throat closure 140g of the upper 100g. After attaching the upper 100g to the strobel 217, the free end 508g of the lateral lace segment 320-1g and the free end 512g of the medial lace segment 320-2g may operatively connect to one another along the bottom surface of the strobel 217 at a location proximate to the forefoot portion 12. For instance, the connector 503 (e.g., clasp; FIG. 50) may connect the free ends 508g, 512g to one another or the free ends 508g, 512g may be knotted together. In other configurations, the free ends 508g, 512g secure to the upper 100g at separate locations proximate to a distal end of the throat closure 140g.

The lateral engagement features 180g include a set of upper lateral engagement features or cable guides 182-1, 182-2, 182-3 disposed upon the upper portion 418-1 of the non-elastic lateral region 418 and a set of lower lateral engagement features or cable guides 183-1, 183-2 opposing the set of upper lateral engagement features or cable guides 182-1, 182-2, 182-3 and disposed upon the lower portion 418-2 of the non-elastic lateral region 418. Accordingly, the elastic lateral region 518 is disposed between the lower lateral engagement features 183-1, 183-2 and the upper lateral engagement features 182-1, 182-2, 182-3. The example shows the lower lateral engagement features 183-1, 183-2 and the upper lateral engagement features 182-1, 182-2, 182-3 including individual sections of tube each having a corresponding inlet for receiving the free end 508g of the lateral segment 320-1g from across the elastic lateral region 518 and a corresponding outlet for directing the end 508g back across the elastic lateral region 518. In some examples, each lateral engagement feature 182, 183 is associated with a section of tubing bent at substantially ninety-degrees (90°) and attached to the corresponding portion 418-1, 418-2 of the non-elastic lateral region 418. For instance, the tubing associated with the features 182, 183 may be sewn or adhesively bonded to the non-elastic lateral region 418 or to an intermediary material attached to the non-elastic lateral region 418. While the example shows the lateral engagement features 180g including three upper lateral engagement features 182-1, 182-2, 182-3 and two lower lateral engagement features 183-1, 183-2, other configurations may include each set including a greater or lesser number of engagement features. In some examples, the lower lateral engagement features 183 include a greater number of engagement features than the upper lateral engagement features 182. In yet another example, the upper and lower lateral engagement features 182, 183 each include the same number of engagement features.

The number of upper and lower lateral engagement features 182, 183 may be optimized to reduce friction of the lateral lace segment 320-1g when the second tensioning cable 502g moves in the tightening direction 504. Moreover, the placement of the upper and lower lateral engagement features 182, 183 upon the upper 100g may be selected so that each section of the cable 502g extending between each corresponding pair of upper and lower lateral engagement features 182, 183 is substantially straight to reduce friction when the cable moves in the tightening and loosening directions 504, 506.

The medial engagement features 190g include a set of upper medial engagement features or cable guides 192-1, 192-2, 192-3 disposed upon upper portion 420-1 of the non-elastic medial region 420 and a set of lower medial engagement features or cable guides 193-1, 193-2 opposing the set of upper medial engagement features 192-1, 192-2, 192-3 and disposed upon the lower portion 420-2 of the non-elastic medial region 420. Accordingly, the elastic medial region 520 is disposed between the lower medial engagement features 193-1, 193-2 and the upper medial engagement features 192-1, 192-2, 192-3. The example shows the lower medial engagement features 193-1, 193-2 and the upper medial engagement features 192-1, 192-2, 192-3 including individual sections of tube each having a corresponding inlet for receiving the free end 512g of the medial segment 320-2g from across the elastic medial region 520 and a corresponding outlet for directing the end 512g back across the elastic medial region 520. In some examples, each medial engagement feature 192, 193 is associated with a section of tubing bent at substantially ninety-degrees (90°)

and attached to the corresponding portion 420-1, 420-2 of the non-elastic medial region 420. For instance, the tubing associated with the features 192, 193 may be sewn or adhesively bonded to the non-elastic medial region 420 or to an intermediary material attached to the non-elastic medial region 420. While the example shows the medial engagement features 190*g* including three upper medial engagement features 192-1, 192-2, 192-3 and two lower medial engagement features 193-1, 193-2, other configurations may include each set including a greater or lesser number of engagement features. In some examples, the lower medial engagement features 193 include a greater number of engagement features than the upper medial engagement features 192.

The number of upper and lower medial engagement features or cable guides 192, 193 may be optimized to reduce friction of the medial lace segment 320-2*g* when the second tensioning cable 502*g* moves in the tightening direction 504. Moreover, the placement of the upper and lower medial engagement features 192, 193 upon the upper 100*g* may be selected so that each section of the cable 502*g* extending between each corresponding pair of upper and lower medial engagement features 192, 193 is substantially straight to reduce friction when the cable moves in the tightening and loosening directions 504, 506.

In yet another example, the upper and lower medial engagement features or cable guides 192, 193 each include the same number of engagement features. In some implementations, to provide an equal distribution of tightening as the upper 100*g* moves into the tightened state, the number of upper medial engagement features 192-1, 192-2, 192-3 is equal to the number of upper lateral engagement features 182-1, 182-2, 182-3 and the number of lower medial engagement features 193-1, 193-2 is equal to the number of lower lateral engagement features 183-1, 183-2.

The tubing of the lateral and medial engagement features 180*g*, 190*g* may be formed from a substantially rigid material and may define interior walls that slidably receive the segments 320-1*g*, 320-2*g* when the second tensioning cable 502*g* moves between the tightening direction 504 and the loosening direction 506. Further, the tubes may not be fully enclosed, whereby the engagement features 180*g*, 190*g* only include walls at a location where the segments 320-1*g*, 320-2*g* contact the features 180*g*, 190*g*. For example, engagement features 193-1, 193-2 may be open proximate to the ends of the leader lines identifying these elements in FIG. 53 such that the engagement features 193-1, 193-2 are closed at a side (i.e., the side in contact with the segments 320-1*g*, 320-2*g*) opposing the other engagement features 192-1, 192-2, 192-3 and are open on an opposite side of the engagement features 193-1, 193-2. Each of the engagement features 180*g*, 190*g* may be formed from an enclosed tube or may have an open side, as described above with respect to features 193-1, 193-2.

In some examples, the interior wall of the tubing are lined or coated with a low friction material, such as a lubricous polymer (e.g., Teflon™), that facilitates movement of the cable 502*g* therein. By coating the tubing with low friction material, the number of turns taken by each lacing pattern can be increased. For instance, the lateral and medial engagement features 180*g*, 190*g* each provide five (5) turns of the cable 502*g* without friction detrimentally inhibiting movement by the cable 502*g* in the tightening direction 504. In other examples, the engagement features 180*g*, 190*g* include apertures (e.g., eyelets) formed through the corresponding non-elastic lateral and medial regions 418, 420 of the upper 100*g*, or fabric or mesh loops attached to the non-elastic lateral and medial regions 418, 420 of the upper 100*g* to receive the lace segments 320-1*g*, 320-2*g*. Fabric or mesh loops/webbing may generate more friction with the cable 502*g* when the cable 502*g* moves in the tightening direction 504 compared to that of the tubing lined with the low friction material. Accordingly, the maximum number of fabric or mesh loops for use as the engagement features 180*g*, 190*g* may be limited to not exceed a threshold number of turns of the cable 502*g* (e.g., three turns) so that friction does not detrimentally inhibit movement by the cable 502*g* in the tightening direction 504.

With reference to FIGS. 48, 49, 51, and 52, a lateral lace pattern of the lateral lace segment 320-1*g* extends from the locking device 350 at the midfoot portion 14 and along the lateral side 18 of the upper 100*g* to a lateral routing feature 187 disposed proximate to the heel portion 16. The lateral routing feature 187 serves as an anchor point for the lateral lace segment 320-1*g* to cause the lateral lace segment 320-1*g* to extend in a direction proximate to the ankle opening 104 along the lateral side 18 of the upper 100*g* to a third upper lateral engagement feature 182-3 disposed proximate to where the ankle opening 104 and the throat closure 140*g* meet. The lateral lace segment 320-1*g* is then fed through the third upper lateral engagement feature 182-3, across the elastic lateral region 518 from the upper lateral edge 142*g* to the lower lateral edge 143*g*, and through a second lower lateral engagement feature 183-2. The lateral lace segment 320-1*g* continues zigzagging across the elastic lateral region 518 to sequentially feed through a second upper lateral engagement feature 182-2, a first lower lateral engagement feature 183-1, and a first upper lateral engagement feature 182-1 before finally operatively connecting to the second lace segment 320-2*g* at the corresponding free ends 508*g*, 510*g* as shown in FIG. 50. The connector 503 may connect the segments 320-1*g*, 320-2*g* together or the segments 320-1*g*, 320-2*g* may be knotted together. In other configurations, the free end 508*g* of the first lace segment 320-1*g* may secure directly to the one or more non-elastic materials 400 of the upper 100*g* upon exiting the first upper lateral engagement feature 182-1.

With reference to FIGS. 49-52, a medial lace pattern of the medial lace segment 320-2*g* extends from the locking device 350 at the midfoot portion 14 and along the medial side 20 of the upper 100*g* to a medial routing feature 189 disposed proximate to the heel portion 16. The lateral and medial routing features 187, 189 may correspond to the same material (e.g., fabric) secured to the heel end of the upper and having a pair of loops associated with corresponding ones of the routing features 187, 189. As with the lateral routing feature 187, the medial routing feature 189 serves as an anchor point for the medial lace segment 320-2*g* to cause the medial lace segment 320-2*g* to extend in a direction proximate to the ankle opening 104 along the medial side 20 of the upper 100*g* to a third upper medial engagement feature 192-3 disposed proximate to where the ankle opening 104 and the throat closure 140*g* meet. The medial lace segment 320-2*g* is then fed through the third upper medial engagement feature 192-3, across the elastic medial region 520 from the upper medial edge 144*g* to the lower medial edge 145*g*, and through a second lower medial engagement feature 193-2. The medial lace segment 320-2*g* continues zigzagging across the elastic medial region 520 to sequentially feed through a second upper medial engagement feature 192-2, a first lower medial engagement feature 193-1, and a first upper medial engagement feature 192-1 before finally operatively connecting to the first lace segment 320-1*g* at the corresponding free ends 508*g*, 510*g* via the connector 503 as shown in FIG. 50.

Referring to FIGS. 52 and 53, in some implementations, the lateral lacing pattern associated with the lateral lace segment 320-1*g* and the medial lacing pattern associated with the medial lace segment 320-2*g* are selected so that a total closure between the upper lateral edge 142*g* and the lower lateral edge 143*g* of the elastic lateral region 518 according to the lateral lacing pattern is approximately equal to a total closure distance between the upper medial edge 144*g* and the lower medial edge 145*g* of the elastic medial region 520 according to the medial lacing pattern. FIG. 52 shows the upper 100*g* in the relaxed state, while FIG. 53 shows the upper 100*g* in the tightened state whereby the distances between the upper lateral edge 142*g* and the lower lateral edge 143*g* of the elastic lateral region 518, and between the upper medial edge 144*g* and the lower medial edge 145*g* of the elastic medial region 520, are reduced when the second tensioning cable 502*g* moves in the tightening direction 504.

In some implementations, a take-up distance of the lateral lace segment 320-1*g* is substantially equal to a take-up distance of the medial lace segment 320-2*g* when the second tensioning cable 502*g* moves in the tightening direction 504. Accordingly, the take-up distance of the lateral lace segment 320-1*g* is approximately equal to the reduction of width between the upper lateral edge 142*g* and the lower lateral edge 143*g* of the elastic lateral region 518 according to the lateral lace pattern, while the take-up distance of the medial lace segment 320-2*g* is approximately equal to the reduction of width between the upper medial edge 144*g* and the lower medial edge 144*g* of the elastic medial region 520 according to the medial lace pattern. Thus, the lacing patterns associated with the lateral and medial lace segments 320-1*g*, 320-2*g* of the second tensioning cable 502*g* may uniformly distribute tension across the throat closure 140*g* by constricting the elastic lateral and medial regions 518, 520 when the tensioning mechanism 300*g* transitions the upper 100*g* from the relaxed state (FIG. 52) to the tightened state (FIG. 53).

The tensioning cables 302*g*, 502*g* may be highly lubricious and/or be formed from one or more fibers having a low modulus of elasticity and a high tensile strength. For instance, the fibers may include high modulus polyethylene fibers having a high strength to weight ratio and very low elasticity. Additionally or alternatively, at least one of the cables 302*g*, 502*g* may be formed from a molded monofilament polymer and/or woven steel with or without other lubrication coating. In some examples, at least one of the cables 302*g*, 502*g* includes multiple strands of material woven together.

In some implementations, one or more routing tubes 325-1*g*, 325-2*g*, 325-3*g*, 325-4*g* are configured to receive portions of the tensioning cables 302*g*, 502*g* for routing the cables 302*g*, 502*g* through the footwear 10*g*. Each routing tube 325-1*g*, 325-2*g*, 325-3*g*, 325-4*g* may include an inner diameter that is greater than an outer diameter of the received portion of the corresponding tensioning cable 302*g*, 502*g*. In some examples, the routing tubes facilitate movement of the cables 302*g*, 502*g* relative to the upper 100*g* when the cables 302*g*, 502*g* are moved in the tightening directions 304, 504 and the loosening directions 306, 506.

With reference to FIGS. 48 and 50, a first routing tube 325-1*g* may receive and route a portion of the lateral lace segment 320-1*g* and a second routing tube 325-2*g* may receive and route a portion of the medial lace segment 320-2*g* through the midsole 220*g* and the upper 100*g*. Similarly, a third routing tube 325-3*g* may receive and route a lateral portion of the first tensioning cable 302*g* and a fourth routing tube 325-4*g* may receive and route a medial portion of the first tensioning cable 302*g* through the midsole 220*g* and the upper 100*g*. Moreover, a fifth routing tube 325-5*g* may receive and route a portion of the release cord 352*g* through the midsole 220*g* and the upper 100*g*. While the examples show the tubes 325-1*g*, 325-2*g*, 325-3*g*, 325-4*g* all extending through passages formed through the upper 100*g* from the midfoot portion 16 of the midsole 220*g* toward the throat closure 140*g* of the upper 100*g* or the ankle opening 104 of the upper 100*g* at the heel portion 16, one or more of the tubes may be disposed on an exterior surface of the upper 100*g* or disposed on an interior surface of the upper 100*g* within the interior void 102*g*.

Figure 54:
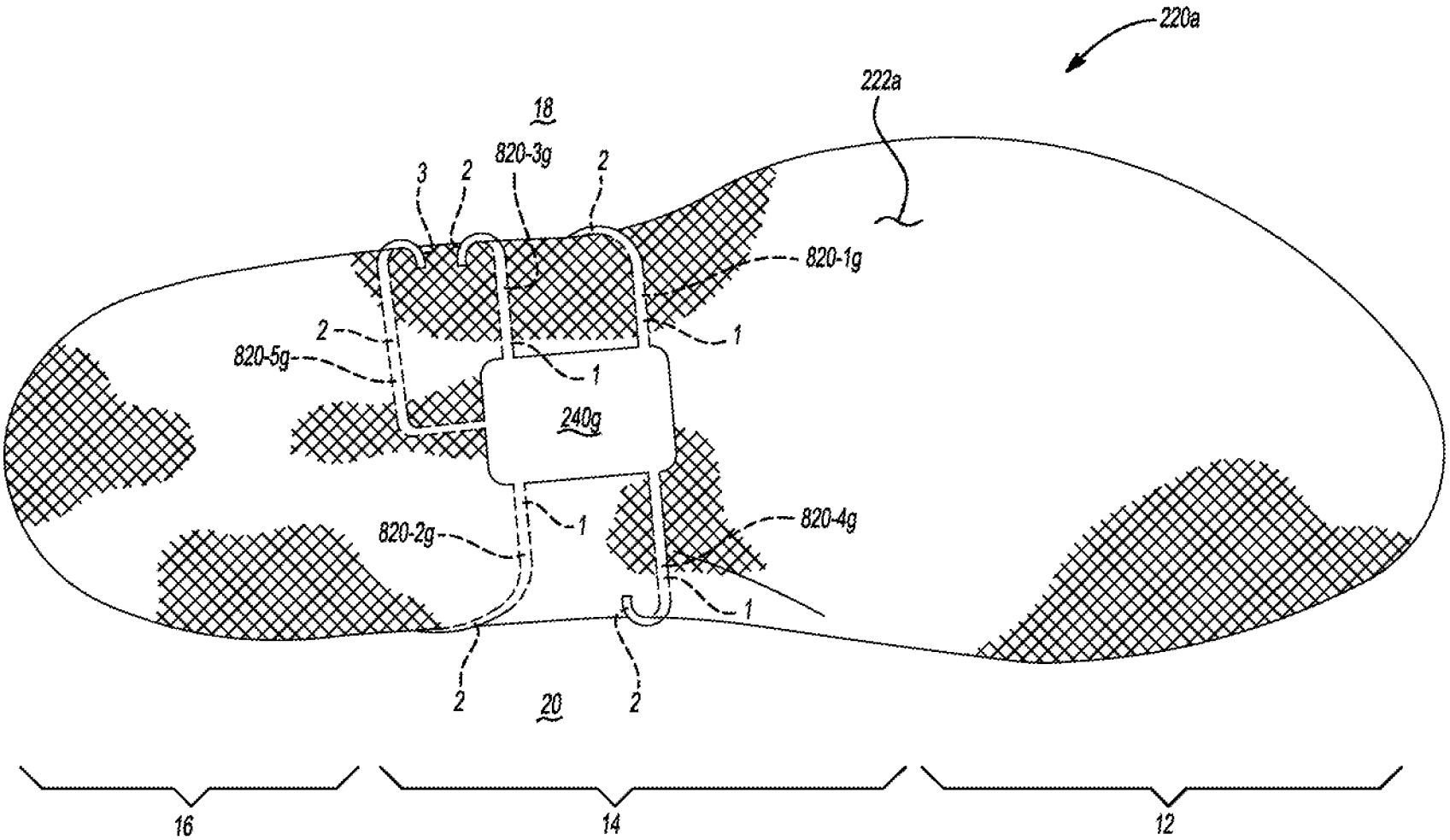
FIG. 54 is a bottom view of a midsole of the article of footwear of FIG. 48 showing a cavity and a plurality of passages formed through the midsole for receiving the locking device and routing tensioning cables through the midsole.

FIG. 54 provides a bottom view of the midsole 220*g* showing a cavity 240*g* for encapsulating the locking device 350 as well as passages/channels 820-1*g*, 820-2*g*, 820-3*g*, 820-4*g*, 820-5*g* formed through the midsole 220*g* for routing the cables 302*g*, 502*g* therethrough. In the example shown, the cavity 240*g* is formed through a footbed and a bottom surface 222*g* of the midsole 222*g* such that the locking device 350 affixed to the strobel 217 resides in the cavity 240*g*. Other configurations may include the cavity 240*g* formed into the footbed without extending through the bottom surface 222*g*. In some examples, the midsole 220*g* is neither bonded to the strobel 217 nor the inner surface 214*g* of the outsole 210*g*, whereas the locking device 350 attaches/bonds to the bottom surface of the strobel 217. For instance, the locking device 350 may correspond to the locking device 350*d* of FIGS. 29-34 such that the housing 360*d* attaches to the bottom surface of the strobel 217 within the midfoot portion 14 and the release cord 352*g* routes under the housing 360*d* via the arcuate aperture 571 and thru the feed slot 774 (FIG. 32) before routing through the passage 820-5*g* (and corresponding routing tube 325-5*g*) formed through the midsole 220*g*. Portions of one or more of the passages 820-1*g*, 820-2*g*, 820-3*g*, 820-4*g*, 820-5*g* may be formed through the bottom surface 222*g*, the footbed 224*g*, or between the bottom surface 222*g* and the footbed 224*g* of the midsole 220*g*.

Passages 820-1*g* and 820-2*g* are configured to receive and route the lace segments 320-1*g* and 320-2*g* of the second tensioning cable 502*g* that extend out of the locking device 350 disposed in the midfoot portion 14. Here, the passage 820-1*g* may receive portions of the routing tube 325-1*g* having the lateral lace segment 320-1*g* enclosed therein, and the passage 820-2*g* may receive portions of the routing tube 325-2*g* having the medial lace segment 320-2*g* enclosed therein. In some implementations, the first passage 820-1*g* and corresponding first routing tube 325-1*g* each include a first portion 1 extending from the locking device 350 toward the lateral side 18 of the midsole 220*g* to a bend section and a second portion 2 extending from the bend section toward the ankle opening 104 at the heel portion 16. The second portion 2 of the routing tube 325-1*g* may exit the passage 820-1*g* of the midsole 220*g* and extend along a portion of the lateral side 18 of the upper 100*g*. Likewise, the second passage 820-2*g* and corresponding second routing tube 325-2*g* may each include a first portion 1 extending from the locking device 350 toward the medial side 20 of the midsole 220*g* to a bend section and a second portion 2 extending from the bend section toward the ankle opening 104 at the heel portion 16. The second portion 2 of the routing tube 325-2*g* may exit the passage 820-2*g* of the midsole 220*g* and extend along a portion of the medial side 20 of the upper 100*g*. Accordingly, and with reference to FIGS. 48 and 50, the upper 100*g* includes additional routing features for the lace segments 320-1*g*, 320-2*g* of the second tensioning cable 502*g* to direct the lace segments 320-1*g*, 320-2*g* along corresponding ones of the lateral and medial sides 18, 20 of the upper 100*g* prior to routing through the corresponding lateral and medial engagement features 180*g*, 190*g* disposed along the lateral and medial sides 18, 20 of the throat closure 140*g*.

FIG. 54 also shows passages 820-3*g* and 820-4*g* configured to receive and route lateral and medial portions along the length 318*g* of the first tensioning cable 302*g* that extend out of the locking device 350. Here, the passage 820-3*g* may receive portions of the routing tube 325-3*g* having the lateral portion of the first tensioning cable 302*g* enclosed therein, and the passage 820-4*g* may receive portions of the routing tube 325-2*g* having the medial portion of the first tensioning cable 302*g* enclosed therein. In some implementations, the third passage 820-3*g* and corresponding third routing tube 325-3*g* each include a first portion 1 extending from the locking device 350 toward the lateral side 18 of the midsole 220*g* to a bend section and a second portion 2 extending from the bend section toward the location proximate to where the throat closure 140*g* and the ankle opening 104 intersect. The second portion 2 of the routing tube 325-3*g* may exit the passage 820-3*g* of the midsole 220*g* and extend along the lateral side 18 of the upper 100*g* in a direction away from the outsole 210*g*. Likewise, the fourth passage 820-4*g* and corresponding fourth routing tube 325-4*g* may each include a first portion 1 extending from the locking device 350 toward the medial side 20 of the midsole 220*g* to a bend section and a second portion 2 extending from the bend section toward the location proximate to where the throat closure 140*g* and the ankle opening 104 intersect. The second portion 2 of the routing tube 325-4*g* may exit the passage 820-4*g* of the midsole 220*g* and extend along the medial side 20 of the upper 100*g* in a direction away from the outsole 210*g*.

The passage 820-5*g* is configured to receive and route portions of the release cable 352*g* that extends out of the locking device 350. Here, the passage 820-5*g* may receive portions of the routing tube 325-5*g* having a portion of the release cable 352*g* enclosed therein. In some implementations, the passage 820-5*g* includes a first portion 1 extending from the locking device 350 toward the heel portion 16 of the midsole 220*g* to a first bend section, a second portion 2 extending from the first bend section toward the medial side 20 of the midsole 220*g* to a second bend section, and a third portion 3 extending from the second bend section toward the location proximate to where the throat closure 140*g* and the ankle opening 104 intersect. The third portion 3 of the routing tube 325-5*g* may exit the passage 820-5*g* of the midsole 220*g* and enter a corresponding passage formed through the upper 100*g* that extends along the medial side of the upper 100*g* before exiting the passage and attaching to the upper 100*g* at the second end 356*g* to provide the loosening grip that allows the user to apply the pulling force 324*g* (FIG. 50) for transitioning the locking device 350 to the unlocked state.

Portions of the routing tubes 325-1*g*, 325-2*g*, 325-3*g*, 325-4*g*, 325-5*g* extending through the corresponding passages 820-1*g*, 820-2*g*, 820-3*g*, 820-4*g*, 820-5*g* formed in the midsole 220*g* may attach to surfaces of the strobel 217 at one or more locations and/or to opposing surfaces of the midsole 220*g*. The routing 325-1*g*, 325-2*g*, 325-3*g*, 325-4*g*, 325-5*g* may be formed from a substantially rigid material and may define interior walls configured to facilitate movement of the cables 302*g*, 502*g* between their corresponding tightening directions 304, 504 and loosening directions 306, 506. In some examples, the tubes 325-1*g*, 325-2*g*, 325-3*g*, 325-4*g*, 325-5*g* are lined or coated with a low friction material, such as a lubricous polymer (e.g., Teflon™), that facilitates the movement of the cables 302*f*, 502*g* therethrough.

In some configurations, once a foot is received by the interior void 102*g* and supported upon the strobel 217 (e.g., upon a sock liner disposed upon the strobel 217), the upper 100*g* may be automatically tightened to secure the fit of the interior void 102*g* around the foot by applying the pulling force 322*g* to the first tensioning cable 302*g* without the need of having to manually tie shoe laces or manually fasten other fasteners to tighten the upper 100*g*. Specifically, the lateral lacing pattern associated with the lateral lace segment 320-1*g* and the medial lacing pattern associated with the medial lace segment 320-2*g* uniformly distribute tension across the throat closure 140*g* by constricting the elastic lateral and the medial regions 518, 520 when the pulling force 322*g* is applied to the first tensioning cable 302*g*. Through the use of the medial and lateral lacing patterns, the fit of the interior void 102*g* around the instep and the forefoot of the foot may be tuned based on the magnitude and/or duration of the applied pulling force 322*g*. With reference to FIGS. 48 and 50, movement by the first tensioning cable 302*g* through the locking device 350 in the tightening direction 304 causes the length of the second tensioning cable 502*g* to move in the tightening direction 504, and thereby cause the lengths of the lateral and medial lace segments 320-1*g*, 320-2*g* of the second tensioning cable 502*g* to decrease simultaneously and the length 318*g* of the first tensioning cable 302*g* to increase.

As shown in FIG. 53, the decrease in length by the lateral lace segment 320-1*g* is operative to constrict the elastic lateral region 518 by reducing the distance between the upper lateral edge 142*g* and the lower lateral edge 143*g*. As the sets of upper and lower lateral engagement features 182-1, 182-2, 182-3, 183-1, 183-2 are attached to the corresponding upper and lower portions 418-1, 418-2 of the non-elastic lateral region 418, the one or more non-elastic materials 400 forming the upper and lower portions 418-1, 418-2 provide reinforcement and prevent bunching by the upper 100*g* for localizing and tuning the fit of the interior void 104*g* along the lateral side 18 of the throat closure 140*g*. Similarly, the decrease in length by the medial lace segment 320-2*g* is operative to constrict the elastic medial region 520 by reducing the distance between the upper medial edge 144*g* and the lower medial edge 145*g*. As the sets of upper and lower medial engagement features 192-1, 192-2, 192-3, 193-1, 193-2 are attached to the corresponding upper and lower portions 420-1, 420-2 of the non-elastic medial region 420, the one or more non-elastic materials 400 forming the upper and lower portions 420-1, 420-2 provide reinforcement and prevent bunching by the upper 100*g* for localizing and tuning the fit of the interior void 104*g* along the medial side 20 of the throat closure 140*g*. As with the pulling force 322 applied to the tightening grip 310 of FIGS. 1-6, the fit of the interior void 102*g* around the foot may be adjustable based upon a magnitude and/or duration of the pulling force 322*g* applied to the first tensioning cable 302*g*. In some scenarios, the user grips the sheath 310*g* enclosing the exposed portion of the first tensioning cable 302*g* that extends around the tongue portion 110 to apply the pulling force 322*g*.

The upper 100*g* may be transitioned to the loosened state in response to the release force 324*g* applied to the release cord 352*g* to transition the locking device 350 from the locked state to the unlocked state. For instance, as the locking device 350 transitions from the locked state to the unlocked state, the tensioning cables 302*g*, 502*g* are permitted to move in the loosening directions 306, 506 when the foot moves and/or the user pulls the tongue portion 110 to loosen the fit of the interior void 102*g*. Here, movement by the second tensioning cable 502*g* in the loosening direction 506 causes the lengths of the segments 320-1*g*, 320-2*g* to increase to allow the respective elastic lateral and medial regions 518, 520 to return to their respective relaxed, substantially flat state, thereby relaxing the upper 100*g* to facilitate the transition from the tightened state to the loosened state such that the foot can be removed from the interior void 102*g*. The example locking device 350 of the footwear 10*g* of FIGS. 48-54 may include any of the locking devices 350-350*d* described above, or the locking device 350*e* of FIGS. 59-62 described in greater detail below.

While the locking device 350 of FIGS. 48-54 described above is described as being disposed upon the bottom surface of the strobel 217 in the midfoot portion 14 and encapsulated by the cavity 240*g* of the midsole 220*g*, the locking device 350 may be disposed at other locations without departing from the scope of the present disclosure. For instance, the location of the locking device 350 under the foot may shift from the midfoot portion 14 to either one of the forefoot portion 12 or the heel portion 16. In other configurations, the locking device 350 may be disposed upon exterior surfaces of the upper 100*g* at any suitable location, such as over the top of the foot (e.g., above the instep) on the upper 100*g* or the tongue portion 110, or along the heel portion of the upper 100*g*. For instance, one of the wedge-shaped locking device 350*b* of FIGS. 17-23 and the wedge-shaped locking device 350*e* of FIGS. 49-62 may be a suitable candidate for having a location upon the exterior surfaces of the upper 100*g* due to the wedge-shaped locking devices 350*b*, 350*e* having a relatively small package size. In other configurations, the locking device 350 may be disposed within the interior void 102*g* of the upper 100*g* and between the inner surface of the strobel 217 and a drop-in midsole, as described above with reference to the article of footwear 10*f* of FIGS. 42-47. The routing of the tensioning cable(s) 302*g*, 502*g* may be adapted to accommodate a change in location for the locking device 350*c*, 350*e* (e.g., disposed upon the upper 100*f* over the foot or along the heel portion 16) so that the upper 100*g* may be moved between the loosened state and the tightened state. The sheath 314*g* enclosing the second end 356*g* of the release cord 352*g* may be disposed at the lateral side 18 or the medial side 20 of the upper 100*g*, or any other suitable location, when the locking device 350 is disposed on the upper 100*g* at the heel portion 16.

FIGS. 57, 60, 63, and 66 show alternate patterns of uppers 100*h*, 100*i*, 100*j*, 100*k*, respectively, for attachment to the sole structure 200*g* to form the article of footwear 10*g* of FIGS. 48-54. In view of the substantial similarity in structure and function of the components associated with the upper 100*g* with respect to the uppers 100*h*, 100*i*, 100*j*, 100*k*, like reference numerals are used hereinafter and in the drawings to identify like components while like reference numerals containing letter extensions are used to identify those components that have been modified.

Figure 55:
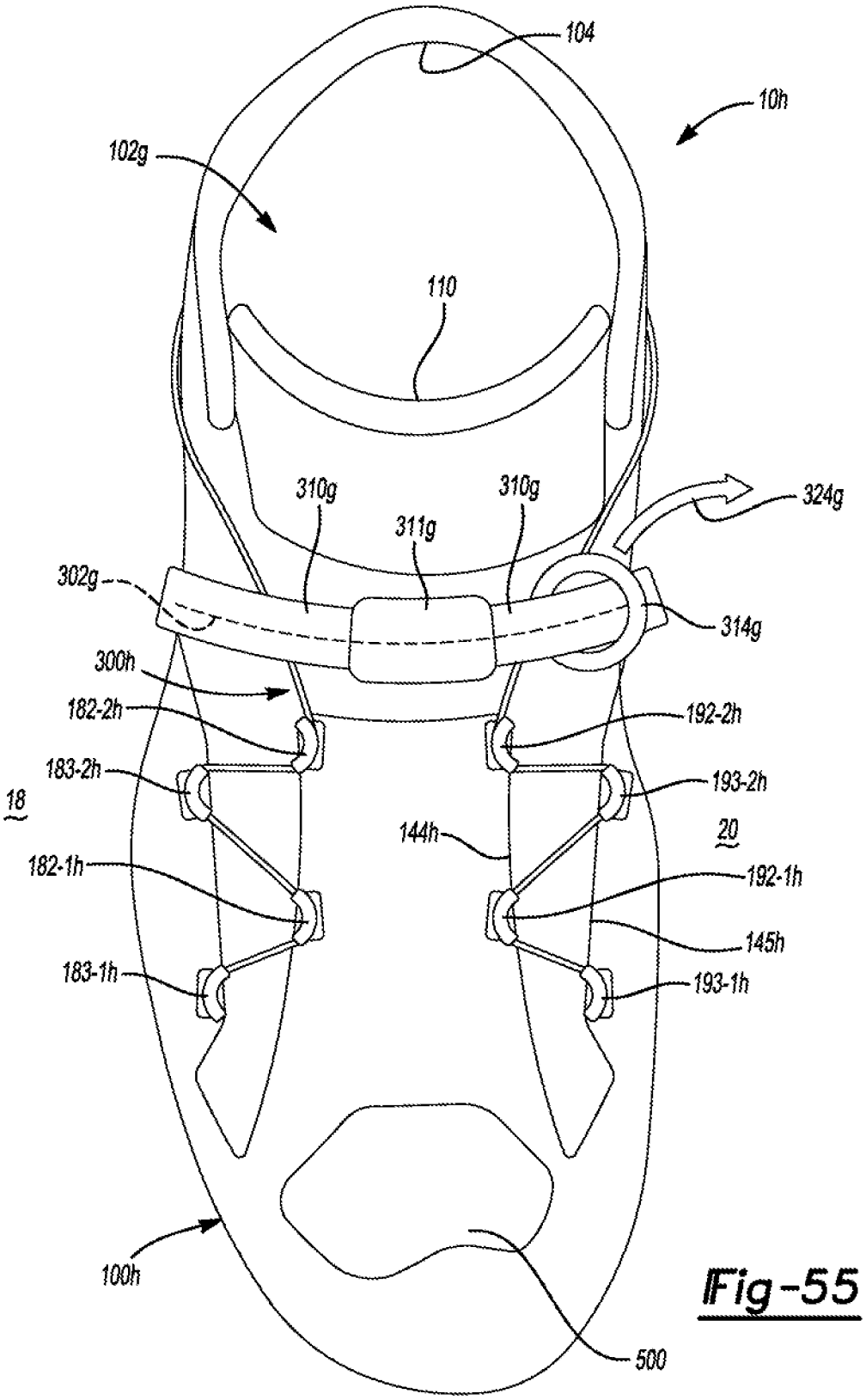
FIG. 55 is a top perspective view of an article an article of footwear having a locking device movable between a locked state to restrict movement of a tensioning cable and an unlocked state to permit movement of the tensioning cable in accordance with principles of the present disclosure.
Figure 56:
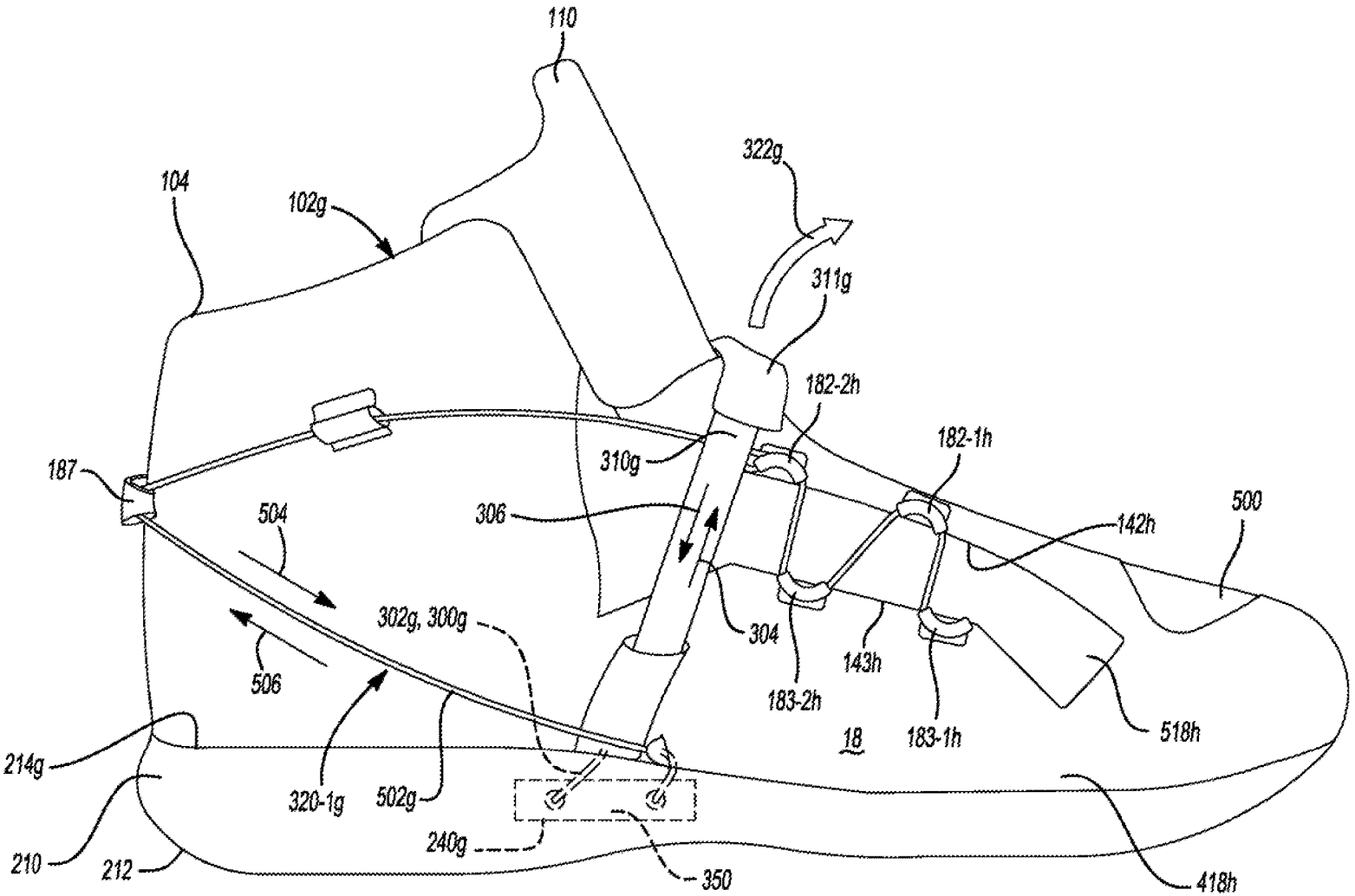
FIG. 56 is a perspective view of the article of footwear of FIG. 55.
Figure 57:
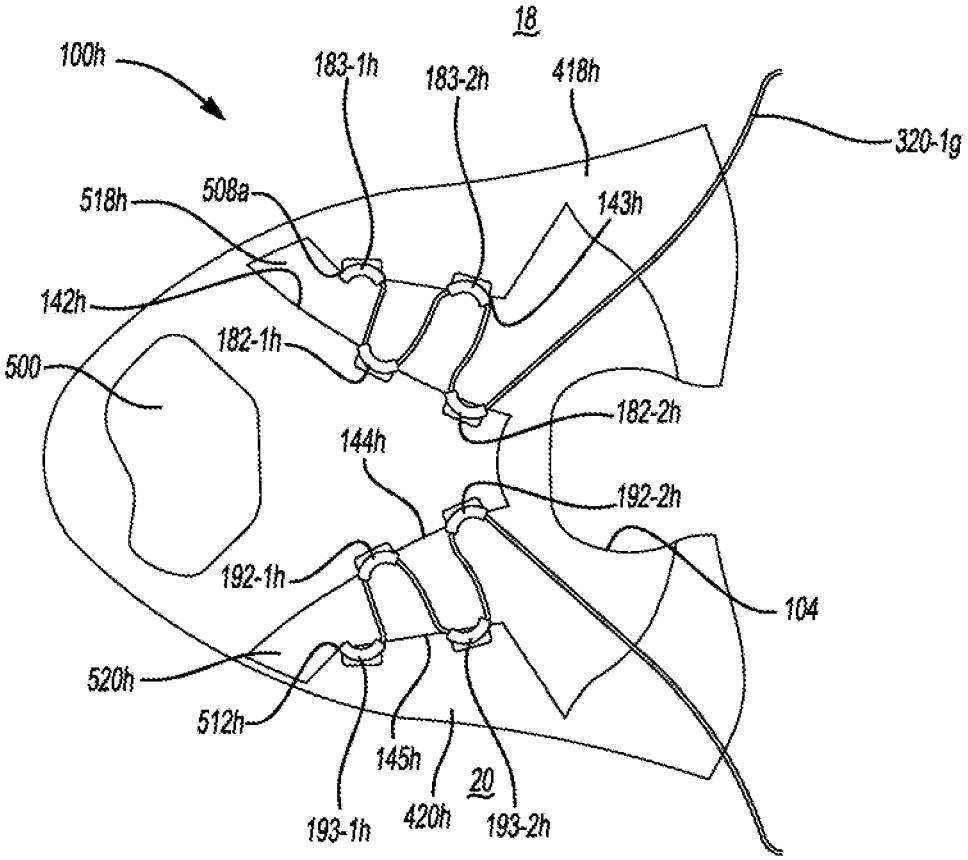
FIG. 57 is a top view of a pattern of an upper of the article of footwear of FIG. 55 formed from a combination of elastic and non-elastic materials.

Referring to FIGS. 55-57, in some implementations, an article of footwear 10*h* includes an upper 100*h*, an outsole 210*g* attached to the upper 100*h*, a midsole 220*g*, and a tightening mechanism 300*h* to move the upper 100*h* between a loosened state and a tightened state. In view of the substantial similarity in structure and function of the components associated with the article of footwear 10 with respect to the article of footwear 10*h*, like reference numerals are used hereinafter and in the drawings to identify like components while like reference numerals containing letter extensions are used to identify those components that have been modified.

The upper 100*h* may be formed from the flexible material forming the upper 100 of FIGS. 1-6 to form an interior void 102*g* and to transition between the tightened state and the loosened state for adjusting the fit of the interior void 102*g* around the foot. The upper 100*h* defines the ankle opening 104 in the heel portion 16 to provide access to the interior void 102*g*. The upper 100*h* further includes a strobel 217 extending around the perimeter of the upper 100*h* and having an interior surface opposing the upper 100*h* and an outer surface opposing the outsole 210*g*. In one configuration, the strobel 217 includes a locking device 350 disposed thereon. For example, the locking device 350 may include the locking device 350*d* of FIGS. 29-34 but could include any of the locking devices 350-350*c* described above or the locking device 350*e* described below.

As with the midsole 220*f* of FIGS. 43 and 45, the midsole 220*g* may define a corresponding cavity 240*g* for receiving the locking device 350 as well as passages/channels for routing cables 302*g*, 502*g* of the tensioning mechanism 300*h*. Because the locking device 350 is attached to the strobel 217, the cavity 240*g* is formed in a surface of the midsole 220*f* that opposes the strobel 217. Namely, the cavity 240*g* is formed in a top surface of the midsole 220*f* that opposes the upper 100*h*. Conversely, the cavity 240 of the article of footwear 10 is formed on an opposite side of the midsole 220 (i.e., a bottom surface) and opposes the outsole 210 (FIG. 5). Similar arrangements are shown in FIGS. 13, 21-23, 36, and 46. In each of the foregoing arrangements, the locking device 350 could be located within a cavity 240 located on a top surface of the respective midsole 220 or, alternatively, could be located within a cavity 240 located on a bottom surface of the respective midsole 220. Further, the cavity 240*g* could be located on a bottom surface of the midsole 220*f* and the locking device 350 could alternatively be attached to the outsole 210*g* rather than the strobel 217.

The outsole 210*g* may further define an aperture/cavity that aligns with the cavity 240*g* of the midsole 220*g* to accommodate at least a portion of the locking device 350 and/or make visible a bottom surface of the locking device 350 when viewed through the ground-engaging surface 212. In other configurations, the midsole 220*g* corresponds to a drop-in midsole received by the interior void 102*g* upon the interior surface of the strobel 217, while the outsole 210*g* attaches to exterior surfaces around the periphery of the upper 100*h* and to the outer surface of the strobel 217, in a similar fashion as described with respect to the article of footwear 10*f*.

The upper 100*g* of FIG. 57 includes an elastic lateral region 518*h* and an elastic medial region 520*h* each formed from the one or more elastic materials 500, as described above with respect to the upper 100*g* of FIGS. 48-54. A non-elastic lateral region 418*h* (formed from the one or more non-elastic materials 400) surrounds an upper lateral edge 142*h* and a lower lateral edge 143*h* of the elastic lateral region 518*h*, while a non-elastic medial region 420*h* (formed from the one or more non-elastic materials 500) surrounds an upper medial edge 144*h* and a lower medial edge 145*h* of the elastic medial region 520*h*. Additional layers formed from the one or more non-elastic materials 400 may be applied over portions of the elastic lateral and medial regions 518*h*, 520*h* and/or portions of the non-elastic lateral and medial regions 418*h*, 420*h* to provide reinforcement and aesthetic properties as evidenced by the footwear 10*g* depicted in FIGS. 48-50. The lateral and medial segments 320-1*g*, 320-2*g* of the second tensioning cable 502*g* route through corresponding ones of lateral engagement features 180*h* and medial engagement features 190*h* disposed along corresponding lateral and medial sides 18, 20 of the upper 100*h*. Whereas the lateral and medial engagement features 180*g*, 190*h* of the upper 100*g* of FIGS. 48-54 include individual sections of tubing lines coated with a lubricious or otherwise low friction material, the lateral and medial engagement features 180*h*, 190*h* of the upper 100*h* of FIG. 55 are associated with individual loops or webbing formed from low friction material and are attached to the corresponding non-elastic lateral region 418*h* or the non-elastic medial region 420*h*. The low friction material may include a thermoplastic polymer, such as Nylon, The lateral engagement features 180*h* include a set of upper lateral engagement features 182-1*h*, 182-2*h* disposed upon the non-elastic lateral region 418*h* opposing the upper lateral edge 142*h* of the elastic lateral region 518*h* and a set of lower lateral engagement features 183-1*h*, 183*h* disposed upon the non-elastic lateral region 418*h* opposing the lower lateral edge 143*h* of the elastic lateral region 518*h*. Thus, the number of upper lateral engagement features 182-1*h*, 182-2*h* is equal to the number of lower lateral engagement features 183-1*h*, 183-2*h*. In the example shown, the free end 508*g* of the lateral lace segment 320-1*g* is knotted to the first lower lateral engagement feature 183-1*h*. In other examples, the free end 508*g* of the lateral lace segment 320-1*g* may be attached (e.g., sewn) to the non-elastic lateral region 418*h* of the upper 100*h*. The medial engagement features 190*h* include a set of upper medial engagement features 192-1*h*, 192-2*h* disposed upon the non-elastic medial region 420*h* opposing the upper medial edge 144*h* of the elastic medial region 520*h* and a set of lower medial engagement features 193-1*h*, 193-2*h* disposed upon the non-elastic medial region 420*h* opposing the lower medial edge 145*h* of the elastic medial region 520*h*. Thus, the number of upper medial engagement features 192-1*h*, 192-2*h* is equal to the number of lower medial engagement features 193-1*h*, 193-2*hh*. In the example shown, the free end 512*g* of the medial lace segment 320-2*g* is knotted to the first lower medial engagement feature 193-1*h*. In other examples, the free end 512*g* of the medial lace segment 320-2*g* may be attached (e.g., sewn) to the non-elastic medial region 420*h* of the upper 100*h*. Whereas the lateral and medial engagement features 180*g*, 190*h* of the upper 100*g* of FIGS. 48-54 provide five (5) turns by each of the lateral lace segment 320-1*g* and the medial lace segment 320-2*g*, the lateral and medial engagement features 180*h*, 190*h* of the upper 100*h* provide three (3) turns by each of the lateral lace segment 320-1*g* and the medial lace segment 320-2*g*. Here, the lower number of turns may compensate for the increased friction associated with the fabric loops or webbing forming the engagement features 180*h*, 190*h* compared to that of the tubes forming the engagement features 180*g*, 190*g* of the upper 100*g* of FIGS. 48-50.

Figure 58:
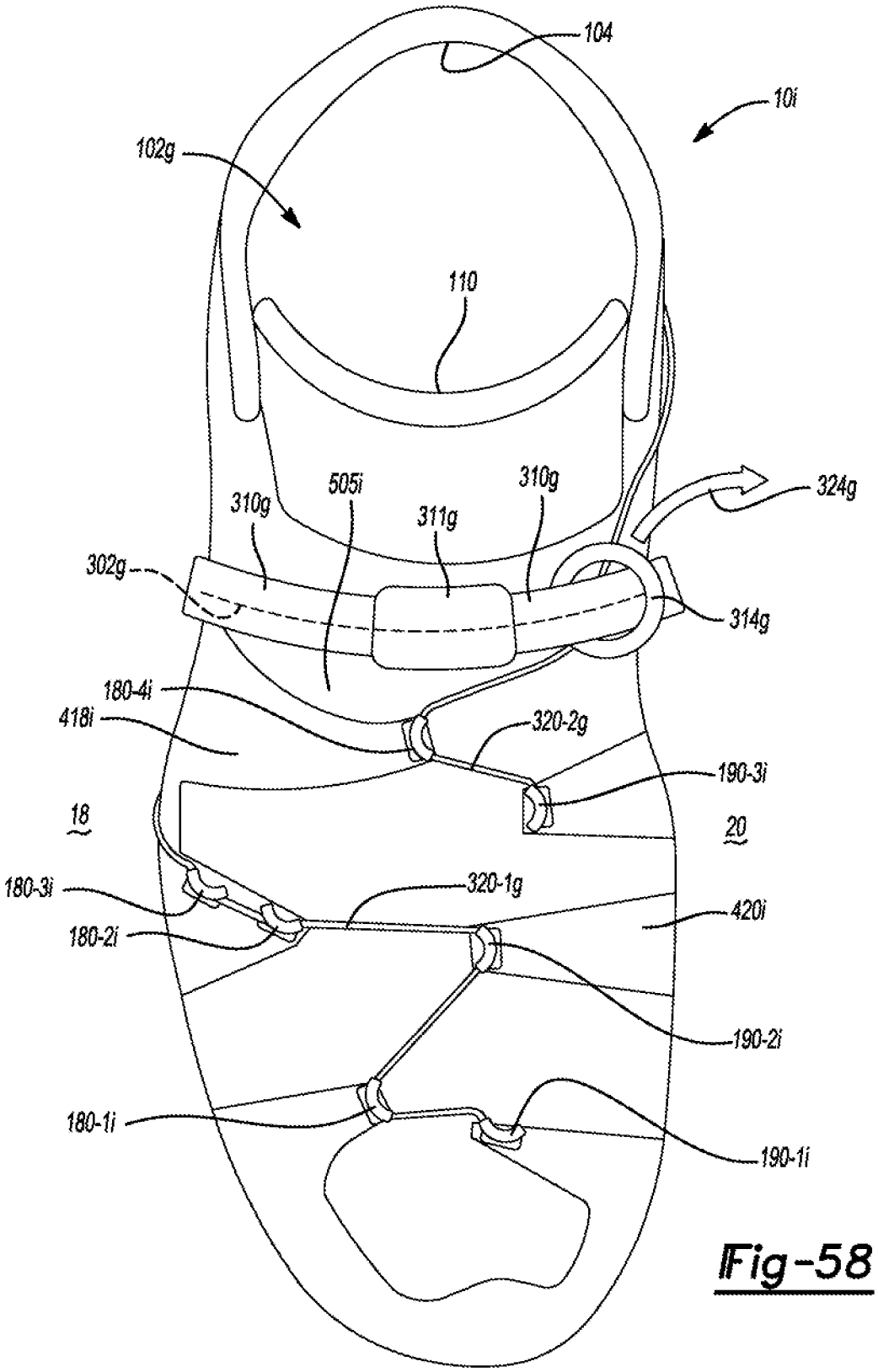
FIG. 58 is a top perspective view of an article an article of footwear having a locking device movable between a locked state to restrict movement of a tensioning cable and an unlocked state to permit movement of the tensioning cable in accordance with principles of the present disclosure.
Figure 59:
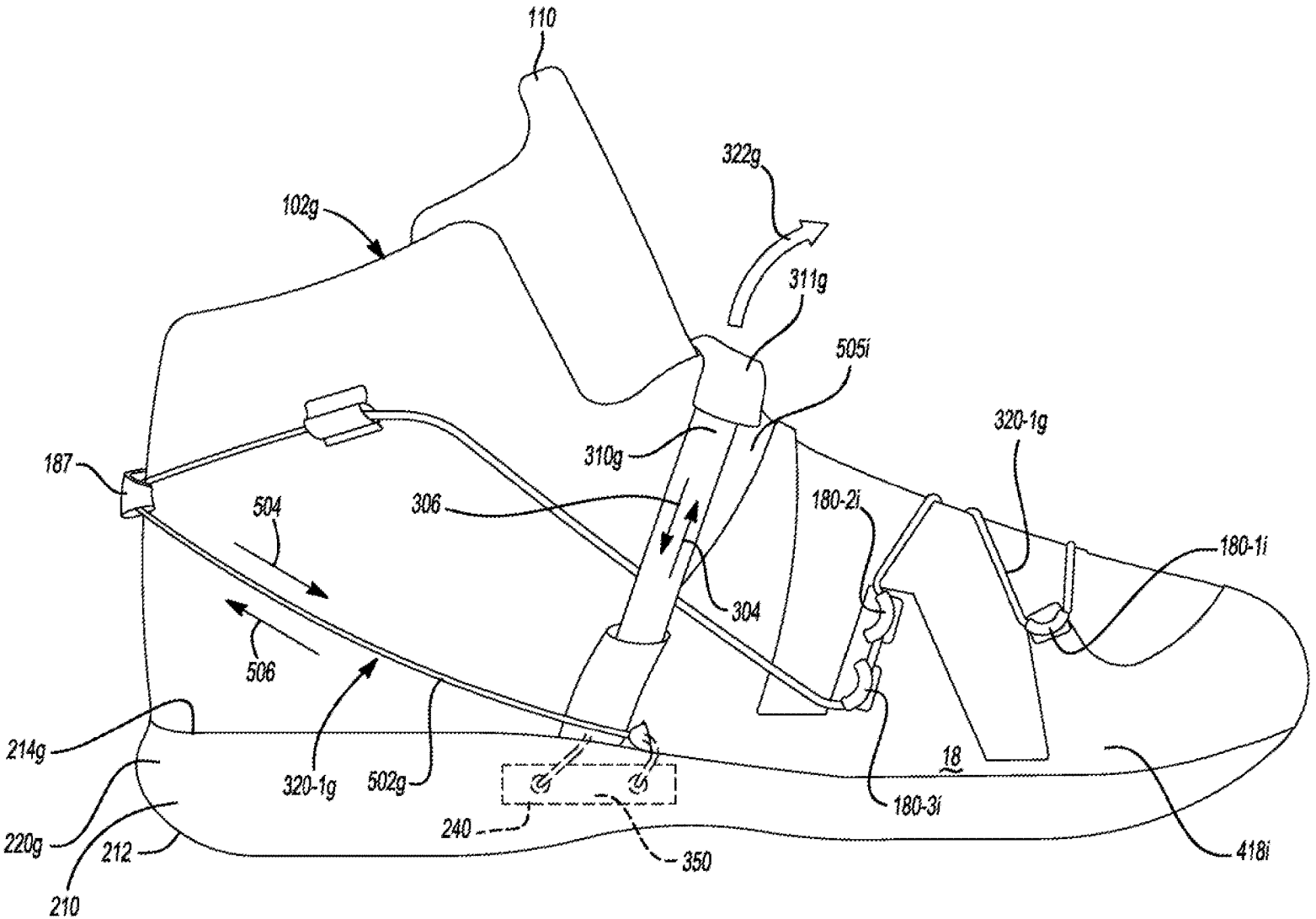
FIG. 59 is a perspective view of the article of footwear of FIG. 58.
Figure 60:
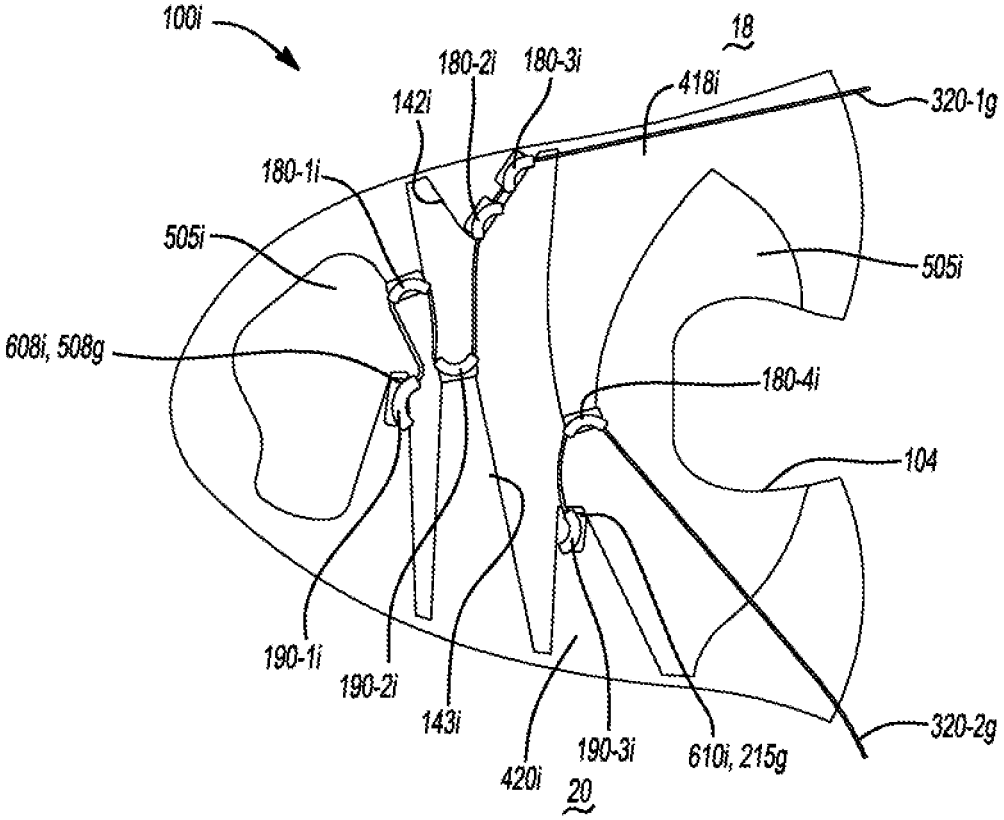
FIG. 60 is a top view of a pattern of an upper of the article of footwear of FIG. 58 formed from a combination of elastic and non-elastic materials.

Referring to FIGS. 58-60, in some implementations, an article of footwear 10*i* includes an upper 100*i*, an outsole 210*g* attached to the upper 100*i*, a midsole 220*g*, and a tightening mechanism 300*i* to move the upper 100*i* between a loosened state and a tightened state. In view of the substantial similarity in structure and function of the components associated with the article of footwear 10 with respect to the article of footwear 10*i*, like reference numerals are used hereinafter and in the drawings to identify like components while like reference numerals containing letter extensions are used to identify those components that have been modified.

The upper 100*i* may be formed from the flexible material forming the upper 100 of FIGS. 1-6 to form an interior void 102*g* and to transition between the tightened state and the loosened state for adjusting the fit of the interior void 102*g* around the foot. The upper 100*i* defines the ankle opening 104 in the heel portion 16 to provide access to the interior void 102*g*. The upper 100*i* further includes a strobel 217 extending around the perimeter of the upper 100*i* and having an interior surface opposing the upper 100*i* and an outer surface opposing the outsole 210*g*. In one configuration, the strobel 217 includes a locking device 350 disposed thereon. For example, the locking device 350 may include the locking device 350*d* of FIGS. 29-34 but could include any of the locking devices 350-350*c* described above or the locking device 350*e* described below.

As with the midsole 220*f* of FIGS. 43 and 45, the midsole 220*g* may define a corresponding cavity 240*g* for receiving the locking device 350 as well as passages/channels for routing cables 302*g*, 502*g* of the tensioning mechanism 300*i*. Because the locking device 350 is attached to the strobel 217, the cavity 240*g* is formed in a surface of the midsole 220*f* that opposes the strobel 217. Namely, the cavity 240*g* is formed in a top surface of the midsole 220*f* that opposes the upper 100*i*. Conversely, the cavity 240 of the article of footwear 10 is formed on an opposite side of the midsole 220 (i.e., a bottom surface) and opposes the outsole 210 (FIG. 5). Similar arrangements are shown in FIGS. 13, 21-23, 36, and 46. In each of the foregoing arrangements, the locking device 350 could be located within a cavity 240 located on a top surface of the respective midsole 220 or, alternatively, could be located within a cavity 240 located on a bottom surface of the respective midsole 220. Further, the cavity 240*g* could be located on a bottom surface of the midsole 220*f* and the locking device 350 could alternatively be attached to the outsole 210*g* rather than the strobel 217.

The outsole 210*g* may further define an aperture/cavity that aligns with the cavity 240*g* of the midsole 220*g* to accommodate at least a portion of the locking device 350 and/or make visible a bottom surface of the locking device 350 when viewed through the ground-engaging surface 212. In other configurations, the midsole 220*g* corresponds to a drop-in midsole received by the interior void 102*g* upon the interior surface of the strobel 217, while the outsole 210*g* attaches to exterior surfaces around the periphery of the upper 100*i* and to the outer surface of the strobel 217, in a similar fashion as described with respect to the article of footwear 10*f*.

The upper 100*i* of FIG. 60 includes an elastic instep region 505*i* defining a lateral edge 142*i* and a medial edge 143*i*, a non-elastic lateral region 418*i* (formed from the one or more non-elastic materials 400) extending from the perimeter of the upper 100*i* at the lateral side 18 to the lateral edge 142*i* of the instep region 505*i*, and a non-elastic medial region 420*i* (formed from the one or more non-elastic materials 400) extending from the perimeter of the upper 100*i* at the medial side 20 to the medial edge 143*i* of the instep region 505*i*. Additional layers formed from the one or more non-elastic materials 400 may be applied over portions of the elastic instep region 505*i* and/or the non-elastic lateral and medial regions 418*i*, 420*i* to provide reinforcement, aesthetic properties, as well as passages for routing portions of the lace segments 320-1*g*, 320-2*g*.

In the example shown, the upper 100*i* includes a series of lateral engagement features 180*i* disposed upon the non-elastic lateral region 418*i* adjacent to the lateral edge 142*i* of the elastic instep region 505*i* and a series of medial engagement features 190*i* disposed upon the non-elastic medial region 420*i* adjacent to the medial edge 143*i* of the elastic instep region 505*i*. Similar to the engagement features 180*h*, 190*h* of the upper 100*h* of FIG. 57, the engagement features 180*i*, 190*i* of the upper 100*i* of FIG. 56 are associated with individual loops or webbing formed from the low friction material (e.g., Nylon) and are attached to the corresponding non-elastic lateral region 418*i* or the non-elastic medial region 420*i*. The lateral and medial lace segments 320-1*g*, 320-2*g* of the second tensioning cable 502*g* may each operably connect to the upper 100*i* upon the non-elastic medial region 420*i* at a corresponding attachment location 608*i*, 612*i* adjacent to the medial edge 143*i* of the elastic instep region 505*i*. For instance, lateral lace segment 320-1*g* may extend between the first end 508*g* of the second tensioning cable 502*g* (i.e., at the attachment location 608*i*) and the locking device 350, and the medial lace segment 320-2*g* may extend between the second end 512*g* of the second tensioning cable 502*g* (i.e., at the attachment location 610*i*) and the locking device 350.

With continued reference to FIG. 60, a lateral lace pattern of the lateral lace segment 320-1*g* extends along the lateral side 18 of the upper 100*i* and is sequentially fed through a third lateral engagement feature 180-3*i* and a second lateral engagement feature 180-2*i*, across the elastic instep region 505*i* from the lateral edge 142*i* to the medial edge 143*i*, and through a second medial engagement feature 190-2*i*. In some examples, the lateral lace segment 320-1*g* extends through a passage defined by the non-elastic lateral region 418*i* between the locking device 350 and the third lateral engagement feature 180-3*i*. Upon exiting the second medial engagement feature 190-2*i*, the lateral lace segment 320-1*g* extends back across the elastic instep region 505*i* from the medial edge 143*i* to the lateral edge 142*i*, through a first lateral engagement feature 142*i*, and back across the elastic instep region 505*i* from the lateral edge 142*i* to the medial edge 143*i*. Finally, the lateral lace segment 320-1*g* feeds through a first medial engagement feature 190-1*i* and operatively connects to the non-elastic medial region 520*i* of the upper 100*i* at the attachment location 608*i* proximate to the first medial engagement feature 190-1*i* adjacent to the medial edge 143*i* of the elastic instep region 505*i*. In some examples, the first end 508*g* of the second tensioning cable 502*g* associated with the free end of the lateral lace segment 320-1*g* includes a mounting feature (e.g., ball) or is knotted to have a larger diameter than the loop or webbing of the corresponding first medial engagement feature 190-1*i* for anchoring the lateral lace segment 320-1*g* to the upper 100*i* at the attachment location 608*i*. However, the lateral lace segment 320-1*g* may operatively connect to the upper 100*i* at the attachment location 608*i* using any attachment/fastening technique.

A medial lace pattern of the medial lace segment 320-2*g* extends along the medial side 20 of the upper 100*i* to a location proximate to the ankle opening 104, across the elastic instep region 505*i* from the medial edge 143*i* to the lateral edge 142*i*, and through a fourth lateral engagement feature 180-4*i*. In some examples, the medial lace segment 320-2*g* extends along the medial side 20 of the upper 100*i* through a passage defined by the non-elastic medial region 420*i* and exits the corresponding passage proximate to the ankle opening 104 to traverse across the elastic instep region 505*i*. Upon exiting the fourth lateral engagement feature 180-4*i*, the medial lace segment 320-2*g* extends back across the elastic instep region 505*i* from the lateral edge 142*i* to the medial edge 143*i*, through a third medial engagement feature 190-3*i*, and operatively connects to the upper 100*i* at the attachment location 610*i* proximate to the third medial engagement feature 190-3*i* adjacent to the medial edge 144*i* of the elastic instep region 505*i*. In some examples, the second end 510*g* of the second tensioning cable 502*g* associated with the free end of the medial lace segment 320-2*g* includes a mounting feature (e.g., ball) or is knotted to have a larger diameter than the loop or webbing of the corresponding third medial engagement feature 190-3*i* for anchoring the medial lace segment 320-2*g* to the upper 100*i* at the attachment location 608*i*. However, the medial lace segment 320-2*g* may operatively connect to the upper 100*i* at the attachment location 610*i* using any attachment/fastening technique.

The example lateral and medial lacing patterns provided by the upper 100*i* of FIG. 60 and the pattern associated with the elastic instep region 505*i* tunes the fit of the interior void 102 around the instep and the forefoot of the foot. For instance, movement by the second tensioning cable 502*g* in the tightening direction 504 constricts the elastic instep region 505*i* at a first location associated with the instep of the foot, and slightly offset toward the medial side 20 of the upper 100*i*, by drawing the lateral and medial edges 142*i*, 143*i* toward one another according to the medial lacing pattern of the medial lace segment 320-2*g*, and also constricts the elastic instep region 505*i* at a second location associated with the forefoot, and offset toward the lateral side 18 of the upper 100*i*, by drawing the lateral and medial edges 142*i*, 143*i* toward one another according to the lateral lacing pattern of the lateral lace segment 320-1*g*.

Figure 61:
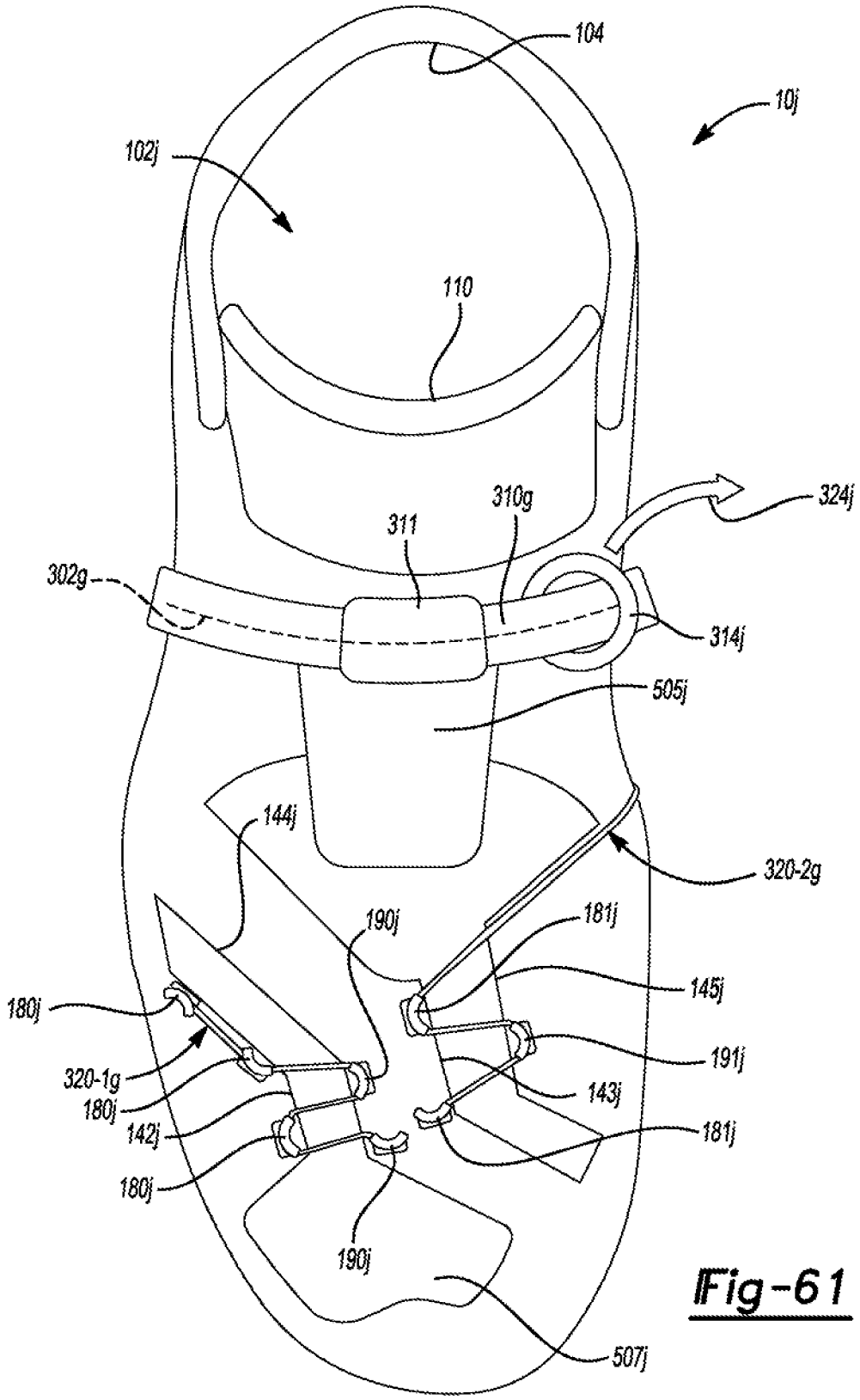
FIG. 61 is a top perspective view of an article an article of footwear having a locking device movable between a locked state to restrict movement of a tensioning cable and an unlocked state to permit movement of the tensioning cable in accordance with principles of the present disclosure.
Figure 62:
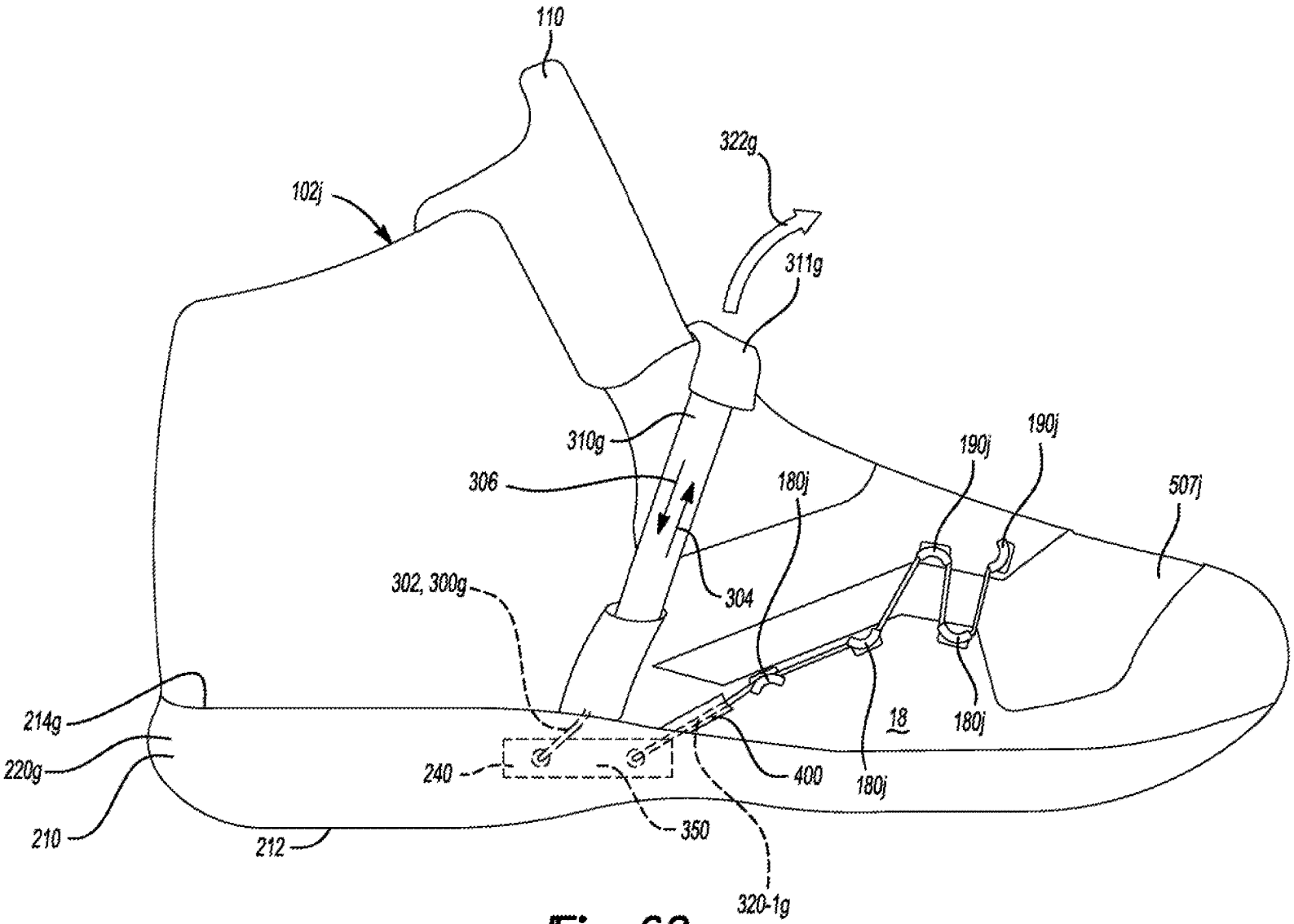
FIG. 62 is a perspective view of the article of footwear of FIG. 61.
Figure 63:
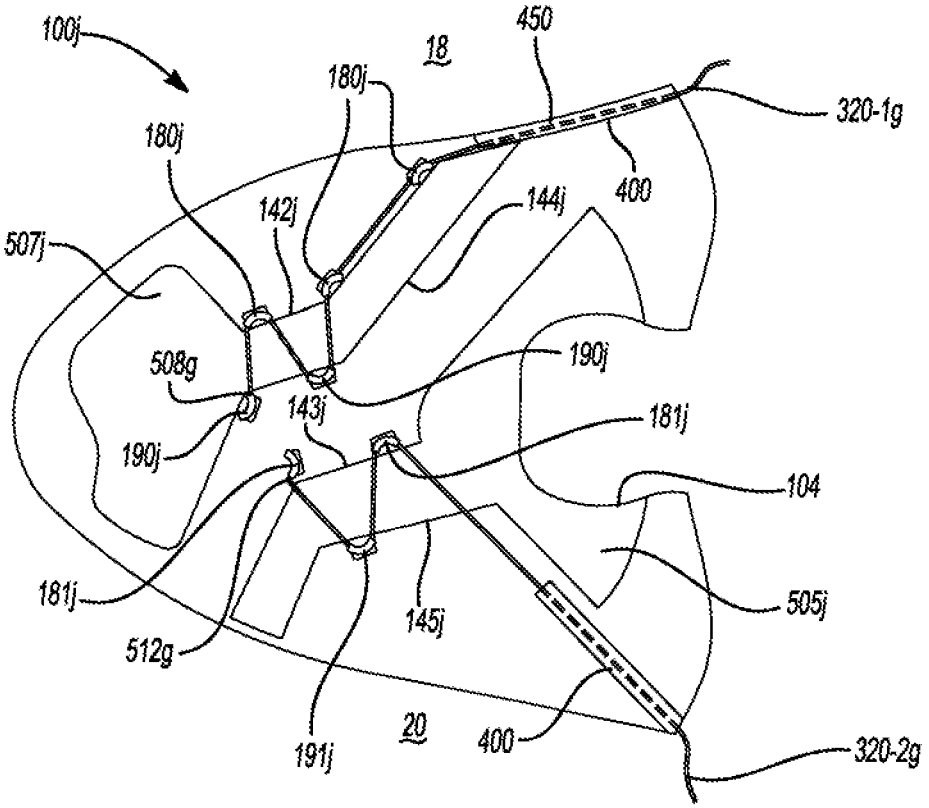
FIG. 63 is a top view of a pattern of an upper of the article of footwear of FIG. 61 formed from a combination of elastic and non-elastic materials.

Referring to FIGS. 61-63, in some implementations, an article of footwear 10*j* includes an upper 100*j*, an outsole 210*g* attached to the upper 100*j*, a midsole 220*g*, and a tightening mechanism 300*j* to move the upper 100*j* between a loosened state and a tightened state. In view of the substantial similarity in structure and function of the components associated with the article of footwear 10 with respect to the article of footwear 10*j*, like reference numerals are used hereinafter and in the drawings to identify like components while like reference numerals containing letter extensions are used to identify those components that have been modified.

The upper 100*j* may be formed from the flexible material forming the upper 100 of FIGS. 1-6 to form an interior void 102*g* and to transition between the tightened state and the loosened state for adjusting the fit of the interior void 102*g* around the foot. The upper 100*j* defines the ankle opening 104 in the heel portion 16 to provide access to the interior void 102*g*. The upper 100*j* further includes a strobel 217 extending around the perimeter of the upper 100*j* and having an interior surface opposing the upper 100*j* and an outer surface opposing the outsole 210*g*. In one configuration, the strobel 217 includes a locking device 350 disposed thereon. For example, the locking device 350 may include the locking device 350*d* of FIGS. 29-34 but could include any of the locking devices 350-350*c* described above or the locking device 350*e* described below.

As with the midsole 220*f* of FIGS. 43 and 45, the midsole 220*g* may define a corresponding cavity 240*g* for receiving the locking device 350 as well as passages/channels for routing cables 302*g*, 502*g* of the tensioning mechanism 300*j*. Because the locking device 350 is attached to the strobel 217, the cavity 240*g* is formed in a surface of the midsole 220*f* that opposes the strobel 217. Namely, the cavity 240*g* is formed in a top surface of the midsole 220*f* that opposes the upper 100*j*. Conversely, the cavity 240 of the article of footwear 10 is formed on an opposite side of the midsole 220 (i.e., a bottom surface) and opposes the outsole 210 (FIG. 5). Similar arrangements are shown in FIGS. 13, 21-23, 36, and 46. In each of the foregoing arrangements, the locking device 350 could be located within a cavity 240 located on a top surface of the respective midsole 220 or, alternatively, could be located within a cavity 240 located on a bottom surface of the respective midsole 220. Further, the cavity 240*g* could be located on a bottom surface of the midsole 220*f* and the locking device 350 could alternatively be attached to the outsole 210*g* rather than the strobel 217.

The outsole 210*g* may further define an aperture/cavity that aligns with the cavity 240*g* of the midsole 220*g* to accommodate at least a portion of the locking device 350 and/or make visible a bottom surface of the locking device 350 when viewed through the ground-engaging surface 212. In other configurations, the midsole 220*g* corresponds to a drop-in midsole received by the interior void 102*g* upon the interior surface of the strobel 217, while the outsole 210*g* attaches to exterior surfaces around the periphery of the upper 100*i* and to the outer surface of the strobel 217, in a similar fashion as described with respect to the article of footwear 10*f*.

FIG. 63 shows the pattern of the upper 100*j* providing lateral and medial lacing patterns operative to tune the fit of the interior void 102*g* around the instep and the forefoot of a foot. The example upper 100*j* includes an elastic instep region 505*j*, an elastic forefoot region 507*j*, and non-elastic regions 450 disposed between and surrounding the elastic instep and forefoot regions 505*j*, 507*j*. Additional layers formed from the one or more non-elastic materials 400 may be applied over portions of the elastic lateral and medial regions 418*j*, 420*j* to provide reinforcement, aesthetic properties, as well as passages 509 for routing portions of the lace segments 320-1*g*, 320-2*g*. The elastic forefoot region 507*j* extends medially from the midfoot portion of the upper 100*j* at the lateral side 18 to the forefoot portion to cover the top of a foot residing in the interior void 102*g*. The elastic forefoot region 507*j* includes a respective lateral edge 142*j* and a respective medial edge 144*j*. The elastic instep region 505*j* covers the instep of the foot residing in the interior void 102*g* proximate to the ankle opening 104 and extends medially therefrom to the midfoot portion to cover the top and medial sides of the foot residing in the interior void 102*g*. The elastic instep region 505*j* includes a respective lateral edge 143*j* and a respective medial edge 145*j*.

In some configurations, the lateral lace segment 320-1*g* routes through a series of forefoot lateral engagement features 180*j* and a series of forefoot medial engagement features 190*j* according to a forefoot lacing pattern. In the example shown, three forefoot lateral engagement features 180*j* are disposed upon the non-elastic region 450 adjacent to the lateral edge 142*j* of the elastic forefoot region 507*j* and two forefoot medial engagement features 190*j* are disposed upon the non-elastic region 450 adjacent to the medial edge 142*j* of the elastic forefoot region 507*j*. On the other hand, the medial lace segment 320-2*g* routes through a series of instep lateral engagement features 181*j* and one or more instep medial engagement features 191*j* according to an instep lacing pattern. In the example shown, two instep lateral engagement features 181*j* are disposed upon the non-elastic region 450 adjacent to the lateral edge 143*j* of the elastic instep region 505*j* and one instep medial engagement feature 191*j* is disposed upon the non-elastic region 450 adjacent to the medial edge 145*j* of the elastic instep region 405*j*. Similar to the engagement features 180*h*, 190*h* of the upper 100*h* of FIG. 57, the engagement features 180*j*, 181*j*, 190*j*, 191*j* of the upper 100*j* of FIG. 63 are associated with individual loops or webbing formed from the low friction material (e.g., Nylon) and attached to the non-elastic region 450. The lateral and medial lace segments 320-1*g*, 320-2*g* of the second tensioning cable 502*g* may each operably connect to the upper 100*j* upon the non-elastic region 450 at a corresponding attachment location adjacent to the medial edge 144*j* of the elastic forefoot region 507*j* and the lateral edge 143*j* of the elastic instep region 505*j*. For instance, lateral lace segment 320-1*g* may extend between the first end 508*g* of the second tensioning cable 502*g* and the locking device 350, and the medial lace segment 320-2*g* may extend between the second end 512*g* of the second tensioning cable 502*g* and the locking device 350.

With continued reference to FIG. 63, the forefoot lacing pattern of the lateral lace segment 320-1*g* extends along the lateral side 18 of the upper 100*j* and is fed through the third forefoot lateral engagement feature 180*j*, extends medially along the lateral edge 142*j* of the elastic forefoot region 507*j* and through the second forefoot lateral engagement feature 180*j*. Upon exiting the second forefoot lateral engagement feature 180*j*, the lateral lace segment 320-1*g* extends across the elastic forefoot region 507*j* from the lateral edge 142*j* to the medial edge 143*j*, through the second forefoot medial engagement feature 190*j*, and back across the elastic forefoot region 507*j* from the medial edge 143*j* to the lateral edge 142*j*. Finally, the lateral lace segment 320-1*g* feeds through the first forefoot lateral engagement feature 180*j*, across the elastic forefoot region 507*j* from the lateral edge 142*j* to the medial edge 143*j*, through the first forefoot medial engagement feature 190*j* and operatively connects to the non-elastic region 450 of the upper 100*j* at the attachment location proximate to the first forefoot medial engagement feature 190*j* adjacent to the medial edge 144*j* of the elastic forefoot region 507*j*.

The instep lacing pattern of the medial lace segment 320-2*g* extends along the medial side 20 of the upper 100*j*, across the elastic instep region 505*j* from the medial edge 145*j* to the lateral edge 143*j*, and through the second instep lateral engagement features 181*j*. In some examples, the medial lace segment 320-2*g* extends along the medial side 20 of the upper 100*j* through a passage defined by the non-elastic region 450 and exits the corresponding passage proximate to the ankle opening 104 to traverse across the elastic instep region 505*j*. Upon exiting the second instep lateral engagement features 181*j*, the medial lace segment 320-2*g* extends back across the elastic instep region 505*j* from the lateral edge 143*j* to the medial edge 145*j*, through the forefoot medial engagement feature 191*j*, across the elastic instep region 505*j* from the medial edge 145*j* to the lateral edge 143*j*, and through the first instep lateral engagement feature 181*j* to operatively connect to the upper 100*j* at the attachment location proximate to the first instep lateral engagement feature 181*j* adjacent to the lateral edge 143*j* of the elastic instep region 505*j*.

The example forefoot and instep lacing patterns provided by the upper 100*j* of FIG. 63 and the patterns associated with the elastic instep and forefoot regions 505*j*, 507*j* tune the fit of the interior void 102 around the instep and the forefoot of the foot. For instance, movement by the second tensioning cable 502*g* in the tightening direction 504 constricts the elastic instep region 505*j* by drawing the lateral and medial edges 143*j*, 145*j* toward one another according to the instep lacing pattern of the of the medial lace segment 320-2*g*. At the same time, the movement by the second tensioning cable 502*g* in the tightening direction 504 constricts the elastic forefoot region 507*j* by drawing the lateral and medial edges 142*j*, 144*j* toward one another according to the forefoot lacing pattern of the lateral lace segment 320-1*g*.

Figure 64:
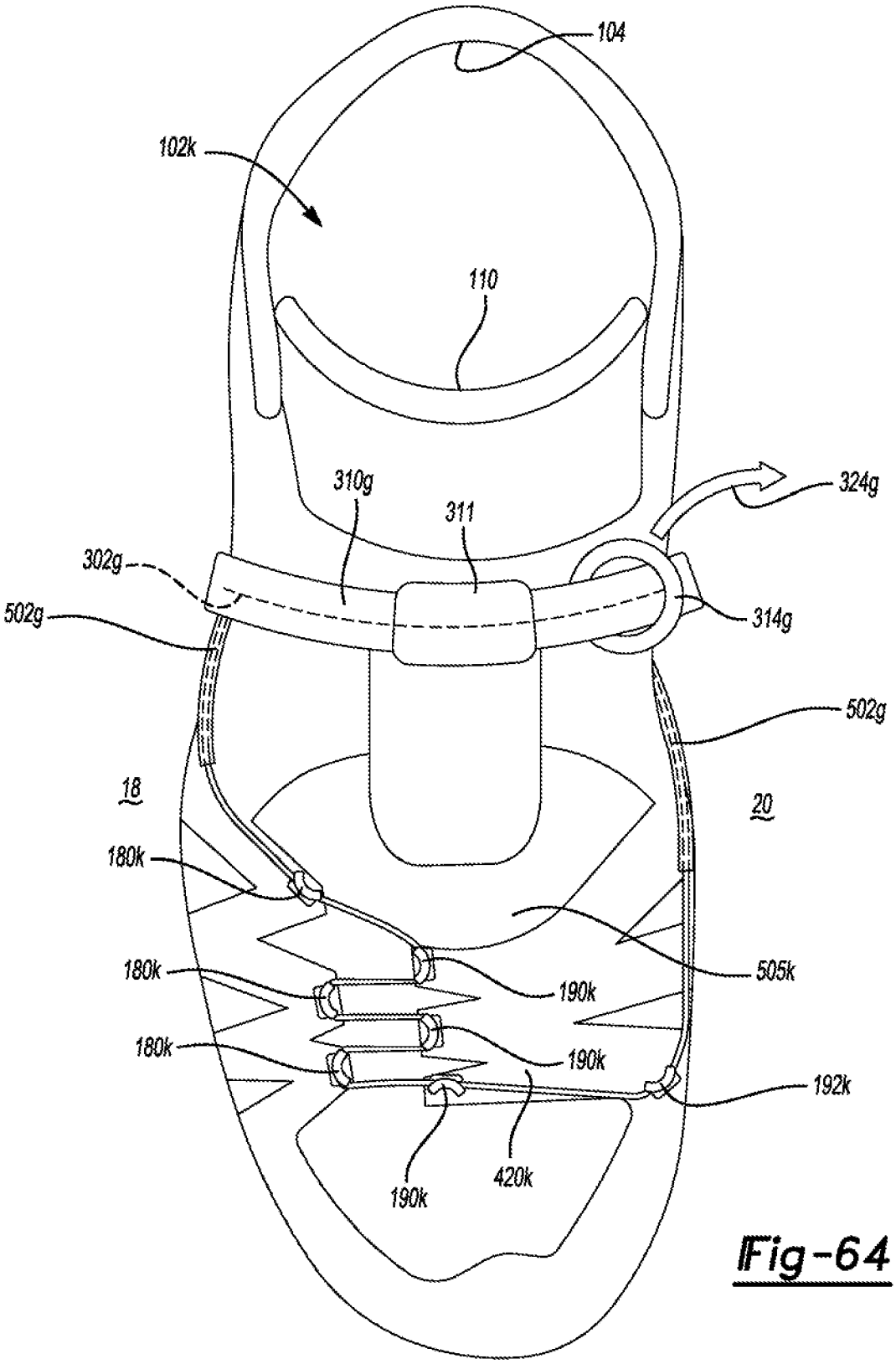
FIG. 64 is a top perspective view of an article an article of footwear having a locking device movable between a locked state to restrict movement of a tensioning cable and an unlocked state to permit movement of the tensioning cable in accordance with principles of the present disclosure.
Figure 65:
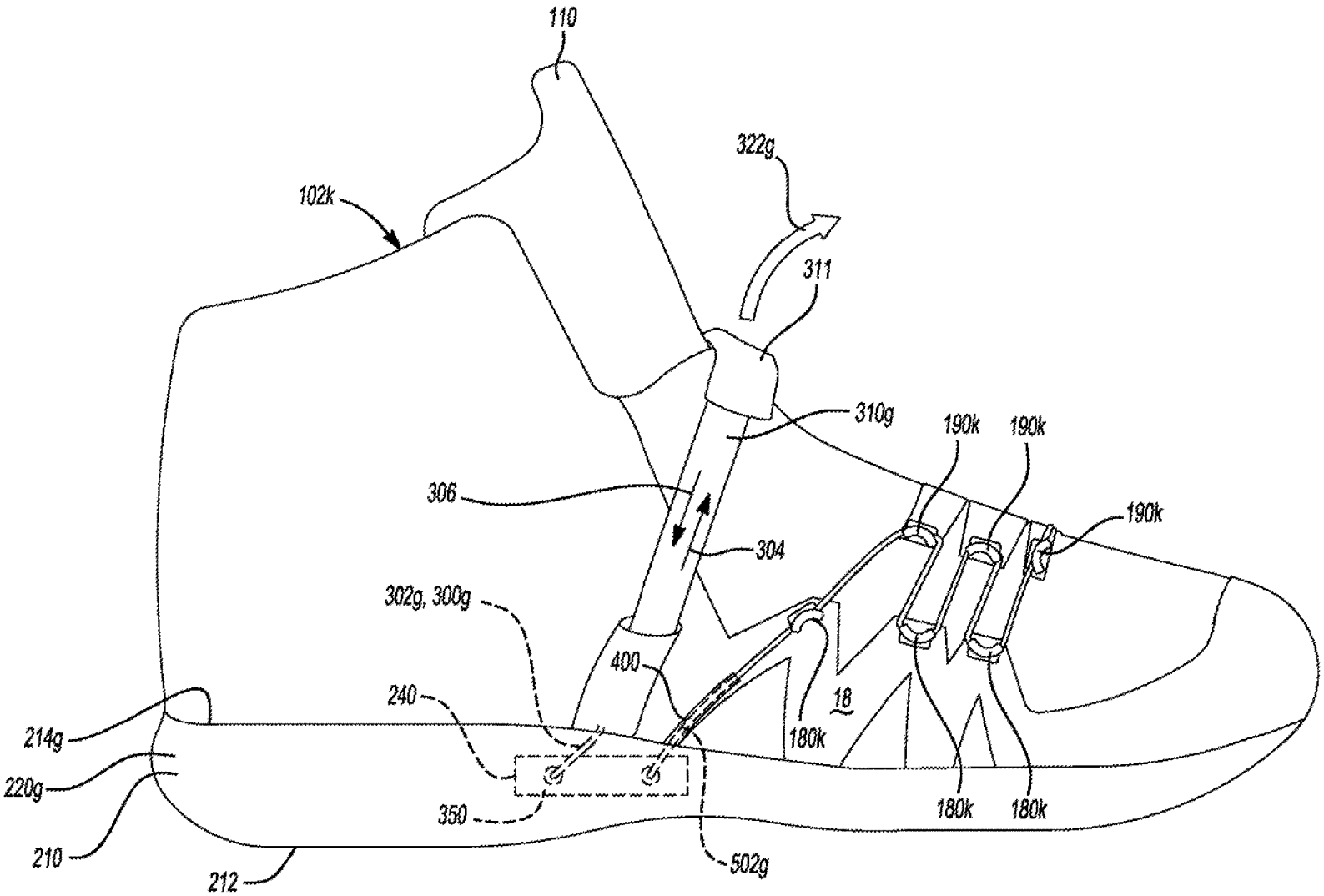
FIG. 65 is a perspective view of the article of footwear of FIG. 64.
Figure 66:
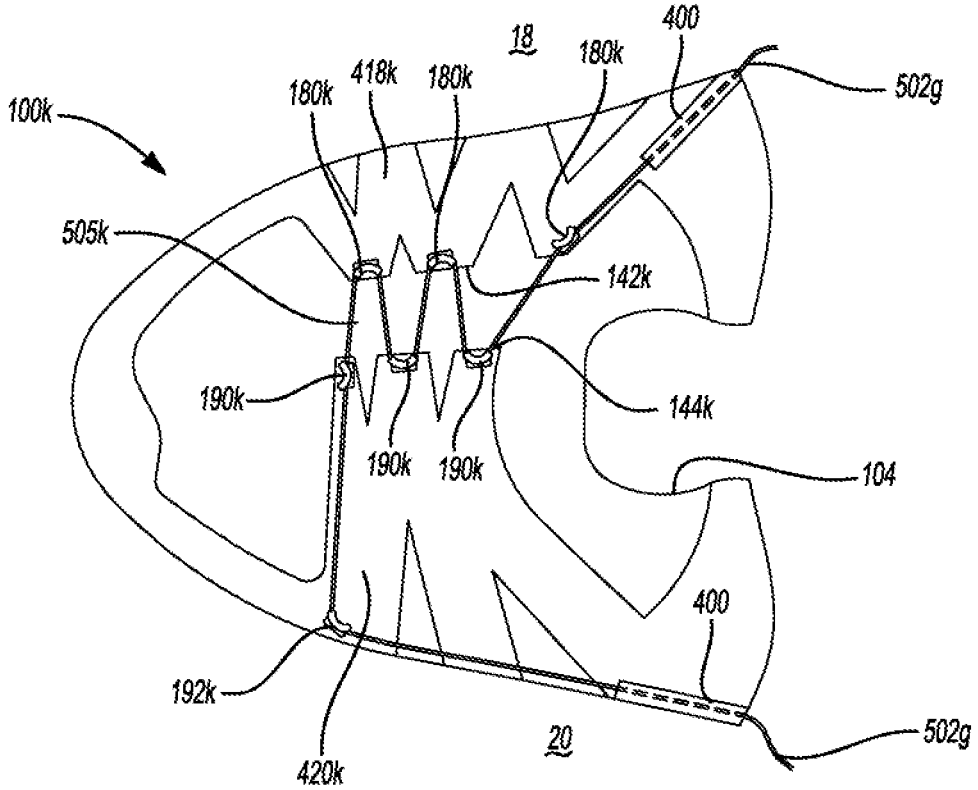
FIG. 66 is a top view of a pattern of an upper of the article of footwear of FIG. 64 formed from a combination of elastic and non-elastic materials.

Referring to FIGS. 64-66, in some implementations, an article of footwear 10*k* includes an upper 100*k*, an outsole 210*g* attached to the upper 100*k*, a midsole 220*g*, and a tightening mechanism 300*k* to move the upper 100*k* between a loosened state and a tightened state. In view of the substantial similarity in structure and function of the components associated with the article of footwear 10 with respect to the article of footwear 10*k*, like reference numerals are used hereinafter and in the drawings to identify like components while like reference numerals containing letter extensions are used to identify those components that have been modified.

The upper 100*k* may be formed from the flexible material forming the upper 100 of FIGS. 1-6 to form an interior void 102*g* and to transition between the tightened state and the loosened state for adjusting the fit of the interior void 102*g* around the foot. The upper 100*k* defines the ankle opening 104 in the heel portion 16 to provide access to the interior void 102*g*. The upper 100*k* further includes a strobel 217 extending around the perimeter of the upper 100*k* and having an interior surface opposing the upper 100*k* and an outer surface opposing the outsole 210*g*. In one configuration, the strobel 217 includes a locking device 350 disposed thereon. For example, the locking device 350 may include the locking device 350*d* of FIGS. 29-34 but could include any of the locking devices 350-350*c* described above or the locking device 350*e* described below.

As with the midsole 220*f* of FIGS. 43 and 45, the midsole 220*g* may define a corresponding cavity 240*g* for receiving the locking device 350 as well as passages/channels for routing cables 302*g*, 502*g* of the tensioning mechanism 300*k*. Because the locking device 350 is attached to the strobel 217, the cavity 240*g* is formed in a surface of the midsole 220*f* that opposes the strobel 217. Namely, the cavity 240*g* is formed in a top surface of the midsole 220*f* that opposes the upper 100*k*. Conversely, the cavity 240 of the article of footwear 10 is formed on an opposite side of the midsole 220 (i.e., a bottom surface) and opposes the outsole 210 (FIG. 5). Similar arrangements are shown in FIGS. 13, 21-23, 36, and 46. In each of the foregoing arrangements, the locking device 350 could be located within a cavity 240 located on a top surface of the respective midsole 220 or, alternatively, could be located within a cavity 240 located on a bottom surface of the respective midsole 220. Further, the cavity 240*g* could be located on a bottom surface of the midsole 220*f* and the locking device 350 could alternatively be attached to the outsole 210*g* rather than the strobel 217.

The outsole 210*g* may further define an aperture/cavity that aligns with the cavity 240*g* of the midsole 220*g* to accommodate at least a portion of the locking device 350 and/or make visible a bottom surface of the locking device 350 when viewed through the ground-engaging surface 212. In other configurations, the midsole 220*g* corresponds to a drop-in midsole received by the interior void 102*g* upon the interior surface of the strobel 217, while the outsole 210*g* attaches to exterior surfaces around the periphery of the upper 100*k* and to the outer surface of the strobel 217, in a similar fashion as described with respect to the article of footwear 10*f*.

FIG. 66 shows the upper 100*k* including an elastic instep region 505*k* defining a lateral edge 142*k* and a medial edge 144*k*, a non-elastic lateral region 418*k* (formed from the one or more non-elastic materials 400) extending from the perimeter of the upper 100*k* at the lateral side 18 to the lateral edge 142*k* of the instep region 505*k*, and a non-elastic medial region 420*k* (formed from the one or more non-elastic materials 400) extending from the perimeter of the upper 100*k* at the medial side 20 to the medial edge 144*k* of the instep region 505*k*. In the example shown, the elastic instep region 505*k* is slightly offset toward the lateral side 18 of the upper 100*k* such that the non-elastic medial region 420*k* extends over the medial side 20 of the foot as well as a portion of the instep of a foot. Additional layers formed from the one or more non-elastic materials 400 may be applied over portions of the non-elastic lateral and medial regions 418*k*, 420*k* to provide reinforcement, aesthetic properties, as well as passages 509 for routing portions of the second tensioning cable 502*g*. The second tensioning cable 502*g* may include a continuous loop of cable defined by operatively connecting the free ends 508*g*, 512*g* together at any location In the example shown, the upper 100*k* includes a series of lateral engagement features 180*k* disposed upon the non-elastic lateral region 418*k* adjacent to the lateral edge 142*k* of the elastic instep region 505*k* and a series of medial engagement features 190*k* disposed upon the non-elastic medial region 420*k* adjacent to the medial edge 144*k* of the elastic instep region 505*k*. While the series of lateral engagement features 180*k* and the series of medial engagement features 180*k* each include three engagement features 180*k*, 190*k*, the series of lateral and medial engagement features 180*k*, 190*k* may each include more or less than three engagement features 180*k*, 190*k*. Similar to the engagement features 180*h*, 190*h* of the upper 100*h* of FIG. 55, the engagement features 180*k*, 190*k* of the upper 100*k* of FIG. 58 are associated with individual loops or webbing formed from the low friction material (e.g., Nylon) and attached to the corresponding non-elastic lateral region 418*k* or the non-elastic medial region 420*k*.

While the example uppers 100*g*, 100*h*, 100*i*, 100*j* of FIGS. 52, 57, 60, and 63 provide two lacing patterns (i.e., lateral and medial lacing patterns), the upper 100*k* of FIG. 66 provides one lacing pattern of the second tensioning cable 502*g* that extends along the lateral side 18 of the upper 100*k*, through the third lateral engagement feature 180*k*, across the elastic instep region 505*k* from the lateral edge 142*k* to the medial edge 144*k*, and through the third medial engagement feature 190*k*. In some examples, the second tensioning cable 502*g* extends through a passage defined by the non-elastic lateral region 418*k* between the locking device 350 and the third lateral engagement feature 180*k*. Upon exiting the third medial engagement feature 190*k*, the second tensioning cable 502*k* continues zigzagging across the elastic instep region 505*k* to sequentially feed through the second lateral engagement feature 180*k*, the second medial engagement feature 190*k*, the first lateral engagement feature 180*k*, and the first medial engagement feature 190*k* before extending medially across the non-elastic medial region 420*k* and through a routing member 192*k* disposed on the non-elastic medial region 420*k* to route the second tensioning cable 502*k* back to the locking device 350. The second tensioning cable 502*k* may extend along the medial side 18 of the upper 100*k* from the routing member 192*k* to the locking device 350 through a corresponding passage defined by the upper 100*k*.

The second lace segment 320-2*f* continues zigzagging across the throat opening 140*f* to sequentially feed through a fourth lateral engagement feature 180-4, a third medial engagement feature 190-3, a second lateral engagement feature 180-2, and a first medial engagement feature 190-1 before finally operatively connecting to the first lace segment 320-1*f* at the corresponding free ends 508*f*, 510*f*.

Figure 69:
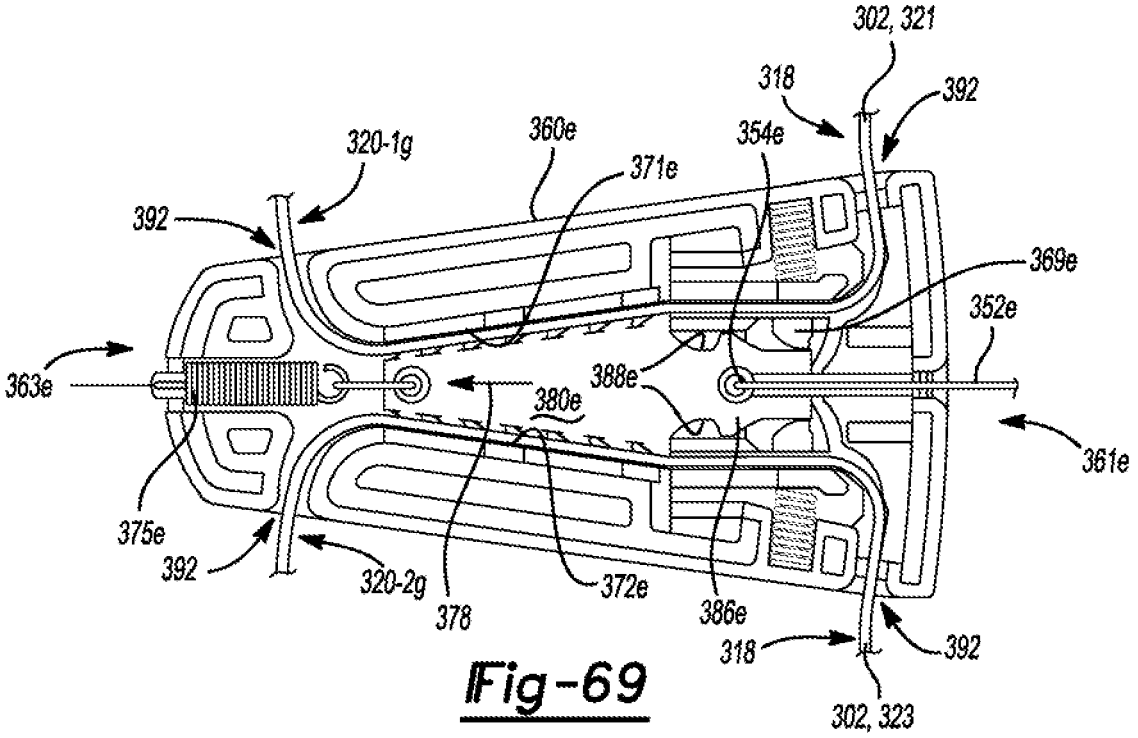
FIG. 69 is a top view of the locking device of FIG. 67 showing a housing having a lid removed to expose a locking member slidably disposed within the housing when the locking member is in a locked position.
Figure 70:
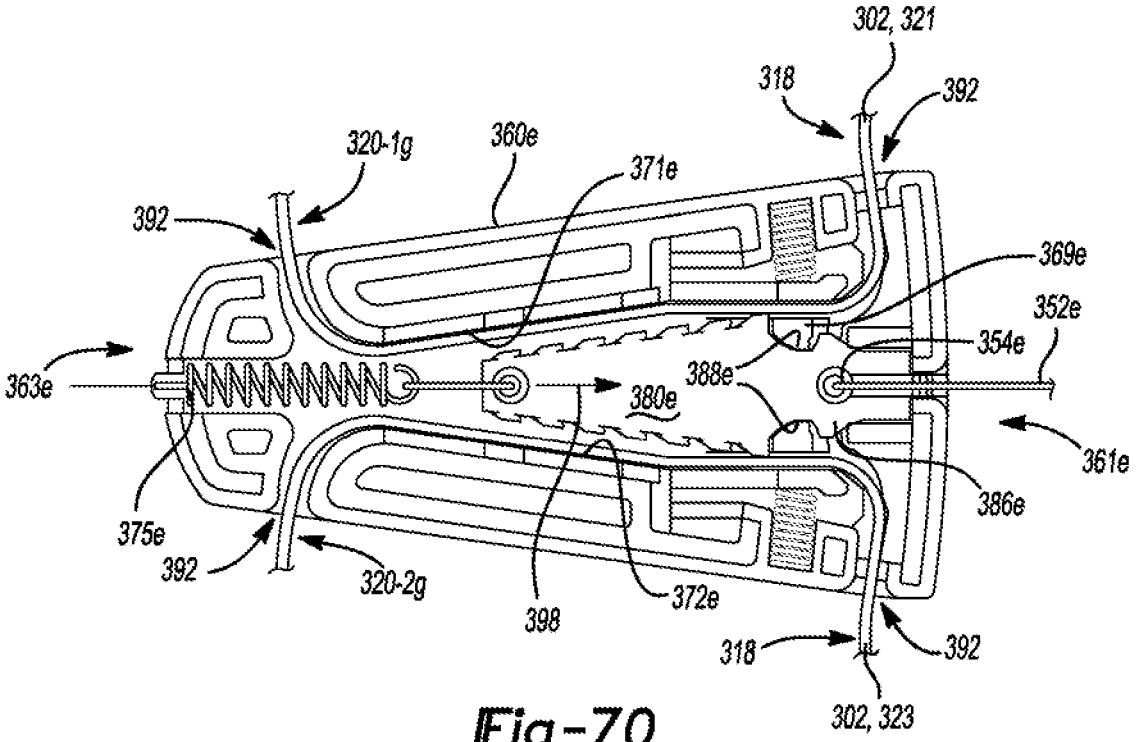
FIG. 70 is a top view of the locking device of FIG. 67 showing a housing having a lid removed to expose a locking member slidably disposed within the housing when the locking member is in an unlocked position.
Figure 71:
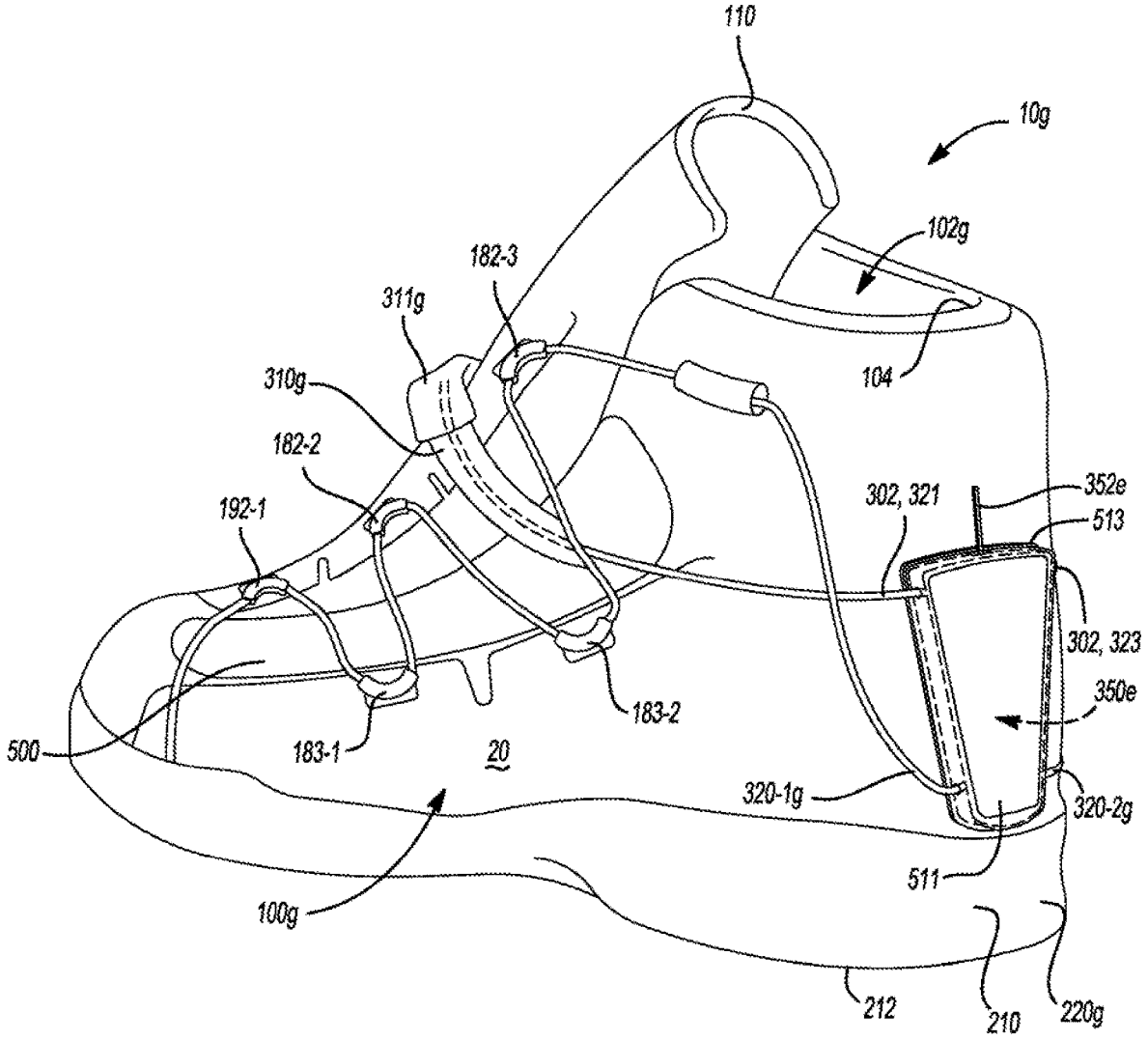
FIG. 71 is a rear perspective view of an article of footwear incorporating the locking device of FIG. 67 at a heel region of the article of footwear.

Referring to FIGS. 67-70, in some implementations, a wedge-shaped locking device 350*e* may be incorporated into any of the articles of footwear 10-10*k* to restrict movement the tensioning cable 302 in at least the loosening direction 306. While the locking device 350*e* may be incorporated into any of the articles of footwear 10-10*k*, the locking device 350*e* will be described with reference to the footwear 10*g* of FIGS. 48-54, as shown in FIG. 71. A release mechanism 352*e* may transition the locking device 350*e* from the locked state to the unlocked state to thereby permit the tensioning cable 302 to move in both directions 304, 306 and may extend in a direction away from the ground-engaging surface 212 when attached to the footwear 10*g*, as shown in FIG. 71. For instance, the release mechanism 352*e* may include the release cord for transitioning the locking device 350*e* from the locked state to the unlocked state when the release cord 352*e* is pulled. The release cord 352*e* may attach to the locking device 350*e* at a first end 354*e* to move the locking device 350*e* from the locked state to the unlocked state when an exposed second end 356*e* receives a force of a predetermined magnitude. For instance, the second end 356*e* of the release cord 352*e* may be located proximate to the loosening grip 314*g* such that the pulling force 324*g* can be subsequently applied to the loosening grip 314*g* once the release cord 352*e* moves the locking device 350*e* to the unlocked state.

In some implementations, the locking device 350*e* or cable lock is elongate and is disposed on an exterior surface of the upper 100*g* such as along the heel end of the upper 100*g* (FIG. 71), however, the locking device 350*e* may be disposed at or near the ankle opening 104 along the lateral side 18 or the medial side 20. The locking device 350*e* includes a longitudinal axis that may be substantially perpendicular to the ground-engaging surface 212 once positioned on the upper 100*g*. While the locking device 350*e* is described and shown as being disposed on an exterior surface of the upper 100*g*, the locking device 350*e* could be located and used in place of any of the foregoing locking devices 350-350*d*.

The heel end of the upper 100*g* may include a foam receptacle or other housing 511 disposed thereon that receives and retains the locking device 350*e* upon the upper 100*g* at the heel end. In other examples, the locking device 350*e* may be disposed on a foam pad 513 attached to the heel end of the upper 100*g*. In other configurations, the locking device 350*e* is disposed in the sole structure 200 between the midsole and the outsole (i.e., within a corresponding cavity formed in the midsole and/or the outsole 210). In these examples, the locking device 350*e* may attach to the bottom surface of the strobel 217. Similarly, the locking device 350*e* may be disposed within the interior void 102*g* of the footwear 10*g* and a drop-in midsole is received by the interior void 102 overtop the locking device 350*e*. Here, the midsole may include a cavity/recess to receive the locking device 350*e*. Implementations herein will be described with reference to the locking device 350*e* disposed/mounted onto the exterior surface of the upper 100-100*g* along the heel end thereof.

Figure 67:
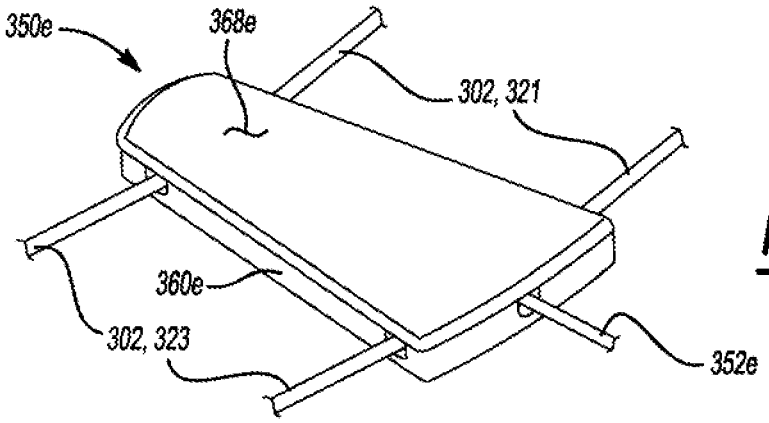
FIG. 67 is a top view of a locking device movable between a locked state to restrict movement of a tensioning cable and an unlocked state to permit movement of the tensioning cable in accordance with principles of the present disclosure.
Figure 68:
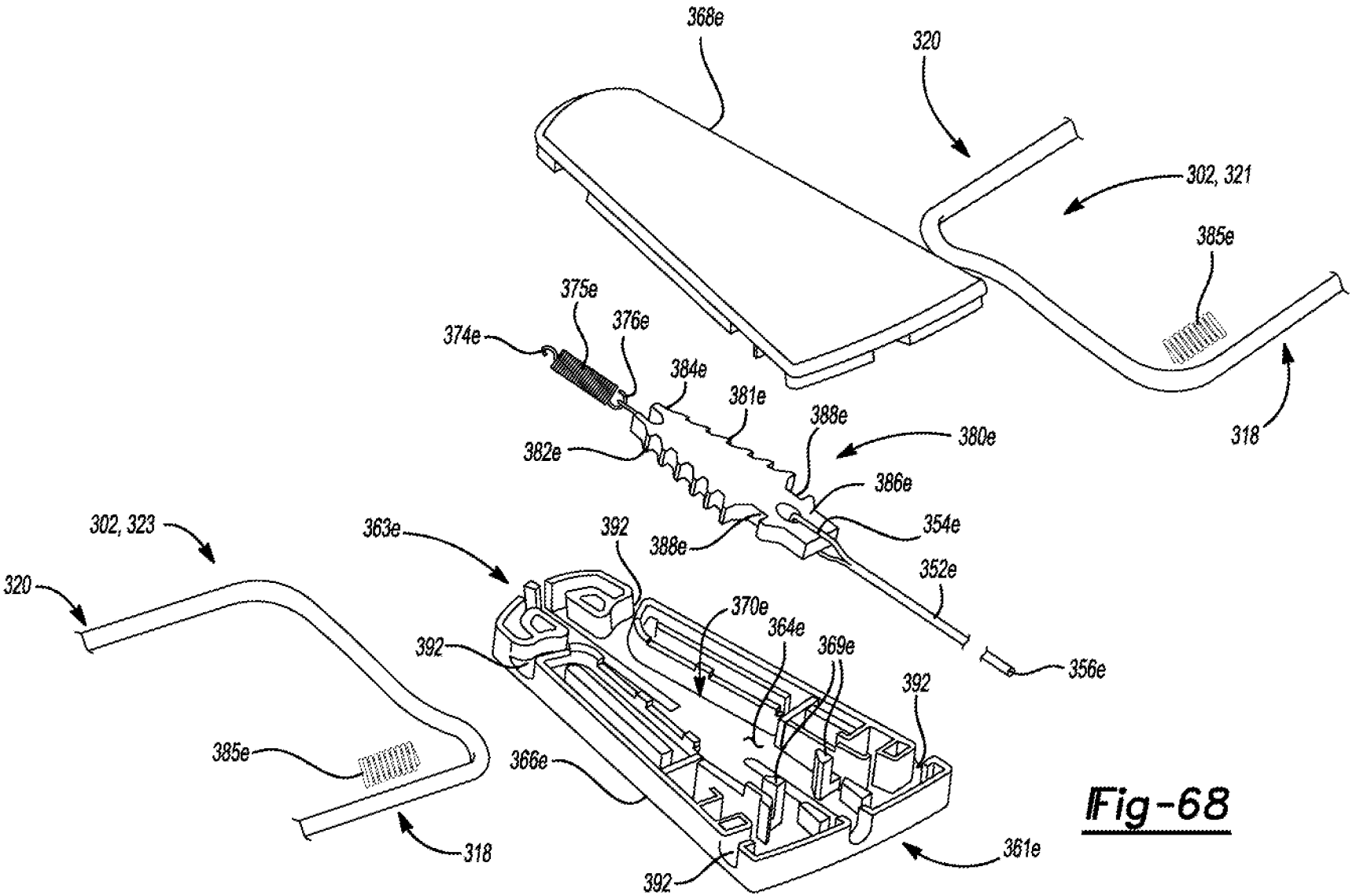
FIG. 68 is an exploded view of the locking device of FIG. 67 showing a housing and a locking member of the locking device.

In some implementations, the locking device 350*e* includes a housing 360*e* and a locking member or lock member 380*e* slidably disposed within the housing 360*e* and enclosed by a lid 368*e* releasably fastened to the housing 360*e*. FIG. 68 provides an exploded view of the locking device 350*e* of FIG. 67 showing the locking member 380*e* and the lid 368*e* removed from the housing 360*e*. The housing 360*e* defines a length extending between a first end 361*e* opposing the ankle opening 104 of the footwear 10*g* and a second end 363*e* opposing the outsole 210*g* of the footwear 10*g* when the housing 360*e* is disposed on the exterior of the upper 100*g* along the heel end of the footwear 10*g*. The housing 360*e* includes a base portion 362*e* having a cable-receiving surface 364*e* and a mounting surface 366*e* disposed on an opposite side of the base portion 362*e* than the cable-receiving surface 364*e* and opposing the exterior surface of the upper 100*e*. The lid 368*e* opposes the cable-receiving surface 364*e* of the base portion 362*e* to define a locking member cavity 370*e* therebetween that is configured to receive the locking member 380*e* and the tensioning cable 302. In some configurations, the locking member cavity 370*e* is bounded by a first engagement or lock surface 371*e* (FIGS. 69 and 70) and a second engagement or lock surface 372*e* (FIGS. 69 and 70) that converge toward one another such that the locking member cavity 370*e* is associated with a wedge-shaped configuration tapering toward the second end 363*e* of the housing 360*e*. Accordingly, the first engagement surface 371*e* and the second engagement surface 372*e* include corresponding sidewalls of the housing 360*e* converging toward one another and extending between the lid 368*e* and the cable-receiving surface 364*e* of the base portion 362*e* to define the locking member cavity 370*e*.

The tensioning cable 302 may define a continuous loop of cable that extends thru the locking member cavity 370*e* and includes a first portion 321 extending along the first engagement surface 371 and a second portion 323 extending along the second engagement surface 372*e*. The tensioning cable 302 (e.g., the first portion 321 and the second portion 323) exits out of corresponding slots 392 (FIGS. 69 and 70) formed through opposing sidewalls of the housing 360*e* proximate to the first end 361*e* to define the first length 318 that extends around the tongue portion 110 proximate to and above the instep of the wearer's foot, and exits out of corresponding slots 392 (FIGS. 69 and 70) formed through the opposing sidewalls of the housing 360*e* proximate to the second end 363*e* to define the second length 320. When the locking device 360*e* is incorporated onto the upper 100*g* of the article of footwear 10*g* of FIGS. 48-54, FIGS. 69 and 70 show the first portion 321 of the tensioning cable 302 along the second length 320 defining the lateral lace segment 320-1*g*, and the second portion 323 of the tensioning cable 302 along the second length 320 defining the medial lace segment 320-1*g*.

In some implementations, the locking member 380*e* includes a first lock surface 381*e* opposing the first engagement surface 371*e* of the housing 360*e* and a second lock surface 382*e* opposing the second engagement surface 372*e* of the housing 360*e* when the locking member 380*e* is disposed within the locking member cavity 370*e* of the housing 360*e*. In some examples, the first lock surface 381*e* and the second lock surface 382*e* converge toward one another. Additionally or alternatively, the first lock surface 381*e* may be substantially parallel to the first engagement surface 371*e* and the second lock surface 382*e* may be substantially parallel to the second engagement surface 372*e*. In the example shown, the locking surfaces 381*e*, 382*e* include projections or teeth each having an angled surface to permit movement by the cable 302 in the tightening direction 304 (i.e., when a pulling force 322*g* is applied to cable 302 along the first length 318) while restricting movement by the cable 302 by gripping the cable 302 in the loosening direction 306 when the locking member 380*e* is in the locked state. A biasing member 375*e* (e.g., a spring) may include a first end 374*e* attached to the second end 363*e* of the housing 360 and a second end 376*e* attached to a first end 384*e* of the locking member 380*e* to attach the locking member 380*e* to the housing 360*e*.

In some implementations, the locking member 380*e* is slidably disposed within the housing 360*e* and is movable between a locked position (FIG. 69) associated with the locked state of the locking device 350*e* and an unlocked position (FIG. 70) associated with the unlocked state of the locking device 350*e*. In some examples, the release mechanism 352*e* (e.g., release cord 352*e*) moves the locking member 380*e* from the locked position (FIG. 69) to the unlocked position (FIG. 70). The locking member 380*e* may include a tab portion 386*e* extending from an opposite end of the locking member 380*e* than the first end 384*e*. In one configuration, the first end 354*e* of the release cord 352*e* attaches to the tab portion 386*e* of the locking member 380*e*. The tab portion 386*e* may include a pair of retention features or recesses 388*e* formed in corresponding ones of the first lock surface 381*e* and the second lock surface 382*e* and selectively receiving one or more retention features 369*e* associated with the housing 360*e* to maintain the locking device 350*e* in the unlocked state. The retention features 369*e* associated with the housing 360*e* may include a first retention feature 369*e* and a second retention feature 369*e* disposed on opposite sides of the housing 360*e*, whereby the retention features 369*e* are biased inward toward the cavity 370*e* and one another by corresponding biasing members 385*e*. The retention features 369*e* may be projections that are integrally formed with the housing 360*e* such that the retention features 369*e* act as living hinges movable between a retracted state (FIG. 69) and an extended state (FIG. 70).

FIG. 69 provides a top view of the locking device 350*e* of FIG. 67 with the lid 368*e* removed to show the locking member 380*e* disposed within the cavity 370*e* of the housing 360*e* while in the locked position. In some examples, the locking member 380*e* is biased into the locked position. For instance, FIG. 69 shows the biasing member 375*e* exerting a biasing force (represented in a direction 378) upon the locking member 380*e* to urge the first end 384*e* of the locking member 380*e* toward the second end 361*e* of the housing 360*e*, and thereby bias the locking member 380*e* into the locked position. While in the locked position, the locking member 380*e* restricts movement of the tensioning cable 302 relative to the housing 360*e* by pinching the first portion 321 of the tensioning cable 302 between the first lock surface 381*e* and the first engagement surface 371*e* and pinching the second portion 323 of the tensioning cable 302 between the second lock surface 382*e* and the second engagement surface 372*e*. Accordingly, the locked position of the locking member 380*e* restricts the tensioning cable 302 from moving in the loosening direction 306 when the pulling force 324*g* is applied to the loosening grip 314*g*. In the example shown, the locking member 380*e* permits movement of the tensioning cable 302 when the pulling force 322*g* is applied to the tightening grip 311*g*, as this direction causes the tensioning cable 302 to apply a force on the locking member 380*e* due to the generally wedge shape of the locking member 380*e*, thereby moving the locking member 380 into the unlocked state. The locking member 380 automatically returns to the locked state once the force applied to the tightening grip 311*g* is released due to the forces imparted on the locking member 380*e* by the biasing member 375*e*.

FIG. 70 provides a top view of the locking device 350*e* of FIG. 67 with the lid 368*e* removed to show the locking member 380*e* disposed within the cavity 370*e* of the housing 360*e* while in the unlocked position. In some examples, the release cord 352*e* attached to the tab portion 386*e* of the locking member 380*e* applies a release force 398 upon the locking member 380*e* to move the locking member 380*e* away from the first engagement surface 371*e* and the second engagement surface 372*e* relative to the housing 360*e*. Here, the release force 398 is sufficient to overcome the biasing force 378 of the biasing member 375*e* to permit the locking member 380*e* to move relative to the housing 360*e* such that the pinching upon the first portion 321 of the tensioning cable 302 between the first lock surface 381*e* and the first engagement surface 371*e* and the pinching upon the second portion 323 of the tensioning cable 302 between the second lock surface 382*e* and the second engagement surface 372*e* is released. In some examples, the biasing force 378 causes the locking member 380*e* to transition back to the locked position when the release force 398 applied by the release cord 352*e* is released. The release cord 352*e* may apply the release force 398 when a pulling force 324*g* of sufficient or predetermined magnitude is applied to pull the release cord 352*e* away from the upper 100*g* relative to the view of FIG. 70.

While in the unlocked position, the locking member 380*e* permits movement of the tensioning cable 302 relative to the housing 360*e* by allowing the first portion 321 of the tensioning cable 302 to freely move between the first lock surface 381*e* and the first engagement surface 371*e* and allowing the second portion 323 of the tensioning cable 302 to freely move between the second lock surface 382*e* and the second engagement surface 372*e*. The unlocked position of the locking member 380*e* permits movement of the tensioning cable 302 in both the tightening direction 304 and the loosening direction 306 when the pulling forces 322*g*, 324*g* are applied to respective ones of the tightening grip 311*g* and the loosening grip 314*g*. As with the footwear 10 of FIGS. 1-6 described above, movement of the tensioning cable 302 in the tightening direction 304 causes the second length 320 (i.e., lateral and medial lace segments 320-1*g*, 320-2*g*) of the tensioning cable 302 to decrease to constrict the elastic lateral and medial regions 518, 520 of the upper 100*g* and thereby move the upper 100*g* into the tightened state for closing the interior void 102*g* around the foot; while movement of the tensioning cable 302 in the loosening direction 306 causes the second length 320 (i.e., lateral and medial lace segments 320-1*g*, 320-2*g*) to increase to allow elastic lateral and medial regions 518, 520 to revert back to their flat relaxed states and thereby facilitate a transition of the upper 100*g* from the tightened state to the loosened state such that the foot can be removed from the interior void 102*g*.

In some examples, a sufficient magnitude and/or duration of the pulling force 324*g* applied to the release cord 352*g* causes the release cord 352*g* to apply the release force 398 (FIG. 70) upon the locking member 380*e* in a direction opposite the direction of the biasing force 378 (FIG. 69) such that the locking member 380*e* moves away from the engagement surfaces 371*e*, 372*e* relative to the housing 360*e* and toward the first end 361*e* of the housing 360*e*. At least one of the retention features 369*e* of the housing 360*e* may engage the retention feature 388*e* of the locking member 380*e* when release force 398 moves the locking member 380*e* a predetermined distance away from the first engagement surface 371*e* and the second engagement surface 372*e* of the housing 360*e*. Here, engagement between the retention feature 388*e* of the locking member 380*e* and the at least one retention feature 369*e* of the housing 360*e* maintains the locking member 380*e* in the unlocked position once the pulling force 324*g* is released to cease the application of the release force 398. The biasing force 378 of the biasing member 375*e* and the forces exerted by the pair of biasing members 385*e* on the retention features 369*e* lock the retention feature 388*e* of the locking member 380*e* into engagement with the retention features 369*e* of the housing 360*e* after the locking member 380*e* moves the predetermined distance and the release force 398 is no longer applied.

In some scenarios, a pulling force 324*g* associated with a first magnitude may be applied to the release cord 352*e* to move the locking member 380*e* away from the engagement surfaces 371*e*, 372*e* by a distance less than the predetermined distance such that the retention features 388*e*, 369*e* do not engage. In these scenarios, the pulling force 324*g* associated with the first magnitude can be maintained when it is desirable to move the tensioning cable 302 in the loosening direction 306 (e.g., by applying the pulling force 324*g* to the loosening grip 314*g*) or the tightening direction 304 (e.g., by applying the pulling force 322*g* to the tightening grip 311*g*) for adjusting the fit of the interior void 102*g* around the foot. Once the desired fit of the interior void 102*g* around the foot is achieved, the pulling force 358*g* can be released to cause the locking member 380*e* to transition back to the locked position so that movement of the tensioning cable 302 is restricted in the loosening direction and the desired fit can be sustained. It should be noted that even when the locking member 380*e* is in the locked position, the tensioning cable 302 can be moved in the tightening direction. As such, once the pulling force 324*g* is released and a desired fit is achieved, the locking member 380*e* automatically retains the desired fit by locking a position of the cable 302 relative to the housing 360*e*.

In other scenarios, a pulling force 358*g* associated with a second magnitude greater than the first magnitude can be applied to the release cord 352*e* to move the locking member 380*g* the predetermined distance away from the engagement surfaces 371*e*, 372*e* to cause the corresponding retention features 369*e*, 388*e* to engage. Engagement of the retention features 369*e*, 388*e* is facilitated by providing the retention features 369*e* with a tapered edge that opposes the locking member 380*e* to allow the locking member 380*e* to more easily move the retention features 369*e* against the biasing force imparted thereon by the biasing members 385*e* when the release cord 352*e* is pulled the predetermined distance. In these scenarios, engagement between the corresponding retention features 369*e*, 388*e* maintains the locking member 380*e* in the unlocked position when the pulling force 358*g* is released.

The locking member 380*e* is returned to the locked position when a tightening force is applied to the lateral and medial lace segments 320-1*g*, 320-2*g*. Namely, when a force is applied to the lateral and medial lace segments 320-1*g*, 320-2*g*, these segments 320-1*g* and 320-2*g* are placed in tension which, in turn, exerts a force on the biasing members 385*e* via the retention features 369*e*, as the segments 320-1*g* and 320-2*g* pass through a portion of the retention features 369*e*, as shown in FIGS. 69 and 70. In so doing, the retention features 369*e* compress the biasing members 385*e* and, as such, cause the retention features 369*e* to move away from one another and disengage the retention features 388*e* of the locking member 380*e*, thereby allowing the biasing member 375*e* to return the locking member 380*e* to the locked position. In some implementations, the locking device 350*e* replaces the locking device 350*b* of FIGS. 17-23.

The following Clauses provide exemplary configurations for an article of footwear and a cable lock in accordance with the principles of the present disclosure.

Clause 1: An article of footwear comprising an upper defining an interior void, a first cable movable in a tightening direction to move the upper into a tightened state and movable in a loosening direction to move the upper into a loosened state, a tightening grip operable to be moved away from the upper in a first direction to move the first cable in the tightening direction, a cable lock operable in a locked state to restrict movement of the first cable in the loosening direction and operable in an unlocked state to permit movement of the first cable in the loosening direction, and a release grip operable to be moved away from the upper in a second direction to move the cable lock from the locked state to the unlocked state, the release grip being separate from the tightening grip.

Clause 2: The article of footwear of Clause 1, wherein the cable lock is disposed remotely from the tightening grip and from the release grip.

Clause 3: The article of footwear of any of the preceding Clauses, further comprising a sole structure attached to the upper.

Clause 4: The article of footwear of Clause 3, wherein the tightening grip extends from the upper and the cable lock is disposed within the sole structure.

Clause 5: The article of footwear of Clause 4, wherein the loosening grip extends from the upper.

Clause 6: The article of footwear of Clause 3, wherein the loosening grip extends from the upper and the cable lock is disposed within the sole structure.

Clause 7: The article of footwear of Clause 3, wherein the sole structure includes a midsole and an outsole.

Clause 8: The article of footwear of Clause 7, wherein the midsole includes a cavity, the cable lock being disposed within the cavity.

Clause 9: The article of footwear of Clause 8, wherein the cavity opposes the outsole.

Clause 10: The article of footwear of Clause 8, wherein the cavity opposes the upper.

Clause 11: The article of footwear of Clause 10, further comprising a strobel attached to the upper, the cavity opposing the strobel.

Clause 12: The article of footwear of Clause 11, wherein the cable lock is attached to the strobel.

Clause 13: The article of footwear of any of the preceding Clauses, wherein the tightening grip and the release grip are disposed on opposite sides of an ankle opening of the upper.

Clause 14: The article of footwear of any of the preceding Clauses, wherein the release grip extends from a heel region of the upper.

Clause 15: The article of footwear of any of the preceding Clauses, further comprising a second cable having a first portion forming the tightening grip and a second portion received by the cable lock.

Clause 16: The article of footwear of Clause 15, wherein an effective length of the second cable is increased when the tightening grip is moved away from the upper.

Clause 17: The article of footwear of Clause 16, wherein an effective length of the first cable is reduced when the tightening grip is moved away from the upper.

Clause 18: The article of footwear of Clause 17, wherein a portion of the first cable is retracted within the cable lock when the tightening grip is moved away from the upper.

Clause 19: The article of footwear of Clause 1, wherein an effective length of the first cable is reduced when the tightening grip is moved away from the upper.

Clause 20: The article of footwear of Clause 1, wherein a portion of the first cable is retracted within the cable lock when the tightening grip is moved away from the upper.

Clause 21: The article of footwear of any of the preceding Clauses, wherein the first direction is different than the second direction.

Clause 22: An article of footwear comprising an upper defining an interior void, a first cable portion movable in a first tightening direction to move the upper into a tightened state and movable in a first loosening direction to move the upper into a loosened state, a second cable portion movable in a second tightening direction to move first cable portion in the first tightening direction and movable in a second loosening direction when the first cable portion is moved in the first loosening direction, and a cable lock operable in a locked state to restrict movement of the first cable portion in the first loosening direction and the second cable portion in the second loosening direction and operable in an unlocked state to permit movement of the first cable portion in the first loosening direction and the second cable portion in the second loosening direction.

Clause 23: The article of footwear of Clause 22, wherein the second cable portion forms a tightening grip formed as a loop and operable to be moved in a first direction away from the upper to move the second cable portion in the second tightening direction.

Clause 24: The article of footwear of any of the preceding Clauses, further comprising a release grip operable to be moved away from the upper in a second direction to move the cable lock from the locked state to the unlocked state.

Clause 25: The article of footwear of Clause 24, wherein the release grip is separate from the tightening grip.

Clause 26: The article of footwear of Clauses 24 or Clause 25, wherein the first direction is different than the second direction.

Clause 27: The article of footwear of Clause 24, wherein the cable lock is disposed remotely from the tightening grip and from the release grip.

Clause 28: The article of footwear of any of the preceding Clauses, further comprising a sole structure attached to the upper.

Clause 29: The article of footwear of Clause 28, wherein the cable lock is disposed within the sole structure.

Clause 30: The article of footwear of Clause 28 or Clause 29, wherein the sole structure includes a midsole and an outsole.

Clause 31: The article of footwear of Clause 30, wherein the midsole includes a cavity, the cable lock being disposed within the cavity.

Clause 32: The article of footwear of Clause 31, wherein the cavity opposes the outsole.

Clause 33: The article of footwear of Clause 31, wherein the cavity opposes the upper.

Clause 34: The article of footwear of Clause 33, further comprising a strobel attached to the upper, the cavity opposing the strobel.

Clause 35: The article of footwear of Clause 34, wherein the cable lock is attached to the strobel.

Clause 36: The article of footwear of any of the preceding Clauses, wherein an effective length of the second cable portion is increased when the second cable portion is moved in the second tightening direction.

Clause 37: The article of footwear of any of the preceding Clauses, wherein an effective length of the first cable portion is reduced when the first cable portion is moved in the first tightening direction.

Clause 38: The article of footwear of any of the preceding Clauses, wherein a portion of the first cable portion is retracted within the cable lock when the first cable portion is moved in the first tightening direction.

Clause 39: The article of footwear of any of the preceding Clauses, wherein a portion of the second cable portion is retracted within the cable lock when the second cable portion is moved in the second loosening direction.

Clause 40: The article of footwear of any of the preceding Clauses, wherein the first cable portion and the second cable portion are part of the same, unitary cable.

Clause 41: A cable lock mechanism comprising a housing defining a cavity, a spool disposed within the cavity and including a first annular groove operable to receive a first cable and a second annular groove operable to receive a second cable, the spool rotatable in a first direction relative to the housing to payout a first portion of the first cable from the housing and spool a first portion of the second cable within the second annular groove and rotatable in a second direction relative to the housing to payout a second portion of the second cable from the housing and spool a second portion of the first cable within the first annular groove, and a first lock pawl operable between a locked state restricting rotation of the spool relative to the housing in the second direction and an unlocked state permitting rotation of the spool relative to the housing in the second direction.

Clause 42: The cable lock mechanism of Clause 41, wherein the first portion of the first cable and the second portion of the first cable are part of the same unitary cable.

Clause 43: The cable lock mechanism of any of the preceding Clauses, wherein the first portion of the second cable and the second portion of the second cable are part of the same unitary cable.

Clause 44: The cable lock mechanism of any of the preceding Clauses, wherein a length of the first portion of the first cable is equal to a length of the first portion of the second cable.

Clause 45: The cable lock mechanism of any of the preceding Clauses, wherein a length of the second portion of the first cable is equal to a length of the second portion of the second cable.

Clause 46: The cable lock mechanism of any of the preceding Clauses, wherein the first lock pawl permits rotation of the spool relative to the housing in the first direction when in the locked state.

Clause 47: The cable lock mechanism of any of the preceding Clauses, wherein the first lock pawl permits rotation of the spool relative to the housing in the first direction when in the unlocked state.

Clause 48: The cable lock mechanism of any of the preceding Clauses, wherein the first lock pawl includes a series of first teeth that engage the spool in the locked state.

Clause 49: The cable lock mechanism of Clause 48, wherein the spool includes a series of second teeth that matingly receive the series of first teeth when the first lock pawl is in the locked state.

Clause 50: The cable lock mechanism of Clause 49, wherein the series of second teeth are formed on an inner surface of the spool.

Clause 51: The cable lock mechanism of any of the preceding Clauses, wherein the first lock pawl is rotatably supported by the housing within the cavity.

Clause 52: The cable lock mechanism of any of the preceding Clauses, wherein the first lock pawl is biased into the locked state.

Clause 53: The cable lock mechanism of any of the preceding Clauses, wherein the first lock pawl is biased into the locked state by a biasing member.

Clause 54: The cable lock mechanism of Clause 53, wherein the biasing member is a spring.

Clause 55: The cable lock mechanism of any of the preceding Clauses, further comprising a second lock pawl rotatably supported within the housing between a first position spaced apart from the spool and a second position in contact with a control surface of the spool.

Clause 56: The cable lock mechanism of Clause 55, wherein the second lock pawl is rotatably supported by the housing.

Clause 57: The cable lock mechanism of Clause 55, wherein the second lock pawl is rotatably supported by the first lock pawl.

Clause 58: The cable lock mechanism of Clause 55, wherein the second lock pawl is biased into the second position.

Clause 59: The cable lock mechanism of Clause 55, wherein the second lock pawl is biased into the second position by a biasing member.

Clause 60: The cable lock mechanism of Clause 59, wherein the biasing member is a spring.

Clause 61: The cable lock mechanism of Clause 55, wherein the control surface is formed on an inner surface of the spool.

Clause 62: The cable lock mechanism of any of the preceding Clauses, wherein the housing includes at least one flange extending therefrom.

Clause 63: The cable lock mechanism of Clause 62, wherein the at least one flange includes at least one aperture formed therethrough.

Clause 64: An article of footwear incorporating the cable lock mechanism of any of the preceding Clauses.

Clause 65: The article of footwear of Clause 64, wherein the cable lock mechanism is disposed within a midsole of the article of footwear.

Clause 66: The article of footwear of Clause 64, wherein the cable lock mechanism is attached to an upper of the article of footwear.

Clause 67: A cable lock mechanism comprising a housing defining a cavity, a spool disposed within the cavity and receiving a first cable and a second cable, and a first lock pawl operable between an unlocked state spaced apart from the spool to permit rotation of the spool relative to the housing in a first direction and in a second direction opposite the first direction and a locked state engaging an inner surface of the spool to restrict rotation of the spool relative to the housing in the second direction.

Clause 68: The cable lock mechanism of Clause 67, wherein the spool includes a first annular groove receiving the first cable and a second annular groove receiving the second cable.

Clause 69: The cable lock mechanism of Clause 68, wherein the spool is operable to payout a first portion of the first cable from the housing and spool a first portion of the second cable within the second annular groove when rotated in the first direction.

Clause 70: The cable lock mechanism of any of the preceding Clauses, wherein the spool is operable to payout a second portion of the second cable from the housing and spool a second portion of the first cable within the first annular groove when rotated in the second direction.

Clause 71: The cable lock mechanism of Clause 70, wherein the first portion of the first cable and the second portion of the first cable are part of the same unitary cable.

Clause 72: The cable lock mechanism of any of Clauses 70 or 71, wherein the first portion of the second cable and the second portion of the second cable are part of the same unitary cable.

Clause 73: The cable lock mechanism of any of Clauses 70-72, wherein a length of the first portion of the first cable is equal to a length of the first portion of the second cable.

Clause 74: The cable lock mechanism of any of Clauses 70-73, wherein a length of the second portion of the first cable is equal to a length of the second portion of the second cable.

Clause 75: The cable lock mechanism of any of the preceding Clauses, wherein the first lock pawl permits rotation of the spool relative to the housing in the first direction when in the locked state.

Clause 76: The cable lock mechanism of any of the preceding Clauses, wherein the first lock pawl ratchets along teeth of the inner surface when the first lock pawl is in the locked state and the spool is rotated in in the first direction.

Clause 77: The cable lock mechanism of any of the preceding Clauses, wherein the first lock pawl includes a series of first teeth that engage the spool in the locked state.

Clause 78: The cable lock mechanism of Clause 77, wherein the spool includes a series of second teeth that matingly receive the series of first teeth when the first lock pawl is in the locked state, the series of second teeth being formed on the inner surface of the spool.

Clause 79: The cable lock mechanism of any of the preceding Clauses, wherein the first lock pawl is rotatably supported by the housing within the cavity.

Clause 80: The cable lock mechanism of any of the preceding Clauses, wherein the first lock pawl is biased into the locked state.

Clause 81: The cable lock mechanism of any of the preceding Clauses, wherein the first lock pawl is biased into the locked state by a biasing member.

Clause 82: The cable lock mechanism of Clause 81, wherein the biasing member is a spring.

Clause 83: The cable lock mechanism of any of the preceding Clauses, further comprising a second lock pawl rotatably supported within the housing between a first position spaced apart from the spool and a second position in contact with a control surface of the spool.

Clause 84: The cable lock mechanism of Clause 83, wherein the second lock pawl is rotatably supported by the housing.

Clause 85: The cable lock mechanism of Clause 83, wherein the second lock pawl is rotatably supported by the first lock pawl.

Clause 86: The cable lock mechanism of Clause 83, wherein the second lock pawl is biased into the second position.

Clause 87: The cable lock mechanism of Clause 83, wherein the second lock pawl is biased into the second position by a biasing member.

Clause 88: The cable lock mechanism of Clause 87, wherein the biasing member is a spring.

Clause 89: The cable lock mechanism of Clause 83, wherein the control surface is formed on the inner surface of the spool.

Clause 90: The cable lock mechanism of any of the preceding Clauses, wherein the housing includes at least one flange extending therefrom.

Clause 91: The cable lock mechanism of Clause 90, wherein the at least one flange includes at least one aperture formed therethrough.

Clause 92: An article of footwear incorporating the cable lock mechanism of any of the preceding Clauses.

Clause 93: The article of footwear of Clause 92, wherein the cable lock mechanism is disposed within a midsole of the article of footwear.

Clause 94: The article of footwear of Clause 92, wherein the cable lock mechanism is attached to an upper of the article of footwear.

Clause 95: A cable lock for a cable, the cable lock comprising a housing including a first engagement surface and a second engagement surface, the first engagement surface and the second engagement surface converging toward one another, a lock member slidably disposed within the housing and movable between a locked state and an unlocked state and including a first lock surface and a second lock surface that converge toward one another, the first lock surface operable to pinch a first portion of the cable between the first engagement surface and the first lock surface in the locked state and the second lock surface operable to pinch a second portion of the cable between the second engagement surface and the second lock surface in the locked state to restrict movement of the cable in a first direction relative to the housing, and a biasing member operable to apply a biasing force and to bias the lock member in the locked state.

Clause 96: The cable lock of Clause 95, wherein the biasing member is a spring.

Clause 97: The cable lock of Clause 96, wherein the spring is a coil spring.

Clause 98: The cable lock of any of the preceding Clauses, further comprising a release cord attached to the lock member and operable to move the lock member from the locked state to the unlocked state when a tensile force exceeding the biasing force of the biasing member is applied to the release cord in an unlocking direction.

Clause 99: The cable lock of Clause 98, wherein the release cord is attached to the lock member at an opposite end of the lock member than the biasing member.

Clause 100: The cable lock of any of the preceding Clauses, wherein the lock member includes a retainer operable to selectively engage the housing and to maintain the lock member in the unlocked state.

Clause 101: The cable lock of Clause 100, wherein the retainer is disposed at an opposite end of the lock member than the biasing member.

Clause 102: The cable lock of Clause 100, wherein the retainer is formed on a tab portion of the lock member.

Clause 103: The cable lock of Clause 102, wherein the tab portion is movable relative to the lock member between a rest state and a flexed state.

Clause 104: The cable lock of Clause 103, wherein the tab portion is biased into the rest state.

Clause 105: The cable lock of Clause 103, wherein the tab portion is operable to move from the rest state to the flexed state to disengage the retainer from the housing.

Clause 106: The cable lock of Clause 105, further comprising a release cord attached to the tab portion, the release cord operable to move the tab portion from the rest state to the flexed state.

Clause 107: The cable lock of Clause 106, wherein the release cord is operable to move the lock member from the locked state to the unlocked state when a tensile force exceeding the biasing force of the biasing member is applied to the release cord in an unlocking direction.

Clause 108: The cable lock of Clause 95, wherein the lock member includes a first recess and a second recess operable to selectively receive a first retainer and a second retainer of the housing to maintain the lock member in the unlocked state.

Clause 109: The cable lock of Clause 108, wherein the first retainer and the second retainer are movable between an extended state and a retracted state.

Clause 110: The cable lock of Clause 109, wherein the first retainer and the second retainer are biased in to the extended state by a first biasing member and a second biasing member.

Clause 111: The cable lock of Clause 110, wherein the first biasing member and the second biasing member are springs.

Clause 112: The cable lock of Clause 110, wherein the first biasing member and the second biasing member are coil springs.

Clause 113: The cable lock of Clause 109, wherein the first retainer and the second retainer are integrally formed with the housing.

Clause 114: The cable lock of Clause 109, wherein the first retainer and the second retainer act as living hinges movable between the extended state and the retracted state.

Clause 115: The cable lock of Clause 109, wherein the first retainer and the second retainer are in the retracted state when received within the first recess and the second recess, respectively.

Clause 116: The cable lock of any of the preceding Clauses, wherein at least one of the first lock surface and the second lock surface include projections operable to grip the cable when the lock member is in the locked state.

Clause 117: The cable lock of any of the preceding Clauses, wherein the projections are angled relative to a longitudinal axis of the lock member to grip the cable when the lock member is in the locked state and restrict movement of the cable in the first direction relative to the housing.

Clause 118: The cable lock of any of the preceding Clauses, wherein the cable is movable in a second direction opposite the first direction when the lock member is in either of the locked state or the unlocked state.

Clause 119: An article of footwear incorporating the cable lock of any of the preceding Clauses.

Clause 120: The article of footwear of Clause 119, wherein the article of footwear includes a sole structure and an upper.

Clause 121: The article of footwear of Clause 120, wherein the cable lock of any of the preceding Clauses is disposed at least partially within a cavity formed in the sole structure.

Clause 122: The article of footwear of Clause 120, wherein the cable lock is attached to the upper.

Clause 123: An article of footwear comprising an upper, a tensioning grip extending from the upper and configured as a loop, and a tensioning cable coupled with the tensioning grip and operable to move the upper into one of a tightened state and a loosened state, the tensioning cable movable in a tightening direction to move the upper into the tightened state and movable in a loosening direction to move the upper into the loosened state, and a first conduit including an inner diameter that is greater than an outer diameter of the tensioning cable and receiving a portion of the tensioning cable therein, the first conduit operable to accommodate bunching by the tensioning cable when the tensioning cable is moved in one of the tightening direction and the loosening direction.

Clause 124: The article of footwear of Clause 123, further comprising a second conduit including an inner diameter that is greater than an outer diameter of the tensioning cable and receiving a portion of the tensioning cable therein, the second conduit operable to accommodate bunching by the tensioning cable when the tensioning cable is moved in the other of the tightening direction and the loosening direction.

Clause 125: The article of footwear of any of the preceding Clauses, further comprising a cable lock operable between a locked state restricting movement of the tensioning cable in the loosening direction and an unlocked state permitting movement of the tensioning cable in both the loosening direction and the tightening direction.

Clause 126: The article of footwear of Clause 125, wherein the cable lock permits movement of the tensioning cable in the tightening direction when the cable lock is the locked state.

Clause 127: The article of footwear of Clause 125, wherein the cable lock restricts movement of the tensioning cable in the tightening direction when the cable lock is in the locked state.

Clause 128: The article of footwear of any of Clauses 125-127, wherein the cable lock is biased into the locked state.

Clause 129: The article of footwear of any of Clauses 125-128, wherein the cable lock includes a release operable to transition the cable lock from the locked state to the unlocked state.

Clause 130: The article of footwear of any of Clauses 125-129, further comprising an outsole attached to the upper and including a ground-engaging surface and an inner surface disposed on an opposite side of the outsole than the ground-engaging surface, the inner surface defining a receiving area that receives the cable lock therein.

Clause 131: The article of footwear of any of Clauses 125-129, further comprising an outsole attached to the upper and including a ground-engaging surface and an inner surface disposed on an opposite side of the outsole than the ground-engaging surface and a midsole having a footbed and a bottom surface disposed on an opposite side of the midsole than the footbed and opposing the inner surface of the outsole to define a cavity therebetween, the cable lock being disposed within the cavity between the inner surface of the outsole and the bottom surface of the midsole.

Clause 132: The article of footwear of any of Clauses 125-131, wherein the tensioning cable includes a continuous loop defining a first length between the cable lock and a tightening grip and a second length between the cable lock and a loosening grip, wherein movement of the tensioning cable in the tightening direction causes the first length to increase and the second length to decrease, and movement of the tensioning cable in the loosening direction causes the first length to decrease and the second length to increase.

Clause 133: The article of footwear of any of Clauses 125-132, wherein the cable lock includes a housing and a lock member slidably disposed within the housing, the lock member movable between a locked position restricting movement of the tensioning cable relative to the housing and an unlocked position permitting movement of the tensioning cable relative to the housing.

Clause 134: The article of footwear of Clause 133, wherein the lock member includes a first lock surface opposing a first engagement surface of the housing and a second lock surface opposing a second engagement surface of the housing, the lock member operable to pinch the tensioning cable between the first lock surface and the first engagement surface in the locked position and operable to pinch the tensioning cable between the second lock surface and the second engagement surface in the locked position.

Clause 135: The article of footwear of Clause 134, wherein the first lock surface and the second lock surface are convergent.

Clause 136: The article of footwear of Clause 135, wherein the first lock surface is substantially parallel to the first engagement surface and the second lock surface is substantially parallel to the second engagement surface.

Clause 137: The article of footwear of any of Clauses 133-136, wherein the cable lock includes a release operable to move the lock member from the locked position to the unlocked position.

Clause 138: The article of footwear of Clause 137, wherein the release is attached to the lock member to permit a force applied to the release to move the lock member in a direction away from the first engagement surface and the second engagement surface relative to the housing.

Clause 139: The article of footwear of Clause 138, wherein the housing includes a retainer operable to engage the lock member when the lock member is moved a predetermined distance away from the first engagement surface and the second engagement surface, the retainer operable to maintain the lock member in the unlocked position.

Clause 140: The article of footwear of any of Clauses 125-139, wherein the cable lock is biased into the locked position by a biasing member.

Clause 141: The article of footwear of Clause 125, wherein the cable lock includes a housing and a spool supported by the housing and rotatable relative to the housing in a first direction when the tensioning cable moves in the tightening direction and in an opposite second direction when the tensioning cable moves in the loosening direction, the spool including a first annular groove configured to collect a first portion of the tensioning cable and a second annular groove configured to collect a second portion of the tensioning cable.

Clause 142: The article of footwear of Clause 141, wherein the cable lock includes a plurality of teeth supported for common rotation with the spool and positioned circumferentially around an axis of the spool and a first pawl supported by the housing and including a first biasing member operable to bias the first pawl into engagement with the plurality of teeth to selectively restrict the spool from rotating in the second direction.

Clause 143: The article of footwear of Clause 142, wherein the plurality of teeth are sloped to permit the spool to rotate in the first direction when the first pawl is engaged with the plurality of teeth.

Clause 144: The article of footwear of Clause 142, wherein the cable lock further includes a release configured to selectively disengage the first pawl from the plurality of teeth to allow the spool to rotate in the second direction when a predetermined force is applied to the release that overcomes a biasing force of the first biasing member.

Clause 145: The article of footwear of Clause 144, wherein the cable lock further includes a second pawl having a second biasing member configured to bias the second pawl into engagement with a control surface associated with the spool when the first pawl is disengaged from the plurality of teeth to permit the spool to rotate in the second direction.

Clause 146: The article of footwear of Clause 145, wherein the second pawl is rotatably supported by the first pawl.

Clause 147: The article of footwear of Clause 141, wherein the first portion of the tightening cable and the second portion of the tightening cable approach the spool from opposite directions.

Clause 148: The article of footwear of any of Clauses 125-129 and 132-147, wherein the cable lock is supported by an outsole attached to the upper.

Clause 149: The article of footwear of any of Clauses 125-129 and 132-147, wherein the cable lock is disposed between an outsole and a midsole of the footwear.

Clause 150: An article of footwear comprising an upper, a tensioning cable movable in a tightening direction to move the upper into a tightened state and movable in a loosening direction to move the upper into a loosened state, and a first conduit operable to receive a length of the tensioning cable therein when the tensioning cable is moved in one of the tightening direction and the loosening direction to accommodate bunching by the tensioning cable, the length of the tensioning cable received within the first conduit when the tensioning cable is moved in the one of the tightening direction and the loosening direction being greater than a length of the first conduit.

Clause 151: The article of footwear of Clause 150, further comprising a second conduit operable to receive a length of the tensioning cable therein when the tensioning cable is moved in the other of the tightening direction and the loosening direction to accommodate bunching by the tensioning cable, the length of the tensioning cable received within the second conduit when the tensioning cable is moved in the other of the tightening direction and the loosening direction being greater than a length of the second conduit Clause 152: The article of footwear of any of the preceding Clauses, further comprising a cable lock operable between a locked state restricting movement of the tensioning cable in the loosening direction and an unlocked state permitting movement of the tensioning cable in both the loosening direction and the tightening direction.

Clause 153: The article of footwear of Clause 152, wherein the cable lock permits movement of the tensioning cable in the tightening direction when the cable lock is the locked state.

Clause 154: The article of footwear of Clause 152, wherein the cable lock restricts movement of the tensioning cable in the tightening direction when the cable lock is in the locked state.

Clause 155: The article of footwear of any of Clauses 152-154, wherein the cable lock is biased into the locked state.

Clause 156: The article of footwear of any of Clauses 152-155 wherein the cable lock includes a release operable to transition the cable lock from the locked state to the unlocked state.

Clause 157: The article of footwear of any of Clauses 152-156, further comprising an outsole attached to the upper and including a ground-engaging surface and an inner surface disposed on an opposite side of the outsole than the ground-engaging surface, the inner surface defining a receiving area that receives the cable lock therein.

Clause 158: The article of footwear of any of Clauses 152-156, further comprising an outsole attached to the upper and including a ground-engaging surface and an inner surface disposed on an opposite side of the outsole than the ground-engaging surface and a midsole having a footbed and a bottom surface disposed on an opposite side of the midsole than the footbed and opposing the inner surface of the outsole to define a cavity therebetween, the cable lock being disposed within the cavity between the inner surface of the outsole and the bottom surface of the midsole.

Clause 159: The article of footwear of any of Clauses 152-158, wherein the tensioning cable includes a continuous loop defining a first length between the cable lock and a tightening grip and a second length between the cable lock and a loosening grip, wherein movement of the tensioning cable in the tightening direction causes the first length to increase and the second length to decrease, and movement of the tensioning cable in the loosening direction causes the first length to decrease and the second length to increase.

Clause 160: The article of footwear of any of Clauses 152-159, wherein the cable lock includes a housing and a lock member slidably disposed within the housing, the lock member movable between a locked position restricting movement of the tensioning cable relative to the housing and an unlocked position permitting movement of the tensioning cable relative to the housing.

Clause 161: The article of footwear of Clause 160, wherein the lock member includes a first lock surface opposing a first engagement surface of the housing and a second lock surface opposing a second engagement surface of the housing, the lock member operable to pinch the tensioning cable between the first lock surface and the first engagement surface in the locked position and operable to pinch the tensioning cable between the second lock surface and the second engagement surface in the locked position.

Clause 162: The article of footwear of Clause 161, wherein the first lock surface and the second lock surface are convergent.

Clause 163: The article of footwear of Clause 162, wherein the first lock surface is substantially parallel to the first engagement surface and the second lock surface is substantially parallel to the second engagement surface.

Clause 164: The article of footwear of any of Clauses 160-163, wherein the cable lock includes a release operable to move the lock member from the locked position to the unlocked position.

Clause 165: The article of footwear of Clause 164, wherein the release is attached to the lock member to permit a force applied to the release to move the lock member in a direction away from the first engagement surface and the second engagement surface relative to the housing.

Clause 166: The article of footwear of Clause 165, wherein the housing includes a retainer operable to engage the lock member when the lock member is moved a predetermined distance away from the first engagement surface and the second engagement surface, the retainer operable to maintain the lock member in the unlocked position.

Clause 167: The article of footwear of any of Clauses 152-166, wherein the cable lock is biased into the locked position by a biasing member.

Clause 168: The article of footwear of Clause 152, wherein the cable lock includes a housing and a spool supported by the housing and rotatable relative to the housing in a first direction when the tensioning cable moves in the tightening direction and in an opposite second direction when the tensioning cable moves in the loosening direction, the spool including a first annular groove configured to collect a first portion of the tensioning cable and a second annular groove configured to collect a second portion of the tensioning cable.

Clause 169: The article of footwear of Clause 168, wherein the cable lock includes a plurality of teeth positioned circumferentially around an axis of the spool and a first pawl supported by the housing and including a first biasing member configured to bias the first pawl into engagement with the plurality of teeth to selectively restrict the spool from rotating in the second direction.

Clause 170: The article of footwear of Clause 169, wherein the plurality of teeth are sloped to permit the spool to rotate in the first direction when the first pawl is engaged with the plurality of teeth.

Clause 171: The article of footwear of Clause 169, wherein the cable lock further includes a release configured to selectively disengage the first pawl from the plurality of teeth to allow the spool to rotate in the second direction when a predetermined force is applied to the release that overcomes a biasing force of the first biasing member.

Clause 172: The article of footwear of Clause 171, wherein the cable lock further includes a second pawl having a second biasing member configured to bias the second pawl into engagement with a control surface associated with the spool when the first pawl is disengaged from the plurality of teeth to permit the spool to rotate in the second direction.

Clause 173: The article of footwear of Clause 172, wherein the second pawl is rotatably supported by the first pawl.

Clause 174: The article of footwear of Clause 168, wherein the first portion of the tightening cable and the second portion of the tightening cable approach the spool from opposite directions.

Clause 175: The article of footwear of any of Clauses 152-154 and 159-174, wherein the cable lock is supported by an outsole attached to the upper.

Clause 176: The article of footwear of any of Clauses 152-154 and 159-174, wherein the cable lock is disposed between an outsole and a midsole of the footwear.

Clause 177: An article of footwear comprising, an upper having a heel portion, an instep portion, and a forefoot portion, a tightening grip disposed at one of the instep portion and the heel portion of the upper, a loosening grip disposed at the other of the instep portion and the heel portion of the upper, and a tensioning cable operably connected to the tightening grip and the loosening grip, the tensioning cable movable in a tightening direction when the tightening grip is pulled away from the upper to move the upper into a tightened state and movable in a loosening direction when the loosening grip is pulled away from the upper to move the upper into a loosened state.

Clause 178: The article of footwear of Clause 177, further comprising a cable lock operable between a locked state restricting movement of the tensioning cable in the loosening direction and an unlocked state permitting movement of the tensioning cable in both the loosening direction and the tightening direction.

Clause 179: The article of footwear of Clause 178, wherein the cable lock permits movement of the tensioning cable in the tightening direction when the cable lock is the locked state.

Clause 180: The article of footwear of Clause 178, wherein the cable lock restricts movement of the tensioning cable in the tightening direction when the cable lock is in the locked state.

Clause 181: The article of footwear of any of Clauses 178-180, wherein the cable lock is biased into the locked state.

Clause 182: The article of footwear of any of Clauses 178-181, wherein the cable lock includes a release operable to transition the cable lock from the locked state to the unlocked state.

Clause 183: The article of footwear of any of Clauses 178-182, further comprising an outsole attached to the upper and including a ground-engaging surface and an inner surface disposed on an opposite side of the outsole than the ground-engaging surface, the inner surface defining a receiving area that receives the cable lock therein.

Clause 184: The article of footwear of any of Clauses 178-182, further comprising an outsole attached to the upper and including a ground-engaging surface and an inner surface disposed on an opposite side of the outsole than the ground-engaging surface and a midsole having a footbed and a bottom surface disposed on an opposite side of the midsole than the footbed and opposing the inner surface of the outsole to define a cavity therebetween, the cable lock being disposed within the cavity between the inner surface of the outsole and the bottom surface of the midsole.

Clause 185: The article of footwear of any of Clauses 178-184, wherein the tensioning cable includes a continuous loop defining a first length between the cable lock and the tightening grip and a second length between the cable lock and the loosening grip, wherein movement of the tensioning cable in the tightening direction causes the first length to increase and the second length to decrease, and movement of the tensioning cable in the loosening direction causes the first length to decrease and the second length to increase.

Clause 186: The article of footwear of any of the preceding Clauses, further comprising a first conduit configured to surround a portion of the tensioning cable along the first length when the tensioning cable moves relative to the conduit, the first conduit defining an inner diameter that is greater than an outer diameter of the tensioning cable to accommodate bunching by the tensioning cable when the first length increases during movement of the tensioning cable in the tightening direction.

Clause 187: The article of footwear of Clause 186, further comprising a second conduit configured to surround a portion of the tensioning cable along the second length when the tensioning cable moves relative to the conduit, the second conduit defining an inner diameter that is greater than an outer diameter of the tensioning cable to accommodate bunching by the tensioning cable when the second length increases during movement of the tensioning cable in the loosening direction.

Clause 188: The article of footwear of Clause 178, wherein the cable lock includes a housing and a lock member slidably disposed within the housing, the lock member movable between a locked position restricting movement of the tensioning cable relative to the housing and an unlocked position permitting movement of the tensioning cable relative to the housing.

Clause 189: The article of footwear of Clause 188, wherein the lock member includes a first lock surface opposing a first engagement surface of the housing and a second lock surface opposing a second engagement surface of the housing, the lock member operable to pinch the tensioning cable between the first lock surface and the first engagement surface in the locked position and operable to pinch the tensioning cable between the second lock surface and the second engagement surface in the locked position.

Clause 190: The article of footwear of Clause 189, wherein the first lock surface and the second lock surface are convergent.

Clause 191: The article of footwear of Clause 190, wherein the first lock surface is substantially parallel to the first engagement surface and the second lock surface is substantially parallel to the second engagement surface.

Clause 192: The article of footwear of Clause 189, wherein the cable lock includes a release operable to move the lock member from the locked position to the unlocked position.

Clause 193: The article of footwear of Clause 192, wherein the release is attached to the lock member to permit a force applied to the release to move the lock member in a direction away from the first engagement surface and the second engagement surface relative to the housing.

Clause 194: The article of footwear of Clause 193, wherein the housing includes a retainer operable to engage the lock member when the lock member is moved a predetermined distance away from the first engagement surface and the second engagement surface, the retainer operable to maintain the lock member in the unlocked position.

Clause 195: The article of footwear of any of Clauses 178-194, wherein the lock member is biased into the locked position by a biasing member.

Clause 196: The article of footwear of Clause 178, wherein the cable lock includes a housing and a spool supported by the housing and rotatable relative to the housing in a first direction when the tensioning cable moves in the tightening direction and in an opposite second direction when the tensioning cable moves in the loosening direction, the spool including a first annular groove configured to collect a first portion of the tensioning cable and a second annular groove configured to collect a second portion of the tensioning cable.

Clause 197: The article of footwear of Clause 196, wherein the cable lock includes a plurality of teeth positioned circumferentially around an axis of the spool and a first pawl supported by the housing and including a first biasing member configured to bias the first pawl into engagement with the plurality of teeth to selectively restrict the spool from rotating in the second direction.

Clause 198: The article of footwear of Clause 197, wherein the plurality of teeth are sloped to permit the spool to rotate in the first direction when the first pawl is engaged with the plurality of teeth.

Clause 199: The article of footwear of Clause 197, wherein the cable lock further includes a release configured to selectively disengage the first pawl from the plurality of teeth to allow the spool to rotate in the second direction when a predetermined force is applied to the release that overcomes a biasing force of the first biasing member.

Clause 200: The article of footwear of Clause 199, wherein the cable lock further includes a second pawl having a second biasing member configured to bias the second pawl into engagement with a control surface associated with the spool when the first pawl is disengaged from the plurality of teeth to permit the spool to rotate in the second direction.

Clause 201: The article of footwear of Clause 200, wherein the second pawl is rotatably supported by the first pawl.

Clause 202: The article of footwear of Clause 196, wherein the first portion of the tightening cable and the second portion of the tightening cable approach the spool from opposite directions.

Clause 203: The article of footwear of any of Clauses 178-182 and 185-202, wherein the cable lock is supported by an outsole attached to the upper.

Clause 204: The article of footwear of any of Clauses 178-182 and 185-202, wherein the cable lock is disposed between an outsole and a midsole of the footwear.

Clause 205: The article of footwear of Clause 177, further comprising a first conduit operable to receive a length of the tensioning cable therein when the tensioning cable is moved in one of the tightening direction and the loosening direction to accommodate bunching by the tensioning cable, the length of the tensioning cable received within the first conduit when the tensioning cable is moved in the one of the tightening direction and the loosening direction being greater than a length of the first conduit.

Clause 206: The article of footwear of Clause 205, further comprising a second conduit operable to receive a length of the tensioning cable therein when the tensioning cable is moved in the other of the tightening direction and the loosening direction to accommodate bunching by the tensioning cable, the length of the tensioning cable received within the second conduit when the tensioning cable is moved in the other of the tightening direction and the loosening direction being greater than a length of the second conduit.

Clause 207: An article of footwear comprising an upper, a sole structure attached to the upper, a first cable extending between the upper and the sole structure and movable in a tightening direction to move the upper into a tightened state and movable in a loosening direction to move the upper into a loosened state, and a cable lock disposed within the sole structure and operable in a locked state to restrict movement of the first cable in the loosening direction and operable in an unlocked state to permit movement of the first cable in the loosening direction.

Clause 208: The article of footwear of Clause 207, wherein the sole structure includes an outsole having a ground-contacting surface and a midsole disposed between the outsole and the upper.

Clause 209: The article of footwear of Clause 208, wherein the cable lock is received within a cavity of the midsole.

Clause 210: The article of footwear of Clause 208 or 209, wherein the cable lock opposes the outsole.

Clause 211: The article of footwear of Clause 208 or 209, wherein the cable lock is in contact with the outsole.

Clause 212: The article of footwear of Clause 208, further comprising a strobel disposed between the upper and the midsole.

Clause 213: The article of footwear of Clause 212, wherein the cable lock is received within a cavity of the midsole.

Clause 214: The article of footwear of Clause 212 or 213, wherein the cable lock opposes the strobel.

Clause 215: The article of footwear of Clause 212 or 213, wherein the cable lock is in contact with the strobel.

Clause 216: The article of footwear of Clause 212 or 213, wherein the cable lock is attached to the strobel.

Clause 217: The article of footwear of Clause 208, wherein the cable lock is attached to the midsole.

Clause 218: The article of footwear of Clause 217, further comprising a strobel attached to the upper.

Clause 219: The article of footwear of Clause 218, wherein the strobel is disposed between the midsole and the outsole.

Clause 220: The article of footwear of Clause 218, wherein the strobel is disposed between the cable lock and the outsole.

Clause 221: The article of footwear of any of the preceding Clauses, wherein the cable lock is disposed within one of a heel region of the sole structure, a midfoot region of the sole structure, and a forefoot region of the sole structure, the midfoot region disposed between the heel region and the forefoot region.

Clause 222: An article of footwear comprising an upper, a sole structure including a midsole, a first cable attached to the upper, the first cable movable relative to the upper in a tightening direction to move the upper into a tightened state and movable relative to the upper in a loosening direction to move the upper into a loosened state, and a cable lock disposed within the midsole and operable in a locked state to restrict movement of the first cable in the loosening direction and operable in an unlocked state to permit movement of the first cable in the loosening direction.

Clause 223: The article of footwear of Clause 207, wherein the sole structure includes an outsole having a ground-contacting surface, the midsole disposed between the outsole and the upper.

Clause 224: The article of footwear of any of the preceding Clauses, wherein the cable lock is received within a cavity of the midsole.

Clause 225: The article of footwear of Clause 223 or 224, wherein the cable lock opposes the outsole.

Clause 226: The article of footwear of Clause 223 or 224, wherein the cable lock is in contact with the outsole.

Clause 227: The article of footwear of any of the preceding Clauses, further comprising a strobel disposed between the upper and the midsole.

Clause 228: The article of footwear of Clause 227, wherein the cable lock is received within a cavity of the midsole.

Clause 229: The article of footwear of Clause 227 or 228, wherein the cable lock opposes the strobel.

Clause 230: The article of footwear of Clause 227 or 228, wherein the cable lock is in contact with the strobel.

Clause 231: The article of footwear of Clause 227 or 228, wherein the cable lock is attached to the strobel.

Clause 232: The article of footwear of Clause 207, wherein the cable lock is attached to the midsole.

Clause 233: The article of footwear of Clause 232, further comprising a strobel attached to the upper.

Clause 234: The article of footwear of Clause 233, wherein the strobel is disposed between the midsole and an outsole of the sole structure.

Clause 235: The article of footwear of Clause 233, wherein the strobel is disposed between the cable lock and an outsole of the sole structure.

Clause 236: The article of footwear of any of the preceding Clauses, wherein the cable lock is disposed within one of a heel region of the sole structure, a midfoot region of the sole structure, and a forefoot region of the sole structure, the midfoot region disposed between the heel region and the forefoot region.

Clause 237: An article of footwear comprising an upper, a sole structure including an outsole having ground-contacting surface, a first cable attached to the upper, the first cable movable relative to the upper in a tightening direction to move the upper into a tightened state and movable relative to the upper in a loosening direction to move the upper into a loosened state, and a cable lock disposed within the sole structure and opposing the outsole, the cable lock operable in a locked state to restrict movement of the first cable in the loosening direction and operable in an unlocked state to permit movement of the first cable in the loosening direction.

Clause 238: The article of footwear of Clause 237, wherein the sole structure includes a midsole disposed between the outsole and the upper.

Clause 239: The article of footwear of Clause 238, wherein the cable lock is received within a cavity of the midsole.

Clause 240: The article of footwear of any of the preceding Clauses, wherein the cable lock is in contact with the outsole.

Clause 241: The article of footwear of any of the preceding Clauses, wherein the cable lock is attached to the outsole.

Clause 242: The article of footwear of any of the preceding Clauses, further comprising a strobel disposed between the upper and the outsole.

Clause 243: The article of footwear of Clause 242, wherein the cable lock is received within a cavity of the midsole.

Clause 244: The article of footwear of Clause 243, wherein the midsole is disposed between the cable lock and the strobel.

Clause 245: The article of footwear of any of the preceding Clauses, wherein the cable lock is disposed within one of a heel region of the sole structure, a midfoot region of the sole structure, and a forefoot region of the sole structure, the midfoot region disposed between the heel region and the forefoot region.

Clause 246: An article of footwear comprising an upper, a sole structure, a strobel attached to the upper and disposed between the upper and the sole structure, a first cable attached to the upper, the first cable movable relative to the upper in a tightening direction to move the upper into a tightened state and movable relative to the upper in a loosening direction to move the upper into a loosened state, and a cable lock disposed within the sole structure and opposing the strobel, the cable lock operable in a locked state to restrict movement of the first cable in the loosening direction and operable in an unlocked state to permit movement of the first cable in the loosening direction.

Clause 247: The article of footwear of Clause 246, wherein the sole structure includes an outsole having a ground-contacting surface and a midsole disposed between the outsole and the upper.

Clause 248: The article of Clause 247, wherein the cable lock is received within a cavity of the midsole.

Clause 249: The article of footwear of Clause 247 or 248, wherein the cable lock is in contact with the strobel.

Clause 250: The article of footwear of Clause 247 or 248, wherein the cable lock is attached to the strobel.

Clause 251: The article of footwear of Clause 247, wherein the cable lock is attached to the midsole.

Clause 252: The article of footwear of Clause 251, wherein the cable lock is attached to the strobel.

Clause 253: The article of footwear of Clause 252, wherein the cable lock is attached to the strobel by at least one of an adhesive and a fastener.

Clause 254: The article of footwear of any of Clauses 251-253, wherein the strobel is disposed between the midsole and the outsole.

Clause 255: The article of footwear of Clause 247, wherein the strobel is disposed between the midsole and the outsole.

Clause 256: The article of footwear of any of Clauses 247-255, wherein the strobel is disposed between the cable lock and the outsole.

Clause 257: The article of footwear of any of the preceding Clauses, wherein the cable lock is disposed within one of a heel region of the sole structure, a midfoot region of the sole structure, and a forefoot region of the sole structure, the midfoot region disposed between the heel region and the forefoot region.

Clause 258: An article of footwear comprising an upper, a sole structure including a midsole, a first cable attached to the upper, the first cable movable relative to the upper in a tightening direction to move the upper into a tightened state and movable relative to the upper in a loosening direction to move the upper into a loosened state, and a cable lock attached to the midsole and operable in a locked state to restrict movement of the first cable in the loosening direction and operable in an unlocked state to permit movement of the first cable in the loosening direction.

Clause 259: The article of footwear of Clause 258, wherein the sole structure includes an outsole having a ground-contacting surface, the midsole disposed between the outsole and the upper.

Clause 260: The article of footwear of any of the preceding Clauses, wherein the cable lock is received within a cavity of the midsole.

Clause 261: The article of footwear of any of the preceding Clauses, further comprising a strobel attached to the upper.

Clause 262: The article of footwear of Clause 261, wherein the cable lock opposes the Strobel.

Clause 263: The article of footwear of Clause 261, wherein the cable lock is in contact with the strobel.

Clause 264: The article of footwear of Clause 261, wherein the cable lock is attached to the strobel.

Clause 265: The article of footwear of Clauses 261-264, wherein the strobel is disposed between the midsole and an outsole of the sole structure.

Clause 266: The article of footwear of Clauses 261-264, wherein the strobel is disposed between the cable lock and an outsole of the sole structure.

Clause 267: The article of footwear of any of the preceding Clauses, wherein the cable lock is disposed within one of a heel region of the sole structure, a midfoot region of the sole structure, and a forefoot region of the sole structure, the midfoot region disposed between the heel region and the forefoot region.

Clause 268: An article of footwear comprising an upper, a first cable movable in a tightening direction away from the upper to move the upper into a tightened state and movable in a loosening direction to move the upper into a loosened state, and a cable lock disposed on the upper and operable in a locked state to restrict movement of the first cable in the loosening direction and operable in an unlocked state to permit movement of the first cable in the loosening direction.

Clause 269: The article of footwear of Clause 268, wherein the cable lock is disposed on a heel of the article of footwear.

Clause 270: The article of footwear of Clause 269, wherein the cable lock includes a release cord operable to move the cable lock from the locked state to the unlocked state.

Clause 271: The article of footwear of Clause 270, further comprising a sole structure attached to the upper and including a ground-contacting surface.

Clause 272: The article of footwear of Clause 271, wherein the release cord extends from the cable lock in a direction away from the ground-contacting surface.

Clause 273: The article of footwear of Clause 271 or 272, wherein the cable lock is elongate.

Clause 274: The article of footwear of Clause 273, wherein a longitudinal axis of the cable lock is substantially perpendicular to the ground-contacting surface.

Clause 275: The article of footwear of Clause 268, wherein the cable lock includes a release cord operable to move the cable lock from the locked state to the unlocked state.

Clause 276: The article of footwear of Clause 275, further comprising a sole structure attached to the upper and including a ground-contacting surface.

Clause 277: The article of footwear of Clause 276, wherein the release cord extends from the cable lock in a direction away from the ground-contacting surface.

Clause 278: The article of footwear of Clause 276 or 277, wherein the cable lock is elongate.

Clause 279: The article of footwear of Clause 278, wherein a longitudinal axis of the cable lock is substantially perpendicular to the ground-contacting surface.

Clause 280: The article of footwear of Clause 268, wherein the cable lock is elongate.

Clause 281: The article of footwear of any of the preceding Clauses, wherein the cable lock includes a housing having a first engagement surface and a second engagement surface, the first engagement surface and the second engagement surface converging toward one another, a lock member slidably disposed within the housing and movable between a locked state and an unlocked state and including a first lock surface and a second lock surface that converge toward one another, the first lock surface operable to pinch a first portion of the first cable between the first engagement surface and the first lock surface in the locked state and the second lock surface operable to pinch a second portion of the first cable between the second engagement surface and the second lock surface in the locked state to restrict movement of the first cable in a first direction relative to the housing, and a biasing member operable to apply a biasing force and to bias the lock member in the locked state.

Clause 282: The article of footwear of Clause 281, wherein the biasing member is a spring.

Clause 283: The article of footwear of Clause 282, wherein the spring is a coil spring.

Clause 284: The article of footwear of any of Clauses 281-283, further comprising a release cord attached to the lock member and operable to move the lock member from the locked state to the unlocked state when a tensile force exceeding the biasing force of the biasing member is applied to the release cord in an unlocking direction.

Clause 285: The article of footwear of Clause 284, wherein the release cord is attached to the lock member at an opposite end of the lock member than the biasing member.

Clause 286: The article of footwear of Clauses 281-285, wherein the lock member includes a retainer operable to selectively engage the housing and to maintain the lock member in the unlocked state.

Clause 287: The article of footwear of Clause 286, wherein the retainer is disposed at an opposite end of the lock member than the biasing member.

Clause 288: The article of footwear of Clause 286, wherein the retainer is formed on a tab portion of the lock member.

Clause 289: The article of footwear of Clause 288, wherein the tab portion is movable relative to the lock member between a rest state and a flexed state.

Clause 290: The article of footwear of Clause 288, wherein the tab portion is biased into the rest state.

Clause 291: The article of footwear of Clause 288, wherein the tab portion is operable to move from the rest state to the flexed state to disengage the retainer from the housing.

Clause 292: The article of footwear of Clause 291, further comprising a release cord attached to the tab portion, the release cord operable to move the tab portion from the rest state to the flexed state.

Clause 293: The article of footwear of Clause 292, wherein the release cord is operable to move the lock member from the locked state to the unlocked state when a tensile force exceeding the biasing force of the biasing member is applied to the release cord in an unlocking direction.

Clause 294: The article of footwear of Clause 281, wherein the lock member includes a first recess and a second recess operable to selectively receive a first retainer and a second retainer of the housing to maintain the lock member in the unlocked state.

Clause 295: The article of footwear of Clause 294, wherein the first retainer and the second retainer are movable between an extended state and a retracted state.

Clause 296: The article of footwear of Clause 295, wherein the first retainer and the second retainer are biased in to the extended state by a first biasing member and a second biasing member.

Clause 297: The article of footwear of Clause 296, wherein the first biasing member and the second biasing member are springs.

Clause 298: The article of footwear of Clause 296, wherein the first biasing member and the second biasing member are coil springs.

Clause 299: The article of footwear of Clause 295, wherein the first retainer and the second retainer are integrally formed with the housing.

Clause 300: The article of footwear of Clause 295, wherein the first retainer and the second retainer act as living hinges movable between the extended state and the retracted state.

Clause 301: The article of footwear of Clause 295, wherein the first retainer and the second retainer are in the retracted state when received within the first recess and the second recess, respectively.

Clause 302: The article of footwear of Clauses 281-301, wherein at least one of the first lock surface and the second lock surface include projections operable to grip the first cable when the lock member is in the locked state.

Clause 303: The article of footwear of Clauses 281-301, wherein the first projections are angled relative to a longitudinal axis of the lock member to grip the cable when the lock member is in the locked state and restrict movement of the cable in the first direction relative to the housing.

Clause 304: The article of footwear of Clauses 281-301, wherein the first cable is movable in a second direction opposite the first direction when the lock member is in the unlocked state.

Clause 305: An article of footwear comprising an upper having a first series of cable guides and a second series of cable guides, a first cable including a first portion received by and extending between adjacent ones of the first cable guides and a second portion received by an extending between adjacent ones of the second cable guides, the first portion movable in a first tightening direction and the second portion movable in a second tightening direction to move the upper into a tightened state and the first portion movable in a first loosening direction and the second portion movable in a second loosening direction to move the upper into a loosened state, a cable lock operable in a locked state to restrict movement of the first portion in the first loosening direction and to restrict movement of the second portion in the second loosening direction, the cable lock operable in an unlocked state to permit movement of the first portion in the first loosening direction and to permit movement of the second cable in the second loosening direction, and a release cable operable to move the cable lock from the locked state to the unlocked state, the release cable including a release grip located remotely from the cable lock.

Clause 306: The article of footwear of Clause 305, further comprising a second cable including a first portion received by the cable lock and a second portion forming a tightening grip located remotely from the cable lock.

Clause 307: The article of footwear of Clause 306, wherein the second cable is operable to place the first cable under tension to move the first portion in the first tightening direction and to move the second portion in the second tightening direction when a force of a predetermined magnitude is applied to the tightening grip.

Clause 308: The article of footwear of Clause 306, wherein the tightening grip is disposed proximate to an ankle opening of the upper.

Clause 309: The article of footwear of Clause 306, wherein the tightening grip is spaced apart from the release cable.

Clause 310: The article of footwear of Clause 306, wherein the tightening grip is located proximate to the release cable.

Clause 311: The article of footwear of Clause 306, wherein the tightening grip is located closer to a forefoot region of the upper than the release cable.

Clause 312: The article of footwear of Clause 306, wherein the tightening grip is located closer to a heel region of the upper than the release cable.

Clause 313: The article of footwear of any of the preceding Clauses, wherein the cable lock is disposed on surface of the upper.

Clause 314: The article of footwear of any of the preceding Clauses, wherein the cable lock is disposed on a heel region of the upper.

Clause 315: The article of footwear of Clauses 305-312-8, further comprising a sole structure including a midsole and an outsole, the cable lock being disposed within the midsole.

Clause 316: The article of footwear of Clause 315, wherein the cable lock is received within a cavity of the midsole.

Clause 317: The article of footwear of Clause 315 or 316, wherein the cable lock opposes the outsole.

Clause 318: The article of footwear of Clause 315 or 316, wherein the cable lock is in contact with the outsole.

Clause 319: The article of footwear of Clause 315, further comprising a strobel disposed between the upper and the midsole.

Clause 320: The article of footwear of Clause 319, wherein the cable lock is received within a cavity of the midsole.

Clause 321: The article of footwear of Clause 319 or 320, wherein the cable lock opposes the strobel.

Clause 322: The article of footwear of Clause 319 or 320, wherein the cable lock is in contact with the strobel.

Clause 323: The article of footwear of Clause 319 or 320, wherein the cable lock is attached to the strobel.

Clause 324: The article of footwear of Clause 315, wherein the cable lock is attached to the midsole.

Clause 325: The article of footwear of Clause 324, further comprising a strobel attached to the upper.

Clause 326: The article of footwear of Clause 325, wherein the strobel is disposed between the midsole and the outsole.

Clause 327: The article of footwear of Clause 325, wherein the strobel is disposed between the cable lock and the outsole.

Clause 328: The article of footwear of Clauses 315-327, wherein the cable lock is disposed within one of a heel region of the sole structure, a midfoot region of the sole structure, and a forefoot region of the sole structure, the midfoot region disposed between the heel region and the forefoot region.

Clause 329: An article of footwear comprising an upper having a first series of cable guides and a second series of cable guides, a first cable including a first portion received by and extending between adjacent ones of the first cable guides and a second portion received by an extending between adjacent ones of the second cable guides, the first portion movable in a first tightening direction and the second portion movable in a second tightening direction to move the upper into a tightened state and the first portion movable in a first loosening direction and the second portion movable in a second loosening direction to move the upper into a loosened state, a cable lock operable in a locked state to restrict movement of the first portion in the first loosening direction and to restrict movement of the second portion in the second loosening direction, the cable lock operable in an unlocked state to permit movement of the first portion in the first loosening direction and to permit movement of the second cable in the second loosening direction, and a second cable including a first portion received by the cable lock and a second portion forming a tightening grip located remotely from the cable lock, the second cable operable to place the first cable under tension to move the first portion in the first tightening direction and to move the second portion in the second tightening direction when a force of a predetermined magnitude is applied to the tightening grip.

Clause 330: The article of footwear of Clause 329, further comprising a release cable operable to move the cable lock from the locked state to the unlocked state.

Clause 331: The article of footwear of Clause 330, wherein the release cable includes a release grip located remotely from the cable lock.

Clause 332: The article of footwear of Clauses 329-331, wherein the tightening grip and the release grip are disposed proximate to one another.

Clause 333: The article of footwear of Clauses 329-331, wherein the tightening grip and the release grip are spaced apart from one another.

Clause 334: The article of footwear of Clauses 329-331, wherein the tightening grip is located closer to a forefoot region of the upper than the release cable.

Clause 335: The article of footwear of Clauses 329-331, wherein the tightening grip is located closer to a heel region of the upper than the release cable.

Clause 336: The article of footwear of Clause 329, wherein the tightening grip is disposed proximate to an ankle opening of the upper.

Clause 337: The article of footwear of any of the preceding Clauses, wherein the cable lock is disposed on surface of the upper.

Clause 338: The article of footwear of any of the preceding Clauses, wherein the cable lock is disposed on a heel region of the upper.

Clause 339: The article of footwear of Clauses 329-336, further comprising a sole structure including a midsole and an outsole, the cable lock being disposed within the midsole.

Clause 340: The article of footwear of Clause 339, wherein the cable lock is received within a cavity of the midsole.

Clause 341: The article of footwear of Clause 339 or 340, wherein the cable lock opposes the outsole.

Clause 342: The article of footwear of Clause 339 or 340, wherein the cable lock is in contact with the outsole.

Clause 343: The article of footwear of Clause 339, further comprising a strobel disposed between the upper and the midsole.

Clause 344: The article of footwear of Clause 343, wherein the cable lock is received within a cavity of the midsole.

Clause 345: The article of footwear of Clause 343 or 344, wherein the cable lock opposes the strobel.

Clause 346: The article of footwear of Clause 343 or 344, wherein the cable lock is in contact with the strobel.

Clause 347: The article of footwear of Clause 343 or 344, wherein the cable lock is attached to the strobel.

Clause 348: The article of footwear of Clause 339, wherein the cable lock is attached to the midsole.

Clause 349: The article of footwear of Clause 348, further comprising a strobel attached to the upper.

Clause 350: The article of footwear of Clause 349, wherein the strobel is disposed between the midsole and the outsole.

Clause 351: The article of footwear of Clause 349, wherein the strobel is disposed between the cable lock and the outsole.

Clause 352: The article of footwear of Clauses 339-351, wherein the cable lock is disposed within one of a heel region of the sole structure, a midfoot region of the sole structure, and a forefoot region of the sole structure, the midfoot region disposed between the heel region and the forefoot region.

Clause 353: An article of footwear comprising an upper defining an interior void, a first cable movable in a tightening direction to move the upper into a tightened state and movable in a loosening direction to move the upper into a loosened state, a cable lock operable in a locked state to restrict movement of the first cable in the loosening direction and operable in an unlocked state to permit movement of the first cable in the loosening direction, and a sole structure attached to the upper and including a cavity receiving the cable lock therein and at least one channel extending from the cavity to an exterior of the sole structure, the first cable extending from the cable lock within the cavity to the exterior of the sole structure via the at least one channel.

Clause 354: The article of footwear of Clause 353, further comprising a tightening grip operable to be moved away from the upper in a first direction to move the first cable in the tightening direction.

Clause 355: The article of footwear of Clause 354, further comprising a release grip operable to be moved away from the upper in a second direction to move the cable lock from the locked state to the unlocked state, the release grip being separate from the tightening grip.

Clause 356: The article of footwear of Clause 355, wherein the cable lock is disposed remotely from the tightening grip and from the release grip.

Clause 357: The article of footwear of Clause 355, wherein the release grip extends from the upper.

Clause 358: The article of footwear of Clause 355, wherein the release grip is aligned with the tightening grip.

Clause 359: The article of footwear of any of the preceding Clauses, wherein the sole structure includes a midsole and an outsole.

Clause 360: The article of footwear of Clause 359, wherein the midsole includes the cavity.

Clause 361: The article of footwear of Clause 360, wherein the cavity opposes the outsole.

Clause 362: The article of footwear of Clause 360, wherein the cavity opposes the upper.

Clause 363: The article of footwear of Clause 360, further comprising a strobel attached to the upper, the cavity opposing the strobel.

Clause 364: The article of footwear of Clause 363, wherein the cable lock is attached to the strobel.

Clause 365: An article of footwear comprising an upper defining an interior void, a first cable portion movable in a first tightening direction to move the upper into a tightened state and movable in a first loosening direction to move the upper into a loosened state, a second cable portion movable in a second tightening direction movable in a second loosening direction when the first cable portion is moved in the first loosening direction, a cable lock operable in a locked state to restrict movement of the first cable portion in the first loosening direction and the second cable portion in the second loosening direction and operable in an unlocked state to permit movement of the first cable portion in the first loosening direction and the second cable portion in the second loosening direction, a first cable guide attached to the upper and receiving the first cable portion, the first cable guide including a first convex inner surface operable to engage and direct movement of the first cable relative to the upper, and a second cable guide attached to the upper and receiving the second cable portion, the second cable guide including a second convex inner surface operable to engage and direct movement of the second cable relative to the upper.

Clause 366: The article of footwear of Clause 365, wherein the second cable portion forms a tightening grip formed as a loop and operable to be moved in a first direction away from the upper to move the second cable portion in the second tightening direction.

Clause 367: The article of footwear of any of the preceding Clauses, further comprising a release grip operable to be moved away from the upper in a second direction to move the cable lock from the locked state to the unlocked state.

Clause 368: The article of footwear of Clause 367, wherein the release grip is separate from the tightening grip.

Clause 369: The article of footwear of Clauses 367 or Clause 368, wherein the first direction is different than the second direction.

Clause 370: The article of footwear of Clause 367, wherein the cable lock is disposed remotely from the tightening grip and from the release grip.

Clause 371: The article of footwear of any of the preceding Clauses, further comprising a sole structure attached to the upper.

Clause 372: The article of footwear of Clause 371, wherein the cable lock is disposed within the sole structure.

Clause 373: The article of footwear of Clause 371 or Clause 372, wherein the sole structure includes a midsole and an outsole.

374: The article of footwear of Clause 373, wherein the midsole includes a cavity, the cable lock being disposed within the cavity.

Clause 375: The article of footwear of Clause 374, wherein the cavity opposes the outsole.

Clause 376: The article of footwear of Clause 374, wherein the cavity opposes the upper.

Clause 377: The article of footwear of Clause 376, further comprising a strobel attached to the upper, the cavity opposing the strobel.

Clause 378: The article of footwear of Clause 377, wherein the cable lock is attached to the strobel.

Clause 379: The article of footwear of any of the preceding Clauses, wherein an effective length of the second cable portion is increased when the second cable portion is moved in the second tightening direction.

380: The article of footwear of any of the preceding Clauses, wherein an effective length of the first cable portion is reduced when the first cable portion is moved in the first tightening direction.

381: The article of footwear of any of the preceding Clauses, wherein a portion of the first cable portion is retracted within the cable lock when the first cable portion is moved in the first tightening direction.

Clause 382: The article of footwear of any of the preceding Clauses, wherein a portion of the second cable portion is retracted within the cable lock when the second cable portion is moved in the second loosening direction.

Clause 383: The article of footwear of any of the preceding Clauses, wherein the first cable portion and the second cable portion are part of the same, unitary cable.

Clause 384: The article of footwear of any of the preceding Clauses, wherein at least one of the first cable guide and the second cable guide includes a substantially C shape.

Clause 385: The article of footwear of any of the preceding Clauses, wherein the first cable guide is disposed along a medial side of the upper and the second cable guide is disposed along a lateral side of the upper.

Clause 386: The article of footwear of Clause 385, wherein the first convex surface opposes the medial side and the second convex surface opposes the lateral side.

Clause 387: The article of footwear of Clause 386, wherein the first cable guide includes a first concave surface disposed on an opposite side of the first cable guide than the first convex surface and the second cable guide includes a second concave surface disposed on an opposite side of the second cable guide than the second convex surface.

Clause 388: The article of footwear of Clause 387, wherein the first concave surface opposes the lateral side and the second concave surface opposes the medial side.

Clause 389: The article of footwear of Clause 387, wherein the first concave surface opposes the second concave surface in a direction extending across the upper between the medial side and the lateral side.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper defining an interior void;

a cable movable in a tightening direction to move the upper into a tightened state and movable in a loosening direction to move the upper into a loosened state; and a cable lock coupled with the article of footwear, including a housing having a first end and a second end opposite the first end, and operable in a locked state to restrict movement of the cable in the loosening direction and in an unlocked state to permit movement of the cable in the loosening direction, the cable lock disposed on an exterior surface of the upper at a heel region of the upper and including a wedge-shaped lock that engages the cable in the locked state, wherein the housing includes a medial sidewall extending between the first end and the second end, the medial sidewall having a first opening, and a lateral sidewall opposite the first sidewall extending between the first end and the second end, the lateral sidewall having a second opening, and wherein the cable extends through the first opening and the second opening.

2. The article of footwear of claim 1, wherein the cable includes a control portion operable to be moved away from the upper in a first direction to move the cable in the tightening direction.

3. The article of footwear of claim 2, wherein the cable lock is spaced apart from the control portion.

4. The article of footwear of claim 2, wherein the control portion extends between a medial side of the upper and a lateral side of the upper, and wherein the control portion extends across a vamp region of the upper.

5. The article of footwear of claim 2, wherein the control portion is coupled to a sheath having a greater cross-sectional area than a cross-sectional area of the cable, the sheath operable to accommodate bunching by the cable after the cable is moved in the tightening direction.

6. The article of footwear of claim 1, wherein the housing includes a wedge shape.

7. The article of footwear of claim 1, wherein the housing includes a rectangular shape.

8. The article of footwear of claim 1, wherein the cable extends along an outer surface of the upper.

9. The article of footwear of claim 1, further comprising at least one cable guide attached to the upper and slidably receiving the cable.

10. An article of footwear comprising:

an upper defining an interior void;

a cable movable in a tightening direction to move the upper into a tightened state and movable in a loosening direction to move the upper into a loosened state;

a cable lock coupled with the article of footwear, including a housing, and operable in a locked state to restrict movement of the cable in the loosening direction and in an unlocked state to permit movement of the cable in the loosening direction, the cable lock disposed rearward of an ankle opening of the upper and including a lock that (i) is slidably disposed within the housing and (ii) engages the cable in the locked state; and a control portion operable to be moved away from the upper in a first direction to move the cable in the tightening direction, the control portion being disposed forward of and below the ankle opening.

11. The article of footwear of claim 10, wherein the control portion extends between a medial side of the upper and a lateral side of the upper.

12. The article of footwear of claim 11, wherein the control portion extends across a vamp region of the upper.

13. The article of footwear of claim 10, wherein the control portion is coupled to a sheath having a greater cross-sectional area than a cross-sectional area of the cable, the sheath operable to accommodate bunching by the cable after the cable is moved in the tightening direction.

14. The article of footwear of claim 10, wherein the housing includes a wedge shape.

15. The article of footwear of claim 10, wherein the housing includes a rectangular shape.

16. The article of footwear of claim 10, wherein the cable extends along an outer surface of the upper.

17. The article of footwear of claim 10, further comprising at least one cable guide attached to the upper and slidably receiving the cable.

18. An article of footwear comprising:

an upper defining an interior void;

a cable configured movable in a tightening direction to move the upper into a tightened state and movable in a loosening direction to move the upper into a loosened state; and a cable lock coupled with the article of footwear, the cable lock including a housing having a locking member, and operable in a locked state to restrict movement of the cable and in an unlocked state to permit movement of the cable, the cable lock including a release cord, coupled to the locking member, that is configured to be pulled to transition the cable lock to the unlocked state.

19. The article of footwear of claim 18, wherein the cable lock is disposed on an exterior surface of the upper at a heel region of the upper.

20. The article of footwear of claim 18, further including:

a control portion operable to be moved away from the upper in a first direction to move the cable in the tightening direction, the control portion being disposed forward of and below an ankle opening.

* * * * *